US008525763B2

(12) United States Patent
Umezaki et al.

(10) Patent No.: US 8,525,763 B2
(45) Date of Patent: Sep. 3, 2013

(54) DISPLAY DEVICE AND METHOD OF DRIVING THE SAME

(75) Inventors: Atsushi Umezaki, Kanagawa (JP); Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 9 days.

(21) Appl. No.: 13/186,509

(22) Filed: Jul. 20, 2011

(65) Prior Publication Data

US 2011/0273435 A1 Nov. 10, 2011

Related U.S. Application Data

(63) Continuation of application No. 11/465,251, filed on Aug. 17, 2006, now Pat. No. 7,986,287.

(30) Foreign Application Priority Data

Aug. 26, 2005 (JP) ..... 2005-245467

(51) Int. Cl.
*G09G 3/32* (2006.01)

(52) U.S. Cl.
USPC ..... 345/82; 315/149

(58) Field of Classification Search
USPC ..... 345/60–102, 204–693; 362/97.1–97.3; 315/149–159, 291–311
See application file for complete search history.

(56) References Cited

U.S. PATENT DOCUMENTS

| | | | |
|---|---|---|---|
| 5,801,791 | A | 9/1998 | Yamazaki et al. |
| 6,078,302 | A | 6/2000 | Suzuki |
| 6,323,515 | B1 | 11/2001 | Yamazaki et al. |
| 6,335,716 | B1 | 1/2002 | Yamazaki et al. |
| 6,369,862 | B1 | 4/2002 | Yamazaki |
| 6,483,551 | B1 | 11/2002 | Yamazaki et al. |
| 6,528,951 | B2 | 3/2003 | Yamazaki et al. |
| 6,597,034 | B2 | 7/2003 | Yamazaki et al. |
| 6,710,548 | B2 | 3/2004 | Kimura |
| 6,724,377 | B2 | 4/2004 | Ouchi et al. |

(Continued)

FOREIGN PATENT DOCUMENTS

| | | | |
|---|---|---|---|
| EP | 1460612 | A2 | 9/2004 |
| EP | 1580719 | A1 | 9/2005 |

(Continued)

OTHER PUBLICATIONS

Taiwanese Office Action (Application No. 95131021), dated Apr. 22, 2013, with English Translation.

*Primary Examiner* — Liliana Cerullo
(74) *Attorney, Agent, or Firm* — Fish & Richardson P.C.

(57) ABSTRACT

When a light-emitting element emits light for a long time, characteristics thereof change and current flowing therethrough is reduced even in the same voltage is applied. In particular, in a case of a display device with light-emitting element, there is a problem such that burn-in is generated in a display screen. A burn-in correction period in which characteristics of a light-emitting element in each pixel are detected is provided in addition to a normal driving period in which an image is displayed. The light-emitting element can emit light which compensates the changes in the characteristics, by correcting video signals inputted to each pixel in the normal driving period according to the characteristics of the light-emitting elements obtained in the burn-in correction period.

10 Claims, 82 Drawing Sheets

(56) References Cited

U.S. PATENT DOCUMENTS

| | | | |
|---|---|---|---|
| 6,774,578 | B2 | 8/2004 | Tanada |
| 6,885,385 | B2 | 4/2005 | Ouchi et al. |
| 6,909,411 | B1 | 6/2005 | Yamazaki et al. |
| 6,958,745 | B2 | 10/2005 | Murase et al. |
| 6,995,753 | B2 | 2/2006 | Yamazaki et al. |
| 7,068,246 | B2 | 6/2006 | Yamazaki et al. |
| 7,072,000 | B2 | 7/2006 | Yamazaki |
| 7,177,062 | B2 | 2/2007 | Yano |
| 7,358,948 | B2 | 4/2008 | Shiomi et al. |
| 7,372,446 | B2 | 5/2008 | Murase et al. |
| 7,518,577 | B2 | 4/2009 | Akimoto et al. |
| 7,573,442 | B2 | 8/2009 | Aoki |
| 8,134,528 | B2 | 3/2012 | Shiomi et al. |
| 8,344,983 | B2 | 1/2013 | Shiomi et al. |
| 2002/0079484 | A1 | 6/2002 | Yamazaki et al. |
| 2002/0093468 | A1 | 7/2002 | Ouchi et al. |
| 2002/0105279 | A1 | 8/2002 | Kimura |
| 2002/0140712 | A1 | 10/2002 | Ouchi et al. |
| 2003/0057895 | A1 | 3/2003 | Kimura |
| 2003/0071924 | A1 | 4/2003 | Yamazaki et al. |
| 2003/0132716 | A1 | 7/2003 | Yamazaki et al. |
| 2003/0214467 | A1 | 11/2003 | Koyama et al. |
| 2003/0214521 | A1 | 11/2003 | Osame et al. |
| 2004/0031986 | A1 | 2/2004 | Yamazaki et al. |
| 2004/0150594 | A1 | 8/2004 | Koyama et al. |
| 2004/0246275 | A1 | 12/2004 | Yoshihara et al. |
| 2004/0257117 | A1 | 12/2004 | Kimura |
| 2005/0001147 | A1 | 1/2005 | Tanada |
| 2005/0024303 | A1 | 2/2005 | Kimura et al. |
| 2005/0041122 | A1 | 2/2005 | Yamazaki et al. |
| 2005/0057191 | A1* | 3/2005 | Jo et al. ..... 315/291 |
| 2005/0099068 | A1 | 5/2005 | Kimura |
| 2005/0179628 | A1 | 8/2005 | Kimura |
| 2005/0206598 | A1 | 9/2005 | Yamazaki et al. |
| 2005/0218405 | A1 | 10/2005 | Yamazaki et al. |
| 2005/0218820 | A1 | 10/2005 | Tanada |
| 2005/0259089 | A1 | 11/2005 | Yamazaki et al. |
| 2006/0011846 | A1 | 1/2006 | Ozaki |
| 2006/0082568 | A1 | 4/2006 | Yamazaki et al. |
| 2006/0220570 | A1* | 10/2006 | Evans et al. ..... 315/86 |

FOREIGN PATENT DOCUMENTS

| | | | |
|---|---|---|---|
| JP | 9-252342 | A | 9/1997 |
| JP | 2002-215092 | A | 7/2002 |
| JP | 2002-297094 | A | 10/2002 |
| JP | 2003-195813 | A | 7/2003 |
| JP | 2003-295827 | A | 10/2003 |
| JP | 2004-287345 | A | 10/2004 |
| TW | 1229310 | B | 3/2005 |
| TW | 1231463 | B | 4/2005 |
| TW | 1235986 | B | 7/2005 |
| TW | 1237227 | B | 8/2005 |
| WO | WO 2004/055987 | A1 | 7/2004 |
| WO | WO 2004/059843 | A1 | 7/2004 |
| WO | WO 2006/011666 | A1 | 2/2006 |
| WO | WO 2006/035953 | A1 | 4/2006 |

* cited by examiner 118
117
116
100
101
S1-R S1-G S1-B S2-R S2-G S2-B Sn-R Sn-G Sn-B
109
104
103
105
106
107
G1 G2 G3 Gm-1 Gm
102
114a
114b
108
113a
114
113
115a
115
115b
110
111
112

118
117
116
100
101
S1-R
S1-G
S1-B
S2-R
S2-G
S2-B
Sn-R
Sn-G
Sn-B
109
102
G1
G2
G3
Gm-1
Gm
104
108
103
105
106
107
114a
114b
114
113a
115a
115
115b
113
113
113
110
111
112

118
117
116
100
101
S1-R
S1-G
S1-B
S2-R
S2-G
S2-B
Sn-R
Sn-G
Sn-B
109
G1
G2
G3
Gm-1
Gm
102
103
104
105
106
107
108
114a
114b
113a
114
115a
115
115b
513
110
111
112 a
b
c
d
θ
4601
4602
4603a
4603b
4621a
4621b
4604
4605
4651a
4651b
4610a
4610b a
b
c
d
θ
4601
4602
4603a
4603b
4604
4605
4610a
4610b
4624

DISPLAY DEVICE AND METHOD OF DRIVING THE SAME

CROSS-REFERENCE TO RELATED APPLICATIONS

This application is a continuation of U.S. application Ser. No. 11/465,251, filed Aug. 17, 2006, now allowed, which claims the benefit of a foreign priority application filed in Japan as Serial No. 2005-245467 on Aug. 26, 2005, both of which are incorporated by reference.

BACKGROUND OF THE INVENTION

1. Field of the Invention

The present invention relates to a display device including a transistor and method of driving the same. Specifically, the present invention relates to a display device having a pixel including a thin film transistor (hereinafter, also referred to as a TFT) and method of driving the same.

2. Description of the Related Art

In recent years, a thin display (also called a flat panel display) using an element which emits light with electrooptic property of liquid crystal or electroluminescence has attracted attention and the market thereof is expected to expand. A so-called active matrix display where pixels are formed with TFTs over a glass substrate have been regarded as important as a thin display. In particular, a TFT having a channel portion formed of a polycrystalline silicon film can achieve a high-speed operation since it has high electron field-effect mobility in comparison with a conventional TFT using an amorphous silicon film. Therefore, pixels can be controlled with a driver circuit which is formed by using TFTs over the same substrate as the pixels. A display in which pixels and various functional circuits using TFTs are formed over a glass substrate has various advantages such as reduction in the number of components, improvement in yield by a simplified manufacturing process, and improvement in productivity.

An active matrix display where electroluminescence elements (also referred to as OLED: Organic Light-Emitting Diode and hereinafter also called "EL element" or "light-emitting element" in this specification) and TFTs are combined has attracted attention as a thin and light display and has been actively studied within both domestic and international. Such a display is also called an organic EL display (OELD) and is examined to be developed to be in practical use as displays with various sizes, from a small size of 2 inches to a large size of over 40 inches.

In general, when an EL element deteriorates, current to voltage applied to the EL element flowing in the EL element is reduced. Current flowing in an EL element and luminance of the EL element are in a proportional relation; therefore reduction in current flowing in the EL element leads to reduction in luminance of the EL element. In addition, in an EL element, a voltage-current luminance characteristic deteriorates more than a current-luminance characteristic. For example, luminance of an EL element deteriorates early when fixed voltage is kept applying thereto compared with when fixed current is kept applying thereto. That is, deterioration in an EL element is easily caused when the EL element is driven in voltage compared to when the EL element is driven in current.

As a driving method for an active matrix EL display using an EL element as a display medium and having a structure in which the EL element and a TFT (hereinafter, also referred to as a driving TFT) are connected in series between two power supply lines, the following methods are known: a method in which a driving TFT operates in a saturation region to change voltage between a gate and source of the driving TFT, thereby controlling a current value flowing to the EL element, and a method in which a driving TFT operates in a linear region, thereby controlling time in which the EL element is supplied with voltage and emits light. In addition, in the driving method in which a driving TFT operates in a saturation region, a driving method in which time in which current flows to an EL element in a certain period is controlled, thereby displaying a gray scale is also known.

In the method in which a driving TFT operates in a leaner region, when the driving TFT is on, potentials of two power supply lines are applied almost as they are to an EL element. That is, the EL element is operated by voltage. As described above, luminance of an EL element deteriorates more when the EL element is operated by voltage compared with when the EL element is operated by current. Therefore, even when luminance of an EL element is the same, the luminance deteriorates more when a driving TFT is operated in a linear region compared with when the driving TFT is operated in a saturation region. Therefore, it can be said that burn-in is easily generated in an active matrix EL display in which a driving TFT is operated in a liner region compared with an active matrix EL display in which a driving TFT is operated in a saturation region.

To prevent burn-in in an active matrix EL display in which a driving TFT is operated in a linear region, a method is known in which deterioration conditions in all EL elements are measured and the EL elements are driven by video signals (see Patent Document 1). In this method, current values of EL elements supplied with certain voltage are measured in each pixel. When there is a deteriorated pixel with a low current value, video signals for the deteriorated pixel is corrected so as to obtain a predetermined current value, which means to obtain predetermined luminance.

[Patent Document 1] Japanese Patent Laid-Open No. 2003-195813

However, in a conventional art, a condition in which characteristics of light-emitting elements are detected is important since current flowing in a light-emitting element in each pixel is small (approximately several μA) when a pixel is formed with an EL element, which is a light-emitting element using a light-emitting medium containing an electroluminescence material. For example, if a detecting condition is different, characteristics of one light-emitting element change significantly and effect of a noise, which is an external factor, also changes significantly.

SUMMARY OF THE INVENTION

It is an object of the present invention to provide specified conditions for detecting characteristics of a light-emitting element and to correct deterioration in the light-emitting element with further accuracy.

A display device of the present invention has a battery, a pixel including a light-emitting element, a timer circuit, a charging unit detection circuit, and a driving method selection circuit. The timer circuit outputs signals for proceeding to a next burn-in correction period when a predetermined time passes after an end of a burn-in correction period in which characteristics of the light-emitting element are obtained through a normal driving period in which an image is displayed. The charging unit detection circuit outputs signals for proceeding to the burn-in correction period when the battery is charged. The driving method selection circuit outputs signals for proceeding to the burn-in correction period from the normal driving period when the signals for proceeding to the burn-in correction period are inputted from both the timer circuit and the charging unit detection circuit, and for proceeding to the normal driving period from the burn-in correction period when any of these signals for proceeding to the burn-in correction period are not inputted.

A display device of the present invention has a pixel including a light-emitting element, a timer circuit, a non-operating detection circuit, and a driving method selection circuit. The timer circuit outputs signals for proceeding to a next burn-in correction period when a predetermined time passes after an end of a burn-in correction period in which characteristics of the light-emitting element are obtained through a normal driving period in which an image is displayed. The non-operating detection circuit outputs signals for proceeding to the burn-in correction period when the display device is not turned on for a predetermined time. The driving method selection circuit outputs signals for proceeding to the burn-in correction period from the normal driving period when the signals for proceeding to the burn-in correction period are inputted from both the timer circuit and the non-operating detection circuit, and for proceeding to the normal driving period from the burn-in correction period when any of these signals for proceeding to the burn-in correction period are not inputted.

A display device of the present invention has a battery, a pixel including a light-emitting element, a timer circuit, a charging unit detection circuit, a surrounding luminance detection circuit, and a driving method selection circuit. The timer circuit outputs signals for proceeding to a next burn-in correction period when a predetermined time passes after an end of a burn-in correction period in which characteristics of the light-emitting element are obtained through a normal driving period in which an image is displayed. The charging unit detection circuit outputs signals for proceeding to the burn-in correction period when the battery is charged. The surrounding luminance detection circuit outputs signals for proceeding to the burn-in correction period when surrounding luminance of the display device is close to predetermined luminance. The driving method selection circuit outputs signals for proceeding to the burn-in correction period from the normal driving period when the signals for proceeding to the burn-in correction period are inputted from all of the timer circuit, the charging unit detection circuit, and the surrounding luminance detection circuit and for proceeding to the normal driving period from the burn-in correction period when any of these signals for proceeding to the burn-in correction period are not inputted.

A display device of the present invention has a pixel including a light-emitting element, a timer circuit, a non-operating detection circuit, a surrounding luminance detection circuit, and a driving method selection circuit. The timer circuit outputs signals for proceeding to a next burn-in correction period when a predetermined time passes after an end of a burn-in correction period in which characteristics of the light-emitting element are obtained through a normal driving period in which an image is displayed. The non-operating detection circuit outputs signals for proceeding to the burn-in correction period when the display device is not turned on for a predetermined time. The surrounding luminance detection circuit outputs signals for proceeding to the burn-in correction period when surrounding luminance of the display device is close to predetermined luminance. The driving method selection circuit outputs signals for proceeding to the burn-in correction period from the normal driving period when the signals for proceeding to the burn-in correction period are inputted from all of the timer circuit, the non-operating detection circuit, and the surrounding luminance detection circuit, and for proceeding to the normal driving period from the burn-in correction period when any of these signals for proceeding to the burn-in correction period are not inputted.

A display device of the present invention has a pixel including a light-emitting element, a timer circuit, and a driving method selection circuit. The timer circuit outputs signals for proceeding to a next burn-in correction period when a predetermined time passes after an end of a burn-in correction period in which characteristics of the light-emitting element are obtained through a normal driving period in which an image is displayed. The driving method selection circuit outputs signals for proceeding to the burn-in correction period from the normal driving period when the signals for proceeding to the burn-in correction period are inputted from the timer/start circuit, and for proceeding to the normal driving period from the burn-in correction period when the signals for proceeding to the burn-in correction period are not inputted.

A display device of the present invention has a battery, a pixel including a light-emitting element, a start circuit, a charging unit detection circuit, and a driving method selection circuit. The start circuit can select a normal driving period in which an image is displayed or a burn-in correction period in which characteristic of the light-emitting element is obtained, and which outputs a first signal for proceeding to the burn-in correction period when proceeding to the burn-in correction period is selected. The charging unit detection circuit outputs signals for proceeding to the burn-in correction period when the battery is charged. The driving method selection circuit outputs signals for proceeding to the burn-in correction period from the normal driving period when the signals for proceeding to the burn-in correction period are inputted from both the start circuit and the charging unit detection circuit, and for proceeding to the normal driving period from the burn-in correction period when any of these signals for proceeding to the burn-in correction period are not inputted.

A display device of the present invention has a pixel including a light-emitting element, a start circuit, a surrounding luminance detection circuit, and a driving method selection circuit. The start circuit can select a normal driving period in which an image is displayed or a burn-in correction period in which characteristic of the light-emitting element is obtained, and which outputs a first signal for proceeding to the burn-in correction period when proceeding to the burn-in correction period is selected. The surrounding luminance detection circuit outputs signals for proceeding to the burn-in correction period when surrounding luminance of the display device is close to predetermined luminance. The driving method selection circuit outputs signals for proceeding to the burn-in correction period from the normal driving period when the signals for proceeding to the burn-in correction period are inputted from both the start circuit and the surrounding luminance detection circuit, and for proceeding to the normal driving period from the burn-in correction period when any of these signals for proceeding to the burn-in correction period are not inputted.

A display device of the present invention has a battery, a pixel including a light-emitting element, a start circuit, a charging unit detection circuit, a surrounding luminance detection circuit, and a driving method selection circuit. The start circuit can select a normal driving period in which an image is displayed or a burn-in correction period in which characteristic of the light-emitting element is obtained, and which outputs a first signal for proceeding to the burn-in correction period when proceeding to the burn-in correction period is selected. The charging unit detection circuit outputs signals for proceeding to the burn-in correction period when the battery is charged. The surrounding luminance detection circuit outputs signals for proceeding to the burn-in correction period when surrounding luminance of the display device is close to predetermined luminance. The driving method selection circuit outputs signals for proceeding to the burn-in correction period from the normal driving period when the signals for proceeding to the burn-in correction period are inputted from all of the start circuit, the charging unit detection circuit, and a surrounding luminance detection circuit, and for proceeding to the normal driving period from the burn-in correction period when any of these signals for proceeding to the burn-in correction period are not inputted.

In the burn-in correction period, the characteristics of a light-emitting element included in each pixel are obtained by detecting current flowing to a counter electrode, which is an electrode of the light-emitting element and is a common electrode in the light-emitting element, the characteristic of a light-emitting element in each pixel are obtained by detecting current flowing in a power supply line, which is the other electrode of the light-emitting element, or the characteristic of a light-emitting element in a pixel in a region in which deterioration of the characteristics is supposed to be easily generated are obtained preferentially.

A potential of the counter electrode in the burn-in correction period is the same as that of the counter electrode in the normal driving period. A potential of the power supply line in the burn-in correction period is the same as that of the power supply line in the normal driving period. Driving frequency in the burn-in correction period is the same as that of the normal driving period.

Various switches can be used as a switch used in the present invention. As an example, there is an electrical switch, a mechanical switch, or the like. That is, as long as current flow can be controlled, the invention is not limited to a particular switch and various switches can be used. For example, the switch may be a transistor, a diode (such as a PN diode, a PIN diode, a Schottky diode, or a diode-connected transistor), a thyristor, or a logic circuit that is a combination thereof. In a case where a transistor is used as a switch, since the transistor is operated just as a switch, a polarity (conductive type) of the transistor is not limited particularly. However, in a case where a lower off current is desired, a transistor which has a polarity with a lower off current is desirably used. As the transistor with a low off current, a transistor provided with an LDD region, a transistor having a multi-gate structure, or the like can be used. In addition, it is desirable to use an n-channel transistor when a transistor to be operated as a switch operates in a state where a potential of a source terminal thereof is close to a low potential side power source (Vss, GND, 0 V, or the like), whereas it is desirable to use a p-channel transistor when a transistor operates in a state where a potential of a source terminal thereof is close to a high potential side power source (Vdd or the like). This is because the absolute value of a gate-source voltage can be increased, so that the transistor easily serves as a switch. Note that the switch may be of a CMOS type using both an n-channel transistor and p-channel transistor. In the case of a CMOS switch, current can flow when one of the p-channel and n-channel switches is electrically connected, so that the CMOS type switch can easily serve as a switch. For example, voltage can be outputted appropriately when voltage of signals inputted to the switch is high and also when voltage of signals inputted to the switch is low. In addition, since an amplitude value of voltage as signals for turning on/off a switch can be made low, power consumption can be lowered. Note that when a transistor is used as a switch, the transistor has an input terminal (one of a source terminal and a drain terminal), an output terminal (the other of the source terminal and the drain terminal) and a terminal controlling continuity (a gate terminal). On the other hand, when a diode is used as a switch, there may be a case where a terminal for controlling continuity is not provided. In such a case, a wire for controlling a terminal can be reduced.

In the present invention, a connection includes an electrical connection, a functional connection, and a direct connection. Accordingly, in the structure disclosed in the present invention, other connections than a predetermined connection may also be included. For example, at least one element which enables an electrical connection (e.g., a switch, a transistor, a capacitor, an inductor, a resistor, or a diode) may be interposed between a portion and another portion. In addition, one or more of circuits which enables a functional connection (e.g., a logic circuit (such as an inverter, a NAND circuit, or a NOR circuit), a signal converter circuit (such as a DA converter circuit, an AD converter circuit, or a gamma correction circuit), an electric potential level converter circuit (e.g., a power supply circuit such as a voltage step-up circuit or a voltage step-down circuit, or a level shift circuit for changing a potential level of an High signal or Low signal), a power source, a current source, a switching circuit, an amplifier circuit (such as an operational amplifier, a differential amplifier circuit, a source follower circuit, a buffer circuit, or a circuit which can increase a signal amplitude or a current amount), a signal generation circuit, a memory circuit, or a control circuit) may be arranged between a portion and another portion. Alternatively, direct connection may be conducted without interposing other elements or other circuits. Note that only the case that connection is conducted directly without interposing other elements or other circuits is described as being "directly connected". Meanwhile, description of "electrically connected" includes an electrical connection (i.e., a connection with another element interposed), a functional connection (i.e., a connection with another circuit interposed), and a direct connection (i.e., a connection without another element or another circuit interposed).

A display element, a display device, a light-emitting element, and a light-emitting device can employ various modes and include various elements. As an example, there is a display medium whose contrast changes by an electromagnetic function, such as an EL element (e.g., an organic EL element, an inorganic EL element, or an EL element containing an organic material or an inorganic material), an electron-emissive element, a liquid crystal element, electronic ink, a grating light valve (GLV), a plasma display (PDP), a digital micromirror device (DMD), a piezoceramic display, or a carbon nanotube. In addition, a display device using an EL element includes an EL display; a display device using an electron-emissive element includes a field emission display (FED) or a surface-conduction electron-emitter display (SED); a display device using a liquid crystal element includes a liquid crystal display, a transmissive liquid crystal display, a semi-transmissive liquid crystal display, or a reflective liquid crystal display; and a display device using electronic ink includes electronic paper.

In the invention, a transistor may have various modes; therefore, the type of applicable transistor is not specifically limited. It is thus possible to apply a thin film transistor (TFT) or the like using a non-single crystalline semiconductor film typified by amorphous silicon or polycrystalline silicon. Due to this, a transistor can be manufactured even with a low manufacturing temperature, with low cost, and over a large-sized and/or transparent substrate, and light can be emitted through the transistor. In addition, a MOS transistor, a junction type transistor, a bipolar transistor, or the like which are formed using a semiconductor substrate or an SOI substrate can be applied. Accordingly, a transistor with few variations, a transistor with high current supply capability, or a transistor with a small size can be manufactured, or a circuit with small power consumption can be manufactured. In addition, it is possible to apply a transistor using a compound semiconductor such as ZnO, a-InGaZnO, SiGe, or GaAs, a thin film transistor thereof, or the like. Due to this, manufacturing can be carried out with a temperature which is not so high, even at a room temperature, and a transistor can be directly formed over a low heat-resistant substrate such as a plastic substrate or a film substrate. In addition, a transistor or the like formed by an ink-jet method or a printing method can be applied. Due to this, manufacturing can be carried out at a room temperature, in a low-vacuum state, or over a large-sized substrate. In addition, since manufacturing can be conducted without a mask (reticle), a layout of a transistor can be easily changed. In addition, a transistor using an organic semiconductor or a carbon nanotube, or other transistors can be applied. Due to this, a transistor can be formed over a flexible substrate. Note that the non-single crystalline semiconductor film may contain hydrogen or halogen. Further, the type of substrate over which a transistor is provided is not specifically limited and various types of substrates may be used. Thus, for example, a transistor can be formed over a single crystalline substrate, an SOI substrate, a glass substrate, a quartz substrate, a plastic substrate, a paper substrate, a cellophane substrate, a stone substrate, a stainless-steel substrate, a substrate containing stainless-steel foil, or the like. Alternatively, a transistor may be formed over a substrate and then transferred onto another substrate to be disposed. By using these substrates, a transistor with favorable characteristics or a transistor with small power consumption, a transistor which hardly breaks, or a heat-resistant transistor can be formed.

Note that the structure of a transistor in the present invention is not limited to a certain type and various structures may be employed. For example, a multi-gate structure having two or more gate electrodes may be used. In the case of a multi-gate structure, since channel regions are connected in series, a structure in which a plurality of transistors is connected in series is obtained. By using the multi-gate structure, off current can be reduced as well as a withstand voltage can be increased to improve reliability of the transistor, and even when drain-source voltage fluctuates at the time when the transistor operates in a saturation region, flat characteristics can be provided without causing fluctuations of drain-source current. In addition, such a structure may also be employed in which gate electrodes are formed to over and below a channel. By using such a structure in which gate electrodes are formed over and below a channel, the area of the channel region can be enlarged to increase the current value flowing therein, and a depletion layer can be easily formed to increase the S value. In the case of forming gate electrodes over and below a channel, a structure in which a plurality of transistors is connected in parallel is obtained. In addition, any of the following structures may be employed in which a gate electrode is formed over a channel; a gate electrode is formed below a channel; a staggered structure; an inversed staggered structure; a structure where a channel region is divided into a plurality of regions; a structure where a channel region is divided into a plurality, of regions and connected in parallel; or a structure where a channel region is divided into a plurality of regions and connected in series. In addition, a channel (or a part of it) may overlap a source electrode or a drain electrode. By forming a structure where a channel (or a part of it) overlaps a source electrode or a drain electrode, unstable operation can be prevented, which may be caused in the case where charges gather in a part of the channel. In addition, an LDD (Lightly Doped Drain) region may be provided. By providing an LDD region, off current can be reduced, withstand voltage can be increased to improve reliability of the transistor, and even when drain-source voltage fluctuates at the time when the transistor operates in the saturation region, flat characteristics can be provided without causing fluctuations of drain-source current.

Note that a transistor in the invention may be formed over a substrate of any type. Therefore, all circuits may be formed over a glass substrate, a plastic substrate, a single crystalline substrate, or an SOI substrate. By forming all circuits over the same substrates, the cost can be reduced since the number of components can be reduced and the reliability can be improved by reducing the number of connection among components in the circuit. Alternatively, such a structure may be employed in which some circuits are formed over a substrate, while some other circuits are formed over another substrate. That is, not the whole circuits are required to be formed over one substrate. For example, some circuits may be formed over a glass substrate by using transistors, while some other circuits may be formed over a single crystalline substrate, and then, the IC chip may be deposited onto the glass substrate by COG (Chip on Glass). Alternatively, the IC chip may be connected to the glass substrate by TAB (Tape Automated Bonding) or by using a printed board. In this manner, when some circuits are formed over one substrate, the cost can be reduced since the number of components can be reduced and the reliability can be improved by reducing the number of connection among components in the circuit. Further, a portion with high driving voltage or high driving frequency which consumes more power is not preferably formed over the same substrate, thereby increase in power consumption can be prevented.

In the present invention, one pixel corresponds to one element which can control brightness. Therefore, for example, one pixel expresses one color element by which brightness is expressed. Accordingly, in the case of a color display device formed of color elements of R (red), G (green), and B (blue), the smallest unit of an image is formed of three pixels of an R pixel, a G pixel, and a B pixel. Note that color elements are not limited to three kinds and may be more colors, and another color in addition to R, G, and B may be used. For example, R, G, B, and W (W is white) may be employed by adding white. Alternatively, one or more color of yellow, cyan, magenta, emerald green, or vermilion may be added to R, G, and B. In addition, a color similar to at least one color of R, G, or B may be added. For example, R, G, B1, and B2 may be used. B1 and B2 both exhibit blue colors but have different frequencies. By using such color elements, it is possible to perform display that is much similar to the real and to reduce power consumption. Further, as another example, when controlling the brightness of one color element by using a plurality of regions, one of the plurality of regions corresponds to one pixel. Therefore, for example, in the case of performing an area gray scale display, a plurality of regions are provided for one color element to control the brightness, which express gray scale as a whole. One of the regions to control the brightness corresponds to one pixel. Therefore, in that case, one color element is formed by a plurality of pixels. Moreover, in that case, regions which contribute to display differ in sizes depending on the pixels. In the plurality of regions to control the brightness provided for one color element, that is, a plurality of pixels which form one color element, the viewing angle may be expanded by supplying each pixel with a slightly different signal. It is to be noted that the description of "one pixel (for three colors)" corresponds to one pixel including three pixels of R, G, and B. The description of "one pixel (for one color)" corresponds to pixels which are provided for one color element, and are collectively considered as one pixel.

Note that in the present invention, pixels may be provided (arranged) in matrix. Here, when it is described that pixels are provided (arranged) in matrix, there may be a case where the pixels are provided in a straight line or in a zigzag line in the longitudinal direction or in the lateral direction. Accordingly, in the case of performing full color display with three color elements (e.g., R, G, and B) for example, there may be a case where dots of three color elements are arranged in stripes or in delta pattern. Further, there may be a case where dots of the color elements are provided in the Bayer arrangement. Color elements are not limited to three kinds and may have more kinds. For example, there is R, G, B, and W (W is white), or R, G, B and at least one of yellow, cyan, or magenta. The area of a display region may differ among dots of the respective color elements. Accordingly, power consumption can be reduced, and a lifetime of a display element can be extended.

A transistor is an element having at least three terminals including a gate, a drain, and a source, and also has a channel formation region between the drain region and the source region, in which current flows through a drain region, a channel region, and a source region. Here, since the source and the drain are changed depending on a structure, an operation condition, or the like of a transistor, it is difficult to identify which is a source or a drain. Therefore, in the present invention, regions serving as a source and drain are not always referred to as a source and a drain. The region serving as a source and the one serving as a drain are sometimes referred to as a first terminal and a second terminal, respectively. Note that a transistor may be an element having at least three terminals including a base, an emitter, and a collector. In this case, an emitter and collector may be referred to as a first terminal and second terminal, respectively, as well.

A gate refers to a part or all of a gate electrode and a gate wire (also called a gate line, a gate signal line, or the like). The gate electrode refers to a conductive film which overlaps a semiconductor for forming a channel region or an LDD (Lightly Doped Drain) region with a gate insulating film sandwiched therebetween. The gate wire refers to a wire for connecting gate electrodes of different pixels, or a wire for connecting a gate electrode with another wire.

Note that there exists a portion serving as both a gate electrode and a gate wire. Such a region may be referred to as either a gate electrode or a gate wire. That is, there is a region where a gate electrode and a gate wire cannot be clearly distinguished from each other. For example, in the case where a channel region overlaps a gate wire which is extended, the overlapped region serves as both a gate wire and a gate electrode. Accordingly, such a region may be called either a gate electrode or a gate wire.

In addition, a region which is formed with the same material as the gate electrode and connected to the gate electrode may be referred to as a gate electrode. Similarly, a region which is formed of the same material as the gate wire and connected to the gate wire may be referred to as a gate wire. In the strict sense, such a region may not overlap the channel region or may not have a function of connecting to another gate electrode. However, there is a case where this region is formed with same material as the gate electrode or the gate wire and connected to the gate electrode or the gate wire in order to provide a sufficient manufacturing margin. Accordingly, such a region may also be referred to as a gate electrode or a gate wire.

In the case of a multi-gate transistor, for example, a gate electrode of a transistor is connected to a gate electrode of another transistor with the use of a conductive film which is formed with the same material as the gate electrodes. Since this region is a region for connecting a gate electrode to another gate electrode, it may be referred to as a gate wire, while it may also be called a gate electrode since the multi-gate transistor may be regarded as one transistor. That is, a region may be called a gate electrode or a gate wire as long as it is formed of the same material as a gate electrode or a gate wire and connected thereto. In addition, a part of a conductive film which connects a gate electrode to a gate wire, for example, may also be called a gate electrode or a gate wire.

Note that a gate terminal refers to a part of a gate electrode or a part of a region electrically connected to a gate electrode.

Note that a source refers to a part or all of a source region, a source electrode, and a source wire (also called a source line, a source signal line, or the like). A source region is a semiconductor region containing a large amount of p-type impurities (e.g., boron or gallium) or n-type impurities (e.g., phosphorus or arsenic). Accordingly, a source region does not include a region containing a slight amount of p-type impurities or n-type impurities, which is a so-called LDD region. The source electrode is a conductive layer which is formed of a different material from the source region and electrically connected to the source region. Note that there is a case where a source electrode and a source region are collectively referred to as a source electrode. A source wire is a wire for connecting source electrodes among different pixels, or a wire for connecting a source electrode with another wire.

However, there exists a portion serving as both a source electrode and a source wire. Such a region may be referred to as either a source electrode or a source wire. That is, there is a region where a source electrode and a source wire cannot be clearly distinguished from each other. For example, in the case where a source region overlaps a source wire which is extended, the overlapped region serves as both a source wire and a source electrode. Accordingly, such a region may be referred to as either a source electrode or a source wire.

In addition, a region which is formed with the same material as a source electrode and connected to the source electrode and a portion which connects a source electrode and another source electrode may each be referred to as a source electrode. A portion which overlaps a source region may be referred to as a source electrode as well. Similarly, a region which is formed of the same material as the source wire and connected to the source wire may be referred to as a source wire as well. In the strict sense, such a region may not have a function of connecting to another source electrode. However, there is a case where this region is formed with same material as the source electrode or the source wire and connected to the source electrode or the source wire in order to provide a sufficient manufacturing margin. Accordingly, such a region may also be referred to as a source electrode or a source wire.

In addition, a part of a conductive film which connects a source electrode to a source wire may be referred to as either a source electrode or a source wire, for example.

Note that a source terminal refers to a part of a source region, a source electrode, or a part of a region electrically connected to a source electrode.

Note also that a drain has a similar structure to the source.

Note that in the present invention, a semiconductor device refers to a device having a circuit including a semiconductor element (such as a transistor or a diode). In addition, it may also refer to a device in general that can operate by utilizing semiconductor characteristics. A display device refers to a device including a display element (such as a liquid crystal element or a light-emitting element). Note that it may also mean a main body of a display panel in which a plurality of pixels each including a display element such as a liquid crystal element or an EL element or a peripheral driver circuit for driving the pixels are formed over one substrate. In addition, a display device may include a peripheral driver circuit formed over a substrate with wire bonding, bump, or the like, that is a so-called chip on glass (COG) bonding. Moreover, it may include a device to which a flexible printed circuit (FPC) or a printed wiring board (PWB) is attached (such as an IC, a resistor, a capacitor, an inductor, or a transistor). Further, it may also include an optical sheet such as a polarizing plate or a retardation film. Furthermore, it may include a backlight unit (which may include a light guide plate, a prism sheet, a diffusion sheet, a reflection sheet, or a light source (such as an LED or a cold cathode tube)). In addition, a light-emitting device refers to a display device particularly including a self-emission type display element such as an EL element or an element used in FED. A liquid crystal display device refers to a display device including a liquid crystal element.

In the present invention, when it is described that an object is formed over another object, it does not necessarily mean that the object is in direct contact with the another object, and also the case is included where the above two objects are not in direct contact with each other, in other words, still another object may be sandwiched therebetween. Accordingly, when it is described that a layer B is formed over a layer A, it refers to either a case where the layer B is formed in direct contact with the layer A, or a case where another layer (e.g., a layer C or a layer D) is formed in direct contact with the layer A, and the layer B is formed in direct contact with the layer C or D. Similarly, when it is described that an object is formed above another object, it does not necessarily mean that the object is in direct contact with the another object, and still another object may be sandwiched therebetween. Accordingly, when it is described that a layer B is formed above a layer A, it refers to either a case where the layer B is formed in direct contact with the layer A, or a case where another layer (e.g., a layer C or a layer D) is formed in direct contact with the layer A, and then the layer B is formed in direct contact with the layer C or D. Similarly, when it is described that an object is formed below or under another object, it refers to either a case where the objects are in direct contact with each other or a case where the objects are not in direct contact with each other.

In this specification, a "source signal line" refers to a wire connected to an output of a source driver, in order to transmit video signals for controlling the operation of a pixel from the source driver.

In addition, in this specification, a "gate signal line" refers to a wire connected to an output of a gate driver, in order to transmit scan signals for controlling selection/non-selection of video signals writing to a pixel from the gate driver.

A burn-in correction period in which characteristics of a light-emitting element in each pixel are detected is provided in addition to a normal driving period in which an image is displayed, and video signals inputted to each pixel in the normal driving period are corrected according to the characteristics of the light-emitting elements obtained in the burn-in correction period, therefore, the light-emitting element can emit light which compensates changes in the characteristics of the light-emitting elements.

In addition, by providing a burn-in correction period, a user is not inconvenienced and a certain condition of obtaining the characteristics can be kept, which leads to obtaining of the characteristics of the light-emitting element with further accuracy.

DETAILED DESCRIPTION OF THE INVENTION

Hereinafter, embodiment mode of the present invention will be described in detail with the reference to the drawings. However, the present invention is not limited to the following description, and it is easily understood by those skilled art that various changes and modifications are possible, unless such changes and modifications depart from the spirit and the scope of the present invention. Therefore, the present invention is not construed as being limited to the description of the following embodiment mode.

[Embodiment Mode 1]

Figure 1:
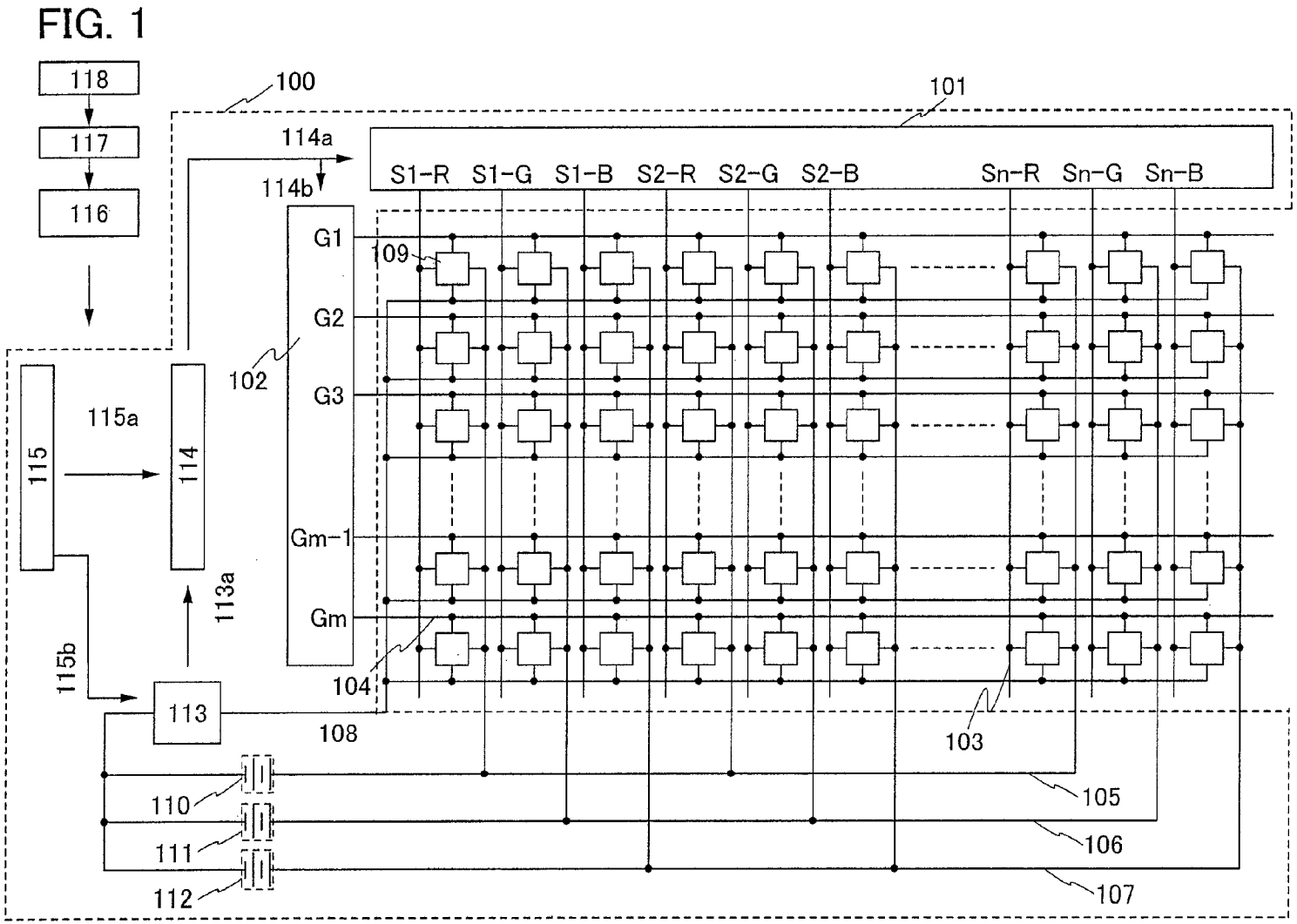
FIG. 1 shows a display device of Embodiment Mode 1.

A description is made on a first structure of a display device of the present invention with reference to FIG. 1.

In FIG. 1, a source driver 101 is a circuit which outputs video signals to pixels 109 through source signal lines 103 indicated by reference symbols S1-R to Sn-B. Video signals may be outputted to all of the source signal lines 103 at the same time. Alternatively, the video signals may be outputted per column, or may be outputted to a plurality of the source signal lines at the same time.

A gate driver 102 scans gate signal lines 104 indicated by reference symbols G1 to Gm per row and judges whether video signals can be written to the pixels 109 or not. Video signals outputted from the source driver 101 are inputted to the pixels 109 in a selected row, whereas the video signals outputted from the source driver 101 are not inputted to the pixels 109 in a row which is not selected.

The pixel 109 includes at least a light-emitting element having a pair of electrodes, a driving TFT connected to one of the electrodes of the light-emitting element, and a switch which turns on by a selected gate signal line 104 and electrically connects the source signal line 103 and a gate of the driving TFT. When a gate signal line 104 is not selected, a switch thereof turns off. Another switch or another TFT may be provided between the source signal line 103 and a gate of the driving TFT, or a capacitor may be connected in series. In FIG. 1, light-emitting elements included in the pixels 109 emit light of R (red), G (green), and B (blue). A light-emitting element which emits light of W (white) may be added thereto. Alternatively, the light-emitting elements included in the pixels 109 may emit light of any one of R (red), G (green), B (blue), or W (white). Further alternatively, colors may be expressed with a single color emission of white (W) and a color filter.

A power source R110 supplies predetermined voltage from one terminal through a power supply line R105 to the pixels 109 including light-emitting elements which emit R (red) light. A power source G111 supplies predetermined voltage from one terminal through a power supply line G106 to the pixels 109 including light-emitting elements which emit G (green) light. A power source B112 supplies predetermined voltage from one terminal through a power supply line B107 to the pixels 109 including light-emitting elements which emit B (blue) light.

The ones of the terminals of the power sources R110, G111, and B112 are connected to the counter electrode 108 of the light-emitting elements included in all the pixels 109 to supply predetermined voltage.

A current value detection circuit 113 is connected in series to the counter electrode 108 and is controlled whether to detect the current value of the counter electrode 108 or not according to current value detection control signals outputted from a controller 115. When the current of the counter electrode 108 is detected, the detected current value data is outputted to a correction circuit 114.

The correction circuit 114 stores the current value data of the counter electrode 108 obtained by the current value detection circuit 113. Then, according to the data of the counter electrode 108, that is, characteristics of the light-emitting elements in the pixels 109, correction of driver control signals and video signals which are generated from image signals 115*a* inputted from the controller 115 is carried out. The source driver 101 and the gate driver 102 are driven with the corrected driver control signals 114*a* and video signals 114*b*. Note that only video signals may be corrected. In addition, another memory circuit may be provided for storing the current value data of the counter electrode 108 obtained by the current value detection circuit 113.

The controller 115 transmits image signals 115*a* to the correction circuit 114 and transmits current value detection control signals 115*b* to the current value detection circuit 113, and controls them. In addition, the controller switches a burn-in correction period and a normal driving period which are described below, according to the image signals 115*a* and the current value detection control signals 115*b*.

A battery 117 (also referred to as a secondary battery) outputs a constant voltage to a power supply generating circuit 116 which serves as a power source. The battery 117 is provided with a charging unit 118 and the battery 117 can be charged by the charging unit 118 when potential thereof is lowered. The charging unit 118 can be used at an arbitrary timing.

The power supply generating circuit 116 can generate various voltages from the constant voltage supplied from the battery 117. The generated voltages are supplied to a display device driver circuit 100 as a power source.

Although the battery 117 is shown as an example of a power source supplied to the power supply generating circuit 116, a single-phase AC power source or three-phase AC power source may be employed. Alternatively, a power source which supplies a constant voltage generated from a single-phase AC power source or three-phase AC power source may be employed. When a single-phase AC power source or three-phase AC power source is employed, the charging unit 118 is not required. Therefore, voltage of a power source is not lowered, which is advantageous since the battery 117 is not drained in a burn-in correction period described below.

Figure 2:
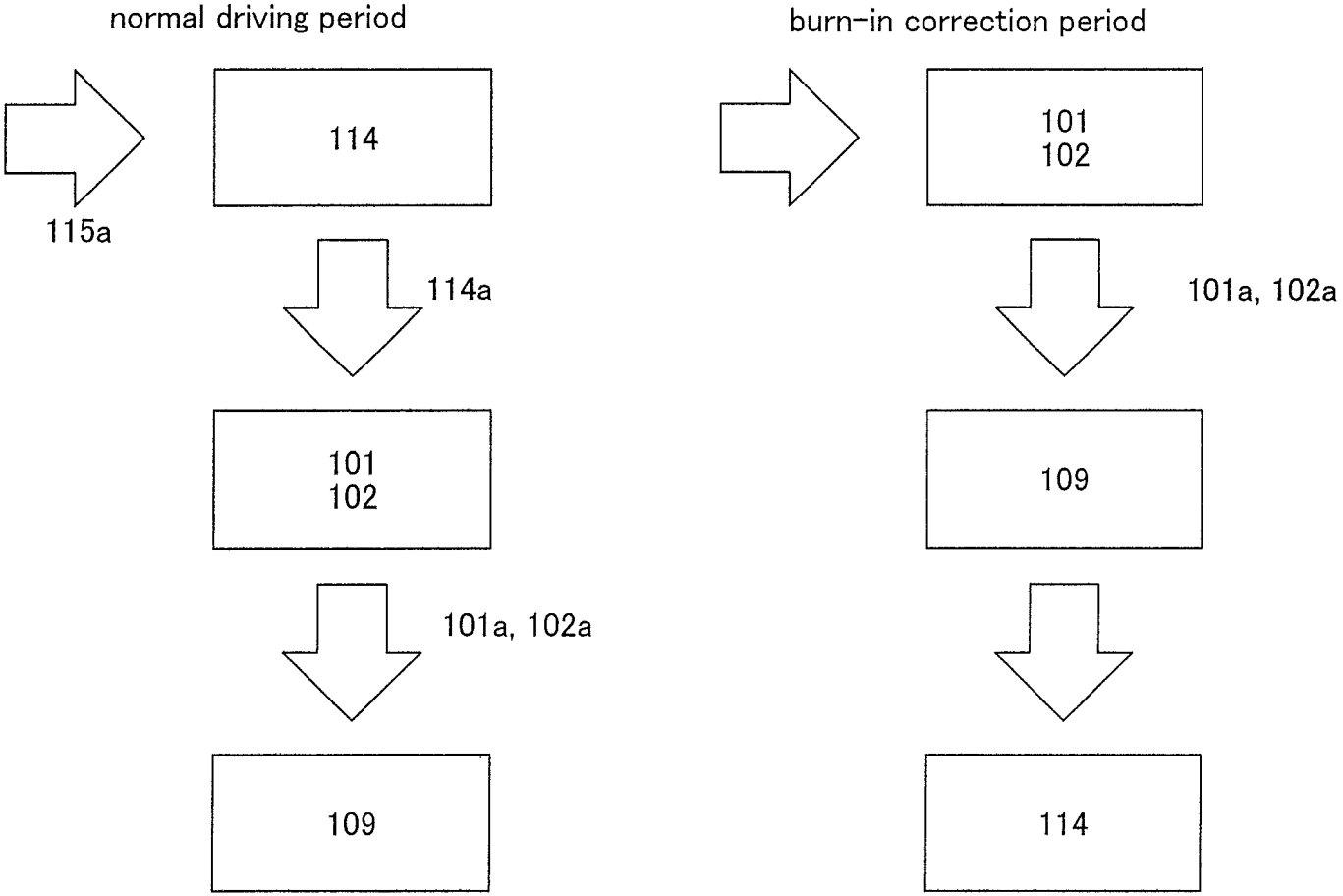
FIG. 2 shows a display device of Embodiment Mode 1.

A description is made on a driving method for the first structure of a display device of the present invention with reference to FIG. 2.

In a driving method for the first structure, a burn-in correction period and a normal driving period, are provided separately, and in the burn-in correction period, a driving method for the first structure is carried out. The normal driving period is a time in which an image is displayed. The burn-in correction period is a time in which characteristics of light-emitting elements included in the pixels 109 are obtained.

The normal driving period is described. In the normal driving period, characteristics of light-emitting elements included in the pixels 109 are already stored in the correction circuit 114. The correction circuit 114 corrects, according to characteristics data of the light-emitting elements included in the pixels 109, driver control signals and video signals which are generated from image signals inputted from the controller 115, and outputs the corrected driver control signals 114*a* and video signals 114*b* to the source driver 101 and the gate driver 102. Then, the source driver 101 outputs the video signals to the source signal lines 103. The gate driver 102 scans the gate signal lines 104 to let the pixels 109 emit light, and an image according to the image signals 115*a* is displayed. At this time, if characteristics of light-emitting element included in the pixels 109 are not stored in the correction circuit 114, the driver control signals and video signals are not necessarily corrected. In this case, the current value detection circuit 113 is not operated according to current value detection control signals 115*b* outputted from the controller 115. That is, current of the counter electrode 108 is not detected, and the current value data 113*a* is not outputted to the correction circuit 114.

The burn-in correction period is described. In the burn-in correction period, the characteristics of light-emitting elements included in the pixels 109 are detected so as to store the data which is detected in the current value detection circuit 113 in the correction circuit 114. Image signals 115*a* with which pixels emit light one by one are outputted to the correction circuit 114 from the controller 115. At this time, the driver control signals and video signals are not corrected according to the characteristics data of light-emitting elements included in the pixels 109, which is stored in the correction circuit 114. In addition, the current value detection circuit 113 is controlled by the current value detection control signals 115*b* so that a current value of the counter electrode in each of the pixels is obtained and outputted to the correction circuit 114 to be stored in the correction circuit 114. Thus, current of the counter electrode 108 including characteristics of a light-emitting element of each pixel 109 can be stored in the correction circuit 114. The current value data to be stored in the correction circuit 114 is renewed in every burn-in correction period. That is, data is overwritten, which means that a memory for storing new data in every burn-in correction period is not required.

In the first structure of a display device of the present invention, the counter electrode 108 is connected to the current value detection circuit 113. Since the counter electrode 108 is shared by every pixel 109, the characteristics of light-emitting elements in every pixel 109 can be detected with one current value detection circuit 113. Thus, the size of a circuit for detecting the characteristics of light-emitting elements included in the pixels 109 can be reduced, which leads to reduction in space and power consumption.

[Embodiment Mode 2]

Figure 3:
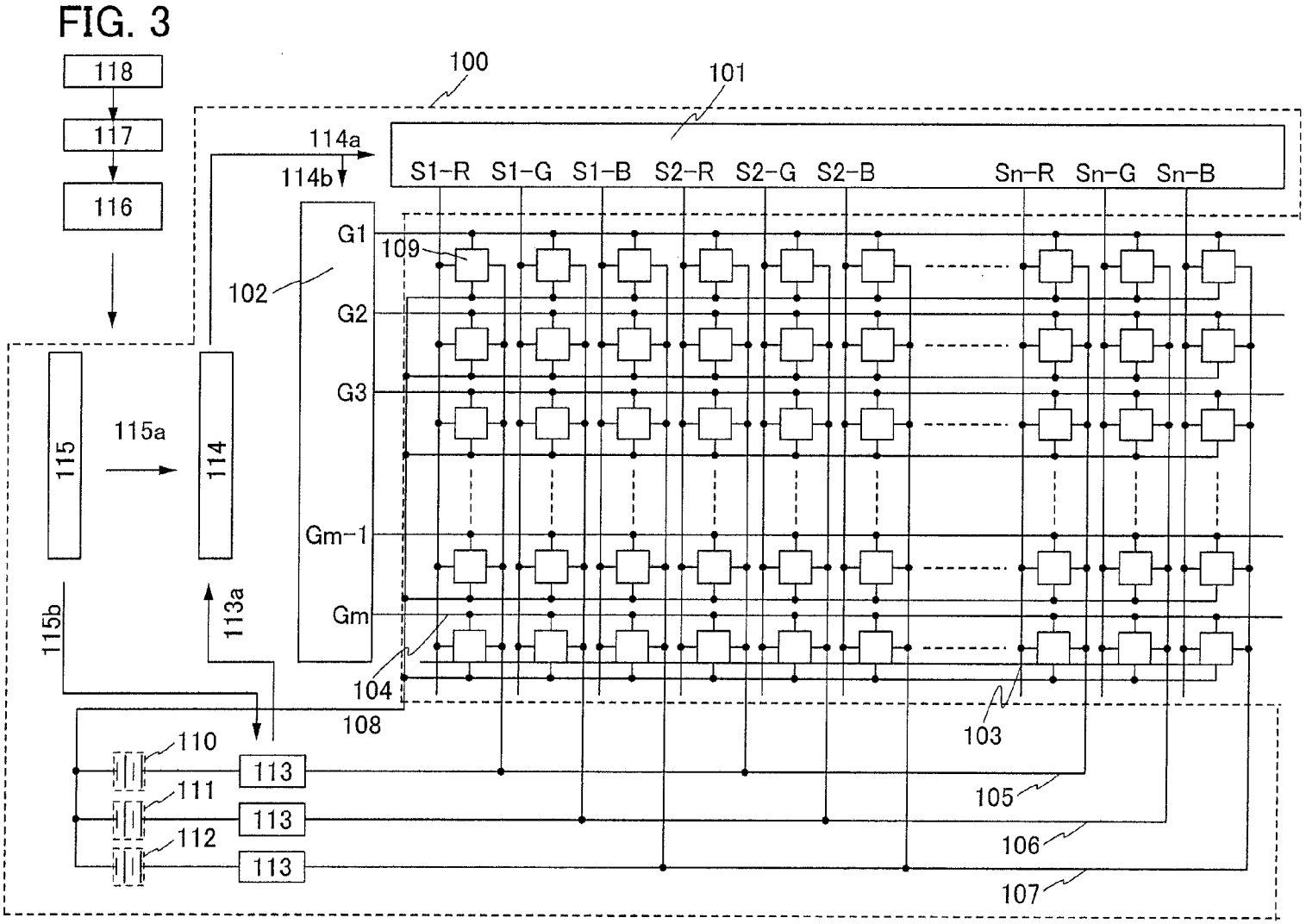
FIG. 3 shows a display device of Embodiment Mode 2.

A description is made on a second structure of a display device of the present invention with reference to FIG. 3.

In this embodiment mode, the source driver 101, the gate driver 102, the source signal lines 103, the gate signal lines 104, the power supply line R105, the power supply line G106, the power supply line B107, the counter electrode 108, the pixels 109, the power source R110, the power source G111, the power source B112, the current value detection circuits 113, the correction circuit 114, the controller 115, the power supply generating circuit 116, the battery 117, and the charging unit 118 have functions similar to those in Embodiment Mode 1.

The current value detection circuits 113 have a function similar to that of the current value detection circuit 113 described in Embodiment Mode 1, and which are connected in series to the power source R110, the power source G111, and a power source B112. It is controlled whether the current value of the power source R110, the power source G111, and the power source B112 is detected or not in accordance with the current value detection control signals 115*b* outputted from the controller 115. When current of the power source R110, the power source G111, and the power source B112 is detected, detected current value data 113*a* is outputted to the correction circuit 114.

Figure 4:
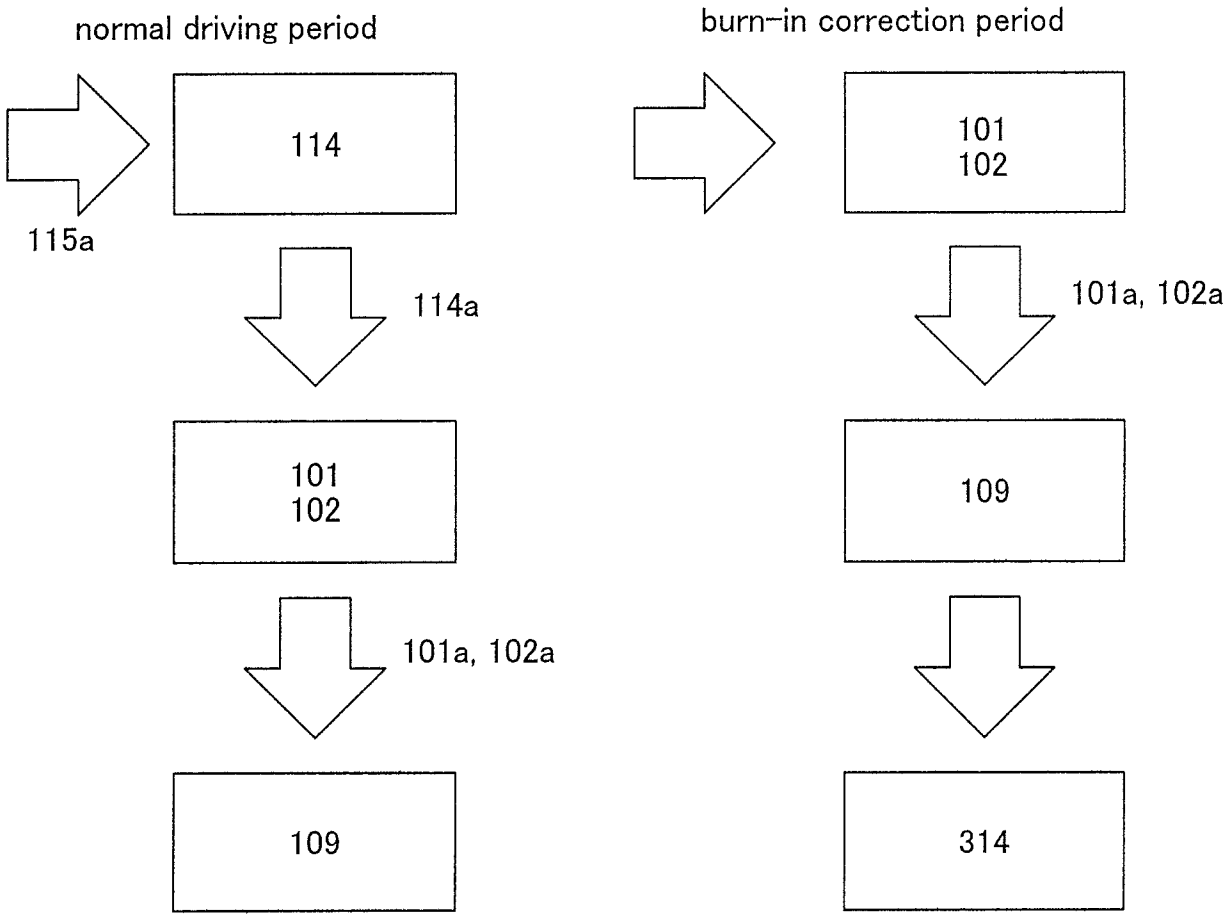
FIG. 4 shows a display device of Embodiment Mode 2.

A description is made on a driving method for the second structure of a display device of the present invention with reference to FIG. 4.

In a driving method for the second structure, a burn-in correction period and a normal driving period are provided separately, and in the burn-in correction period, a driving method for the second structure is carried out. The normal driving period is a time in which an image is displayed. The burn-in correction period is a time in which characteristics of light-emitting elements included in the pixels 109 are obtained.

The normal driving period is described. In the normal driving period, characteristics of light-emitting elements included in the pixels 109 are already stored in the correction circuit 114. The correction circuit 114 corrects, according to characteristics data of the light-emitting elements included in the pixels 109, driver control signals and video signals which are generated from image signals 115*a* inputted from the controller 115 and outputs the corrected driver control signals 114*a* and video signals 114*b* to the source driver 101 and the gate driver 102. Then, the source driver 101 outputs the video signals 114*b* to the source signal lines 103. The gate driver 102 scans the gate signal lines 104 to let the pixels 109 emit light, and an image according to the image signals 115*a* is displayed.

The burn-in correction period is described. In the burn-in correction period, the characteristics of light-emitting elements included in the pixels 109 are detected so as to be stored in the correction circuit 114. Image signals 115*a* with which the pixels 109 emit light of R, G, and B at the same time are outputted to the correction circuit 114 from the controller 115. At this time, the driver control signals and video signals are not corrected according to the characteristics data of light-emitting elements included in the pixels 109, which is stored in the correction circuit 114. In addition, the current value detection circuit 113 is controlled by the current value detection control signals 115*b* so that current of the power supply line R105, power supply line G106, and power supply line B107 of each pixel is obtained at the same time and outputted to the correction circuit 114 to be stored in the correction circuit 114. Thus, current of the power supply line R105, power supply line G106, and power supply line B107 each including characteristics of the light-emitting element of the pixel 109 can be stored in the correction circuit 114. The current value data 113*a* to be stored in the correction circuit 114 is renewed in every burn-in correction period. That is, data is overwritten, which means that a memory for storing new data in every burn-in correction period is not required.

In the second structure of a display device of the present invention, the power supply line R105, power supply line G106, and power supply line B107 are connected to the current value detection circuits 113. The connection of the power supply line R105, power supply line G106, and power supply line B107 to the current value detection circuits 113 makes it possible to concurrently detect the characteristics of the light-emitting elements included in the pixels 109 which emit light of R, G and B. Therefore, a burn-in correction period can be shortened significantly.

[Embodiment Mode 3]

Figure 5:
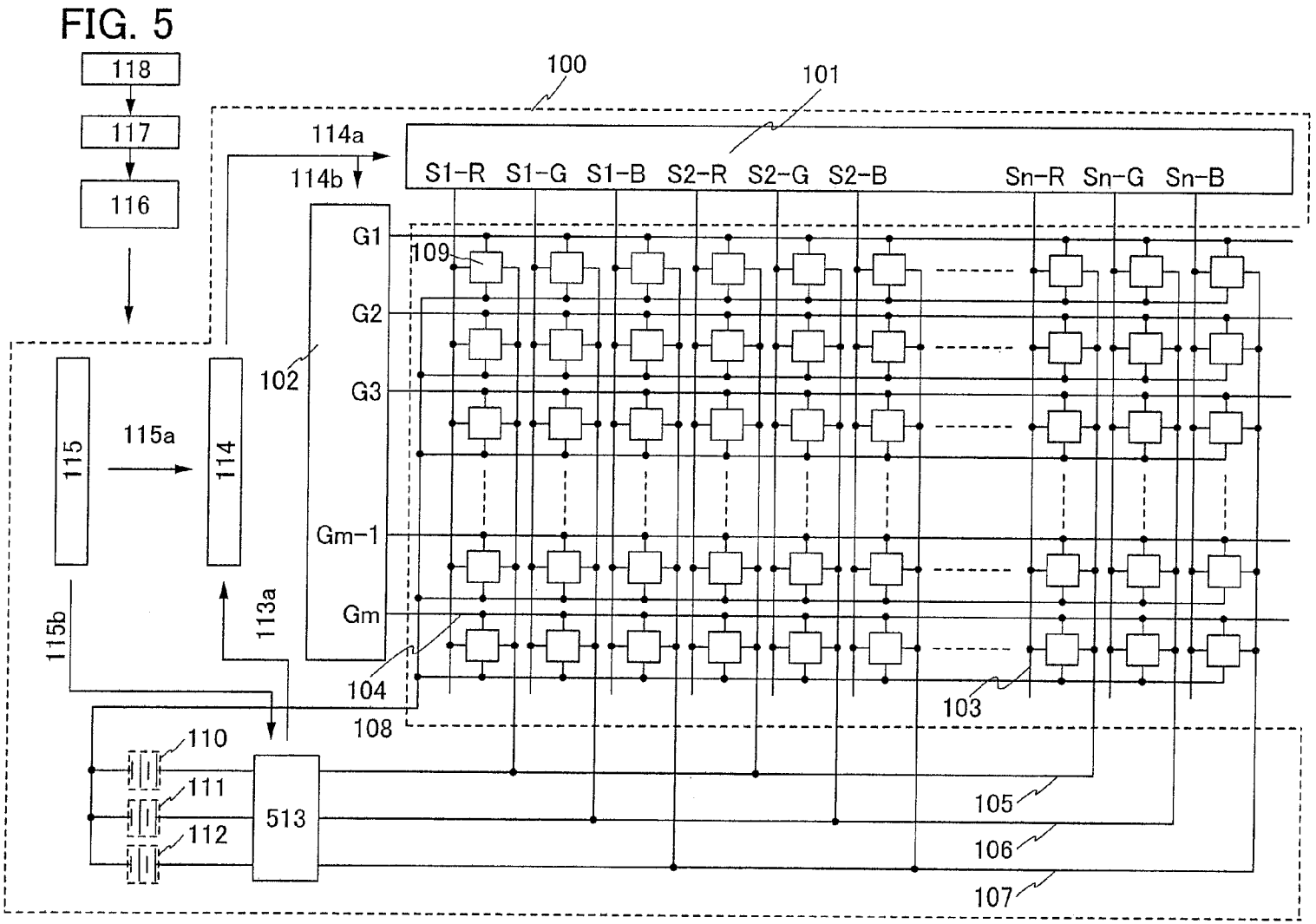
FIG. 5 shows a display device of Embodiment Mode 3.

A description is made on a third structure of a display device of the present invention with reference to FIG. 5.

In this embodiment mode, the source driver 101, the gate driver 102, the source signal lines 103, the gate signal lines 104, the power supply line R105, the power supply line G106, the power supply line B107, the counter electrode 108, the pixels 109, the power source R110, the power source G111, the power source B112, a current value detection circuit 113, the correction circuit 114, the controller 115, the power supply generating circuit 116, the battery 117, and the charging unit 118 have functions similar to those in Embodiment Modes 1 and 2.

The current value detection selector circuit 513 is connected in series to the power supply line R105, the power supply line G106, and the power supply line B107. The current value detection selector circuit 513 selects one of the power supply line R105, the power supply line G106, and the power supply line B107 and detects current thereof.

Figure 6:
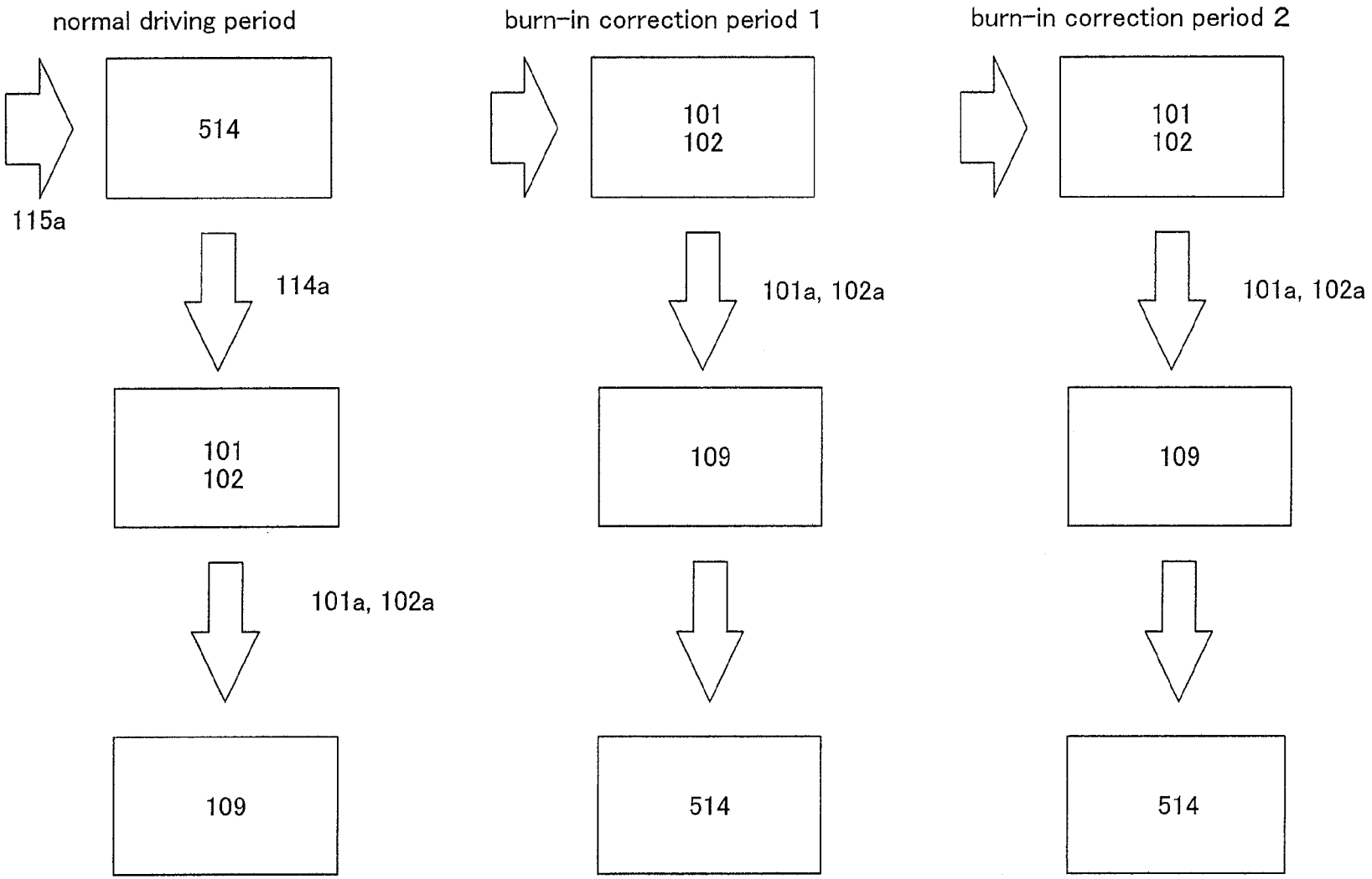
FIG. 6 shows a display device of Embodiment Mode 3.

A description is made on a driving method of the third structure of the display device of the present invention with reference to FIG. 6.

In a driving method for the third structure, a burn-in correction period and a normal driving period are provided separately, and in the burn-in correction period, a driving method for the third structure is carried out. The normal driving period is a time in which an image is displayed. The burn-in correction period is a time in which characteristics of light-emitting elements included in the pixels 109 are obtained.

The normal driving period is described. In the normal driving period, characteristics of the light-emitting elements included in the pixels 109 are already stored in the correction circuit 114. The correction circuit 114 corrects, according to characteristics data of the light-emitting elements included in the pixels 109, driver control signals and video signals which are generated from image signals 115*a* inputted from the controller 115 and outputs the corrected driver control signals and video signals 114*a* to the source driver 101 and the gate driver 102. Then, the source driver 101 outputs the video signals 101*a* to the source signal lines 103. The gate driver 102 outputs scan signals 102*a* and scans the gate signal lines 104 to let the pixels 109 emit light, and an image according to the video signals is displayed.

The burn-in correction period is described. In the driving method for the third structure, there are two kinds of burn-in correction periods as described as a burn-in correction period 1 and a burn-in correction period 2.

The burn-in correction period 1 is described. In the burn-in correction period 1, the characteristics of light-emitting elements included in the pixels 109 are detected to be stored in the correction circuit 114. Image signals 115*a* with which pixels emit light one by one are outputted to the correction circuit 114 from the controller 115. At this time, the driver control signals and video signals are not corrected according to the characteristics data of light-emitting elements included in the pixels 109, which is stored in the correction circuit 114. In addition, the current value detection selector circuit 513 is controlled by the current value detection control signals 115*b* so that current in each pixel of the power supply line R105, power supply line G106, and power supply line B107 is obtained sequentially and outputted to the correction circuit 114 to be stored in the correction circuit 114. Thus, current of the power supply line R105, power supply line G106, and power supply line B107 including characteristics of the light-emitting element of each pixel 109 can be stored in the correction circuit 114. The current value data 513*a* to be stored in the correction circuit 114 is renewed in every burn-in correction period. That is, data is overwritten, which means that a memory for storing new data in every burn-in correction period is not required.

The burn-in correction period 2 is described. In the burn-in correction period 2, the characteristics of light-emitting elements included in the pixels 109 are detected to be stored in the correction circuit 114. Image signals 115*a* with which the pixels 109 emit light of R, Q and B at the same time are outputted to the correction circuit 114 from the controller 115. At this time, the driver control signals and video signals are not corrected according to the characteristics data of light-emitting elements included in the pixels 109, which is stored in the correction circuit 114. In addition, the current value detection selector circuit 513 is controlled by the current value detection control signals 115*b* so that current of the power supply line R105, power supply line G106, and power supply line B107 of each pixel is obtained sequentially and outputted to the correction circuit 114 to be stored in the correction circuit. Thus, current of the power supply line R105, power supply line G106, and power supply line B107 including characteristics of the light-emitting element of each pixel 109 can be stored in the correction circuit 114. The current value data 513*a* to be stored in the correction circuit 114 is renewed in every burn-in correction period. That is, data is overwritten, which means that a memory for storing new data in every burn-in correction period is not required.

Figure 7:
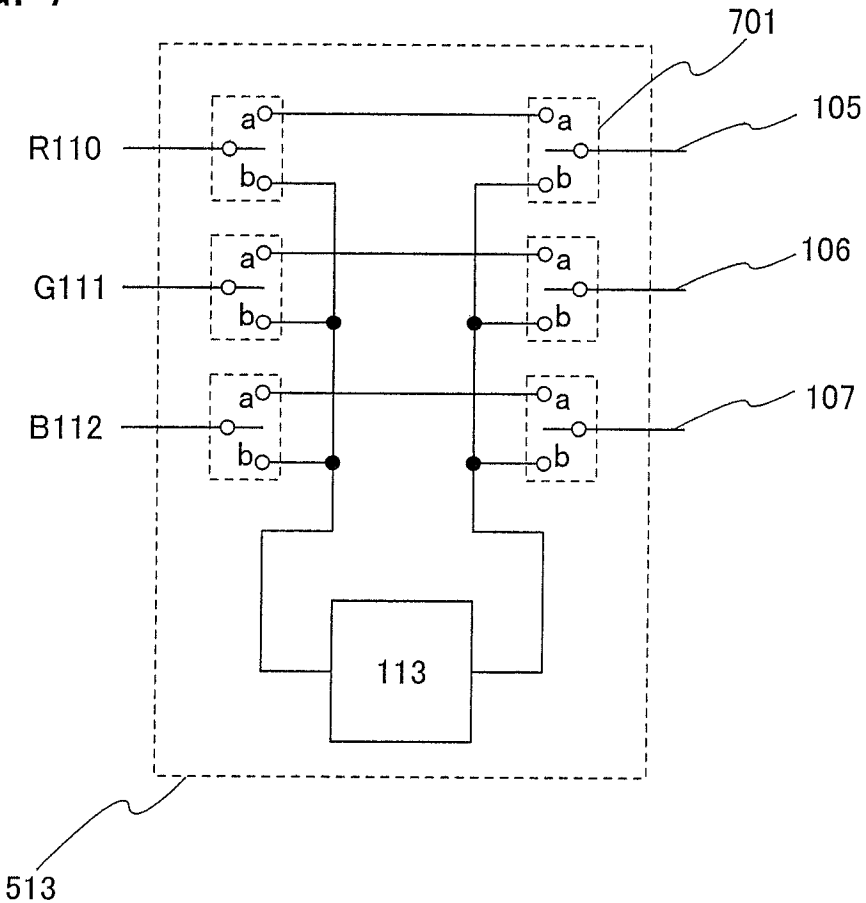
FIG. 7 shows a display device of Embodiment Mode 3.

A description is made on an example of a structure of the current value detection selector circuit 513 with reference to FIG. 7.

In the burn-in correction period 1 and the burn-in correction period 2, a select switch 701 selects whether each of the power supply line R105, the power supply line G106, and the power supply line B107 is connected to a terminal a or a terminal b. Note that one of select switches 701 of the power supply line R105, power supply line G106, and power supply line B107 is connected to the terminal a. All power supply lines which are not connected to the terminals a are connected to the terminals b.

The current value detection circuit 113 detects current flowing in a power supply line which is connected to the terminal b by the select switch 701. In a normal driving period, all select switches 701 are connected to the terminals a.

In the third structure of a display device of the present invention, the power supply line R105, power supply line G106, and power supply line B107 are connected to the current value detection selector circuit 513. The connection of the power supply line R105, power supply line G106, and power supply line B107 to the current value detection selector circuit 513 makes it possible to detect each current of the power supply line R105, power supply line G106, and power supply line B107 with one current value detection circuit 113. Thus, the size of a circuit for detecting characteristics of light-emitting elements included in the pixels 109 can be reduced, which leads to reduction in space and power consumption.

[Embodiment Mode 4]

Figure 8:
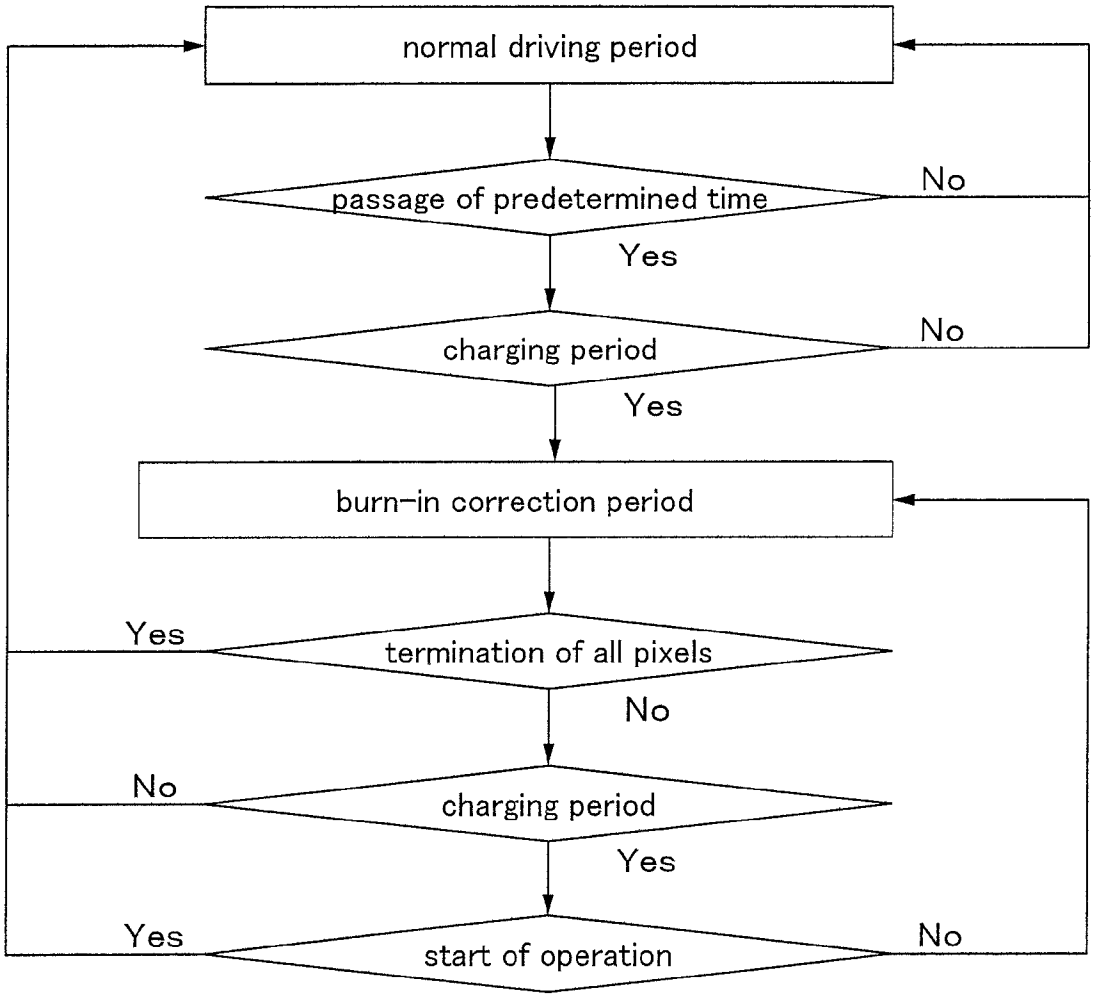
FIG. 8 shows a display device of Embodiment Mode 4.

A description is made on the timing and conditions for proceeding from the normal driving period to the burn-in correction period with reference to a flow chart of FIG. 8, to which Embodiment Modes 1 to 3 are applied. In the flow chart, a rectangular box represents a process and a diamond-shaped box represents a decision.

In this embodiment mode, a "normal driving period" refers to a time in which an image can be displayed according to video signals, as described in Embodiment Modes 1 to 3.

A "burn-in correction period" refers to a time in which characteristics of light-emitting elements are obtained, as described in Embodiment Modes 1 to 3.

In a step of "passage of predetermined time", it is judged whether a predetermined time has passed or not after proceeding from the last burn-in correction period to a normal driving period.

In a step of "charging period", it is judged whether a battery mounted on an electronic appliance or the like of the present invention is charged or not by the user.

In a decision of "termination of all pixels", it is judged whether characteristics of light-emitting elements included in all pixels are obtained or not in a burn-in correction period.

In a decision of "start of operation", it is judged whether a user operates an electronic appliance of the present invention or not.

A description is made on the flow of a flow chart of FIG. 8. If a predetermined time has not passed after the process proceeds from the last "burn-in correction period" to a "normal driving period" in the "passage of predetermined time", the process proceeds to the "normal driving period", whereas the process proceeds to a "charging period" if the predetermined time has passed. If a battery is not charged in the "charging period", the process proceeds to the "normal driving period", whereas the process proceeds to the "burn-in correction period" if the battery is charged. When the process proceeds to the "burn-in correction period", operations described in the burn-in correction period in Embodiment Modes 1 to 3 are carried out, and then, the process proceeds to the "termination of all pixels". If characteristics of light-emitting elements included in all pixels are obtained in the "termination of all pixels", the process proceeds to the "normal driving period", whereas the process proceeds to the "charging period" if the characteristics of light-emitting elements included in all pixels are not obtained. If the battery is not charged in the "charging period", the process proceeds to the "normal driving period", whereas the process proceeds to the "start of operation" if the battery is charged. If the user starts operation in the "start of operation", the process proceeds to the "normal driving period", whereas the process proceeds to the "burn-in correction period" if the user has not started operation.

By adding the "passage of predetermined time" to the conditions for proceeding from the normal driving period to the burn-in correction period, the number of proceedings to the burn-in correction period can be controlled. In the burn-in correction period, light-emitting elements included in pixels need to emit light as described in Embodiment Modes 1 to 3. Therefore, decrease in frequency of proceeding to the burn-in correction period can prevent deterioration of light-emitting elements included in pixels due to the burn-in correction period.

By adding the "charging period" to the conditions for proceeding from the normal driving period to the burn-in correction period, the process can proceed to the burn-in correction period while charging the battery. In the burn-in correction period, light-emitting elements included in pixels emit light, so that characteristics of the light-emitting elements are stored as described in Embodiment Modes 1 to 3. Therefore, power consumption therein is large. Proceeding to the burn-in correction period while charging the battery can prevent reduction in power of the battery due to the burn-in correction period. Besides, when charging the battery, it is highly possible that the user has finished using the electronic appliance or the like and it is unlikely that the process returns to the normal driving period.

By adding the "termination of all pixels" to the conditions for proceeding from the burn-in correction period to the normal driving period, characteristics of the light-emitting elements included in all pixels can be detected under the same conditions. When the conditions under which characteristics of the light-emitting elements included in pixels are detected, that is, when the operating environments are the same, variation in characteristics due to difference in the operating environments can be suppressed.

By adding the "charging period" to the conditions for proceeding from the burn-in correction period to the normal driving period, the process can proceed to the normal driving period on finishing charging of the battery. Proceeding to the normal driving period from the burn-in correction period on finishing charging of the battery, drain of the battery can be suppressed. Besides, when charging the battery is finished, it is highly possible that the user is going to use the electronic appliance; therefore, the process needs to proceed to the normal driving period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "charging period" and the "start of operation", the burn-in correction period finishes before characteristics of the light-emitting elements included in all pixels are detected. In this case, the characteristics of light-emitting elements included in pixels which are not detected in the last burn-in correction period may be detected in the next burn-in correction period. In addition, when the process proceeds to the next burn-in correction period, it is preferable that the predetermined time in the "passage of predetermined time" be shorter. The predetermined time is preferably zero second and the process preferably proceeds to the burn-in correction period via the next "charging period".

Figure 61:
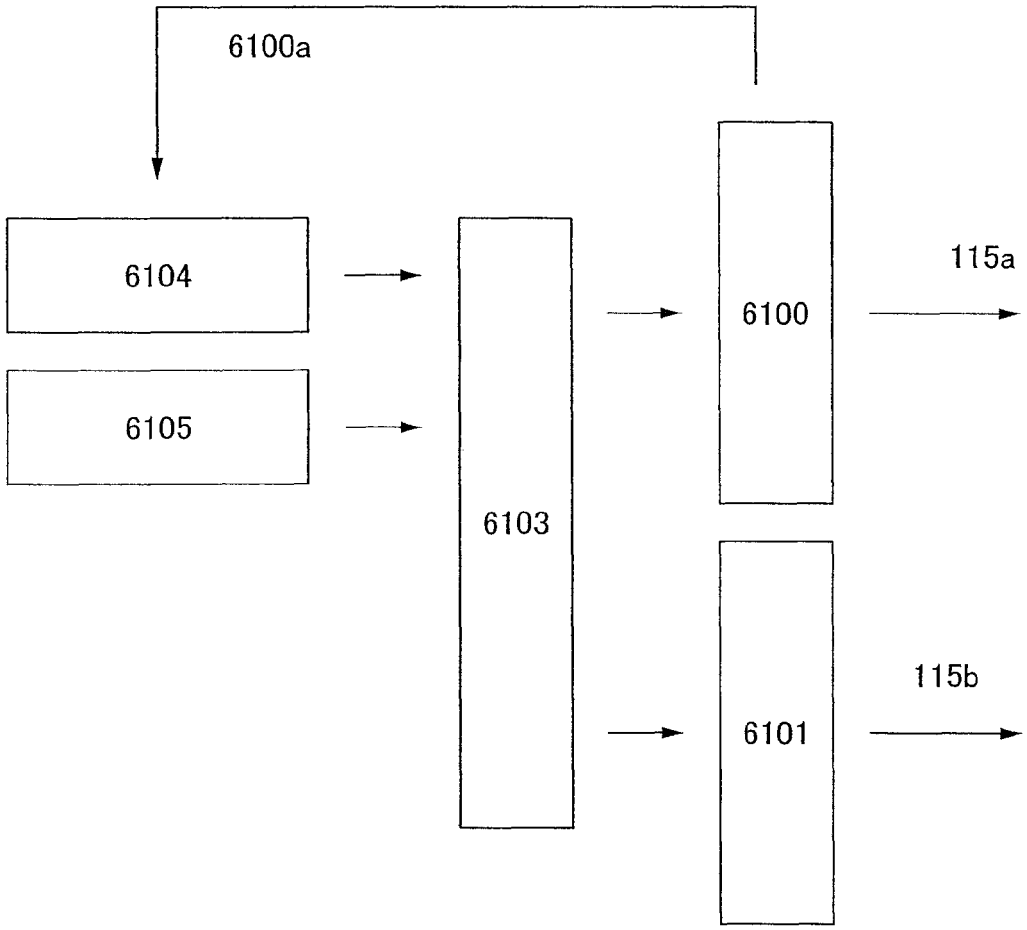
FIG. 61 shows a display device of Embodiment Mode 4.

A description is made on the structure and operation of the controller 115 for realizing the flow chart of FIG. 8 described in this embodiment mode, with reference to FIG. 61.

In FIG. 61, a driving method selection circuit 6103 decides and selects whether an image signal generation circuit 6100 and a current value detection control signal generation circuit 6101 conduct operation of the normal driving period or the burn-in correction period described in Embodiment Modes 1 to 3. The driving method selection circuit 6103 outputs signals for conducting operation of the burn-in correction period to the image signal generation circuit 6100 and the current value detection control signal generation circuit 6101 when signal for proceeding to the burn-in correction period is inputted from the circuit from which signal is inputted to the driving method selection circuit 6103. In other cases, signals for conducting operation of the normal driving period are outputted therefrom. For example, the driving method selection circuit 6103 includes a discriminating circuit comprising NOR, AND.

The image signal generation circuit 6100 outputs the image signals and the correction circuit control signals 115*a*. When the operation of the normal driving period is selected by the driving method selection circuit 6103, the image signals and the correction circuit control signals 115*a* are outputted with which the correction circuit 114 conducts operation of the normal driving period described in Embodiment Modes 1 to 3. When the operation of the burn-in correction period is selected by the driving method selection circuit 6103, the image signals and the correction circuit control signals are outputted with which the correction circuit 114 conducts operation of the burn-in correction period described in Embodiment Modes 1 to 3.

The current value detection control signal generation circuit 6101 outputs the current value detection control signals 115*b*. When the operation of the normal driving period is selected by the driving method selection circuit 6103, the current value detection control signals 115*b* are outputted with which the current value detection circuit 113 conducts operation of the normal driving period described in Embodiment Modes 1 to 3. When the operation of the burn-in correction period is selected by the driving method selection circuit 6103, the current value detection control signals 115*b* are outputted with which the current value detection circuit 113 conducts operation of the burn-in correction period described in Embodiment Modes 1 to 3.

A timer circuit 6104 detects a time passed from the end of the burn-in correction period. When the burn-in correction period ends and the process proceeds to the normal driving period, reset signals 6100*a* are outputted from the video signal generation circuit 6100, and signals for proceeding to the burn-in correction period are stopped. Note that as long as the reset signals 6100*a* are inputted to the timer circuit 6104 at the end of the burn-in correction period, the reset signals 6100*a* may be outputted from anywhere. When the time detected by the timer circuit 6104 is longer than the predetermined time, signals for proceeding to the burn-in correction period are outputted to the driving method selection circuit 6103. The reset signals 6100*a* inputted to the timer circuit 6104 are not necessarily inputted if characteristics of all the pixels or set pixels are not detected. For example, the timer circuit 6104 includes a reset signal generation circuit, a counter, and a count value generation circuit, a memory, or a resistor in which count number corresponded to the predetermined time is stored.

A charging unit detection circuit 6105 judges whether the battery 117 is charged by the charging unit 118 or not. If the battery 117 is charged, signals for proceeding to the burn-in correction period are outputted to the driving method selection circuit 6103. For example, the charging unit detection circuit 6105 includes a terminal, a high resistivity element, and a discriminating circuit in which 1 or 0 is judged.

A description is made on operation in this embodiment mode. When the predetermined time has passed from the input of the reset signals 6100*a* to the timer circuit 6104, that is, the predetermined time has passed from the end of the last burn-in correction period, and the charging unit detection circuit 6105 detects charging of the battery 117; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of all pixels, the reset signals 6100*a* are inputted to the timer circuit 6104. In this embodiment mode, between the "normal driving period" and the "burn-in correction period", the judgment of "passage of predetermined time", the judgment of "charging period", the judgment of "termination of all pixels", the judgment of "start of operation" are conducted, the present invention can operate by conducting at least one of the judgment of "passage of predetermined time", the judgment of "charging period", the judgment of "termination of all pixels", and the judgment of "start of operation". That is, for example, between the normal driving period and the burn-in correction period, only the judgment of passage of predetermined time is conducted. In this case, the operation is conducted by using at least the timer circuit 6104 and the driving method selection circuit 6103.

[Embodiment Mode 5]

Figure 9:
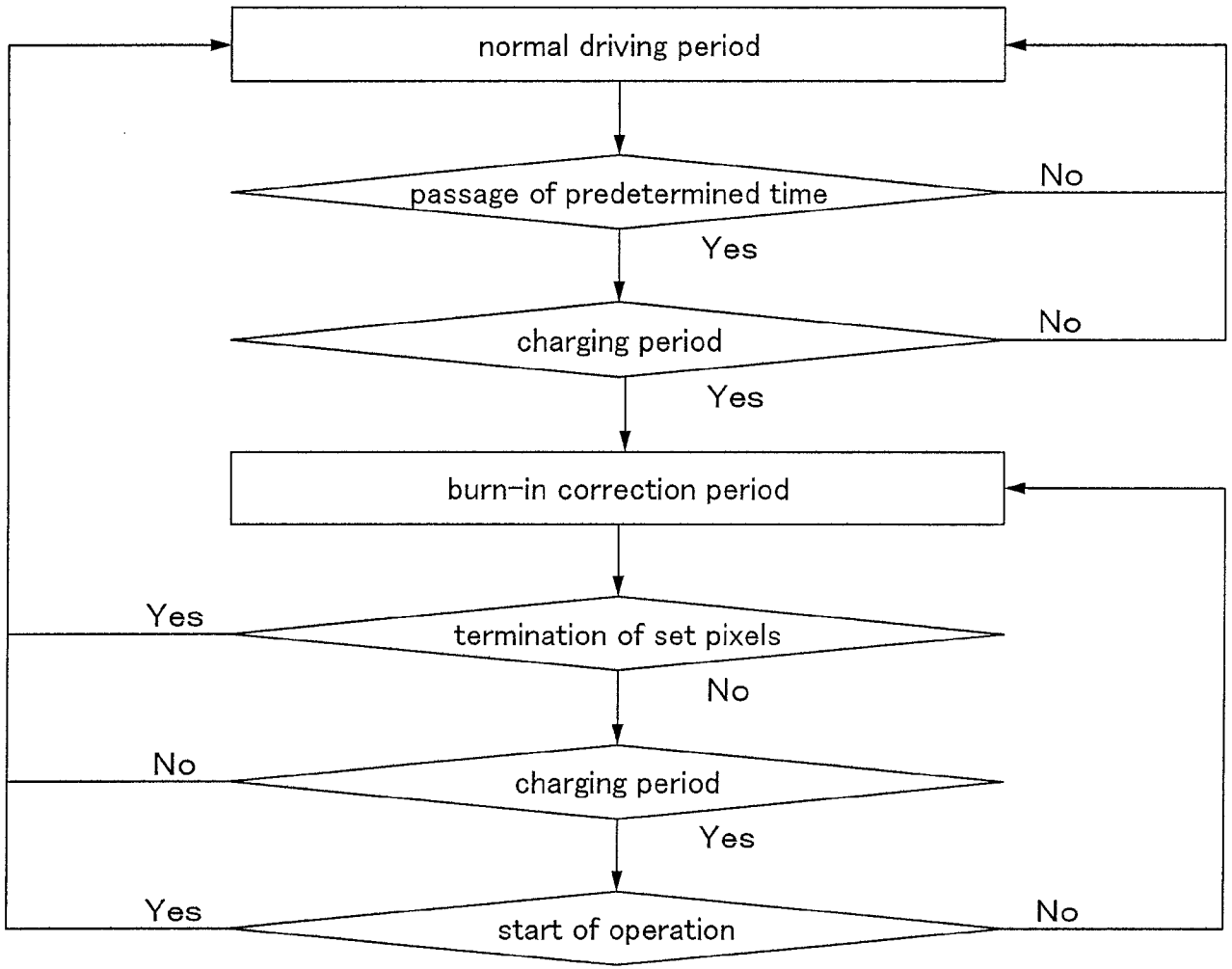
FIG. 9 shows a display device of Embodiment Mode 5.

A description is made on the timing and conditions for proceeding from the normal driving period to the burn-in correction period with reference to a flow chart of FIG. 9, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "passage of predetermined time", the decision of "charging period", and the decision of "start of operation" are similar to those in Embodiment Mode 4. In a decision of "termination of set pixels", it is judged whether characteristics of light-emitting elements included in preset pixels are obtained or not. The preset pixels refer to pixels which are included in one portion, when all the pixels are divided into a plurality of portions. For example, when all the pixels are divided in two parts, the upper half portion and the lower half portion are formed.

A description is made on the flow of a flow chart of FIG. 9. By adding the "passage of predetermined time" to the conditions for proceeding from the normal driving period to the burn-in correction period, the number of proceedings to the burn-in correction period can be controlled. In the burn-in correction period, light-emitting elements included in pixels need to emit light as described in Embodiment Modes 1 to 3. Therefore, decrease in frequency of proceeding to the burn-in correction period can prevent deterioration of light-emitting elements included in pixels due to the burn-in correction period.

By adding the "charging period" to the conditions for proceeding from the normal driving period to the burn-in correction period, the process can proceed to the burn-in correction period while charging the battery. In the burn-in correction period, light-emitting elements included in pixels emit light, so that characteristics of the light-emitting elements are stored as described in Embodiment Modes 1 to 3. Therefore, power consumption therein is large. Proceeding to the burn-in correction period while charging the battery can prevent reduction in power of the battery due to the burn-in correction period. Besides, when charging the battery, it is highly possible that the user has finished using the electronic appliance or the like and it is unlikely that the process returns to the normal driving period.

By adding the "termination of set pixels" to the conditions with which the process proceeds from the burn-in correction period to the normal driving period, the process can proceed to the normal driving period without interrupting the burn-in correction period. In addition it is possible that the process proceeds to the burn-in correction period selectively in a portion in which burn-in is supposed to be easily generated.

By adding the "charging period" to the conditions for proceeding from the burn-in correction period to the normal driving period, the process can proceed to the normal driving period on finishing charging of the battery. Proceeding to the normal driving period from the burn-in correction period on finishing charging of the battery, drain of the battery can be suppressed. Besides, when charging the battery is finished, it is highly possible that the user is going to use the electronic appliance; therefore, the process needs to proceed to the normal driving period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from burn-in correction period via the "charging period" and the "start of operation", the burn-in correction period finishes before characteristics of the light-emitting elements included in the preset pixels are detected. In this case, the characteristics of light-emitting elements included in pixels which are not detected in the last burn-in correction period may be detected in the next burn-in correction period. In addition, when the process proceeds to the next burn-in correction period, it is preferable that the predetermined time in the "passage of predetermined time" be shorter. The predetermined time is preferably zero second and the process preferably proceeds to the burn-in correction period via the next "charging period".

Figure 62:
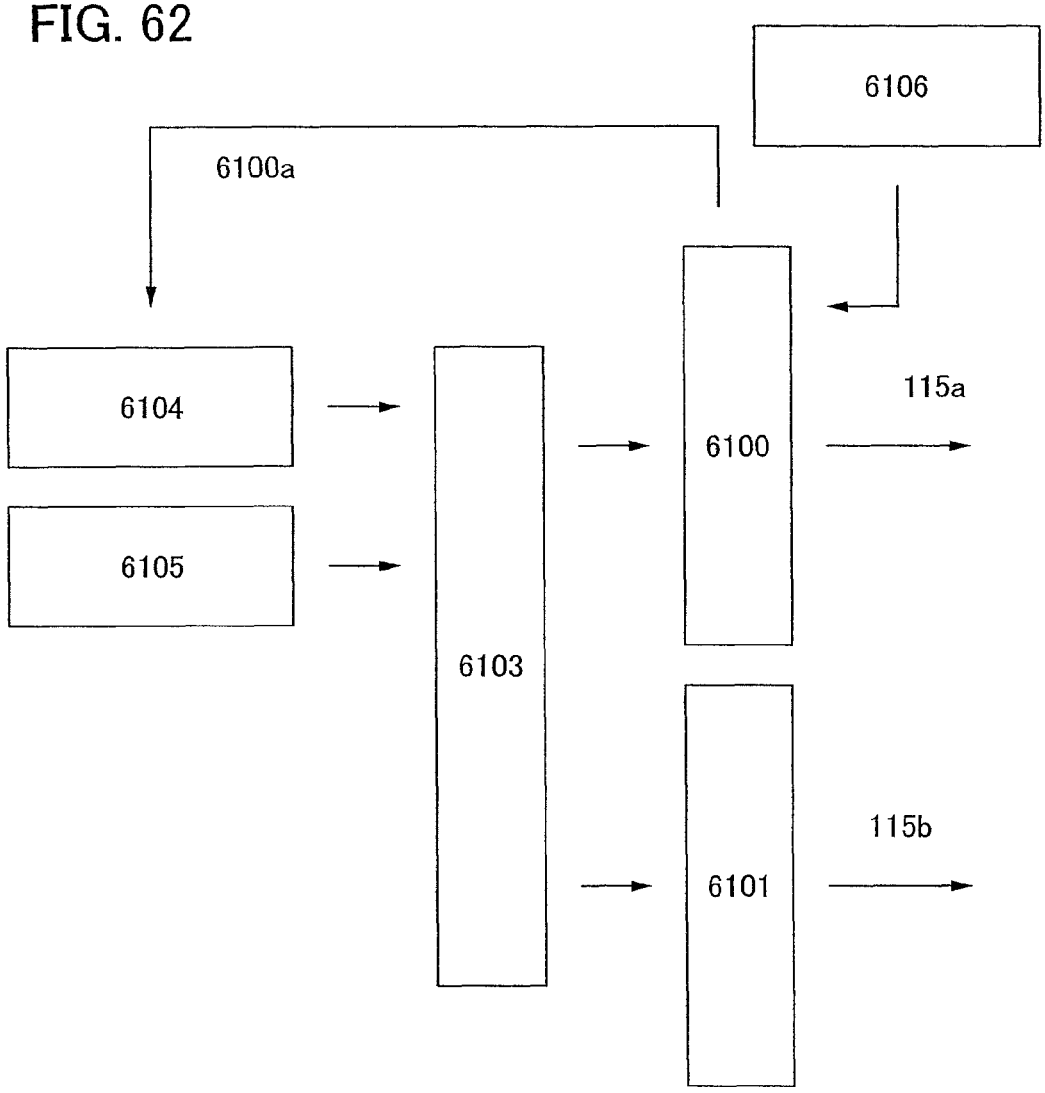
FIG. 62 shows a display device of Embodiment Mode 5.

A description is made on the structure and operation of the controller 115 for realizing the flow chart of FIG. 9 described in this embodiment mode, with reference to FIG. 62.

In this embodiment mode, the image signal generation circuit 6100, the current value detection control signal generation circuit 6101, the driving method selection circuit 6103, the timer circuit 6104, and the charging unit detection circuit 6105 are similar to those in Embodiment Mode 4.

A detection pixel set circuit 6106 specifies pixels included in one portion, when all the pixels are divided into a plurality of portions.

A description is made on operation in this embodiment mode. When the predetermined time has passed from the input of the reset signals 6100*a* to the timer circuit 6104, that is, the predetermined time has passed from the end of the last burn-in correction period, and the charging unit detection circuit 6105 detects charging of the battery 117; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of the pixels set by the detection pixel set circuit 6106, the reset signals 6100*a* are inputted to the timer circuit 6104. In this embodiment mode, between "the normal driving period" and "the burn-in correction period", the judgment of "passage of predetermined time", the judgment of "charging period", the judgment of "termination of set pixels", the judgment of "start of operation" are conducted, the present invention can operate by conducting at least one of the judgment of "passage of predetermined time", the judgment of "charging period", the judgment of "termination of set pixels", and the judgment of "start of operation". That is, for example, between "the normal driving period" and "the burn-in correction period", only the judgment of "charging period" is conducted. In this case, the operation is conducted by using at least the charging unit detection circuit 6105 and the driving method selection circuit 6103.

[Embodiment Mode 6]

Figure 10:
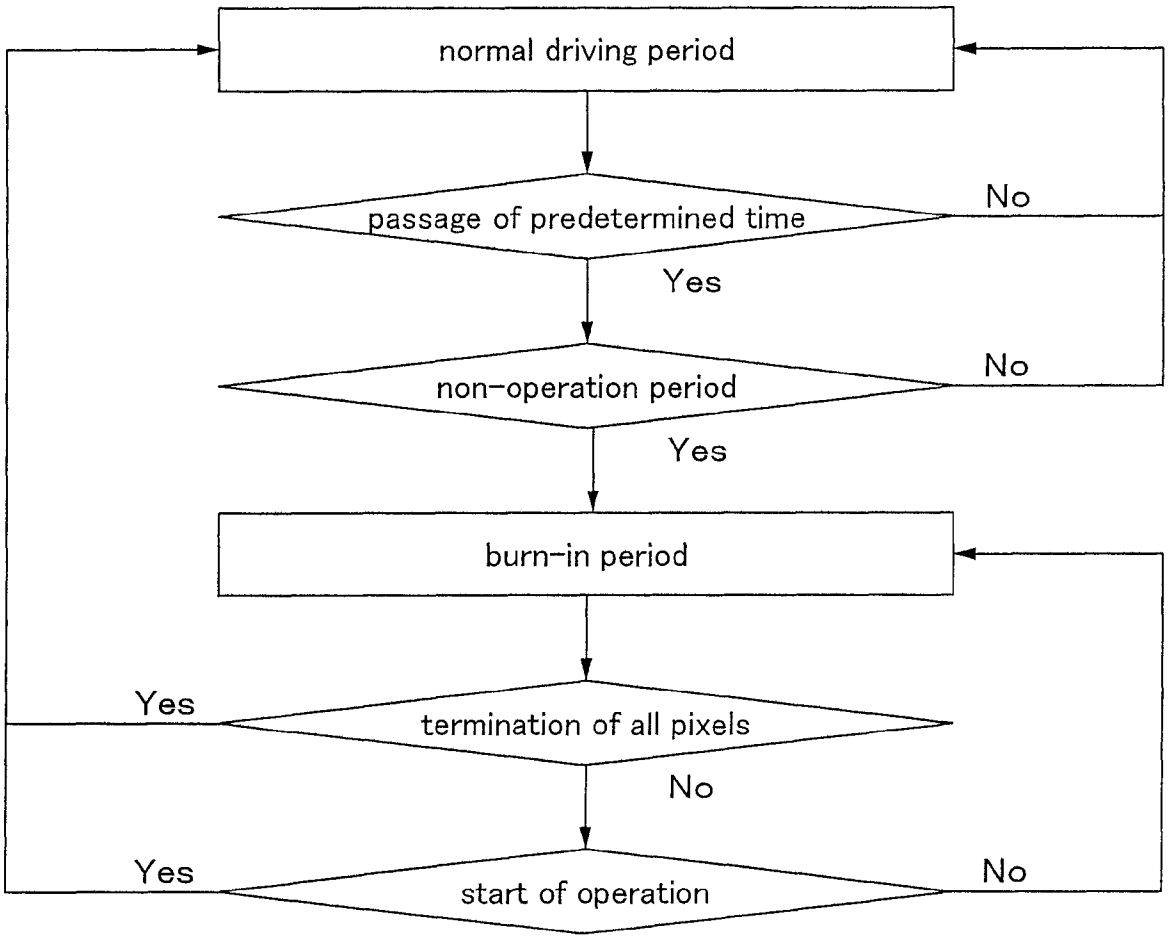
FIG. 10 shows a display device of Embodiment Mode 6.

A description is made on the timing and conditions for proceeding from the normal driving period to the burn-in correction period with reference to a flow chart of FIG. 10, to which Embodiment Modes 1 to 3 are applied. In the flow chart, a rectangular box represents a process and a diamond-shaped box represents a decision.

In FIG. 10, the process of "normal driving period" refers to a time in which an image can be displayed according to video signals, as described in Embodiment Modes 1 to 3.

In this embodiment mode, the process of "burn-in correction period", the decision of "passage of predetermined time", the decision of "termination of all pixels" and the decision of "start of operation" are similar to those in Embodiment Mode 4. In a decision of "non-operating period", it is judged whether the user operates an electronic appliance or the like for a predetermined time or not.

A description is made on the flow of a flow chart of FIG. 10. If a predetermined time has not passed after the process proceeds from the last "burn-in correction period" to a "normal driving period" in the "passage of predetermined time", the process proceeds to the "normal driving period", whereas the process proceeds to a "non-operating period" if the predetermined time has passed. If the user operates the electronic appliance or the like for the predetermined time in the "non-operating period", the process proceeds to the "normal driving period", whereas the process proceeds to the "burn-in correction period" if the user does not operate the electronic appliance or the like for the predetermined time. When the process proceeds to the "burn-in correction period", operations described in the burn-in correction period in Embodiment Modes 1 to 3 are carried out, and then, the process proceeds to the "termination of all pixels". If characteristics of light-emitting elements included in all pixels are obtained in the "termination of all pixels", the process proceeds to the "normal driving period", whereas the process proceeds to the "start of operation" if the characteristics of light-emitting elements included in all pixels are not obtained. If the user starts operation in the "start of operation", the process proceeds to the "normal driving period", whereas the process proceeds to the "burn-in correction period" if the user has not started operation.

By adding the "passage of predetermined time" to the conditions for proceeding from the normal driving period to the burn-in correction period, the number of proceedings to the burn-in correction period can be controlled. In the burn-in correction period, light-emitting elements included in pixels need to emit light as described in Embodiment Modes 1 to 3. Therefore, decrease in frequency of proceeding to the burn-in correction period can prevent deterioration of light-emitting elements included in pixels due to the burn-in correction period.

By adding the "non-operating period" to the conditions for proceeding from the normal driving period to the burn-in correction period, the process can proceed to the burn-in correction period when the user does not operate the electronic appliance or the like. It can be judged that the electronic appliance or the like is not being used when the user does not operate the electronic appliance or the like for the predetermined time.

By adding the "termination of all pixels" to the conditions for proceeding from the burn-in correction period to the normal driving period, characteristics of the light-emitting elements included in all pixels can be detected under the same conditions. When the conditions under which characteristics of the light-emitting elements included in pixels are detected, that is, when the operating environments are the same, variation in characteristics due to difference in the operating environments can be suppressed.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "start of operation", the burn-in correction period finishes before characteristics of the light-emitting elements included in all pixels are detected. In this case, the characteristics of light-emitting elements included in pixels which are not detected in the last burn-in correction period may be detected in the next burn-in correction period. In addition, when the process proceeds to the next burn-in correction period, it is preferable that the predetermined time in the "passage of predetermined time" be shorter. The predetermined time is preferably zero second and the process preferably proceeds to the burn-in correction period via the next "non-operating period".

Figure 63:
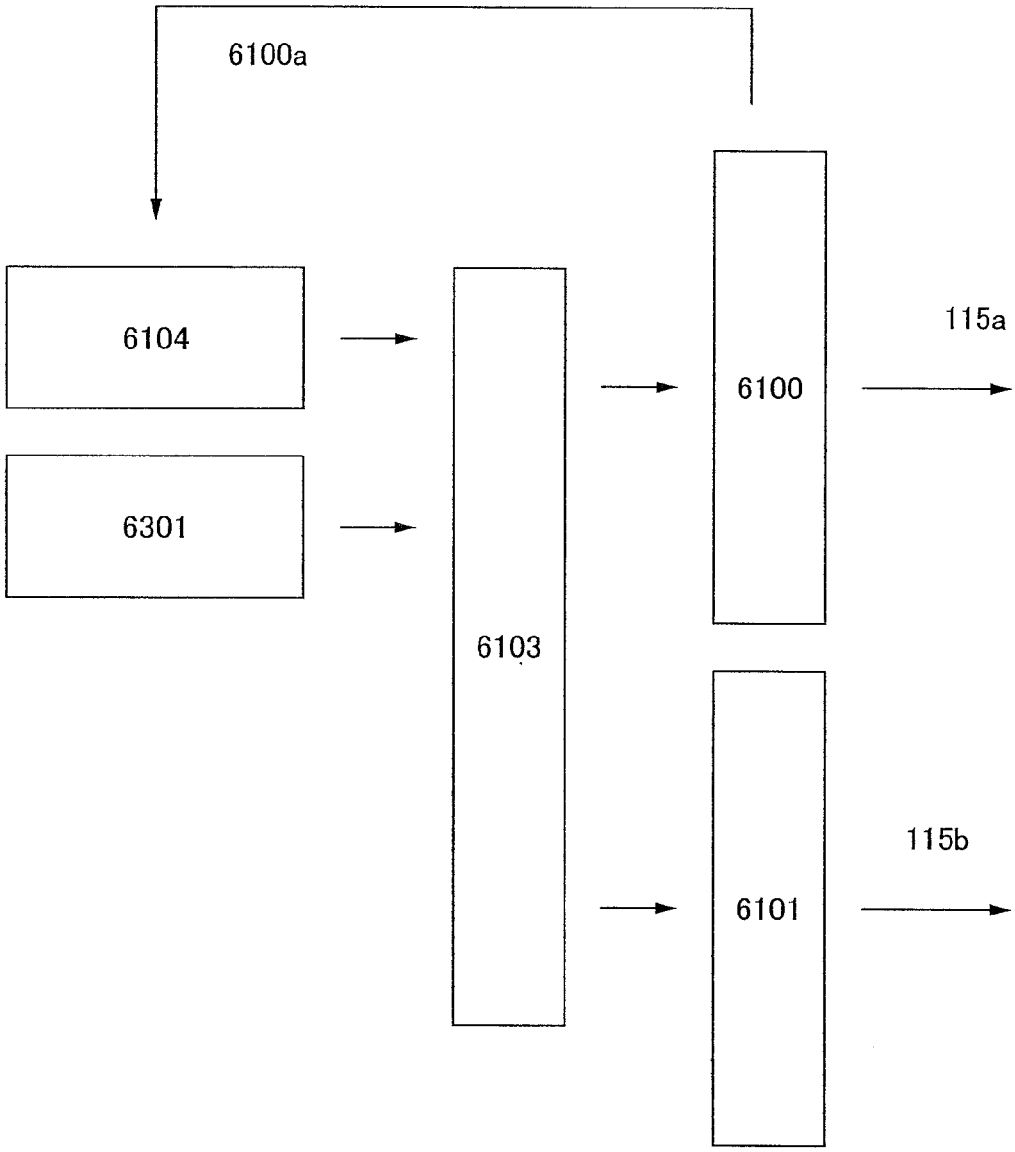
FIG. 63 shows a display device of Embodiment Mode 6.

A description is made on the structure and operation of the controller 115 for realizing the flow chart of FIG. 10 described in this embodiment mode, with reference to FIG. 63.

In this embodiment mode, the image signal generation circuit 6100, the current value detection control signal generation circuit 6101, the driving method selection circuit 6103, and the timer circuit 6104 are similar to those in Embodiment Mode 4.

A non-operating period detection circuit 6301 detects whether the user operates the electronic appliance or the like for the predetermined time or not. When the predetermined time has passed, the signals for proceeding to the burn-in correction period are outputted to the driving method selection circuit 6103. For example, the non-operating period detection circuit 6301 includes of a reset signal generation circuit, a counter, and a count value generation circuit, a memory, or a resistor in which count number corresponded to the predetermined time is stored.

A description is made on operation in this embodiment mode. When the predetermined time has passed from the input of the reset signals 6100*a* to the timer circuit 6104, that is, the predetermined time has passed from the end of the last burn-in correction period, and the user does not operate the electronic appliance or the like for a predetermined time; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of all pixels, the reset signals 6100*a* are inputted to the timer circuit 6104. In this embodiment mode, between "the normal driving period" and "the burn-in correction period", the judgment of "passage of predetermined time", the judgment of "non-operating period", the judgment of "termination of all pixels", and the judgment of "start of operation" are conducted, the present invention can operate by conducting at least one of the judgment of "passage of predetermined time", the judgment of "non-operating period", the judgment of "termination of all pixels", and the judgment of "start of operation". That is, for example, between "the normal driving period" and "the burn-in correction period", only the judgment of "non-operating period" is conducted. In this case, the operation is conducted by using at least the non-operating detection circuit 6301 and the driving method selection circuit 6103.

[Embodiment Mode 7]

Figure 11:
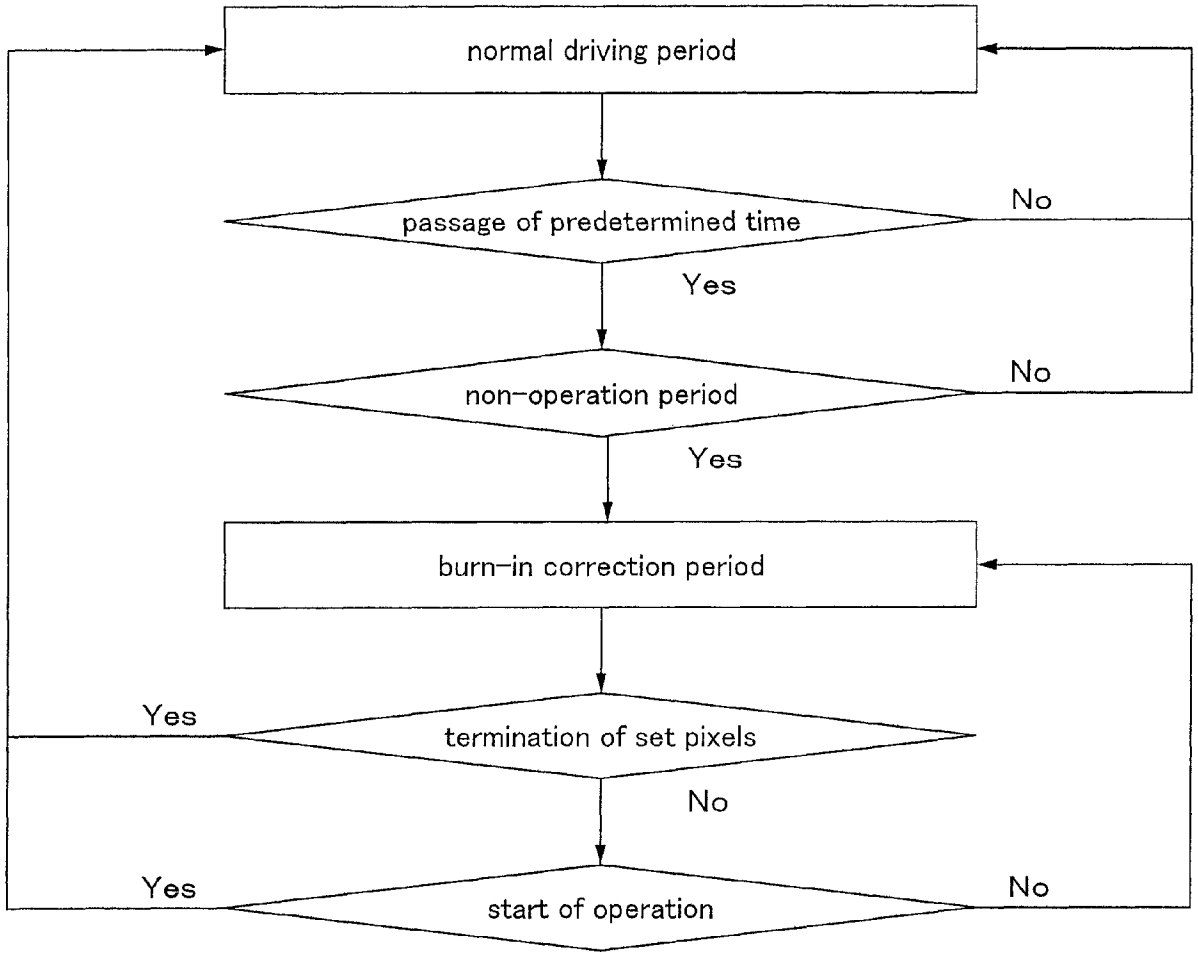
FIG. 11 shows a display device of Embodiment Mode 7.

A description is made on the timing and conditions for proceeding from the normal driving period to the burn-in correction period with reference to a flow chart of FIG. 11, to which Embodiment Modes 1 to 3 are applied. In the flow chart, a rectangular box represents a process and a diamond-shaped box represents a decision.

In this embodiment mode, the "normal driving period", the "burn-in correction period", the "passage of predetermined time", and the "start of operation" are similar to those in Embodiment Mode 4. The "non-operating period" is similar to that in Embodiment Mode 6. In the decision of "termination of set pixels", it is judged whether characteristics of light-emitting elements included in a preset pixel is obtained or not. The preset pixel refers to pixels which are included in one portion, when all the pixels are divided into a plurality of portions. For example, when all the pixels are divided in two parts, the upper half portion and the lower half portion are formed.

A description is made on the flow of a flow chart of FIG. 11. If a predetermined time has not passed after the process proceeds from the last "burn-in correction period" to a "normal driving period" in the "passage of predetermined time", the process proceeds to the "normal driving period", whereas the process proceeds to a "non-operating period" if the predetermined time has passed. If the user operates the electronic appliance or the like for the predetermined time in the "non-operating period", the process proceeds to the "normal driving period", whereas the process proceeds to the "burn-in correction period" if the user does not operate the electronic appliance or the like for the predetermined time. When the process proceeds to the "burn-in correction period", operations described in the burn-in correction period in Embodiment Modes 1 to 3 are carried out, and then, the process proceeds to the "termination of set pixels". If characteristics of light-emitting elements included in the preset pixels are obtained in the "termination of set pixels", the process proceeds to the "normal driving period", whereas the process proceeds to the "start of operation" if the characteristics of light-emitting elements included in the preset pixels are not obtained. If the user starts operation in the "start of operation", the process proceeds to the "normal driving period", whereas the process proceeds to the "burn-in correction period" if the user has not started operation.

By adding the "passage of predetermined time" to the conditions for proceeding from the normal driving period to the burn-in correction period, the number of proceedings to the burn-in correction period can be controlled. In the burn-in correction period, light-emitting elements included in pixels need to emit light as described in Embodiment Modes 1 to 3. Therefore, decrease in frequency of proceeding to the burn-in correction period can prevent deterioration of light-emitting elements included in pixels due to the burn-in correction period.

By adding the "non-operating period" to the conditions for proceeding from the normal driving period to the burn-in correction period, the process can proceed to the burn-in correction period when the user does not operate the electronic appliance or the like. It can be judged that the electronic appliance or the like is not being used when the user does not operate the electronic appliance or the like for the predetermined time.

By adding the "termination of set pixels" to the conditions for proceeding from the burn-in correction period to the normal driving period, the process can proceed to the normal driving period without interrupting the burn-in correction period. In addition, it is possible that the process proceeds to the burn-in correction period selectively in a portion in which burn-in is supposed to be easily generated.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "start of operation", the burn-in correction period finishes before characteristics of the light-emitting elements included in the preset pixels are detected. In this case, the characteristics of light-emitting elements included in pixels which are not detected in the last burn-in correction period may be detected in the next burn-in correction period. In addition, when the process proceeds to the next burn-in correction period, it is preferable that the predetermined time in the "passage of predetermined time" be shorter. The predetermined time is preferably zero second and the process preferably proceeds to the burn-in correction period via the next "non-operating period".

Figure 64:
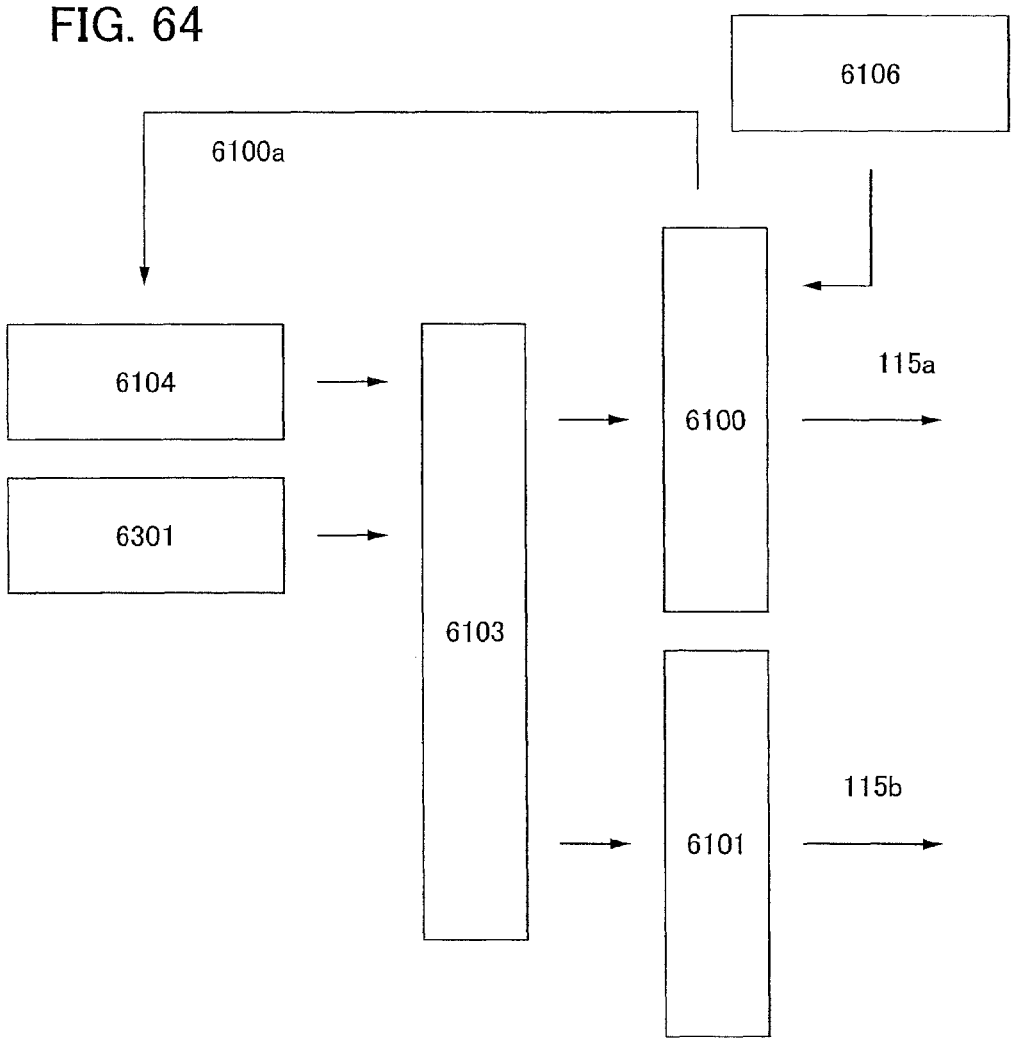
FIG. 64 shows a display device of Embodiment Mode 7.

A description is made on the structure and operation of the controller 115 for realizing the flow chart of FIG. 11 described in this embodiment mode with reference to FIG. 64.

In this embodiment mode, the image signal generation circuit 6100, the current value detection control signal generation circuit 6101, the driving method selection circuit 6103, and the timer circuit 6104 are similar to those in Embodiment Mode 4. The detection pixel set circuit 6106 is similar to that in Embodiment Mode 5. The non-operating period detection circuit 6301 is similar to that in Embodiment Mode 6.

The non-operating period detection circuit 6301 detects whether the user operates the electronic appliance or the like for the predetermined time or not. When the predetermined time has passed, the signals for proceeding to the burn-in correction period are outputted to the driving method selection circuit 6103.

A description is made on operation in this embodiment mode. When the predetermined time has passed from the input of the reset signals 6100*a* to the timer circuit 6104, that is, the predetermined time has passed from the end of the last burn-in correction period, and the user does not operate the electronic appliance or the like for a predetermined time; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of the pixels set by the detection pixel set circuit 6106, the reset signals 6100*a* are inputted to the timer circuit 6104. In this embodiment mode, between "the normal driving period" and "the burn-in correction period", the judgment of "passage of predetermined time", the judgment of "non-operating period", the judgment of "termination of set pixels", and the judgment of "start of operation" are conducted, the present invention can operate by conducting at least one of the judgment of "passage of predetermined time", the judgment of "non-operating period", the judgment of termination of set pixels, and the judgment of "start of operation". That is, for example, between "the normal driving period" and "the burn-in correction period", only the judgment of "termination of set pixels" is conducted. In this case, the operation is conducted by using at least the detection pixel set circuit 6106 and the driving method selection circuit 6103.

[Embodiment Mode 8]

Figure 12:
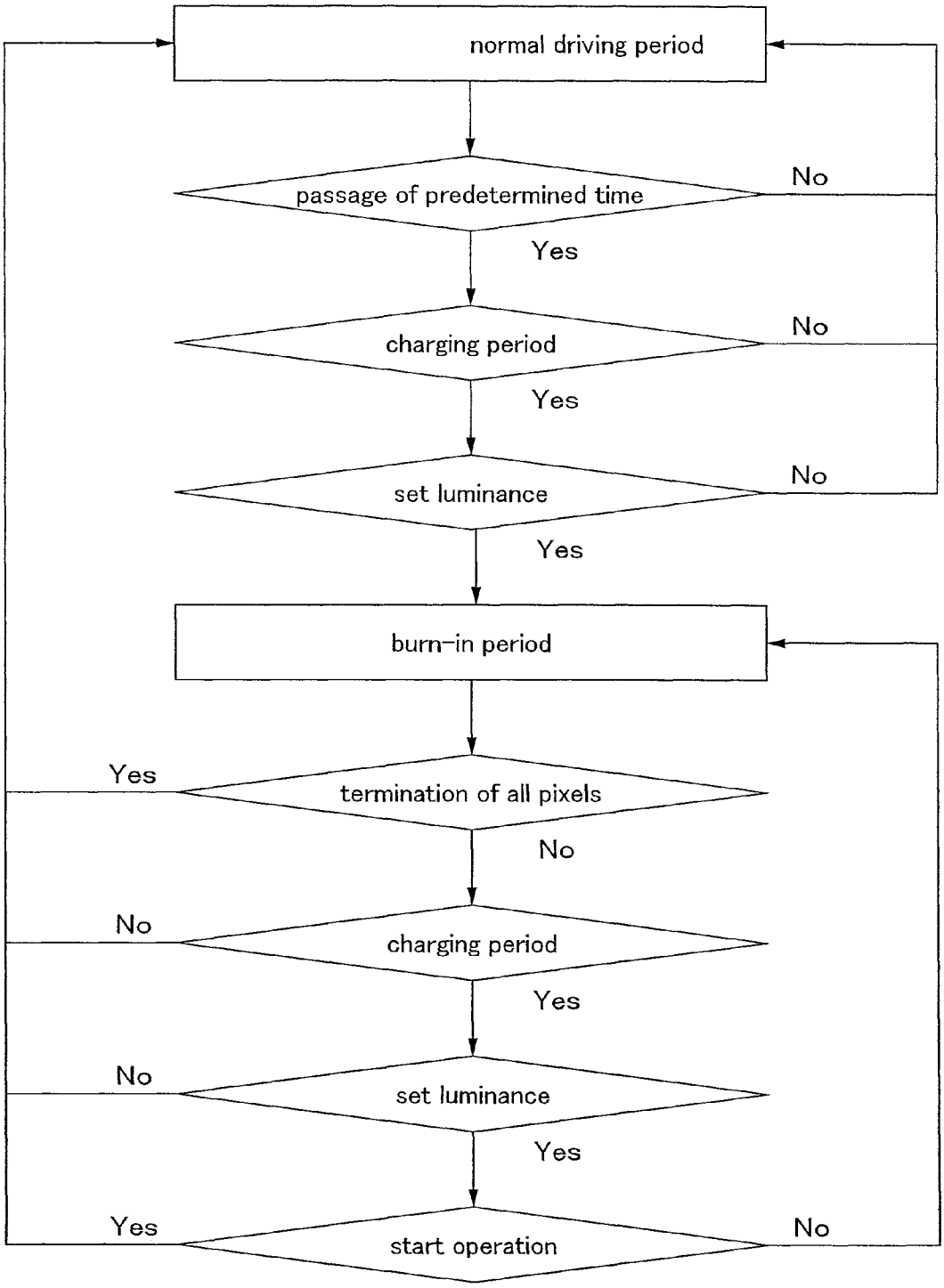
FIG. 12 shows a display device of Embodiment Mode 8.

A description is made on the timing and conditions for proceeding from the normal driving period to the burn-in correction period with reference to a flow chart of FIG. 12, to which Embodiment Modes 1 to 3 are applied. In the flow chart, a rectangular box represents a process and a diamond-shaped box represents a decision.

In this embodiment mode, the "normal driving period", the "burn-in correction period", the "passage of predetermined time", the "charging period", the "termination of all pixels", and the "start of operation" are similar to those in Embodiment Mode 4. In the "set luminance", it is judged whether the surrounding luminance is in the predetermined range or not.

A description is made on the flow of the flow chart of FIG. 12. If a predetermined time has not passed after the process proceeds from the last "burn-in correction period" to the "normal driving period" in the "passage of predetermined time", the process proceeds to the "normal driving period", whereas the process proceeds to the "charging period" if the predetermined time has passed. If a battery is not charged in the "charging period", the process proceeds to the "normal driving period", whereas the process proceeds to the "set luminance" if the battery is charged. If the surrounding luminance is not in the predetermined range in the "set luminance", the process proceeds to the "normal driving period", whereas the process proceeds to the "burn-in correction period" if the surrounding luminance is in the predetermined range. When the process proceeds to the "burn-in correction period", operations described in the burn-in correction period in Embodiment Modes 1 to 3 are carried out, and then, the process proceeds to the "termination of all pixels". If characteristics of light-emitting elements included in all pixels are obtained in the "termination of all pixels", the process proceeds to the "normal driving period", whereas the process proceeds to the "charging period" if the characteristics of light-emitting elements included in all pixels are not obtained. If the battery is not charged in the "charging period", the process proceeds to the "normal driving period", whereas the process proceeds to the "set luminance" if the battery is charged. If the surrounding luminance is not in the predetermined range in the "set luminance", the process proceeds to the "normal driving period", whereas the process proceeds to the "start of operation" if the surrounding luminance is in the predetermined range. If the user starts operation in the "start of operation", the process proceeds to the "normal driving period", whereas the process proceeds to the "burn-in correction period" if the user has not started operation.

By adding the "passage of predetermined time" to the conditions for proceeding from the normal driving period to the burn-in correction period, the number of proceedings to the burn-in correction period can be controlled. In the burn-in correction period, light-emitting elements included in pixels need to emit light as described in Embodiment Modes 1 to 3. Therefore, decrease in frequency of proceeding to the burn-in correction period can prevent deterioration of light-emitting elements included in pixels due to the burn-in correction period.

By adding the "charging period" to the conditions for proceeding from the normal driving period to the burn-in correction period, the process can proceed to the burn-in correction period while charging the battery. In the burn-in correction period, light-emitting elements included in pixels emit light, so that characteristics of the light-emitting elements are stored as described in Embodiment Modes 1 to 3. Therefore, power consumption therein is large. Proceeding to the burn-in correction period while charging the battery can prevent reduction in power of the battery due to the burn-in correction period. Besides, when charging the battery, it is highly possible that the user has finished using the electronic appliance or the like and it is unlikely that the process returns to the normal driving period.

By adding the "set luminance" to the conditions for proceeding from the normal driving period to the burn-in correction period, the process can proceed to the burn-in correction period without being effected by the surrounding luminance. In Embodiment Modes 1 to 3, one pixel or three pixels emit light at the same time and driving TFTs in the other pixels which do not emit light are in off state. Therefore, off-state current changes according to the surrounding luminance, which leads to variation in detected current value. By detecting the characteristics of the light-emitting elements included in the pixels when the surrounding luminances are the same, the effect of changes in surrounding luminance is eliminated. The surrounding luminance is preferably about 0 [cd/m$^2$]. In the case of a foldable mobile phone, such a state can be realized when the foldable mobile phone is folded and in the case of a digital camera, such a state can be realized when the digital camera is placed in its case.

By adding the "termination of all pixels" to the conditions for proceeding from the burn-in correction period to the normal driving period, characteristics of the light-emitting elements included in all pixels can be detected under the same conditions. When the conditions under which characteristics of the light-emitting elements included in pixels are detected, that is, when the operating environments are the same, variation in characteristics due to difference in the operating environments can be suppressed.

By adding the "charging period" to the conditions for proceeding from the burn-in correction period to the normal driving period, the process can proceed to the normal driving period on finishing charging of the battery. Proceeding to the normal driving period from the burn-in correction period on finishing charging of the battery, drain of the battery can be suppressed. Besides, when charging the battery is finished, it is highly possible that the user is going to use the electronic appliance; therefore, the process needs to proceed to the normal driving period.

By adding the "set luminance" to the conditions for proceeding from the burn-in correction period to the normal driving period, the process can proceed to the normal driving period immediately when the surrounding luminance changes during the burn-in correction period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "charging period", the "set luminance", and the "start of operation", the burn-in correction period finishes before characteristics of the light-emitting elements included in all pixels are detected. In this case, the characteristics of light-emitting elements included in pixels which are not detected in the last burn-in correction period may be detected in the next burn-in correction period. In addition, when the process proceeds to the next burn-in correction period, it is preferable that the predetermined time in the "passage of predetermined time" be shorter. The predetermined time is preferably zero second and the process preferably proceeds to the burn-in correction period via the next "charging period" and the "set luminance".

Figure 65:
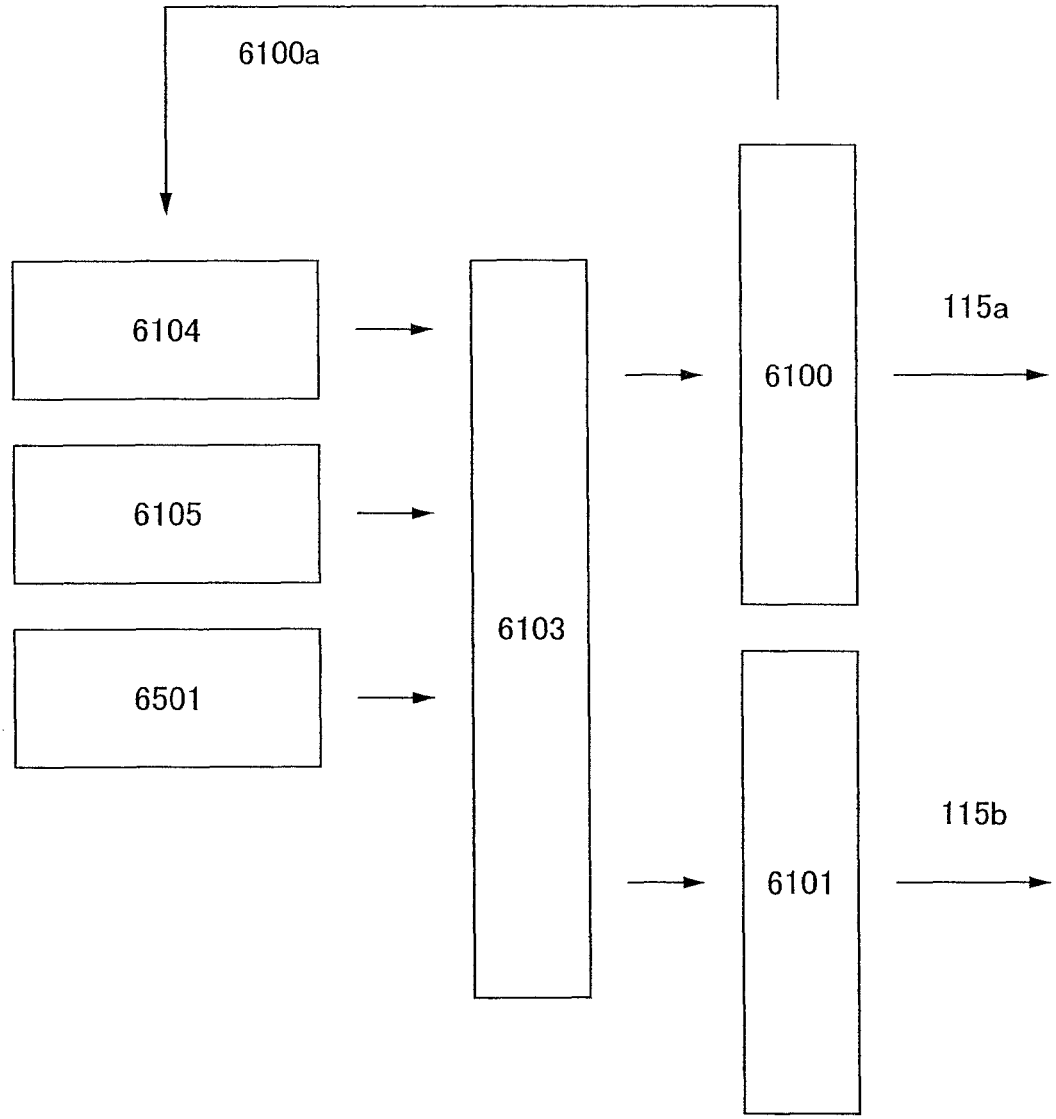
FIG. 65 shows a display device of Embodiment Mode 8.

A description is made on the structure and operation of the controller 115 for realizing the flow chart of FIG. 12 described in this embodiment mode with reference to FIG. 65.

In this embodiment mode, the image signal generation circuit 6100, the current value detection control signal generation circuit 6101, the driving method selection circuit 6103, the timer circuit 6104, and the charging unit detection circuit 6105 are similar to those in Embodiment Mode 4.

A surrounding luminance detection circuit 6501 outputs signals to the driving method selection circuit 6103 for proceeding to the burn-in correction period when the surrounding luminance of the display device is close to the predetermined luminance. Note that the surrounding luminance is the luminance around the light-emitting portion of the display device driver circuit 100. For example, even in the case where the set luminance is 0 [cd/m$^2$] and the luminance around the electronic appliance is different from the set luminance, if the display device driver circuit 100 is shielded from light and the luminance thereof is approximately 0 [cd/m$^2$], the signals for proceeding to the burn-in correction period is outputted to the driving method selection circuit 6103. For example, the surrounding luminance detection circuit 6501 includes a photosensor, a current-voltage converter circuit, an analog digital converter, a memory 1 in which a maximum luminance data is stored, a memory 2 in which a minimum luminance data is stored, a comparator 1, a comparator 2, and a discriminating circuit such as NOR and AND.

A description is made on operation in this embodiment mode. When the predetermined time has passed from the input of the reset signals 6100*a* to the timer circuit 6104, that is, the predetermined time has passed from the end of the last burn-in correction period, and the charging unit detection circuit 6105 detects charging of the battery 117 and the surrounding luminance detection circuit 6501 decides that the surrounding luminance of the display device is close to the predetermined luminance; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of all pixels, the reset signals 6100*a* are inputted to the timer circuit 6104. In this embodiment mode, between "the normal driving period", and "the burn-in correction period", the judgment of "passage of predetermined time", the judgment of "charging period", the judgment of "set luminance", the judgment of "termination of all pixels", and the judgment of "start of operation" are conducted, the present invention can operate by conducting at least one of the judgment of "charging period", the judgment of "set luminance", the judgment of "termination of all pixels", and the judgment of "start of operation". That is, for example, between "the normal driving period" and "the burn-in correction period", only the judgment of "termination of set luminance" is conducted. In this case, the operation is conducted by using at least the surrounding luminance detection circuit 6501 and the driving method selection circuit 6103.

[Embodiment Mode 9]

Figure 13:
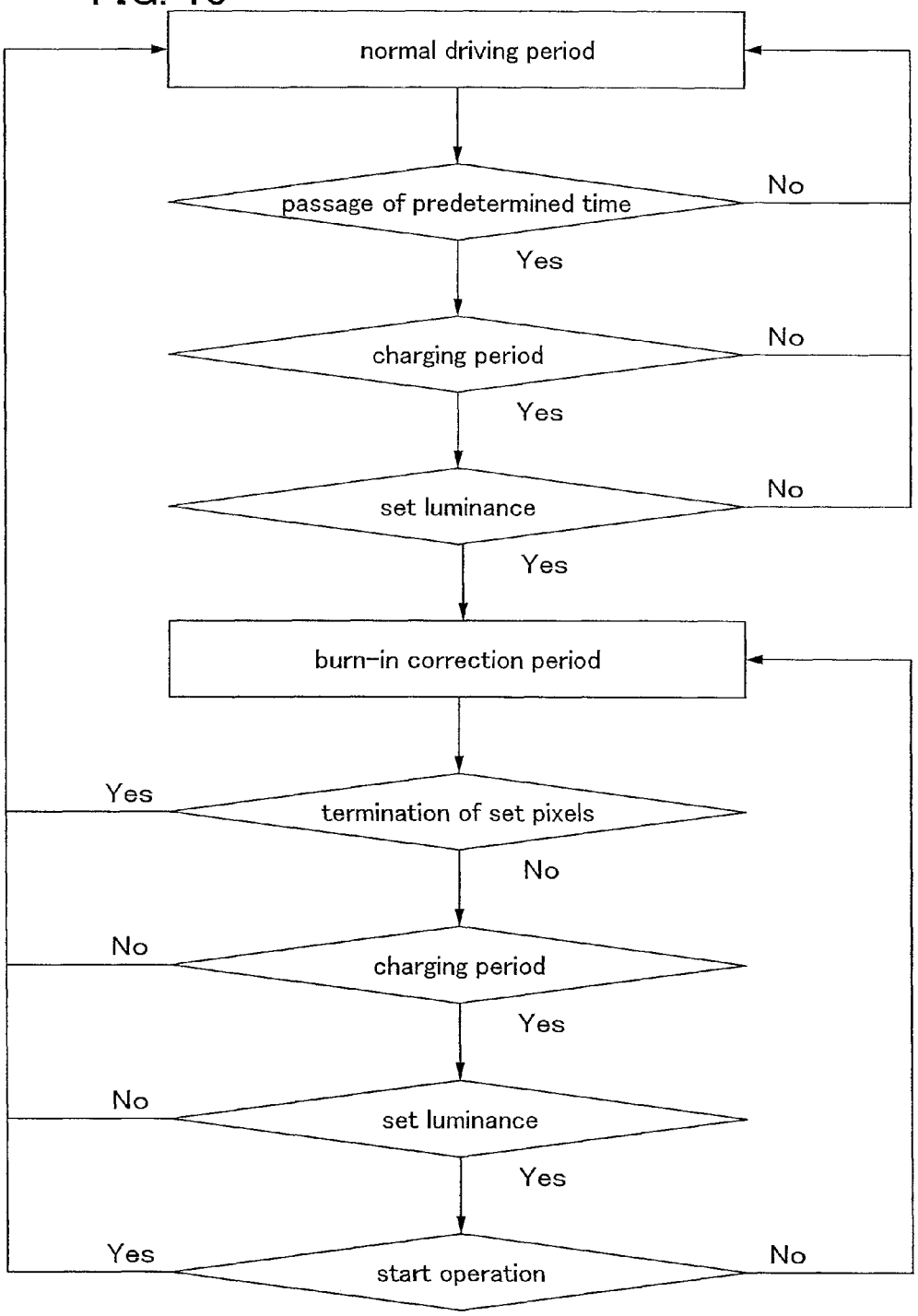
FIG. 13 shows a display device of Embodiment Mode 9.

A description is made on the timing and conditions for proceeding from the normal driving period to the burn-in correction period with reference to a flow chart of FIG. 13, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "passage of predetermined time", the decision of "charging period", and the decision of "start of operation" are similar to those in Embodiment Mode 4. The decision of "termination of set pixels" is similar to that in Embodiment Mode 7. The decision of "set luminance" is similar to that in Embodiment Mode 8.

A description is made on the flow of the flow chart of FIG. 13. If a predetermined time has not passed after the process proceeds from the last "burn-in correction period" to the "normal driving period" in the "passage of predetermined time", the process proceeds to the "normal driving period", whereas the process proceeds to the "charging period" if the predetermined time has passed. If a battery is not charged in the "charging period", the process proceeds to the "normal driving period", whereas the process proceeds to the "set luminance" if the battery is charged. If the surrounding luminance is not in the predetermined range in the "set luminance", the process proceeds to the "normal driving period", whereas the process proceeds to the "burn-in correction period" if the surrounding luminance is in the predetermined range. When the process proceeds to the "burn-in correction period", operations described in the burn-in correction period in Embodiment Modes 1 to 3 are carried out, and then, the process proceeds to the "termination of set pixels". If characteristics of light-emitting elements included in preset pixels are obtained in the "termination of set pixels", the process proceeds to the "normal driving period", whereas the process proceeds to the "charging period" if the characteristics of light-emitting elements included in the preset pixels are not obtained. If the battery is not charged in the "charging period", the process proceeds to the "normal driving period", whereas the process proceeds to the "set luminance" if the battery is charged. If the surrounding luminance is not in the predetermined range in the "set luminance", the process proceeds to the "normal driving period", whereas the process proceeds to the "start of operation" if the surrounding luminance is in the predetermined range. If the user starts operation in the "start of operation", the process proceeds to the "normal driving period", whereas the process proceeds to the "burn-in correction period" if the user has not started operation.

By adding the "passage of predetermined time" to the conditions for proceeding from the normal driving period to the burn-in correction period, the number of proceedings to the burn-in correction period can be controlled. In the burn-in correction period, light-emitting elements included in pixels need to emit light as described in Embodiment Modes 1 to 3. Therefore, decrease in frequency of proceeding to the burn-in correction period can prevent deterioration of light-emitting elements included in pixels due to the burn-in correction period.

By adding the "charging period" to the conditions for proceeding from the normal driving period to the burn-in correction period, the process can proceed to the burn-in correction period while charging the battery. In the burn-in correction period, light-emitting elements included in pixels emit light, so that characteristics of the light-emitting elements are stored as described in Embodiment Modes 1 to 3. Therefore, power consumption therein is large. Proceeding to the burn-in correction period while charging the battery can prevent reduction in power of the battery due to the burn-in correction period. Besides, when charging the battery, it is highly possible that the user has finished using the electronic appliance or the like and it is unlikely that the process returns to the normal driving period.

By adding the "set luminance" to the conditions for proceeding from the normal driving period to the burn-in correction period, the process can proceed to the burn-in correction period without being effected by the surrounding luminance. In Embodiment Modes 1 to 3, one pixel or three pixels emit light at the same time and driving TFTs in the other pixels which do not emit light are in off state. Therefore, off-state current changes according to the surrounding luminance, which leads to variation in detected current value. By detecting the characteristics of the light-emitting elements included in the pixels when the surrounding luminances are the same, the effect of changes in surrounding luminance is eliminated. The surrounding luminance is preferably about 0 [cd/m$^2$]. In the case of a foldable mobile phone, such a state can be realized when the foldable mobile phone is folded and in the case of a digital camera, such a state can be realized when the digital camera is placed in its case.

By adding the "termination of set pixels" to the conditions for proceeding from the burn-in correction period to the normal driving period, the process can proceed to the normal driving period without interrupting the burn-in correction period. In addition, it is possible that the process proceeds to the burn-in correction period selectively in a portion in which burn-in is supposed to be easily generated.

By adding the "charging period" to the conditions for proceeding from the burn-in correction period to the normal driving period, the process can proceed to the normal driving period on finishing charging of the battery. Proceeding to the normal driving period from the burn-in correction period on finishing charging of the battery, drain of the battery can be suppressed. Besides, when charging the battery is finished, it is highly possible that the user is going to use the electronic appliance; therefore, the process needs to proceed to the normal driving period.

By adding the "set luminance" to the conditions for proceeding from the burn-in correction period to the normal driving period, the process can proceed to the normal driving period immediately when the surrounding luminance changes during the burn-in correction period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "charging period", the "set luminance", and the "start of operation", the burn-in correction period finishes before characteristics of the light-emitting elements included in preset pixels are detected. In this case, the characteristics of light-emitting elements included in pixels which are not detected in the last burn-in correction period may be detected in the next burn-in correction period. In addition, when the process proceeds to the next burn-in correction period, it is preferable that the predetermined time in the "passage of predetermined time" be shorter. The predetermined time is preferably zero second and the process preferably proceeds to the burn-in correction period via the next "charging period" and the next "set luminance".

Figure 66:
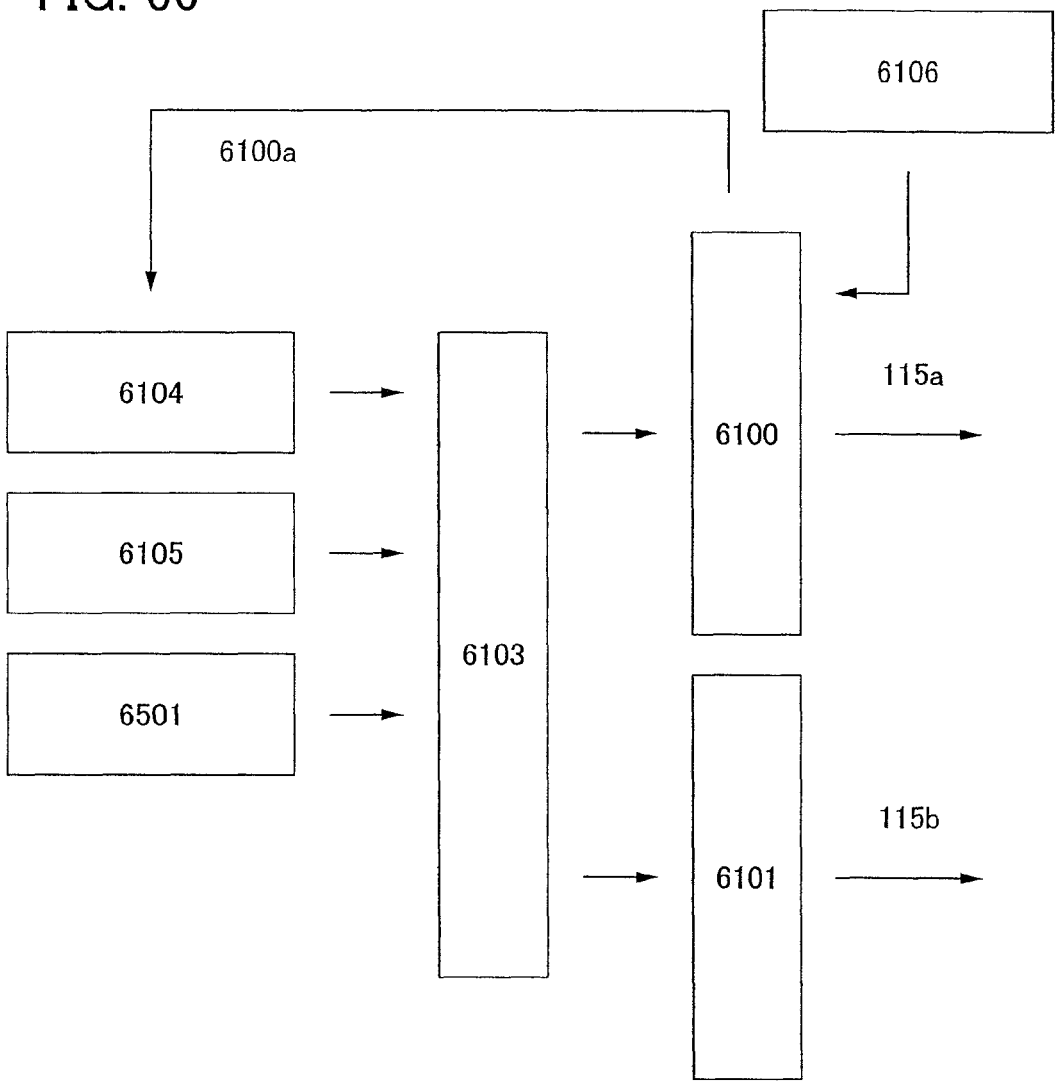
FIG. 66 shows a display device of Embodiment Mode 9.

A description is made on the structure and operation of the controller 115 for realizing the flow chart of FIG. 13 described in this embodiment mode, with reference to FIG. 66.

In this embodiment mode, the image signal generation circuit 6100, the current value detection control signal generation circuit 6101, the driving method selection circuit 6103, the timer circuit 6104, and the charging unit detection circuit 6105 are similar to those in Embodiment Mode 4. The detection pixel set circuit 6106 is similar to that in Embodiment Mode 5. The surrounding luminance detection circuit 6501 is similar to that in Embodiment Mode 8.

A description is made on operation in this embodiment mode. When the predetermined time has passed from the input of the reset signals 6100*a* to the timer circuit 6104, that is, the predetermined time has passed from the end of the last burn-in correction period, and the charging unit detection circuit 6105 detects charging of the battery 117 and the surrounding luminance detection circuit 6501 decides that the surrounding luminance of the display device is close to the predetermined luminance; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of the pixels set by the detection pixel set circuit 6106, the reset signals 6100*a* are inputted to the timer circuit 6104. In this embodiment mode, between "the normal driving period" and "the burn-in correction period", the judgment of "passage of predetermined time", the judgment of "charging period", the judgment of "set luminance", the judgment of "termination of set pixels", and the judgment of "start of operation" are conducted, the present invention can operate by conducting at least one of the judgment of "charging period", the judgment of "set luminance", the judgment of "termination of set pixels", and the judgment of "start of operation". That is, for example, between "the normal driving period" and "the burn-in correction period", only the judgment of "termination of set pixels" is conducted. In this case, the operation is conducted by using at least the detection pixel set circuit 6106 and the driving method selection circuit 6103.

[Embodiment Mode 10]

Figure 14:
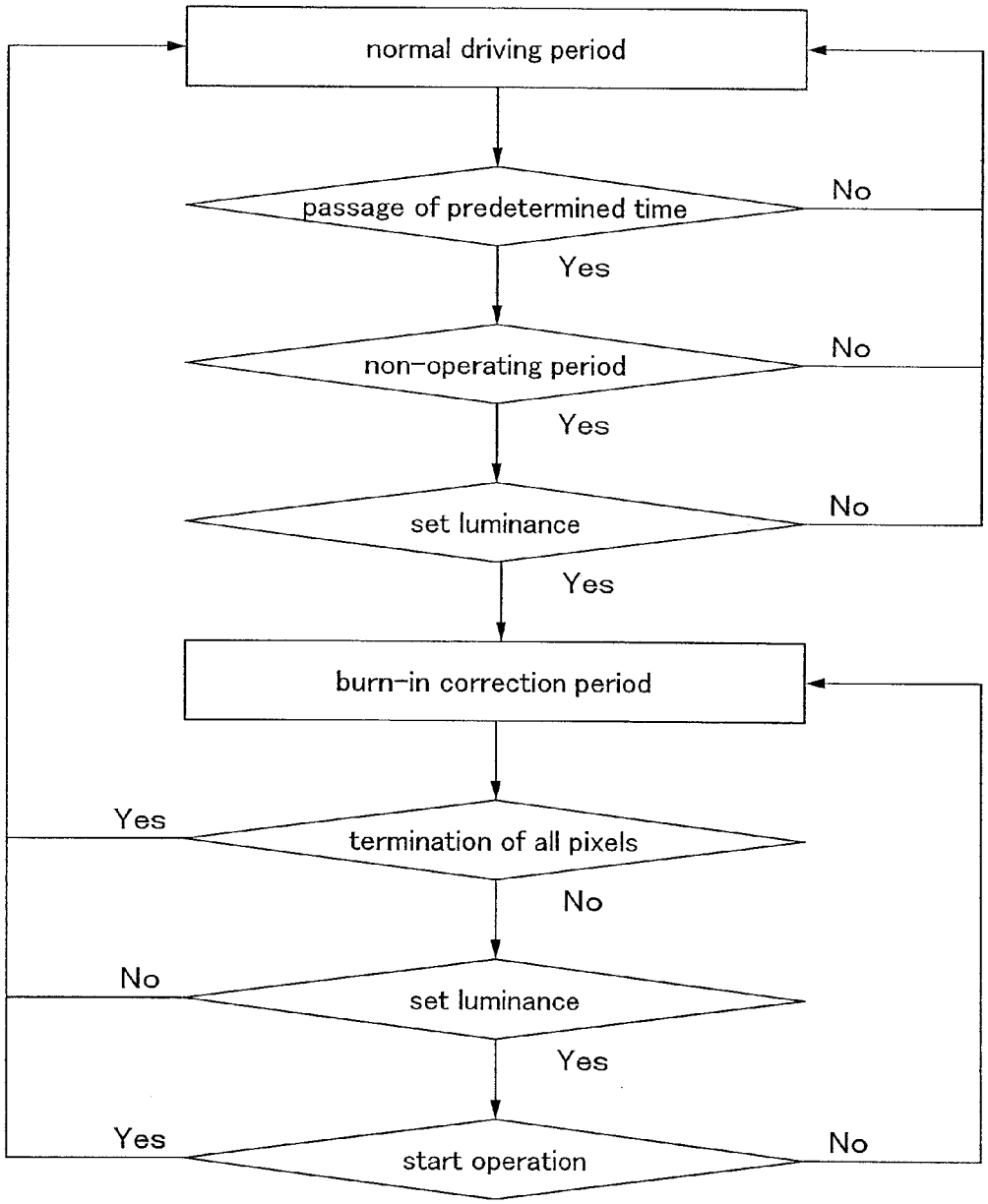
FIG. 14 shows a display device of Embodiment Mode 10.

A description is made on the timing and conditions for proceeding from the normal driving period to the burn-in correction period with reference to a flow chart of FIG. 14, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "passage of predetermined time", the decision of "termination of all pixels", and the decision of "start of operation" are similar to those in Embodiment Mode 4. The decision of "non-operating period" is similar to that in Embodiment Mode 6. The decision of "set luminance" is similar to that in Embodiment Mode 8.

A description is made on the flow of the flow chart of FIG. 14. If a predetermined time has not passed after the process proceeds from the last "burn-in correction period" to a "normal driving period" in the "passage of predetermined time", the process proceeds to the "normal driving period", whereas the process proceeds to a "non-operating period" if the predetermined time has passed. If the user operates the electronic appliance or the like for the predetermined time in the "non-operating period", the process proceeds to the "normal driving period", whereas the process proceeds to the "set luminance" if the user does not operate the electronic appliance or the like for the predetermined time. If the surrounding luminance is not in the predetermined range in the "set luminance", the process proceeds to the "normal driving period", whereas the process proceeds to the "burn-in correction period" if the surrounding luminance is in the predetermined range. When the process proceeds to the "burn-in correction period", operations described in the burn-in correction period in Embodiment Modes 1 to 3 are carried out, and then, the process proceeds to the "termination of all pixels". If characteristics of light-emitting elements included in all pixels are obtained in the "termination of all pixels", the process proceeds to the "normal driving period", whereas the process proceeds to the "set luminance" if the characteristics of light-emitting elements included in all pixels are not obtained. If the surrounding luminance is not in the predetermined range in the "set luminance", the process proceeds to the "normal driving period", whereas the process proceeds to the "start of operation" if the surrounding luminance is in the predetermined range. If the user starts operation in the "start of operation", the process proceeds to the "normal driving period", whereas the process proceeds to the "burn-in correction period" if the user has not started operation.

By adding the "passage of predetermined time" to the conditions for proceeding from the normal driving period to the burn-in correction period, the number of proceedings to the burn-in correction period can be controlled. In the burn-in correction period, light-emitting elements included in pixels need to emit light as described in Embodiment Modes 1 to 3. Therefore, decrease in frequency of proceeding to the burn-in correction period can prevent deterioration of light-emitting elements included in pixels due to the burn-in correction period.

By adding the "non-operating period" to the conditions for proceeding from the normal driving period to the burn-in correction period, the process can proceed to the burn-in correction period when the user does not operate the electronic appliance or the like. It can be judged that the electronic appliance or the like is not being used when the user does not operate the electronic appliance or the like for the predetermined time.

By adding the "set luminance" to the conditions for proceeding from the normal driving period to the burn-in correction period, the process can proceed to the burn-in correction period without being effected by the surrounding luminance. In Embodiment Modes 1 to 3, one pixel or three pixels emit light at the same time and driving TFTs in the other pixels which do not emit light are in off state. Therefore, off-state current changes according to the surrounding luminance, which leads to variation in detected current value. By detecting the characteristics of the light-emitting elements included in the pixels when the surrounding luminances are the same, the effect of changes in surrounding luminance is eliminated. The surrounding luminance is preferably about 0 [cd/m$^2$]. In the case of a foldable mobile phone, such a state can be realized when the foldable mobile phone is folded and in the case of a digital camera, such a state can be realized when the digital camera is placed in its case.

By adding the "termination of all pixels" to the conditions for proceeding from the burn-in correction period to the normal driving period, characteristics of the light-emitting elements included in all pixels can be detected under the same conditions. When the conditions under which characteristics of the light-emitting elements included in pixels are detected, that is, when the operating environments are the same, variation in characteristics due to difference in the operating environments can be suppressed.

By adding the "charging period" to the conditions for proceeding from the burn-in correction period to the normal driving period, the process can proceed to the normal driving period on finishing charging of the battery. Proceeding to the normal driving period from the burn-in correction period on finishing charging of the battery, drain of the battery can be suppressed. Besides, when charging the battery is finished, it is highly possible that the user is going to use the electronic appliance; therefore, the process needs to proceed to the normal driving period.

By adding the "set luminance" to the conditions for proceeding from the burn-in correction period to the normal driving period, the process can proceed to the normal driving period immediately when the surrounding luminance changes during the burn-in correction period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "set luminance" and the "start of operation", the burn-in correction period finishes before characteristics of the light-emitting elements included in all pixels are detected. In this case, the characteristics of light-emitting elements included in pixels which are not detected in the last burn-in correction period may be detected in the next burn-in correction period. In addition, when the process proceeds to the next burn-in correction period, it is preferable that the predetermined time in the "passage of predetermined time" be shorter. The predetermined time is preferably zero second and the process preferably proceeds to the burn-in correction period via the next "non-operating period" and "set luminance".

Figure 67:
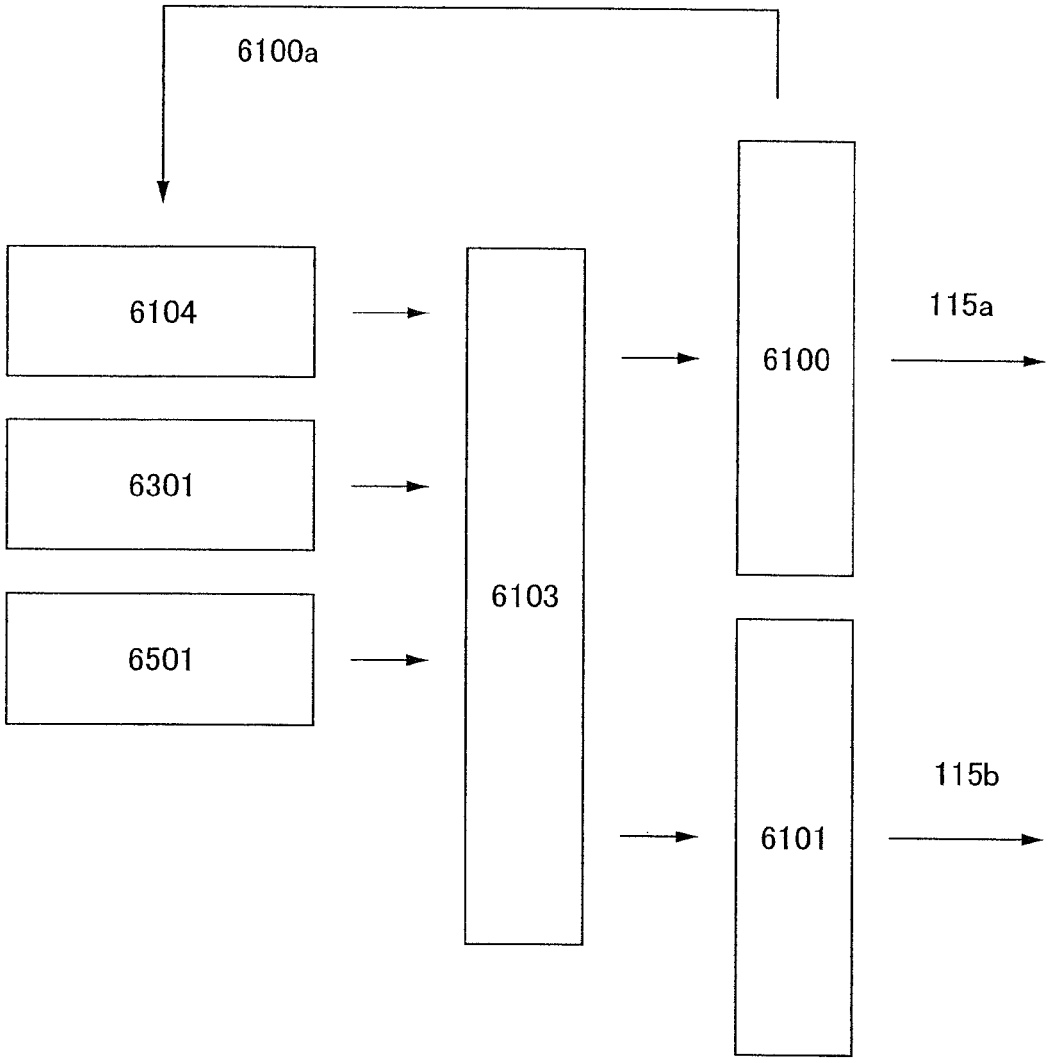
FIG. 67 shows a display device of Embodiment Mode 10.

A description is made on the structure and operation of the controller 115 for realizing the flow chart of FIG. 14 described in this embodiment mode, with reference to FIG. 67.

In this embodiment mode, the image signal generation circuit 6100, the current value detection control signal generation circuit 6101, the driving method selection circuit 6103, and the timer circuit 6104 are similar to those in Embodiment Mode 4. The non-operating period detection circuit 6301 is similar to that in Embodiment Mode 6. The surrounding luminance detection circuit 6501 is similar to that in Embodiment Mode 8.

A description is made on operation in this embodiment mode. When the predetermined time has passed from the input of the reset signals 6100*a* to the timer circuit 6104, that is, the predetermined time has passed from the end of the last burn-in correction period, and the user does not operate the electronic appliance or the like for a predetermined time and the surrounding luminance detection circuit 6501 decides that the surrounding luminance of the display device is close to the predetermined luminance; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of all pixels, the reset signals 6100*a* are inputted to the timer circuit 6104. In this embodiment mode, between "the normal driving period" and "the burn-in correction period", the judgment of "passage of predetermined time", the judgment of "non-operating period", the judgment of "set luminance", the judgment of "termination of all pixels", and the judgment of "start of operation" are conducted, the present invention can operate by conducting at least one of the judgment of "passage of predetermined time", the judgment of "non-operating period", the judgment of "set luminance", the judgment of "termination of all pixels", and the judgment of "start of operation". That is, for example, between "the normal driving period" and "the burn-in correction period", the judgment of "passage of predetermined time", and the judgment of "set luminance" are conducted. In this case, the operation is conducted by using at least the timer circuit 6104, the surrounding luminance detection circuit 6501, and the driving method selection circuit 6103.

[Embodiment Mode 11]

Figure 15:
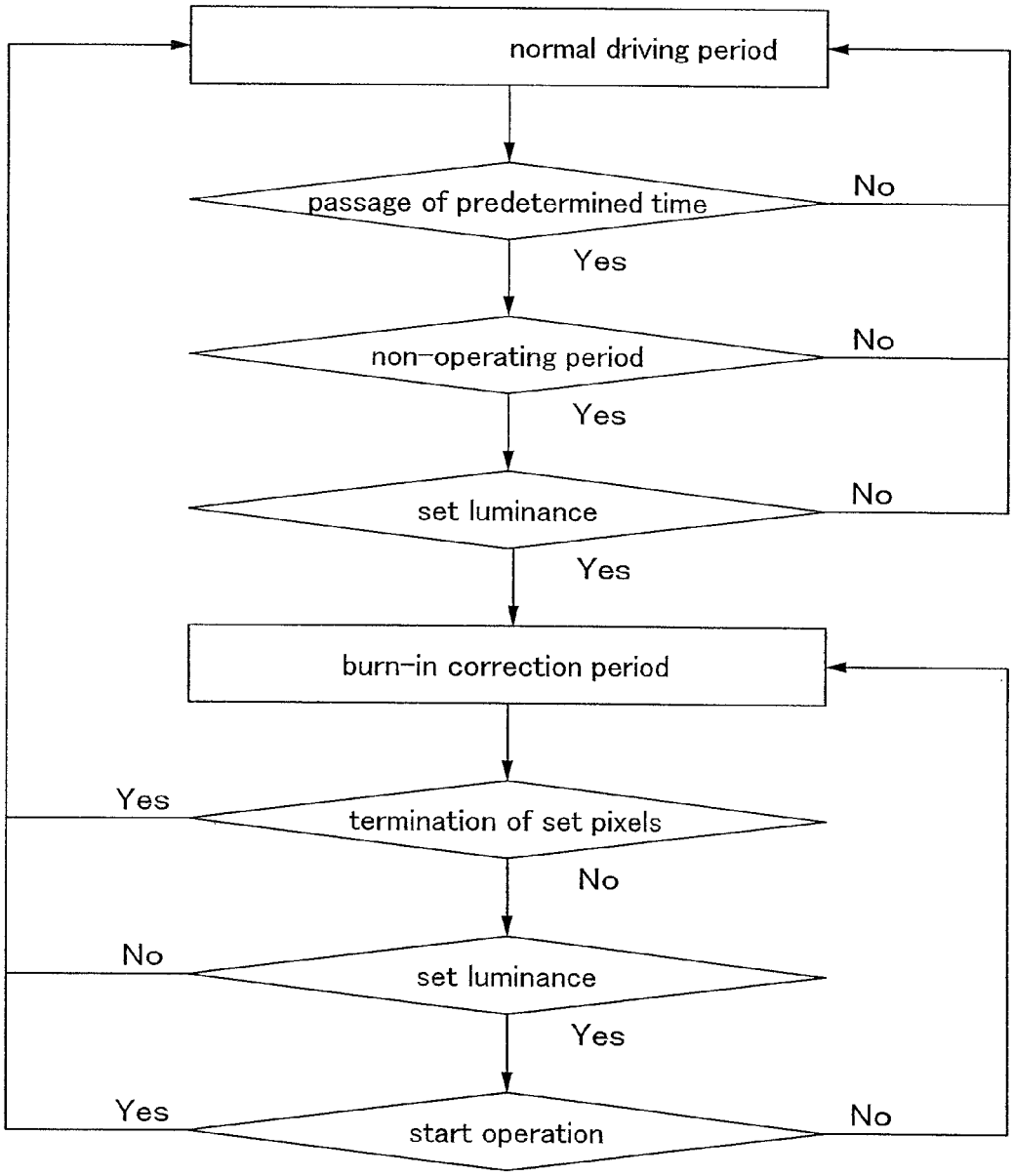
FIG. 15 shows a display device of Embodiment Mode 11.

A description is made on the timing and conditions for proceeding from the normal driving period to the burn-in correction period with reference to a flow chart of FIG. 15, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "passage of predetermined time", and the decision of "start of operation" are similar to those in Embodiment Mode 4. The decision of "non-operating period" is similar to that in Embodiment Mode 6. The decision of "termination of set pixels" is similar to that in Embodiment Mode 7. The decision of "set luminance" is similar to that in Embodiment Mode 8.

A description is made on the flow of the flow chart of FIG. 15. If a predetermined time has not passed after the process proceeds from the last "burn-in correction period" to a "normal driving period" in the "passage of predetermined time", the process proceeds to the "normal driving period", whereas the process proceeds to a "non-operating period" if the predetermined time has passed. If the user operates the electronic appliance or the like for the predetermined time in the "non-operating period", the process proceeds to the "normal driving period", whereas the process proceeds to the "set luminance" if the user does not operate the electronic appliance or the like for the predetermined time. If the surrounding luminance is not in the predetermined range in the "set luminance", the process proceeds to the "normal driving period", whereas the process proceeds to the "burn-in correction period" if the surrounding luminance is in the predetermined range. When the process proceeds to the "burn-in correction period", operations described in the burn-in correction period in Embodiment Modes 1 to 3 are carried out, and then, the process proceeds to the "termination of set pixels". If characteristics of light-emitting elements included in the preset pixels are obtained in "termination of set pixels", the process proceeds to the "normal driving period", whereas the process proceeds to the "set luminance" if the characteristics of light-emitting elements included in the preset pixels are not obtained. If the surrounding luminance is not in the predetermined range in the "set luminance", the process proceeds to the "normal driving period", whereas the process proceeds to the "start of operation" if the surrounding luminance is in the predetermined range. If the user starts operation in the "start of operation", the process proceeds to the "normal driving period", whereas the process proceeds to the "burn-in correction period" if the user has not started operation.

By adding the "passage of predetermined time" to the conditions for proceeding from the normal driving period to the burn-in correction period, the number of proceedings to the burn-in correction period can be controlled. In the burn-in correction period, light-emitting elements included in pixels need to emit light as described in Embodiment Modes 1 to 3. Therefore, decrease in frequency of proceeding to the burn-in correction period can prevent deterioration of light-emitting elements included in pixels due to the burn-in correction period.

By adding the "non-operating period" to the conditions for proceeding from the normal driving period to the burn-in correction period, the process can proceed to the burn-in correction period when the user does not operate the electronic appliance or the like. It can be judged that the electronic appliance or the like is not being used when the user does not operate the electronic appliance or the like for the predetermined time.

By adding the "set luminance" to the conditions for proceeding from the normal driving period to the burn-in correction period, the process can proceed to the burn-in correction period without being effected by the surrounding luminance. In Embodiment Modes 1 to 3, one pixel or three pixels emit light at the same time and driving TFTs in the other pixels which do not emit light are in off state. Therefore, off-state current changes according to the surrounding luminance, which leads to variation in detected current value. By detecting the characteristics of the light-emitting elements included in the pixels when the surrounding luminances are the same, the effect of changes in surrounding luminance is eliminated. The surrounding luminance is preferably about 0 [cd/m$^2$]. In the case of a foldable mobile phone, such a state can be realized when the foldable mobile phone is folded and in the case of a digital camera, such a state can be realized when the digital camera is placed in its case.

By adding the "termination of set pixels" to the conditions for proceeding from the burn-in correction period to the normal driving period, the process can proceed to the normal driving period without interrupting the burn-in correction period. In addition, it is possible that the process proceeds to the burn-in correction period selectively in a portion in which burn-in is supposed to be easily generated.

By adding the "charging period" to the conditions for proceeding from the burn-in correction period to the normal driving period, the process can proceed to the normal driving period on finishing charging of the battery. Proceeding to the normal driving period from the burn-in correction period on finishing charging of the battery, drain of the battery can be suppressed. Besides, when charging the battery is finished, it is highly possible that the user is going to use the electronic appliance; therefore, the process needs to proceed to the normal driving period.

By adding the "set luminance" to the conditions for proceeding from the burn-in correction period to the normal driving period, the process can proceed to the normal driving period immediately when the surrounding luminance changes during the burn-in correction period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "set luminance" and the "start of operation", the burn-in correction period finishes before characteristics of the light-emitting elements included in preset pixels are detected. In this case, the characteristics of light-emitting elements included in pixels which are not detected in the last burn-in correction period may be detected in the next burn-in correction period. In addition, when the process proceeds to the next burn-in correction period, it is preferable that the predetermined time in the "passage of predetermined time" be shorter. The predetermined time is preferably zero second and the process preferably proceeds to the burn-in correction period via the next "non-operating period" and "set luminance".

Figure 68:
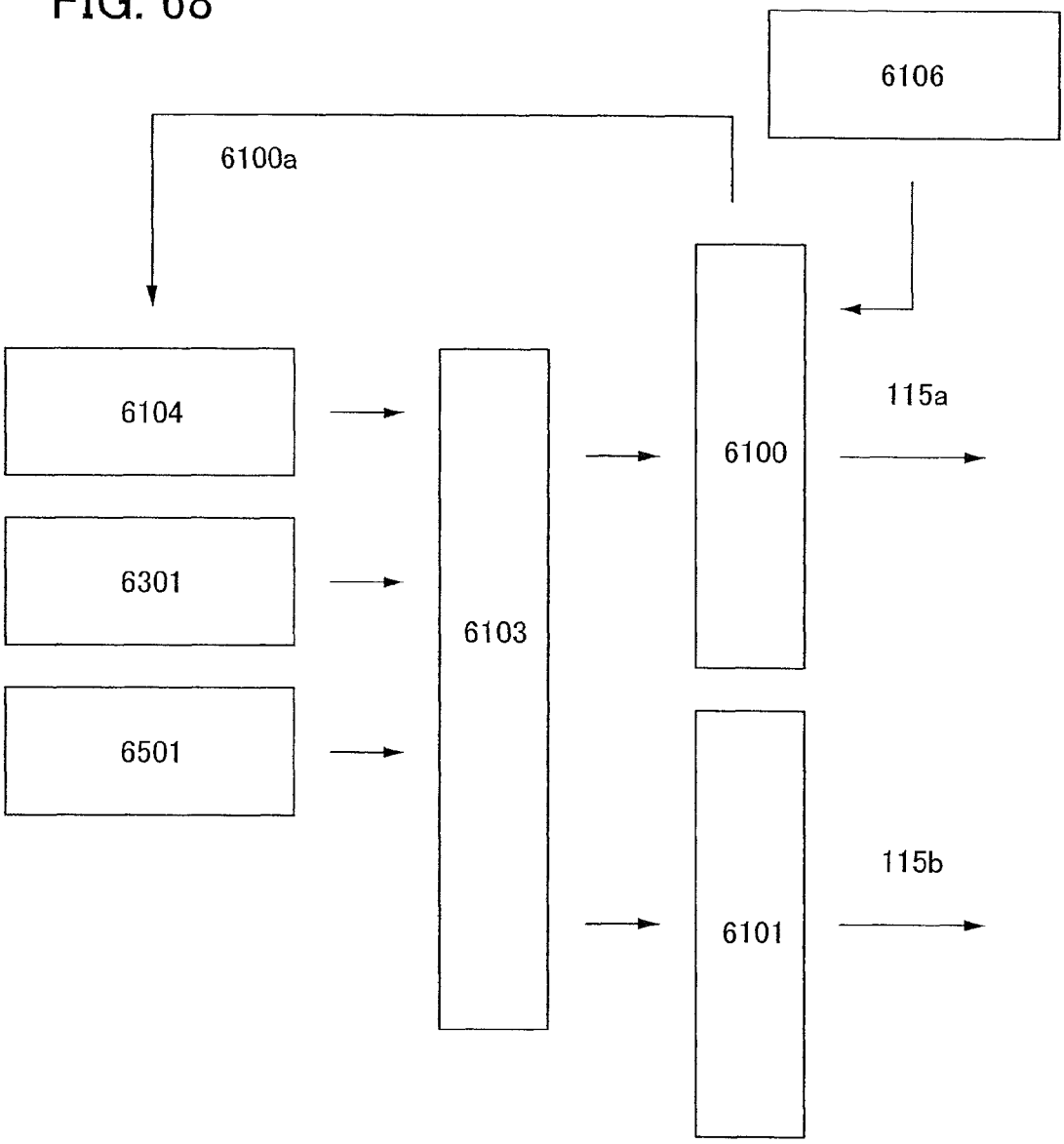
FIG. 68 shows a display device of Embodiment Mode 11.

A description is made on the structure and operation of the controller 115 for realizing the flow chart of FIG. 15 described in this embodiment mode, with reference to FIG. 68.

In this embodiment mode, the image signal generation circuit 6100, the current value detection control signal generation circuit 6101, the driving method selection circuit 6103, and the timer circuit 6104 are similar to those in Embodiment Mode 4. The detection pixel set circuit 6106 is similar to that in Embodiment Mode 5. The non-operating period detection circuit 6301 is similar to that in Embodiment Mode 6. The surrounding luminance detection circuit 6501 is similar to that in Embodiment Mode 8.

A description is made on operation in this embodiment mode. When the predetermined time has passed from the input of the reset signals 6100*a* to the timer circuit 6104, that is, the predetermined time has passed from the end of the last burn-in correction period, and the user does not operate the electronic appliance or the like for a predetermined time and the surrounding luminance detection circuit 6501 decides that the surrounding luminance of the display device is close to the predetermined luminance; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of the pixels set by the detection pixel set circuit 6106, the reset signals 6100*a* are inputted to the timer circuit 6104. In this embodiment mode, between "the normal driving period" and "the burn-in correction period", the judgment of "passage of predetermined time", the judgment of "non-operating period", the judgment of "set luminance", the judgment of "termination of set pixels", and the judgment of "start of operation" are conducted, the present invention can operate by conducting at least one of the judgment of "passage of predetermined time", the judgment of "non-operating period", the judgment of "set luminance", the judgment of "termination of set pixels", and the judgment of "start of operation". That is, for example, between "the normal driving period" and "the burn-in correction period", the judgment of "non-operating period" and the judgment of "set luminance" are conducted. In this case, the operation is conducted by using at least the non-operating period detection circuit 6301, the surrounding luminance detection circuit 6501, and the driving method selection circuit 6103.

[Embodiment Mode 12]

Figure 16:
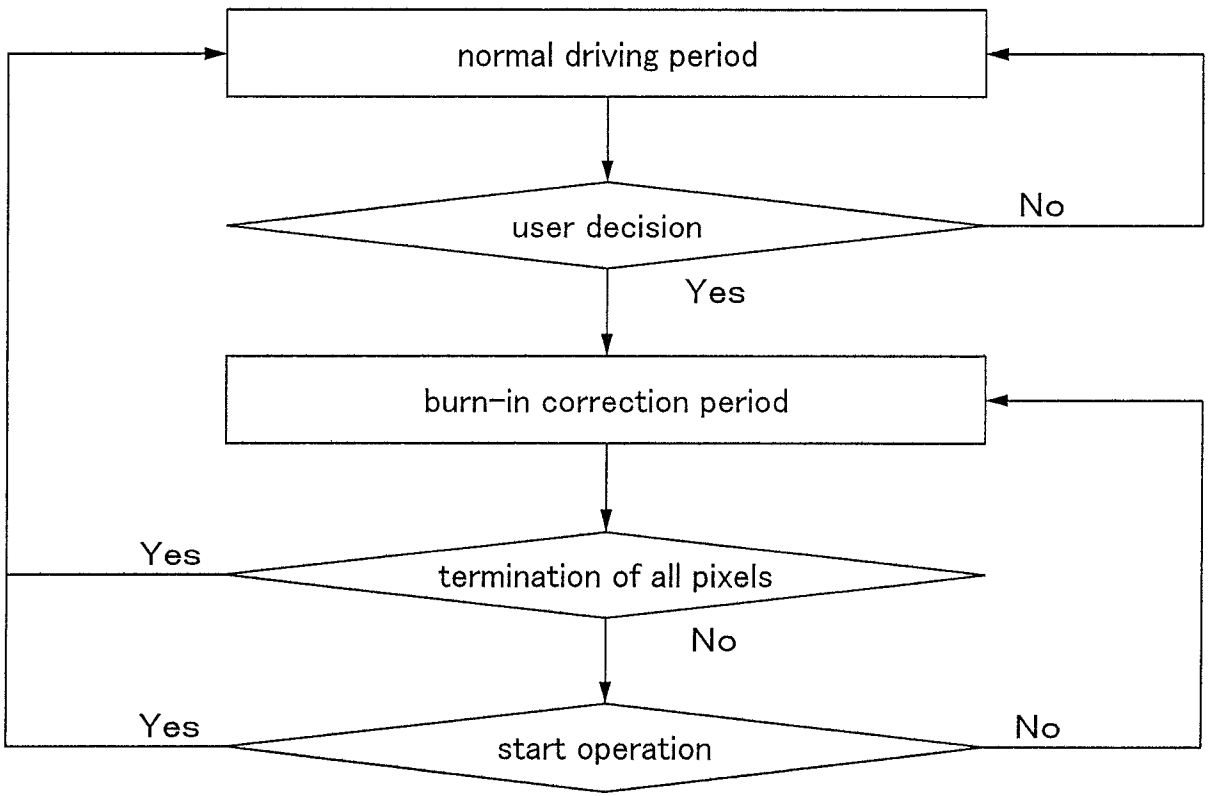
FIG. 16 shows a display device of Embodiment Mode 12.

A description is made on the timing and conditions for proceeding from the normal driving period to the burn-in correction period with reference to a flow chart of FIG. 16, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "termination of all pixels", and the decision of "start of operation" are similar to those in Embodiment Mode 4. In a decision of "user decision", the user of the electronic appliance or the like of the present invention decides whether the process proceeds to the burn-in correction period or not.

A description is made on the flow of the flow chart of FIG. 16. In the "user decision", if the user does not determine that the process proceeds to the "burn-in correction period", the process proceeds to the "normal driving period, whereas the process proceeds to the "burn-in correction period" if the user determines that the process proceeds to the "burn-in correction period". When the process proceeds to the "burn-in correction period", operations described in the burn-in correction period in Embodiment Modes 1 to 3 are carried out, and then, the process proceeds to the "termination of all pixels". If characteristics of light-emitting elements included in all pixels are obtained in the "termination of all pixels", the process proceeds to the "normal driving period", whereas the process proceeds to the "start of operation" if the characteristics of light-emitting elements included in all pixels are not obtained. If the user starts operation in the "start of operation", the process proceeds to the "normal driving period", whereas the process proceeds to the "burn-in correction period" if the user has not started operation.

By adding the "user decision" to the conditions for proceeding from the normal driving period to the burn-in correction period, the user can decide whether the process proceeds to the burn-in correction period or not. Therefore, the decision of proceeding to the burn-in correction period is made to suit each user since frequency of using the electronic appliance or the like and the display screen or the like thereof are different depending on users.

By adding the "termination of all pixels" to the conditions for proceeding from the burn-in correction period to the normal driving period, characteristics of the light-emitting elements included in all pixels can be detected under the same conditions. When the conditions under which characteristics of the light-emitting elements included in pixels are detected, that is, when the operating environments are the same, variation in characteristics due to difference in the operating environments can be suppressed.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "start of operation", the burn-in correction period finishes before characteristics of the light-emitting elements included in all pixels are detected. In this case, the characteristics of light-emitting elements included in pixels which are not detected in the last burn-in correction period may be detected in the next burn-in correction period.

Figure 69:
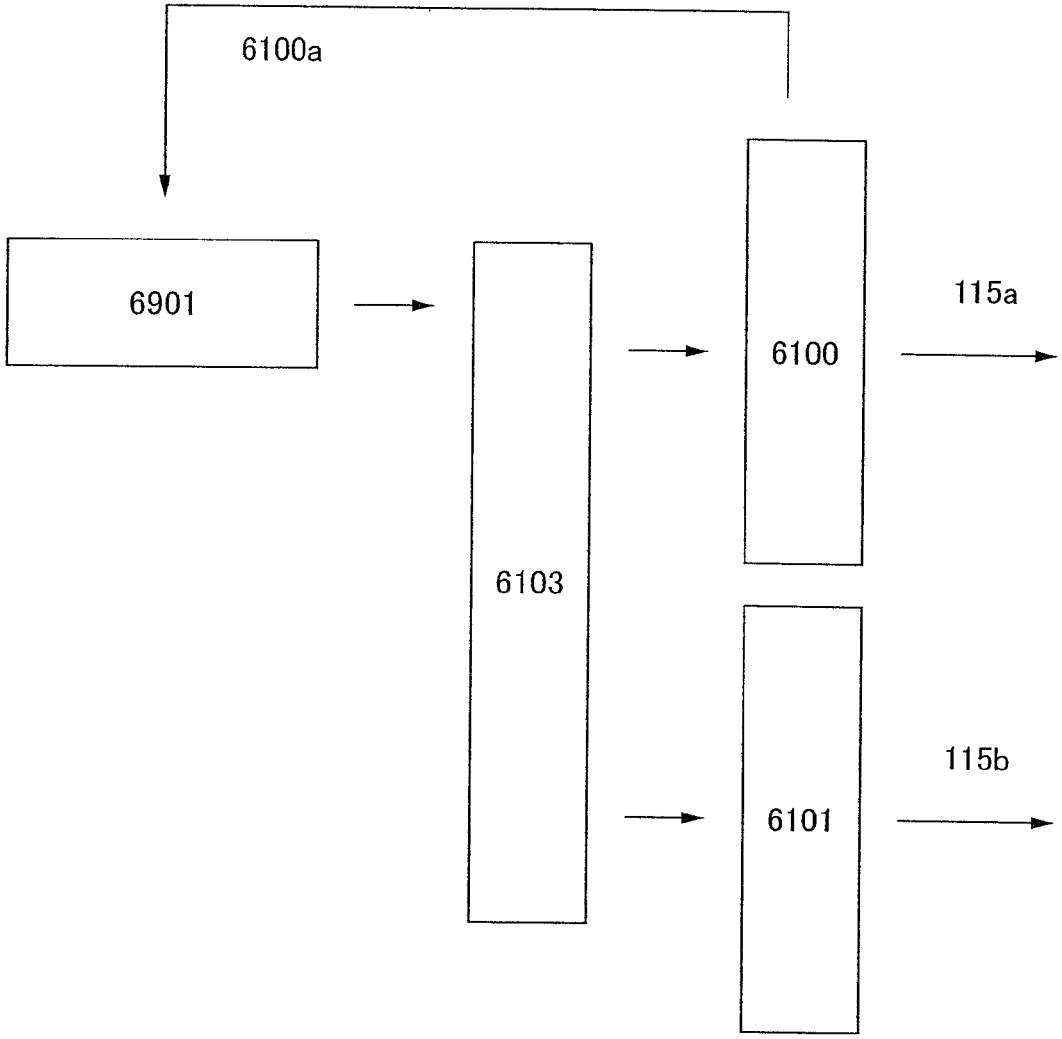
FIG. 69 shows a display device of Embodiment Mode 12.

A description is made on the structure and operation of the controller 115 for realizing the flow chart of FIG. 16 described in this embodiment mode, with reference to FIG. 69.

In this embodiment mode, the image signal generation circuit 6100, the current value detection control signal generation circuit 6101, and the driving method selection circuit 6103 are similar to those in Embodiment Mode 4.

A start circuit 6901 operates when the user determines that the process proceeds to the burn-in correction period and conducts certain operation. When the burn-in correction period ends and the process proceeds to the normal driving period, reset signals 6100*a* are outputted from the video signal generation circuit 6100, and signals for proceeding to the burn-in correction period are stopped. Note that as long as the reset signals are inputted to the start circuit 6901 at the end of the burn-in correction period, the reset signals may be outputted from anywhere. When the user determines that the process proceeds to the burn-in correction period in the start circuit 6901, signals for proceeding to the burn-in correction period are outputted to the driving method selection circuit 6103. When the user determines that the process proceeds to the normal driving period, signals for proceeding to the burn-in correction period are stopped. The reset signals inputted to the start circuit 6901 are not necessarily inputted if characteristics of all the pixels or set pixels are not detected. For example, the start circuit 6901 includes a 1-bit counter.

A description is made on operation in this embodiment mode. When the user determines that the process proceeds to the burn-in correction period, the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of all pixels, the reset signals are inputted to the start circuit 6901. In this embodiment mode, between "the normal driving period" and "the burn-in correction period", the judgment of "passage of user decision", the judgment of "termination of all pixels", and "the judgment of start of operation" are conducted, the present invention can operate by conducting at least one of the judgment of "passage of user decision", the judgment of "termination of all pixels", and the judgment of "start of operation". That is, for example, between "the normal driving period" and "the burn-in correction period", the judgment of "user decision" is conducted. In this case, the operation is conducted by using at least the start circuit 6901 and the driving method selection circuit 6103.

[Embodiment Mode 13]

Figure 17:
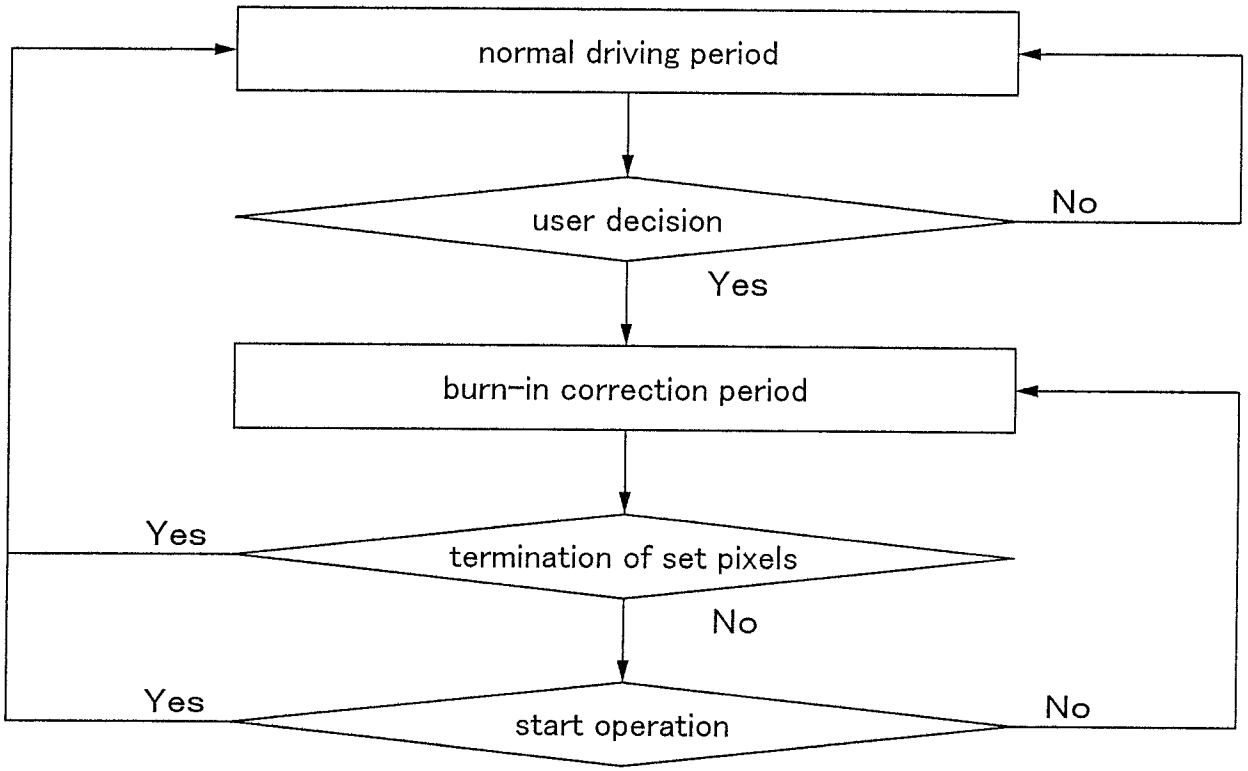
FIG. 17 shows a display device of Embodiment Mode 13.

A description is made on the timing and conditions for proceeding from the normal driving period to the burn-in correction period with reference to a flow chart of FIG. 17, to which Embodiment Modes 1 to 3 are applied. In the flow chart, a rectangular box represents a process and a diamond-shaped box represents a decision.

In this embodiment mode, the process of "normal driving period", the process of "burn-in correction period", and the decision of "start of operation" are similar to those in Embodiment Mode 4. The decision of "termination of set pixels" is similar to that in Embodiment Mode 7. The decision of "user decision" is similar to that in Embodiment Mode 12.

A description is made on the flow of the flow chart of FIG. 17. In the "user decision", if the user does not determine that the process proceeds to the "burn-in correction period", the process proceeds to the "normal driving period, whereas the process proceeds to the "burn-in correction period" if the user determines that the process proceeds to the "burn-in correction period". When the process proceeds to the "burn-in correction period", operations described in the burn-in correction period in Embodiment Modes 1 to 3 are carried out, and then, the process proceeds to the "termination of set pixels". If characteristics of light-emitting elements included in the preset pixels are obtained in "termination of set pixels", the process proceeds to the "normal driving period", whereas the process proceeds to the "start of operation" if the characteristics of the light-emitting elements included in the preset pixels are not obtained. If the user starts operation in the "start of operation", the process proceeds to the "normal driving period", whereas the process proceeds to the "burn-in correction period" if the user has not started operation.

By adding the "user decision" to the conditions for proceeding from the normal driving period to the burn-in correction period, the user can decide whether the process proceeds to the burn-in correction period or not. Therefore, the decision of proceeding to the burn-in correction period is made to suit each user since frequency of using the electronic appliance or the like and the display screen or the like thereof are different depending on users.

By adding the "termination of set pixels" to the conditions for proceeding from the burn-in correction period to the normal driving period, the process can proceed to the normal driving period without interrupting the burn-in correction period. In addition, it is possible that the process proceeds to the burn-in correction period selectively in a portion in which burn-in is supposed to be easily generated.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "start of operation", the burn-in correction period finishes before characteristics of the light-emitting elements included in the preset pixels are detected. In this case, the characteristics of light-emitting elements included in pixels which are not detected in the last burn-in correction period may be detected via the next burn-in correction period.

Figure 70:
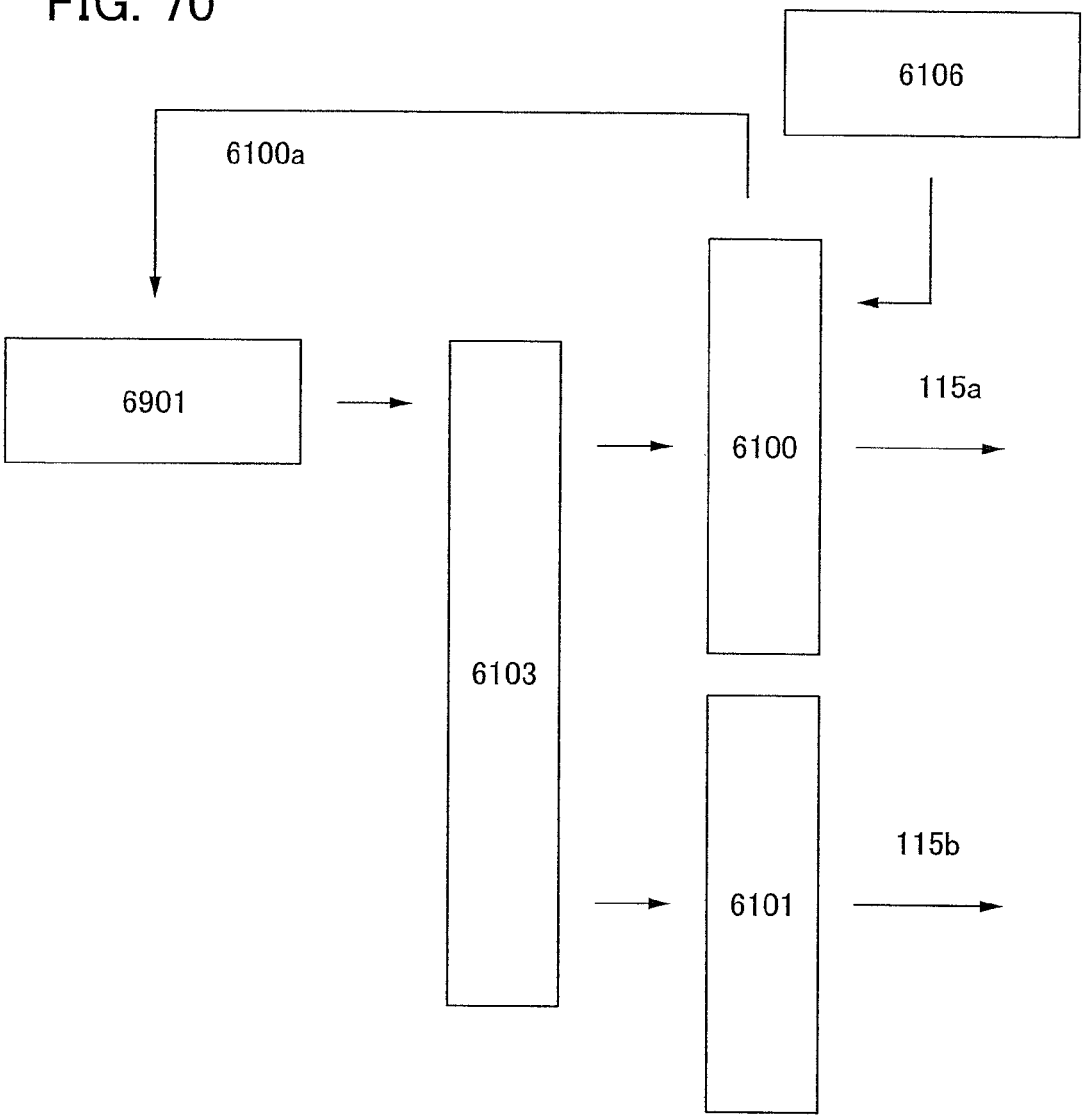
FIG. 70 shows a display device of Embodiment Mode 13.

A description is made on the structure and operation of the controller 115 for realizing the flow chart of FIG. 17 described in this embodiment mode, with reference to FIG. 70.

In this embodiment mode, the image signal generation circuit 6100, the current value detection control signal generation circuit 6101, and the driving method selection circuit 6103 are similar to those in Embodiment Mode 4. The detection pixel set circuit 6106 is similar to that in Embodiment Mode 5. The start circuit 6901 is similar to that in Embodiment Mode 12.

A description is made on operation in this embodiment mode. When the user determines that the process proceeds to the burn-in correction period, the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of the pixels set by the detection pixel set circuit 6106, the reset signals are inputted to the start circuit 6901. In this embodiment mode, between "the normal driving period" and "the burn-in correction period", the judgment of "passage of user decision", the judgment of "termination of set pixels", and the judgment of "start of operation" are conducted, the present invention can operate by conducting at least one of the judgment of "passage of user decision", the judgment of "termination of set pixels", and the judgment of "start of operation". That is, for example, between "the normal driving period" and "the burn-in correction period", the judgment of user decision is conducted. In this case, the operation is conducted by using at least the start circuit 6901 and the driving method selection circuit 6103.

[Embodiment Mode 14]

Figure 18:
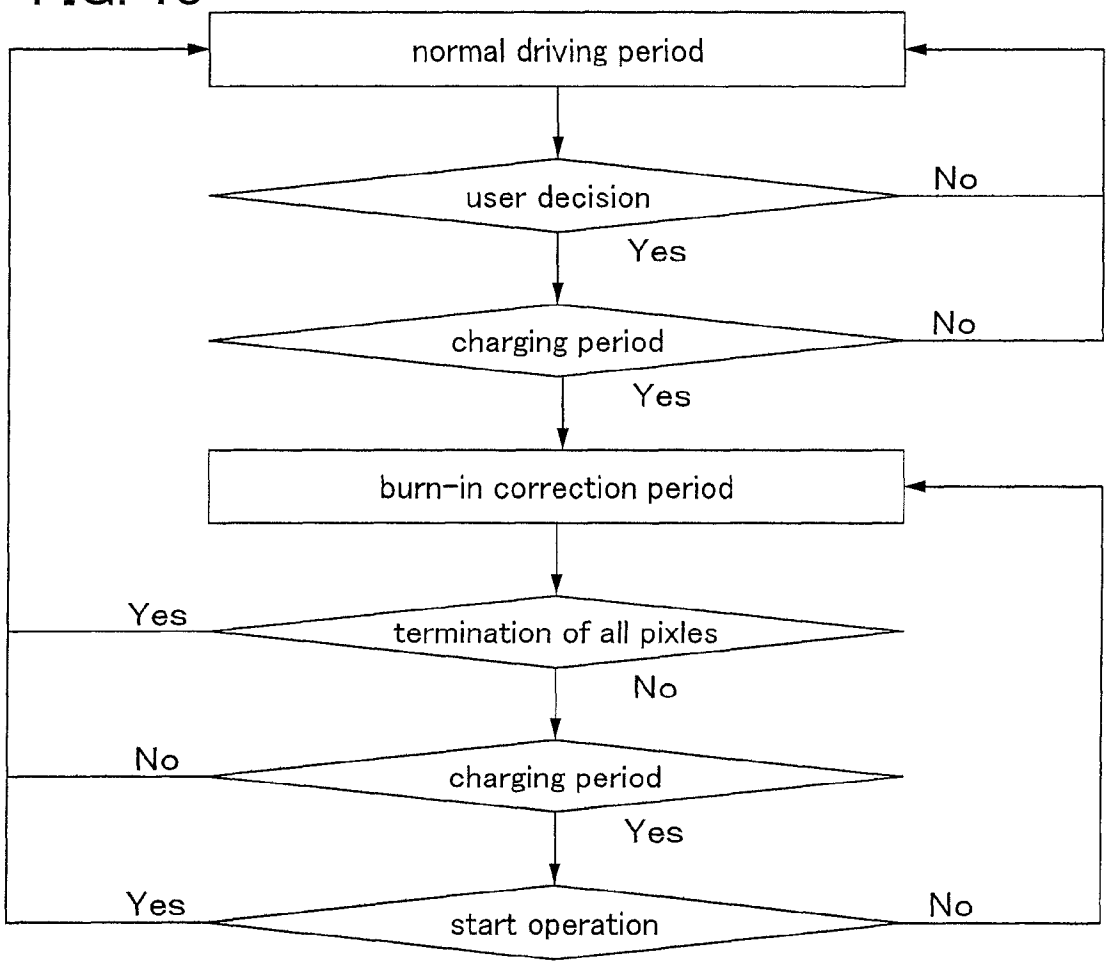
FIG. 18 shows a display device of Embodiment Mode 14.

A description is made on the timing and conditions for proceeding from the normal driving period to the burn-in correction period with reference to a flow chart of FIG. 18, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "charging period", the decision of "termination of all pixels" and the decision of "start of operation" are similar to those in Embodiment Mode 4. The decision of "user decision" is similar to that in Embodiment Mode 12.

A description is made on the flow of the flow chart of FIG. 18. In the "user decision", if the user does not determine that the process proceeds to the "burn-in correction period", the process proceeds to the "normal driving period, whereas the process proceeds to the "charging period" if the user determines that the process proceeds to the "burn-in correction period" "charging period". If a battery is not charged in the "charging period", the process proceeds to the "normal driving period", whereas the process proceeds to the "burn-in correction period" if the battery is charged. When the process proceeds to the "burn-in correction period", operations described in the burn-in correction period in Embodiment Modes 1 to 3 are carried out, and then, the process proceeds to the "termination of all pixels". If characteristics of light-emitting elements included in all pixels are obtained in the "termination of all pixels", the process proceeds to the "normal driving period", whereas the process proceeds to the "charging period" if the characteristics of light-emitting elements included in all pixels are not obtained. If the battery is not charged in the "charging period", the process proceeds to the "normal driving period", whereas the process proceeds to the "start of operation" if the battery is charged. If the user starts operation in the "start of operation", the process proceeds to the "normal driving period", whereas the process proceeds to the "burn-in correction period" if the user has not started operation.

By adding the "user decision" to the conditions for proceeding from the normal driving period to the burn-in correction period, the user can decide whether the process proceeds to the burn-in correction period or not. Therefore, the decision of proceeding to the burn-in correction period is made to suit each user since frequency of using the electronic, appliance or the like and the display screen or the like thereof are different depending on users.

By adding the "charging period" to the conditions for proceeding from the normal driving period to the burn-in correction period, the process can proceed to the burn-in correction period while charging the battery. In the burn-in correction period, light-emitting elements included in pixels emit light, so that characteristics of the light-emitting elements are stored as described in Embodiment Modes 1 to 3. Therefore, power consumption therein is large. Proceeding to the burn-in correction period while charging the battery can prevent reduction in power of the battery due to the burn-in correction period. Besides, when charging the battery, it is highly possible that the user has finished using the electronic appliance or the like and it is unlikely that the process returns to the normal driving period.

By adding the "termination of all pixels" to the conditions for proceeding from the burn-in correction period to the normal driving period, characteristics of the light-emitting elements included in all pixels can be detected under the same conditions. When the conditions under which characteristics of the light-emitting elements included in pixels are detected, that is, when the operating environments are the same, variation in characteristics due to difference in the operating environments can be suppressed.

By adding the "charging period" to the conditions for proceeding from the burn-in correction period to the normal driving period, the process can proceed to the normal driving period on finishing charging of the battery. Proceeding to the normal driving period from the burn-in correction period on finishing charging of the battery, drain of the battery can be suppressed. Besides, when charging the battery is finished, it is highly possible that the user is going to use the electronic appliance; therefore, the process needs to proceed to the normal driving period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "charging period" and the "start of operation", the burn-in correction period finishes before characteristics of the light-emitting elements included in the all pixels are detected. In this case, the characteristics of light-emitting elements included in pixels which are not detected in the last burn-in correction period may be detected in the next burn-in correction period.

Figure 71:
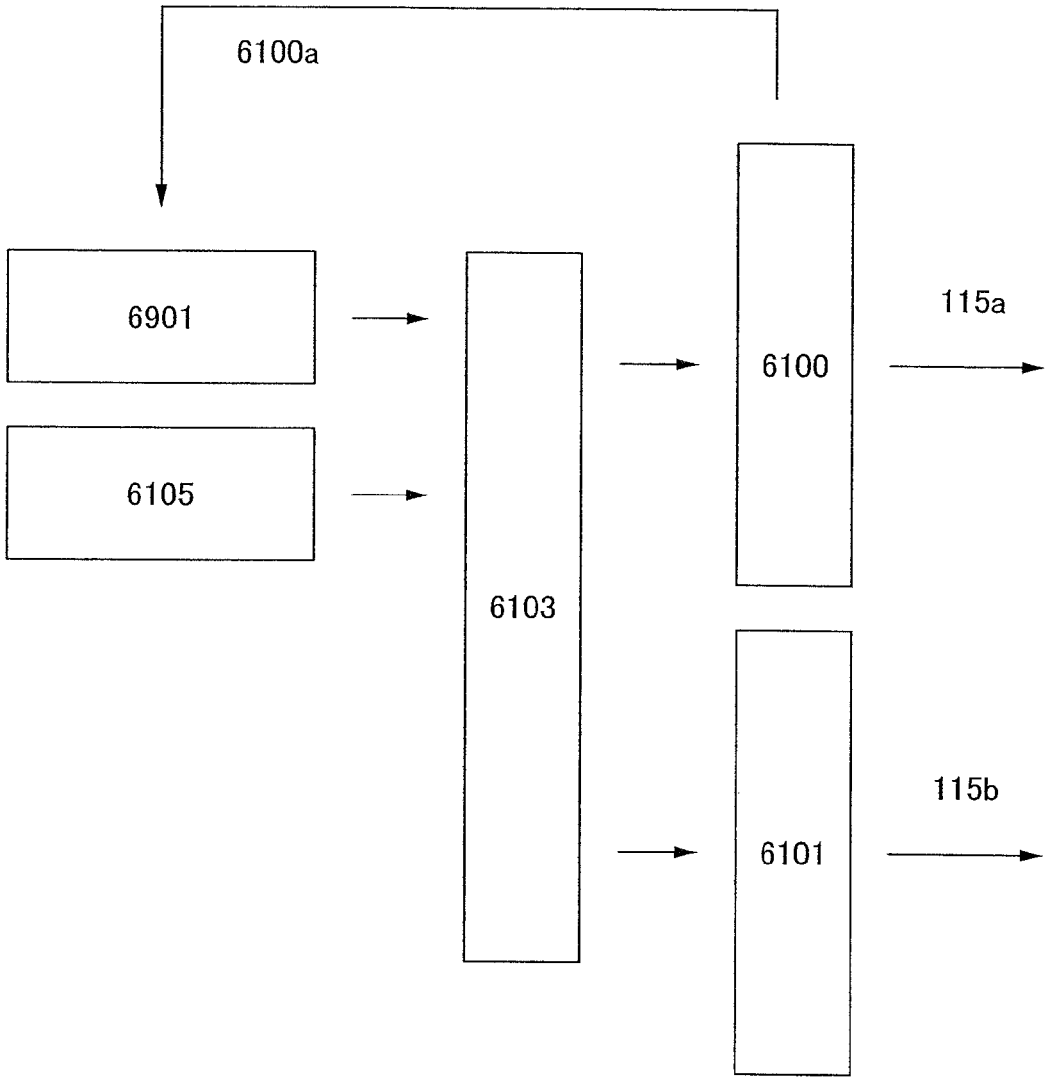
FIG. 71 shows a display device of Embodiment Mode 14.

A description is made on the structure and operation of the controller 115 for realizing the flow chart of FIG. 18 described in this embodiment mode, with reference to FIG. 71.

In this embodiment mode, the image signal generation circuit 6100, the current value detection control signal generation circuit 6101, the driving method selection circuit 6103, and the charging unit detection circuit 6105 are similar to those in Embodiment Mode 4. The start circuit 6901 is similar to that in Embodiment Mode 12.

A description is made on operation in this embodiment mode. When the user determines that the process proceeds to the burn-in correction period and the charging unit detection circuit 6105 detects charging of the battery 117, the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of all pixels, the reset signals 6100*a* are inputted to the start circuit 6901. In this embodiment mode, between "the normal driving period" and "the burn-in correction period", the judgment of "passage of user decision", the judgment of "charging period", the judgment of "termination of all pixels", and the judgment of "start of operation" are conducted, the present invention can operate by conducting at least one of the judgment of "passage of user decision", the judgment of "charging period", the judgment of "termination of all pixels", and the judgment of "start of operation". That is, for example, between "the normal driving period" and "the burn-in correction period", the judgment of "user decision" is conducted. In this case, the operation is conducted by using at least the start circuit 6901, the charging unit detection circuit 6105 and the driving method selection circuit 6103.

[Embodiment Mode 15]

Figure 19:
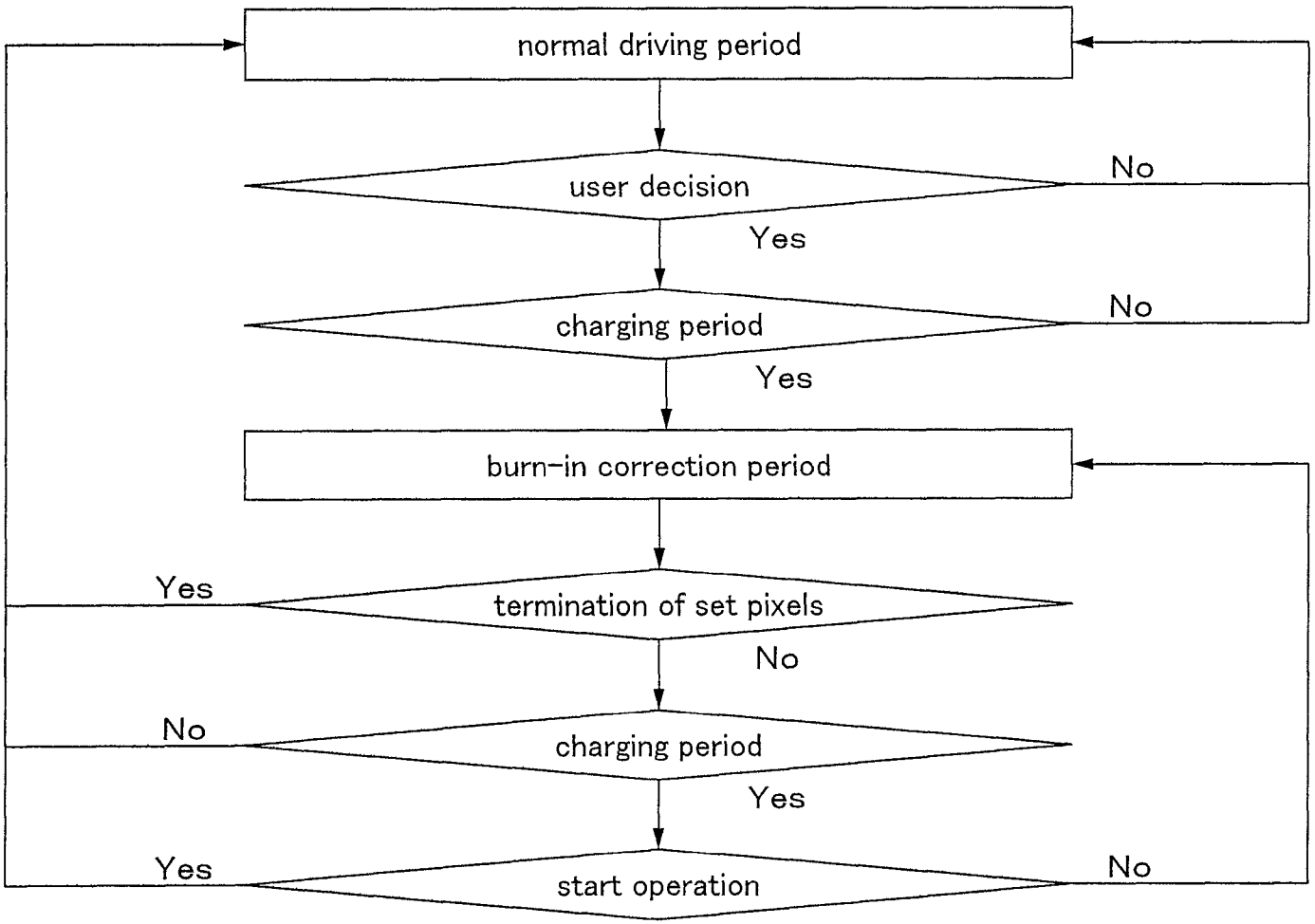
FIG. 19 shows a display device of Embodiment Mode 15.

A description is made on the timing and conditions for proceeding from the normal driving period to the burn-in correction period with reference to a flow chart of FIG. 19, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "charging period", and the decision of "start of operation" are similar to those in Embodiment Mode 4. The decision of "termination of set pixels" is similar to that in Embodiment Mode 7. The decision of "user decision" is similar to that in Embodiment Mode 12.

A description is made on the flow of the flow chart of FIG. 19. In the "user decision", if the user does not determine that the process proceeds to the "burn-in correction period", the process proceeds to the "normal driving period", whereas the process proceeds to the "charging period" if the user determines that the process proceeds to the "burn-in correction period". If a battery is not charged in the "charging period", the process proceeds to the "normal driving period", whereas the process proceeds to the "burn-in correction period" if the battery is charged. When the process proceeds to the "burn-in correction period", operations described in the burn-in correction period in Embodiment Modes 1 to 3 are carried out, and then, the process proceeds to the "termination of set pixels". If characteristics of light-emitting elements included in the preset pixels are obtained in the "termination of set pixels", the process proceeds to the "normal driving period", whereas the process proceeds to the "charging period" if the characteristics of light-emitting elements included in the preset pixels are not obtained. If the battery is not charged in the "charging period", the process proceeds to the "normal driving period", whereas the process proceeds to the "start of operation" if the battery is charged. If the user starts operation in the "start of operation", the process proceeds to the "normal driving period", whereas the process proceeds to the "burn-in correction period" if the user has not started operation.

By adding the "user decision" to the conditions for proceeding from the normal driving period to the burn-in correction period, the user can decide whether the process proceeds to the burn-in correction period or not. Therefore, the decision of proceeding to the burn-in correction period is made to suit each user since frequency of using the electronic appliance or the like and the display screen or the like thereof are different depending on users.

By adding the "charging period" to the conditions for proceeding from the normal driving period to the burn-in correction period, the process can proceed to the burn-in correction period while charging the battery. In the burn-in correction period, light-emitting elements included in pixels emit light, so that characteristics of the light-emitting elements are stored as described in Embodiment Modes 1 to 3. Therefore, power consumption therein is large. Proceeding to the burn-in correction period while charging the battery can prevent reduction in power of the battery due to the burn-in correction period. Besides, when charging the battery, it is highly possible that the user has finished using the electronic appliance or the like and it is unlikely that the process returns to the normal driving period.

By adding the "termination of set pixels" to the conditions for proceeding from the burn-in correction period to the normal driving period, the process can proceed to the normal driving period without interrupting the burn-in correction period. In addition, it is possible that the process proceeds to the burn-in correction period selectively in a portion in which burn-in is supposed to be easily generated.

By adding the "charging period" to the conditions for proceeding from the burn-in correction period to the normal driving period, the process can proceed to the normal driving period on finishing charging of the battery. Proceeding to the normal driving period from the burn-in correction period on finishing charging of the battery, drain of the battery can be suppressed. Besides, when charging the battery is finished, it is highly possible that the user is going to use the electronic appliance; therefore, the process needs to proceed to the normal driving period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "charging period" and the "start of operation", the burn-in correction period finishes before characteristics of the light-emitting elements included in the preset pixels are detected. In this case, the characteristics of light-emitting elements included in pixels which are not detected in the last burn-in correction period may be detected in the next burn-in correction period.

Figure 72:
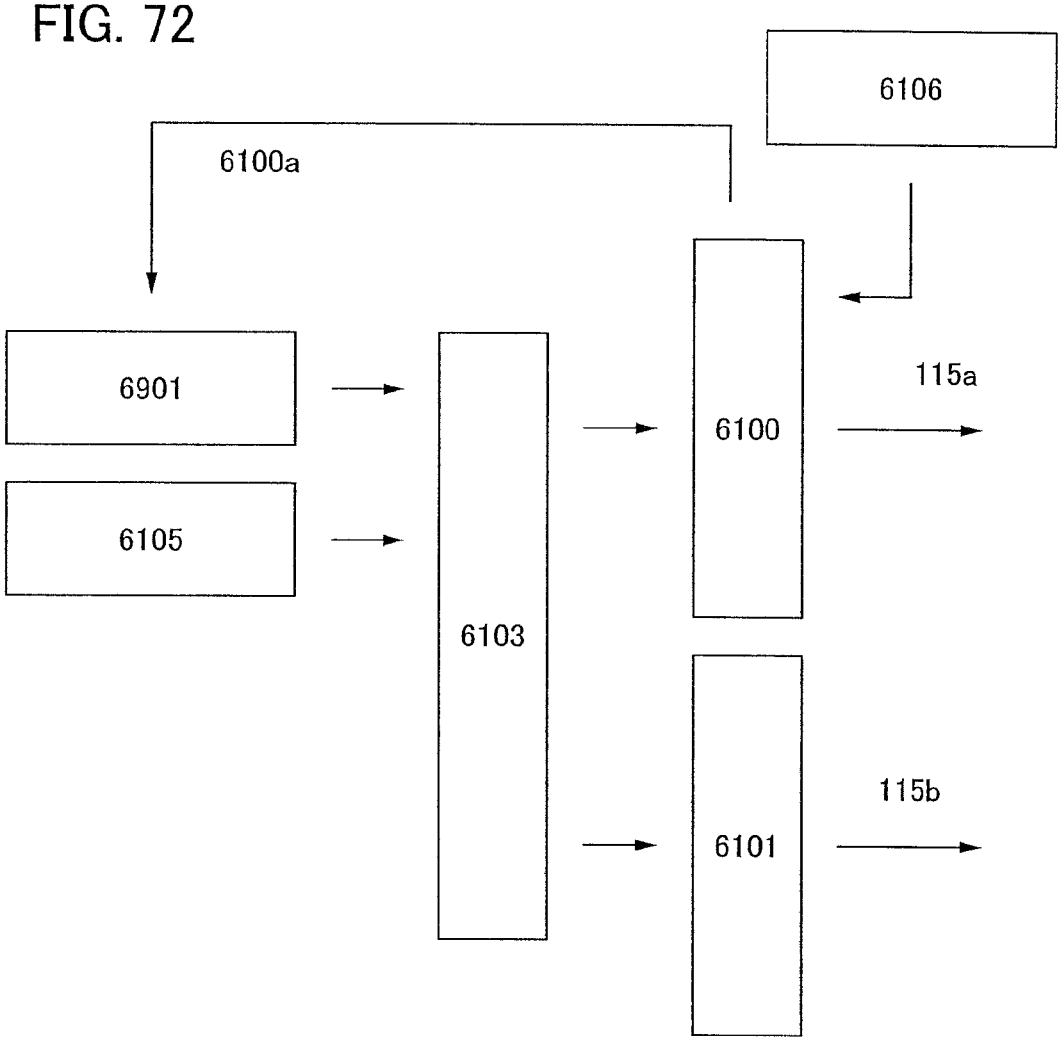
FIG. 72 shows a display device of Embodiment Mode 15.

A description is made on the structure and operation of the controller 115 for realizing the flow chart of FIG. 19 described in this embodiment mode, with reference to FIG. 72.

In this embodiment mode, the image signal generation circuit 6100, the current value detection control signal generation circuit 6101, the driving method selection circuit 6103, and the charging unit detection circuit 6105 are similar to those in Embodiment Mode 4. The detection pixel set circuit 6106 is similar to that in Embodiment Mode 5. The start circuit 6901 is similar to that in Embodiment Mode 12.

A description is made on operation in this embodiment mode. When the user determines that the process proceeds to the burn-in correction period and the charging unit detection circuit 6105 detects charging of the battery 117, the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of the pixels set by the detection pixel set circuit 6106, the reset signals 6100*a* are inputted to the start circuit 6901. In this embodiment mode, between "the normal driving period" and "the burn-in correction period", the judgment of "passage of user decision", the judgment of "charging period", the judgment of "termination of set pixels", and the judgment of "start of operation" are conducted, the present invention can operate by conducting at least one of the judgment of "passage of user decision", the judgment of "charging period", the judgment of "termination of set pixels", and the judgment of "start of operation". That is, for example, between "the normal driving period" and "the burn-in correction period", the judgment of "user decision" and "charging period" are conducted. In this case, the operation is conducted by using at least the start circuit 6901, the charging unit detection circuit 6105 and the driving method selection circuit 6103.

[Embodiment Mode 16]

Figure 20:
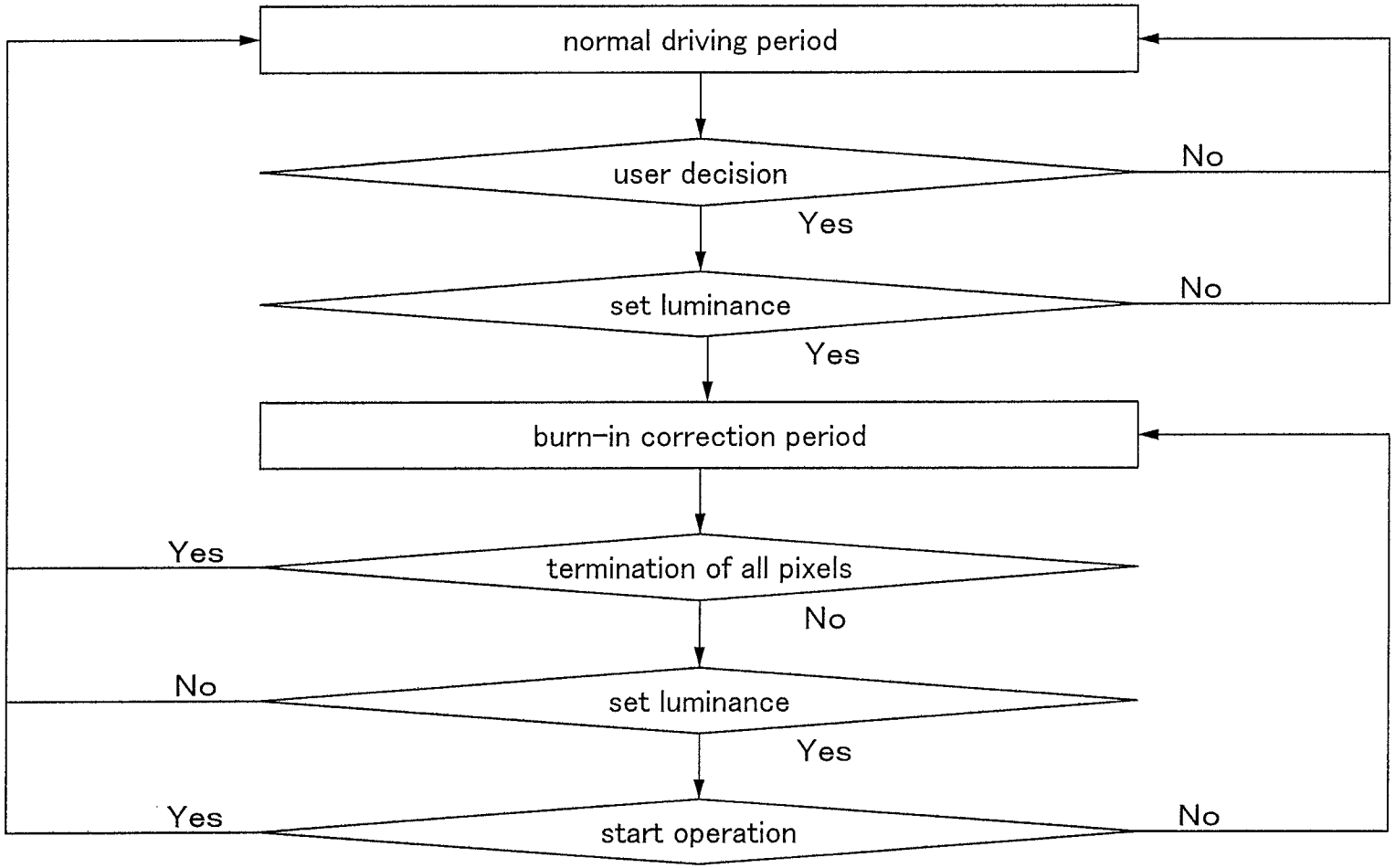
FIG. 20 shows a display device of Embodiment Mode 16.

A description is made on the timing and conditions for proceeding from the normal driving period to the burn-in correction period with reference to a flow chart of FIG. 20, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "termination of all pixels", and the decision of "start of operation" are similar to those in Embodiment Mode 4. The decision of "set luminance" is similar to that in Embodiment Mode 8. The decision of "user decision" is similar to that in Embodiment Mode 12.

A description is made on the flow of the flow chart of FIG. 20. In the "user decision", if the user does not determine that the process proceeds to the "burn-in correction period", the process proceeds to the "normal driving period, whereas the process proceeds to the "set luminance" if the user determines that the process proceeds to the "burn-in correction period". If the surrounding luminance is not in the predetermined range in the "set luminance", the process proceeds to the "normal driving period", whereas the process proceeds to the "burn-in correction period" if the surrounding luminance is in the predetermined range. When the process proceeds to the "burn-in correction period", operations described in the burn-in correction period in Embodiment Modes 1 to 3 are carried out, and then, the process proceeds to the "termination of all pixels". If characteristics of light-emitting elements included in all pixels are obtained in the "termination of all pixels", the process proceeds to the "normal driving period", whereas the process proceeds to the "set luminance" if the characteristics of light-emitting elements included in all pixels are not obtained. If the surrounding luminance is not in the predetermined range in the "set luminance", the process proceeds to the "normal driving period", whereas the process proceeds to the "start of operation" if the surrounding luminance is in the predetermined range. If the user starts operation in the "start of operation", the process proceeds to the "normal driving period", whereas the process proceeds to the "burn-in correction period" if the user has not started operation.

By adding the "user decision" to the conditions for proceeding from the normal driving period to the burn-in correction period, the user can decide whether the process proceeds to the burn-in correction period or not. Therefore, the decision of proceeding to the burn-in correction period is made to suit each user since frequency of using the electronic appliance or the like and the display screen or the like thereof are different depending on users.

By adding the "set luminance" to the conditions for proceeding from the normal driving period to the burn-in correction period, the process can proceed to the burn-in correction period without being effected by the surrounding luminance. In Embodiment Modes 1 to 3, one pixel or three pixels emit light at the same time and driving TFTs in the other pixels which do not emit light are in off state. Therefore, off-state current changes according to the surrounding luminance, which leads to variation in detected current value. By detecting the characteristics of the light-emitting elements included in the pixels when the surrounding luminances are the same, the effect of changes in surrounding luminance is eliminated. The surrounding luminance is preferably about 0 [cd/m$^2$]. In the case of a foldable mobile phone, such a state can be realized when the foldable mobile phone is folded and in the case of a digital camera, such a state can be realized when the digital camera is placed in its case.

By adding the "termination of all pixels" to the conditions for proceeding from the burn-in correction period to the normal driving period, characteristics of the light-emitting elements included in all pixels can be detected under the same conditions. When the conditions under which characteristics of the light-emitting elements included in pixels are detected, that is, when the operating environments are the same, variation in characteristics due to difference in the operating environments can be suppressed.

By adding the "set luminance" to the conditions for proceeding from the burn-in correction period to the normal driving period, the process can proceed to the normal driving period immediately when the surrounding luminance changes during the burn-in correction period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "set luminance" and the "start of operation", the burn-in correction period finishes before characteristics of the light-emitting elements included in the all pixels are detected. In this case, the characteristics of light-emitting elements included in pixels which are not detected in the last burn-in correction period may be detected in the next burn-in correction period.

Figure 73:
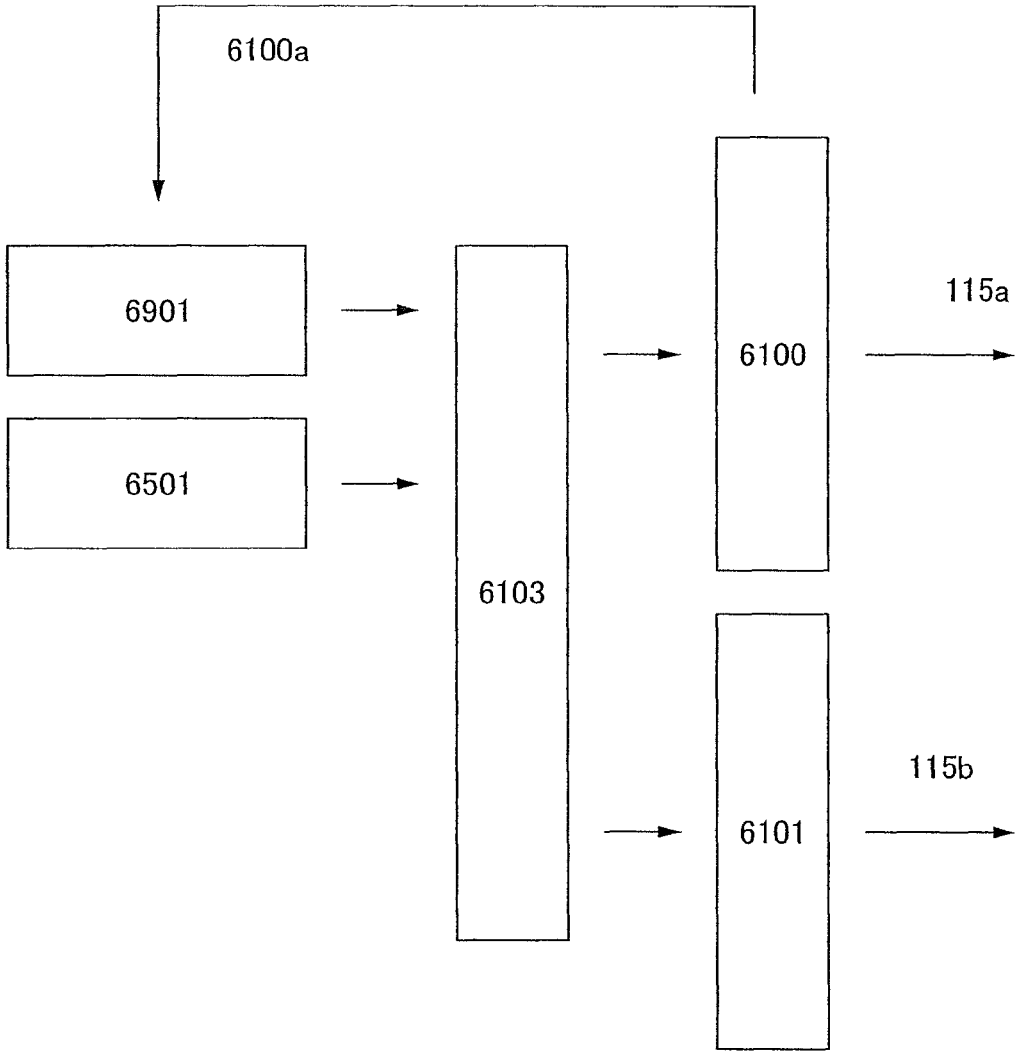
FIG. 73 shows a display device of Embodiment Mode 16.

A description is made on the structure and operation of the controller 115 for realizing the flow chart of FIG. 20 described in this embodiment mode, with reference to FIG. 73.

In this embodiment mode, the image signal generation circuit 6100, the current value detection control signal generation circuit 6101, and the driving method selection circuit 6103 are similar to those in Embodiment Mode 4. The surrounding luminance detection circuit 6501 is similar to that in Embodiment Mode 8. The start circuit 6901 is similar to that in Embodiment Mode 12.

A description is made on operation in this embodiment mode. When the user determines that the process proceeds to the burn-in correction period and the surrounding luminance detection circuit 6501 decides that the surrounding luminance of the display device is close to the predetermined luminance, the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of all pixels, the reset signals 6100*a* are inputted to the timer circuit 6901. In this embodiment mode, between "the normal driving period" and "the burn-in correction period", the judgment of "passage of user decision", the judgment of "set luminance", the judgment of "termination of all pixels", and the judgment of "start of operation" are conducted, the present invention can operate by conducting at least one of the judgment of "passage of user decision", the judgment of "set luminance", the judgment of "termination of all pixels", and the judgment of "start of operation". That is, for example, between "the normal driving period" and "the burn-in correction period", the judgment of "user decision" and "set luminance" are conducted. In this case, the operation is conducted by using at least the start circuit 6901, the surrounding luminance detection circuit 6501 and the driving method selection circuit 6103.

[Embodiment Mode 17]

Figure 21:
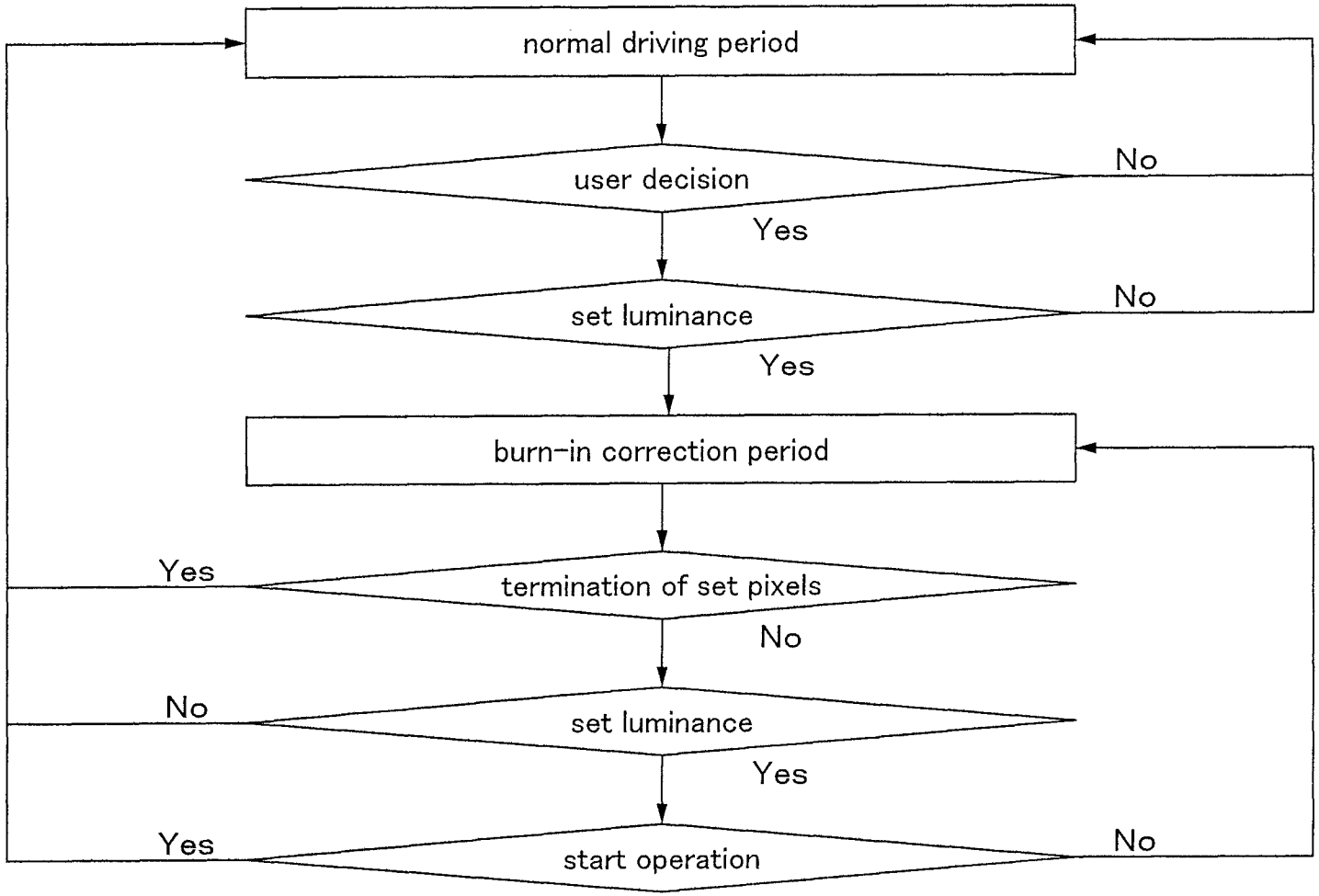
FIG. 21 shows a display device of Embodiment Mode 17.

A description is made on the timing and conditions for proceeding from the normal driving period to the burn-in correction period with reference to a flow chart of FIG. 21, to which Embodiment Modes 1 to 3 are applied. In the flow chart, a rectangular box represents a process and a diamond-shaped box represents a decision.

In this embodiment mode, the process of "normal driving period", the process of "burn-in correction period", and the decision of "start of operation" are similar to those in Embodiment Mode 4. The decision of "termination of set pixels" is similar to that in Embodiment Mode 7. The decision of "set luminance" is similar to that in Embodiment Mode 8. The decision of "user decision" is similar to that in Embodiment Mode 12.

A description is made on the flow of a flow chart of FIG. 21. In the "user decision", if the user does not determine that the process proceeds to the "burn-in correction period", the process proceeds to the "normal driving period, whereas the process proceeds to the "set luminance" if the user determines that the process proceeds to the "burn-in correction period". If the surrounding luminance is not in the predetermined range in the "set luminance", the process proceeds to the "normal driving period", whereas the process proceeds to the "burn-in correction period" if the surrounding luminance is in the predetermined range. When the process proceeds to the "burn-in correction period", operations described in the burn-in correction period in Embodiment Modes 1 to 3 are carried out, and then, the process proceeds to the "termination of set pixels". If characteristics of light-emitting elements included in the preset pixels are obtained in the "termination of set pixels", the process proceeds to the "normal driving period", whereas the process proceeds to the "set luminance" if the characteristics of light-emitting elements included in the preset pixels are not obtained. If the surrounding luminance is not in the predetermined range in the "set luminance", the process proceeds to the "normal driving period", whereas the process proceeds to the "start of operation" if the surrounding luminance is in the predetermined range. If the user starts operation in the "start of operation", the process proceeds to the "normal driving period", whereas the process proceeds to the "burn-in correction period" if the user has not started operation.

By adding the "user decision" to the conditions for proceeding from the normal driving period to the burn-in correction period, the user can decide whether the process proceeds to the burn-in correction period or not. Therefore, the decision of proceeding to the burn-in correction period is made to suit each user since frequency of using the electronic appliance or the like and the display screen or the like thereof are different depending on users.

By adding the "set luminance" to the conditions for proceeding from the normal driving period to the burn-in correction period, the process can proceed to the burn-in correction period without being effected by the surrounding luminance. In Embodiment Modes 1 to 3, one pixel or three pixels emit light at the same time and driving TFTs in the other pixels which do not emit light are in off state. Therefore, off-state current changes according to the surrounding luminance, which leads to variation in detected current value. By detecting the characteristics of the light-emitting elements included in the pixels when the surrounding luminances are the same, the effect of changes in surrounding luminance is eliminated. The surrounding luminance is preferably about 0 [cd/m$^2$]. In the case of a foldable mobile phone, such a state can be realized when the foldable mobile phone is folded and in the case of a digital camera, such a state can be realized when the digital camera is placed in its case.

By adding the "termination of set pixels" to the conditions for proceeding from the burn-in correction period to the normal driving period, the process can proceed to the normal driving period without interrupting the burn-in correction period. In addition, it is possible that the process proceeds to the burn-in correction period selectively in a portion in which burn-in is supposed to be easily generated.

By adding the "set luminance" to the conditions for proceeding from the burn-in correction period to the normal driving period, the process can proceed to the normal driving period immediately when the surrounding luminance changes during the burn-in correction period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "set luminance" and the "start of operation", the burn-in correction period finishes before characteristics of the light-emitting elements included in the preset pixels are detected. In this case, the characteristics of light-emitting elements included in pixels which are not detected in the last burn-in correction period may be detected in the next burn-in correction period.

Figure 74:
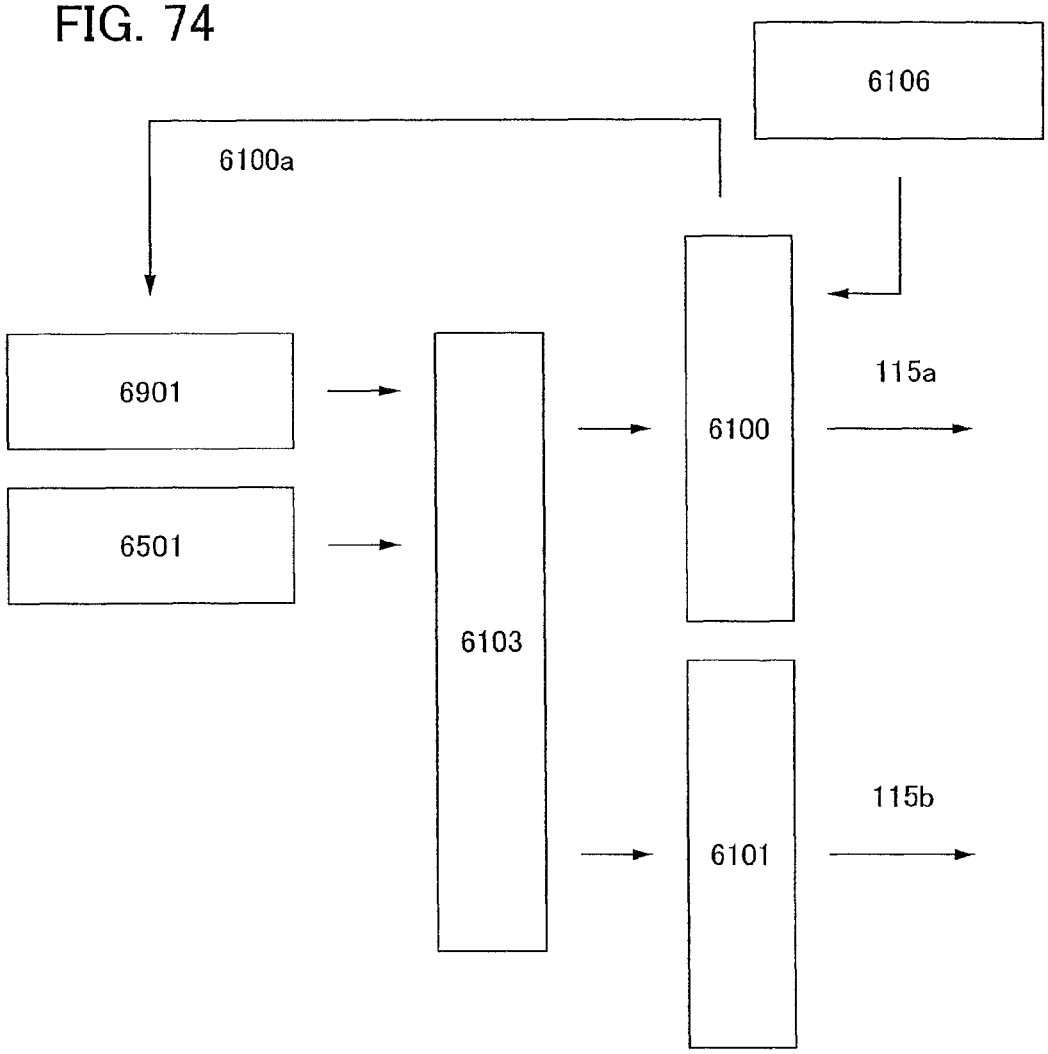
FIG. 74 shows a display device of Embodiment Mode 17.

A description is made on the structure and operation of the controller 115 for realizing the flow chart of FIG. 21 described in this embodiment mode, with reference to FIG. 74.

In this embodiment mode, the image signal generation circuit 6100, the current value detection control signal generation circuit 6101, and the driving method selection circuit 6103 are similar to those in Embodiment Mode 4. The detection pixel set circuit 6106 is similar to that in Embodiment Mode 5. The surrounding luminance detection circuit 6501 is similar to that in Embodiment Mode 8. The start circuit 6901 is similar to that in Embodiment Mode 12.

A description is made on operation in this embodiment mode. When the user determines that the process proceeds to the burn-in correction period and the surrounding luminance detection circuit 6501 decides that the surrounding luminance of the display device is close to the predetermined luminance, the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of the pixels set by the detection pixel set circuit 6106, the reset signals are inputted to the start circuit 6901. In this embodiment mode, between "the normal driving period" and "the burn-in correction period", the judgment of "passage of user decision", the judgment of "set luminance", the judgment of "termination of set pixels", and the judgment of "start of operation" are conducted, the present invention can operate by conducting at least one of the judgment of "passage of user decision", the judgment of "set luminance", the judgment of "termination of set pixels", and the judgment of "start of operation". That is, for example, between "the normal driving period" and "the burn-in correction period", the judgment of "user decision" and "set luminance" are conducted. In this case, the operation is conducted by using at least the start circuit 6901, the surrounding luminance detection circuit 6501 and the driving method selection circuit 6103.

[Embodiment Mode 18]

Figure 22:
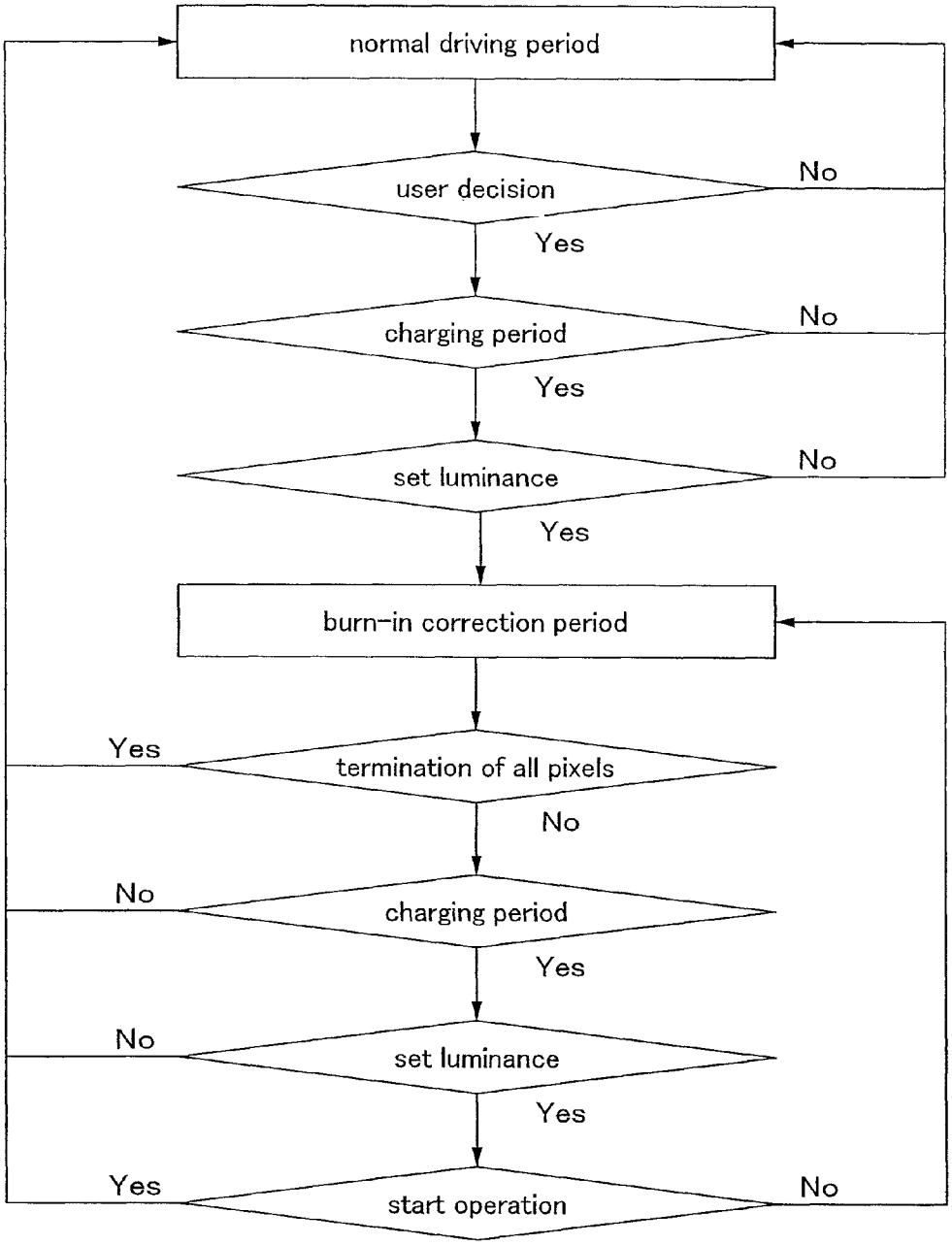
FIG. 22 shows a display device of Embodiment Mode 18.

A description is made on the timing and conditions with which the process proceeds from the normal driving period to the burn-in correction period with reference to a flow chart of FIG. 22, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "charging period", the decision of "termination of all pixels", and the decision of "start of operation" are similar to those in Embodiment Mode 4. The decision of "set luminance" is similar to that in Embodiment Mode 8. The decision of "user decision" is similar to that in Embodiment Mode 12.

A description is made on the flow of a flow chart of FIG. 22. In the "user decision", if the user does not determine that the process proceeds to the "burn-in correction period", the process proceeds to the "normal driving period, whereas the process proceeds to the "charging period" if the user determines that the process proceeds to the "burn-in correction period". If a battery is not charged in the "charging period", the process proceeds to the "normal driving period", whereas the process proceeds to the "set luminance" if the battery is charged. If the surrounding luminance is not in the predetermined range in the "set luminance", the process proceeds to the "normal driving period", whereas the process proceeds to the "burn-in correction period" if the surrounding luminance is in the predetermined range. When the process proceeds to the "burn-in correction period", operations described in the burn-in correction period in Embodiment Modes 1 to 3 are carried out, and then, the process proceeds to the "termination of all pixels". If characteristics of light-emitting elements included in all pixels are obtained in the "termination of all pixels", the process proceeds to the "normal driving period", whereas the process proceeds to the "charging period" if the characteristics of light-emitting elements included in all pixels are not obtained. If the battery is not charged in the "charging period", the process proceeds to the "normal driving period", whereas the process proceeds to the "set luminance" if the battery is charged. If the surrounding luminance is not in the predetermined range in the "set luminance", the process proceeds to the "normal driving period", whereas the process proceeds to the "start of operation" if the surrounding luminance is in the predetermined range. If the user starts operation in the "start of operation", the process proceeds to the "normal driving period", whereas the process proceeds to the "burn-in correction period" if the user has not started operation.

By adding the "user decision" to the conditions for proceeding from the normal driving period to the burn-in correction period, the user can decide whether the process proceeds to the burn-in correction period or not. Therefore, the decision of proceeding to the burn-in correction period is made to suit each user since frequency of using the electronic appliance or the like and the display screen or the like thereof are different depending on users.

By adding the "charging period" to the conditions for proceeding from the normal driving period to the burn-in correction period, the process can proceed to the burn-in correction period while charging the battery. In the burn-in correction period, light-emitting elements included in pixels emit light, so that characteristics of the light-emitting elements are stored as described in Embodiment Modes 1 to 3. Therefore, power consumption therein is large. Proceeding to the burn-in correction period while charging the battery can prevent reduction in power of the battery due to the burn-in correction period. Besides, when charging the battery, it is highly possible that the user has finished using the electronic appliance or the like and it is unlikely that the process returns to the normal driving period.

By adding the "set luminance" to the conditions for proceeding from the normal driving period to the burn-in correction period, the process can proceed to the burn-in correction period without being effected by the surrounding luminance. In Embodiment Modes 1 to 3, one pixel or three pixels emit light at the same time and driving TFTs in the other pixels which do not emit light are in off state. Therefore, off-state current changes according to the surrounding luminance, which leads to variation in detected current value. By detecting the characteristics of the light-emitting elements included in the pixels when the surrounding luminances are the same, the effect of changes in surrounding luminance is eliminated. The surrounding luminance is preferably about 0 [cd/m$^2$]. In the case of a foldable mobile phone, such a state can be realized when the foldable mobile phone is folded and in the case of a digital camera, such a state can be realized when the digital camera is placed in its case.

By adding the "termination of all pixels" to the conditions for proceeding from the burn-in correction period to the normal driving period, characteristics of the light-emitting elements included in all pixels can be detected under the same conditions. When the conditions under which characteristics of the light-emitting elements included in pixels are detected, that is, when the operating environments are the same, variation in characteristics due to difference in the operating environments can be suppressed.

By adding the "set luminance" to the conditions for proceeding from the burn-in correction period to the normal driving period, the process can proceed to the normal driving period immediately when the surrounding luminance changes during the burn-in correction period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "charging period", the "set luminance", and the "start of operation", the burn-in correction period finishes before characteristics of the light-emitting elements included in the all pixels are detected. In this case, the characteristics of light-emitting elements included in pixels which are not detected in the last burn-in correction period may be detected in the next burn-in correction period.

Figure 75:
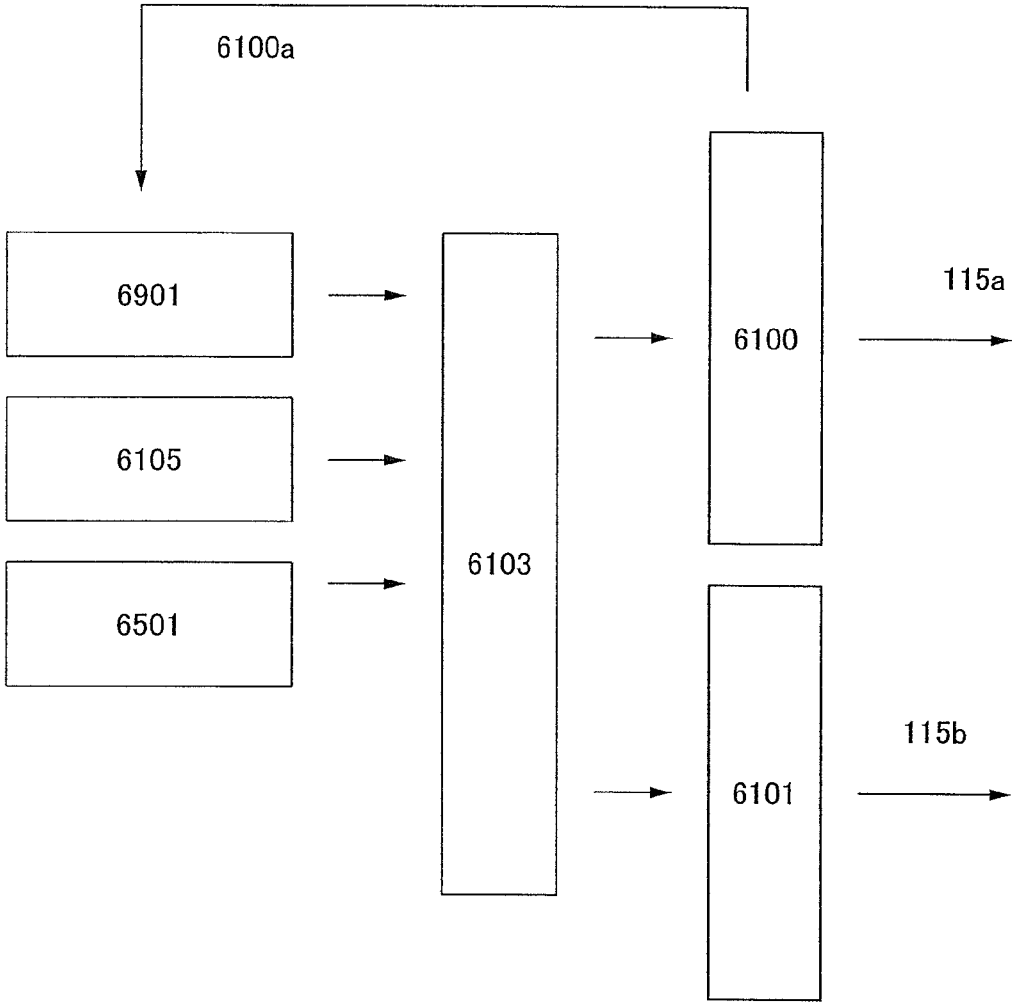
FIG. 75 shows a display device of Embodiment Mode 18.

A description is made on the structure and operation of the controller 115 for realizing the flow chart of FIG. 22 described in this embodiment mode, with reference to FIG. 75.

In this embodiment mode, the image signal generation circuit 6100, the current value detection control signal generation circuit 6101, the driving method selection circuit 6103, and the charging unit detection circuit 6105 are similar to those in Embodiment Mode 4. The surrounding luminance detection circuit 6501 is similar to that in Embodiment Mode 8. The start circuit 6901 is similar to that in Embodiment Mode 12.

A description is made on operation in this embodiment mode. When the user determines that the process proceeds to the burn-in correction period, and the predetermined time has passed from the input of the reset signals to the start circuit 6901, that is, after the predetermined time has passed from the end of the last burn-in correction period, and the surrounding luminance detection circuit 6501 decides that the surrounding luminance of the display device is close to the predetermined luminance; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of all pixels, the reset signals 6100*a* are inputted to the start circuit 6901. In this embodiment mode, between "the normal driving period" and "the burn-in correction period", the judgment of "passage of user decision", the judgment of "charging period", the judgment of "set luminance", the judgment of "termination of all pixels", and the judgment of "start of operation2 are conducted, the present invention can operate by conducting at least one of the judgment of "passage of user decision", the judgment of "charging period", the judgment of "set luminance", the judgment of "termination of all pixels", and the judgment of "start of operation". That is, for example, between "the normal driving period" and "the burn-in correction period", the judgment of "user decision", the judgment of "charging period" and "set luminance" are conducted. In this case, the operation is conducted by using at least the start circuit 6901, the charging unit detection circuit 6105 and the driving method selection circuit 6103.

[Embodiment Mode 19]

Figure 23:
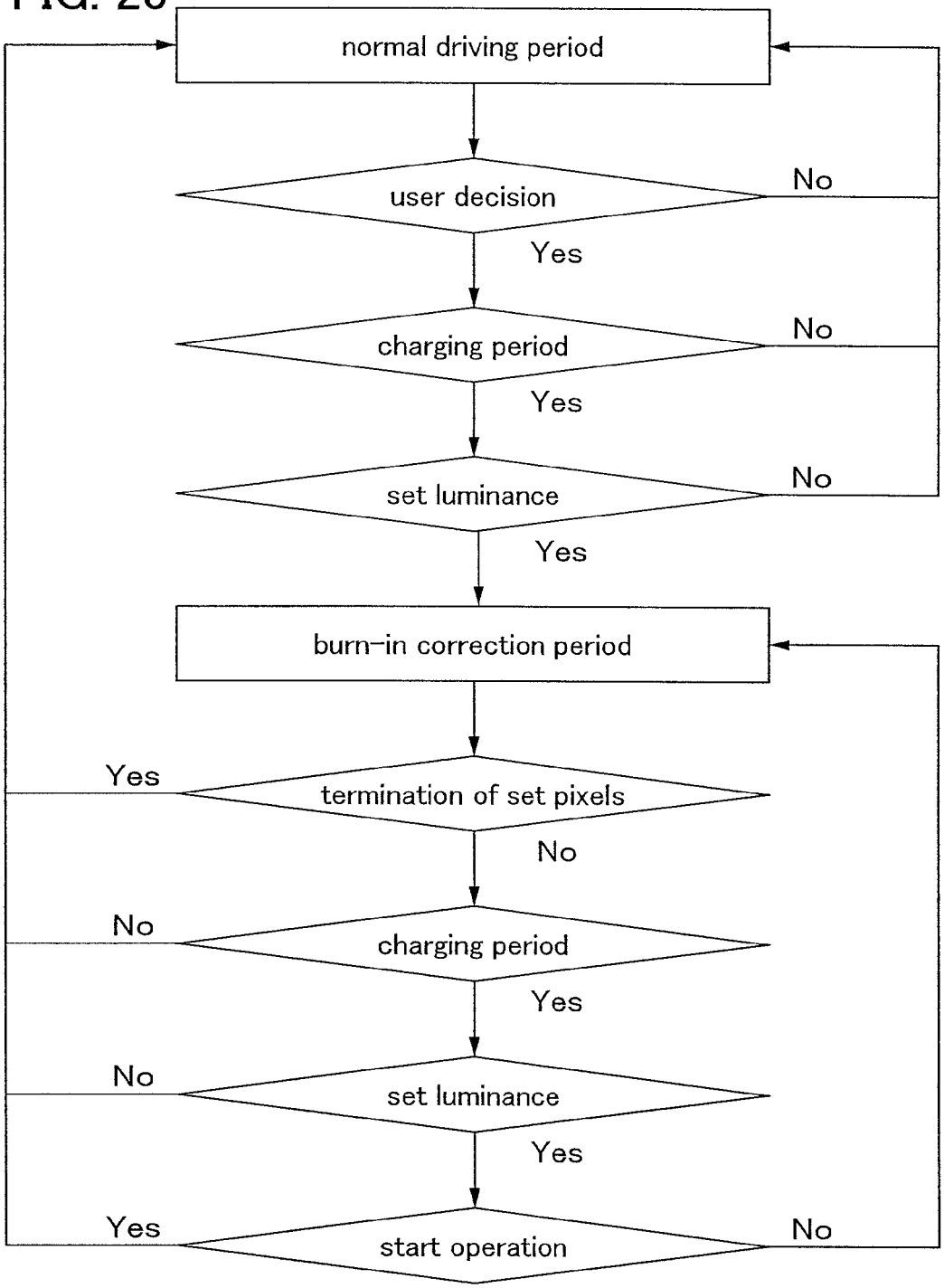
FIG. 23 shows a display device of Embodiment Mode 19.

A description is made on the timing and conditions for proceeding from the normal driving period to the burn-in correction period with reference to a flow chart of FIG. 23, to which Embodiment Modes 1 to 3 are applied. In the flow chart, a rectangular box represents a process and a diamond-shaped box represents a decision.

In this embodiment mode, the process of "normal driving period", the process of "burn-in correction period", the decision of "charging period", the decision of "termination of all pixels", and the decision of "start of operation" are similar to those in Embodiment Mode 4. The decision of "termination of set pixels" is similar to that in Embodiment Mode 7. The decision of "set luminance" is similar to that in Embodiment Mode 8. The decision of "user decision" is similar to that in Embodiment Mode 12.

A description is made on the flow of the flow chart of FIG. 23. In the "user decision", if the user does not determine that the process proceeds to the "burn-in correction period", the process proceeds to the "normal driving period, whereas the process proceeds to the "charging period" if the user determines that the process proceeds to the "burn-in correction period". If a battery is not charged in the "charging period", the process proceeds to the "normal driving period", whereas the process proceeds to the "set luminance" if the battery is charged. If the surrounding luminance is not in the predetermined range in the "set luminance", the process proceeds to the "normal driving period", whereas the process proceeds to the "burn-in correction period" if the surrounding luminance is in the predetermined range. When the process proceeds to the "burn-in correction period", operations described in the burn-in correction period in Embodiment Modes 1 to 3 are carried out, and then, the process proceeds to the "termination of set pixels". If characteristics of light-emitting elements included in the preset pixels are obtained in the "termination of set pixels", the process proceeds to the "normal driving period", whereas the process proceeds to the "charging period" if the characteristics of light-emitting elements included in the preset pixels are not obtained. If the battery is not charged in the "charging period", the process proceeds to the "normal driving period", whereas the process proceeds to the "set luminance" if the battery is charged. If the surrounding luminance is not in the predetermined range in the "set luminance", the process proceeds to the "normal driving period", whereas the process proceeds to the "start of operation" if the surrounding luminance is in the predetermined range. If the user starts operation in the "start of operation", the process proceeds to the "normal driving period", whereas the process proceeds to the "burn-in correction period" if the user has not started operation.

By adding the "user decision" to the conditions for proceeding from the normal driving period to the burn-in correction period, the user can decide whether the process proceeds to the burn-in correction period or not. Therefore, the decision of proceeding to the burn-in correction period is made to suit each user since frequency of using the electronic appliance or the like and the display screen or the like thereof are different depending on users.

By adding the "charging period" to the conditions for proceeding from the normal driving period to the burn-in correction period, the process can proceed to the burn-in correction period while charging the battery. In the burn-in correction period, light-emitting elements included in pixels emit light, so that characteristics of the light-emitting elements are stored as described in Embodiment Modes 1 to 3. Therefore, power consumption therein is large. Proceeding to the burn-in correction period while charging the battery can prevent reduction in power of the battery due to the burn-in correction period. Besides, when charging the battery, it is highly possible that the user has finished using the electronic appliance or the like and it is unlikely that the process returns to the normal driving period.

By adding the "set luminance" to the conditions for proceeding from the normal driving period to the burn-in correction period, the process can proceed to the burn-in correction period without being effected by the surrounding luminance. In Embodiment Modes 1 to 3, one pixel or three pixels emit light at the same time and driving TFTs in the other pixels which do not emit light are in off state. Therefore, off-state current changes according to the surrounding luminance, which leads to variation in detected current value. By detecting the characteristics of the light-emitting elements included in the pixels when the surrounding luminances are the same, the effect of changes in surrounding luminance is eliminated. The surrounding luminance is preferably about 0 [cd/m$^2$]. In the case of a foldable mobile phone, such a state can be realized when the foldable mobile phone is folded and in the case of a digital camera, such a state can be realized when the digital camera is placed in its case.

By adding the "termination of set pixels" to the conditions for proceeding from the burn-in correction period to the normal driving period, the process can proceed to the normal driving period without interrupting the burn-in correction period. In addition, it is possible that the process proceeds to the burn-in correction period selectively in a portion in which burn-in is supposed to be easily generated.

By adding the "set luminance" to the conditions for proceeding from the burn-in correction period to the normal driving period, the process can proceed to the normal driving period immediately when the surrounding luminance changes during the burn-in correction period.

By adding the "start of operation" to the conditions for proceeding from the burn-in correction period to the normal driving period, the process can proceed immediately to the normal driving period when the user is going to use the electronic appliance or the like.

If the process proceeds to the normal driving period from the burn-in correction period via the "charging period", the "set luminance", and the "start of operation", the burn-in correction period finishes before characteristics of the light-emitting elements included in the preset pixels are detected. In this case, the characteristics of light-emitting elements included in pixels which are not detected in the last burn-in correction period may be detected in the next burn-in correction period.

Figure 76:
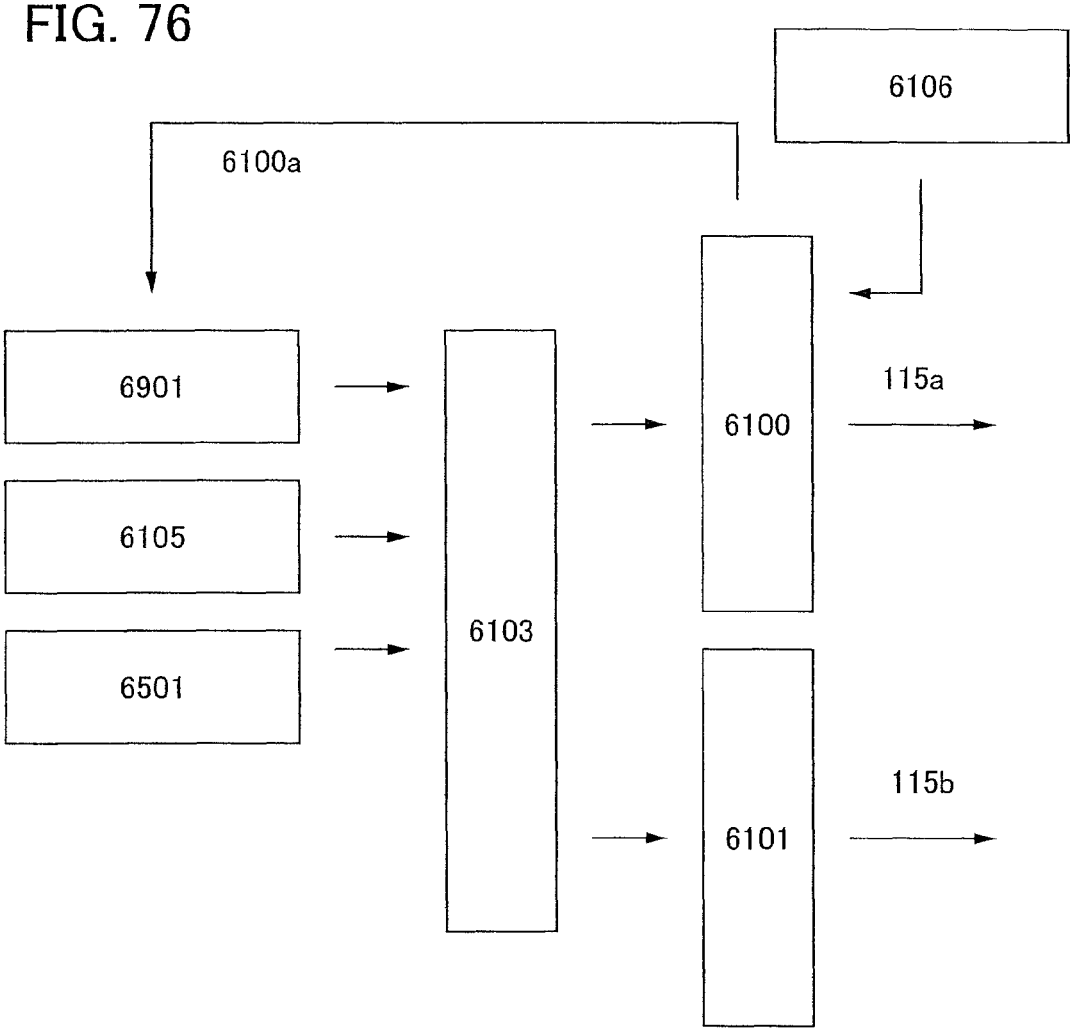
FIG. 76 shows a display device of Embodiment Mode 19.

A description is made on the structure and operation of the controller 115 for realizing the flow chart of FIG. 22 described in this embodiment mode, with reference to FIG. 76.

In this embodiment mode, the image signal generation circuit 6100, the current value detection control signal generation circuit 6101, the driving method selection circuit 6103, and the charging unit detection circuit 6105 are similar to those in Embodiment Mode 4. The detection pixel set circuit 6106 is similar to that in Embodiment Mode 5. The surrounding luminance detection circuit 6501 is similar to that in Embodiment Mode 8. The start circuit 6901 is similar to that in Embodiment Mode 12.

A description is made on operation in this embodiment mode. When the user determines that the process proceeds to the burn-in correction period, and the predetermined time has passed from the input of the reset signals to the start circuit 6901, that is, after the predetermined time has passed from the end of the last burn-in correction period, and the surrounding luminance detection circuit 6501 decides that the surrounding luminance of the display device is close to the predetermined luminance; the driving method selection circuit 6103 controls the image signal generation circuit 6100 and the current value detection control signal generation circuit 6101 to conduct operation of the burn-in correction period. Then, the image signal generation circuit 6100 and the current value detection control signal generation circuit 6101 control the correction circuit 114 and the current value detection circuit 113 to conduct operation of the burn-in correction period, respectively. In other cases, the driving method selection circuit 6103 controls the image signal generation circuit 6100 and the current value detection control signal generation circuit 6101 to conduct operation of the normal driving period. Then, the image signal generation circuit 6100 and the current value detection control signal generation circuit 6101 control the correction circuit 114 and the current value detection circuit 113 to conduct operation of the normal driving period, respectively. After detection of characteristics of the pixels set by the detection pixel set circuit 6106, the reset signals 6100*a* are inputted to the start circuit 6901. In this embodiment mode, between "the normal driving period" and "the burn-in correction period", the judgment of "passage of user decision", the judgment of "charging period", the judgment of "set luminance", the judgment of "termination of set pixels", and the judgment of "start of operation" are conducted, the present invention can operate by conducting at least one of the judgment of "passage of user decision", the judgment of "charging period", the judgment of "set luminance", the judgment of "termination of set pixels", and the judgment of "start of operation". That is, for example, between "the normal driving period" and "the burn-in correction period", the judgment of "user decision", the judgment of "charging period" and "set luminance" are conducted. In this case, the operation is conducted by using at least the start circuit 6901, the charging unit detection circuit 6105 and the driving method selection circuit 6103.

[Embodiment Mode 20]

A description is made on some of the driving conditions in Embodiment Modes 1 to 3. That is, the difference in the driving conditions between the normal driving period and the burn-in correction period is described.

First, the relations among potentials of the power supply line R105, the power supply line G106, the power supply line B107, and the counter electrode 108 in the burn-in correction period are described.

In the case where the process proceeds to the burn-in correction period from the normal driving period, if the potentials of the power supply line R105, power supply line G106, power supply line B107, and the counter electrode 108 are the same in the normal driving period and in the burn-in correction period, a new power source for the burn-in correction period is not required. Therefore, the size of the circuit can be small.

In the case where the process proceeds to the burn-in correction period from the normal driving period, if the potentials of the power supply line R105, power supply line G106, and power supply line B107 are lowered and that of the counter electrode 108 is kept the same, voltage applied to light-emitting elements included in pixels can be lowered. Therefore, deterioration in light-emitting elements included in pixels due to the burn-in correction period can be prevented and power consumption in the burn-in correction period can be reduced.

In the case where the process proceeds to the burn-in correction period from the normal driving period, if the potentials of the power supply line R105, power supply line G106, and power supply line B107 are heightened and that of the counter electrode 108 is kept the same, voltage applied to light-emitting elements included in pixels can be heightened. Therefore, current of a power supply line can be heightened when characteristics of light-emitting elements included in pixels are obtained in the burn-in correction period. The current value of the power supply line in the burn-in correction period is small and it may be lost in the noise. When the current is increased, it is not lost in the noise and accurate current can be detected. Note that the same effect can be obtained when the potential of the power supply line R105, power supply line G106, and power supply line B107 are kept the same and the counter electrode 108 is lowered.

Next, a description is made on the difference of driving frequency in the burn-in correction period. In the case where the process proceeds to the burn-in correction period from the normal driving period, if the driving frequency is the same in the normal driving period and in the burn-in correction period, a new clock period for the burn-in correction period is not required. Therefore, the size of the circuit can be small.

In the case where the process proceeds to the burn-in correction period from the normal driving period, if the driving frequency is lowered, a time for detecting a current value of each pixel can be set longer. Therefore, video signals can be inputted to pixels with accuracy. Light-emitting elements included in pixels move to a steady state from a transient state. Therefore, it is preferable that a current value be detected when the characteristics of the light-emitting elements included in the pixels are in a steady state in order to detect a current value of each pixel with accuracy. When the driving frequency is lowered, characteristics of pixels included in the light-emitting element can be detected in a sufficient steady state.

In the case where the process proceeds to the burn-in correction period from the normal driving period, if the driving frequency is heightened, a time for detecting a current value of each pixel can be shortened and the burn-in correction period can be shortened. Thus, it becomes less likely that the process proceeds to the normal driving period before characteristics of light-emitting elements included in all pixels or preset pixels are detected.

[Embodiment Mode 21]

Figure 47:
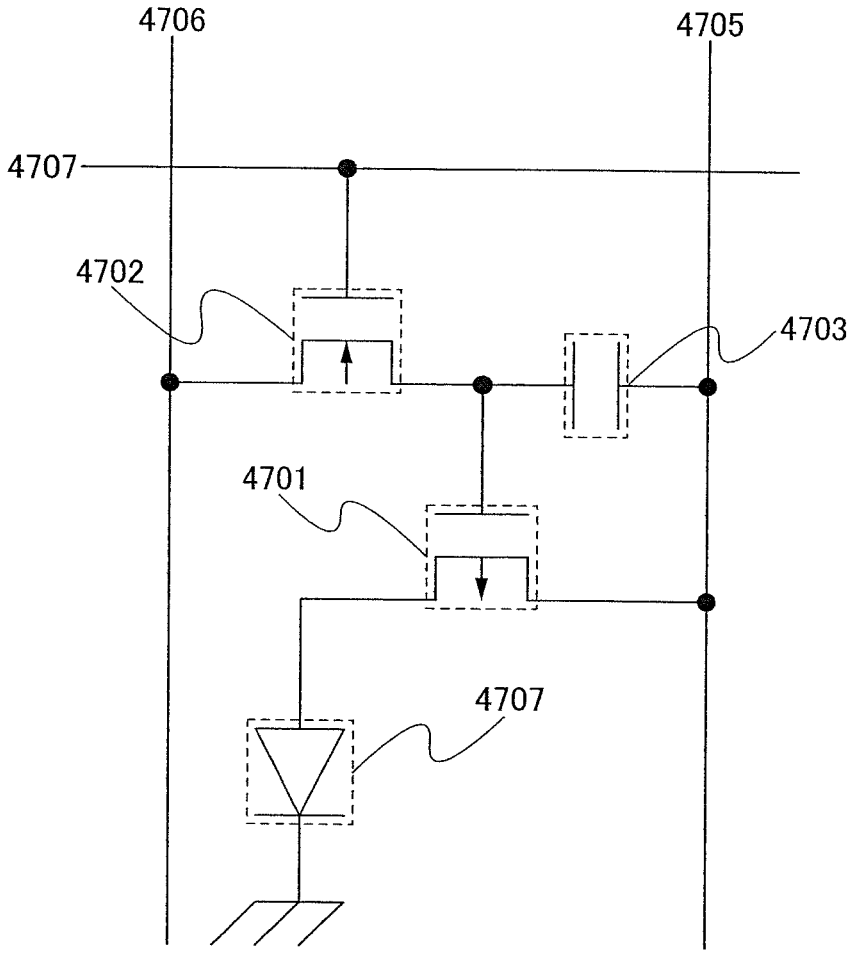
FIG. 47 shows a display device of Embodiment Mode 21.

A description is made on an example of the structure of the pixel 109 described in Embodiment Modes 1 to 3 with reference to FIG. 47. As for the structures of the parts other than the pixel 109, structures which can satisfy a pixel structure and a driving method described in this embodiment mode can be employed.

On or off of a selection transistor 4702 is controlled using the gate signal line 4707. When the selection transistor 4702 turns on, video signals are inputted to a capacitor 4703 from a source signal line 4706. Then, a driving transistor 4701 turns on/off according to the video signals. When the driving transistor 4701 turns on, current flows from a power supply line 4705 to a counter electrode through the driving transistor 4701 and a light-emitting element 4704. When the driving transistor 4701 turns off, current does not flow. Note that one electrode of the light-emitting element 4704 is connected to either a source or a drain of the driving transistor 4701, and the other electrode of the light-emitting element 4704 serves as the counter electrode.

Above driving method is digital driving in which a video signal has a binary value and the driving transistor 4701 serves as a switch. In digital driving, the driving transistor 4701 can operate in a linear region or a saturation region. When the driving transistor 4701 operates in a linear region, the potential of the power supply line 4705 is applied to one electrode of the light-emitting element 4704 almost as it is. When the driving transistor 4701 operates in a saturation region, current according to a gate-source voltage of the driving transistor 4701 flows.

In this embodiment mode, analog driving can be employed as well as digital driving. In digital driving, a video signal has a binary value while in analog driving, a video signal is required to have the same number of values as the number of gray scales to be expressed. By driving the driving transistor 4701 in a saturation region and changing the gate voltage of the driving transistor according to the video signals, current according to the video signals can be applied to the light-emitting element 4704.

Note that the capacitor 4703 holds a gate potential of the driving transistor 4701. Therefore, the capacitor 4703 is connected between a gate of the driving transistor 4701 and the power supply line 4705; however, the present invention is not limited thereto. The capacitor 4703 is only required to be disposed so as to be able to hold the gate potential of the driving transistor 4701. In a case where the gate potential of the driving transistor 4701 can be held using the gate capacitance of the driving transistor 4701 or the like, the capacitor 4703 may be omitted.

The selection transistor 4702 serves as a switch connected between the source signal line 4706 and the gate of the driving transistor 4701. In FIG. 47, an n-channel transistor is used as the selection transistor 4702; however, the present invention is not limited thereto. Any element having a function of connecting/disconnecting the source signal line 4706 and the gate of the driving transistor 4701 may be employed. Therefore, a p-channel transistor may be employed. In that case, a potential of the gate signal line 4707 is inverted.

[Embodiment Mode 22]

Figure 50:
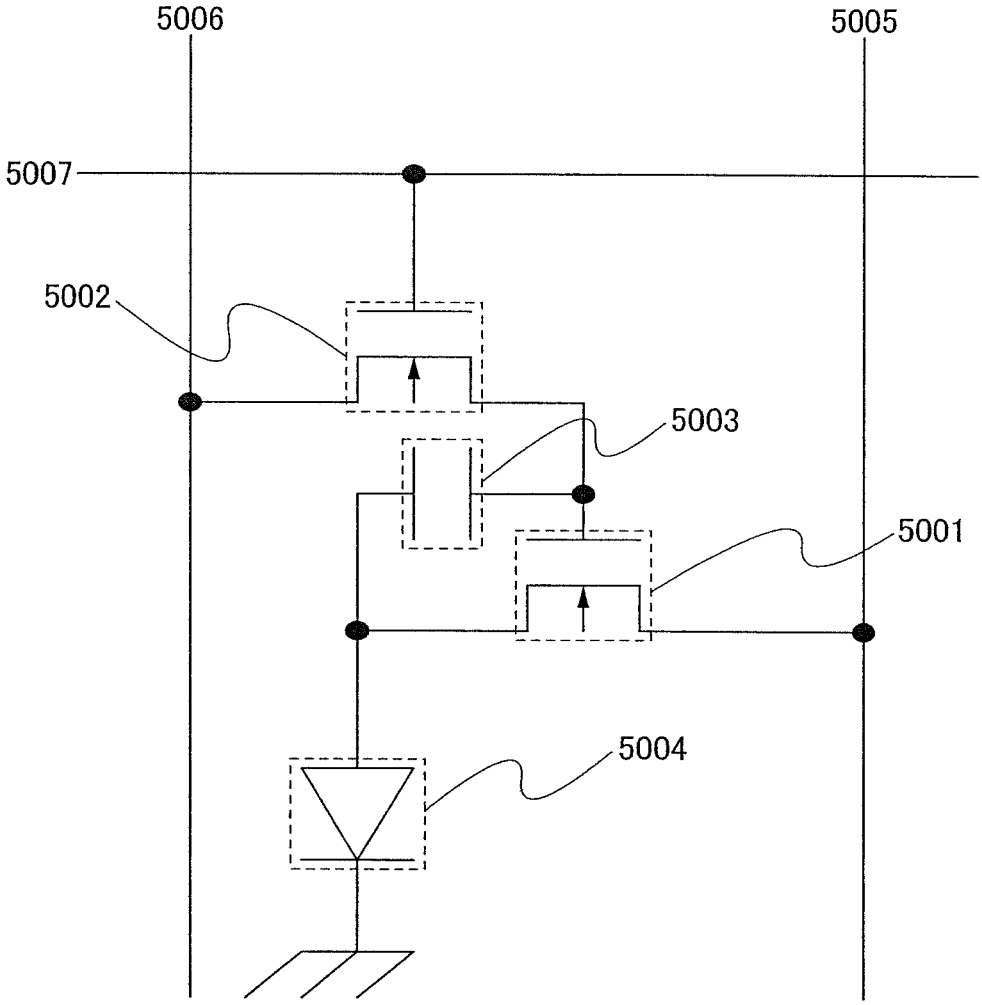
FIG. 50 shows a display device of Embodiment Mode 22.

A description is made on an example of a structure of the pixel 109 described in Embodiment Modes 1 to 3 with reference to FIG. 50. As for the structures of the parts other than the pixel 109, structures which can satisfy a pixel structure and a driving method described in this embodiment mode can be employed.

On or off of a selection transistor 5002 is controlled using the gate signal line 5007. When the selection transistor 5002 turns on, video signals are inputted to a capacitor 5003 from a source signal line 5006. Then, a driving transistor 5001 turns on/off according to the video signals. When the driving transistor 5001 turns on, current flows from a power supply line 5005 to a counter electrode through the driving transistor 5001 and a light-emitting element 5004. When the driving transistor 5001 turns off, current does not flow. Note that one electrode of the light-emitting element 5004 is connected to either a source or a drain of the driving transistor 5001, and the other electrode of the light-emitting element 5004 serves as a counter electrode.

Above driving method is digital driving in which a video signal has a binary value and the driving transistor 5001 serves as a switch. In digital driving, the driving transistor 5001 can operate in a linear region or a saturation region. When the driving transistor 5001 operates in a linear region, the potential of the power supply line 5005 is applied to one electrode of the light-emitting element 5004 almost as it is. When the driving transistor 5001 operates in a saturation region, current according to a gate-source voltage flows.

In this embodiment mode, analog driving can be employed as well as digital driving. In digital driving, a video signals has a binary value while in analog driving, a value signal is required to have the same number of values as the number of gray scales to be expressed. By driving the driving transistor 5001 in a saturation region and changing the gate voltage of the driving transistor according to the video signals, current according to the video signals can be applied to the light-emitting element 5004.

Note that the capacitor 5003 holds the gate potential of the driving transistor 5001. Therefore, the capacitor 5003 is connected between a gate of the driving transistor 5001 and one electrode of the light-emitting element 5004; however, the present invention is not limited thereto. The capacitor 5003 is only required to be disposed so as to be able to store the gate potential of the driving transistor 5001. In a case where the gate potential of the driving transistor 5001 can be held using the gate capacitance of the driving transistor 5001 or the like, the capacitor 5003 may be omitted.

In this embodiment mode, both the selection transistor 5002 and the driving transistor 5001 are n-channel transistors. With such a structure, amorphous silicon can be used, so that a low cost and a large screen can be easily realized. Note that there are problems with amorphous silicon such that a transistor is deteriorated, that is, the characteristics of the transistor change with time, which is called a threshold value shift. To solve such a phenomenon, it is necessary to employ a pixel structure in which a threshold value is corrected or a pixel structure in which video signals are inputted as current. However, when employing a pixel structure in which a threshold value is corrected, there arise other problems such that the number of transistors increases and so the aperture ratio of pixels is lowered, or a potential of the power supply line 5005 or the counter electrode is lowered, which leads to reduction in duty ratio of the light-emitting element 5004. The reduction in aperture ratio and duty ratio requires increase in luminance of the light-emitting element 5004. Therefore, the light-emitting element deteriorates earlier and the lifetime of the display device is shortened. On the other hand, when the driving method of Embodiment Modes 1 to 3 of the present invention is employed, change in characteristics of the driving transistor 5001 can be corrected as well as the deterioration in light-emitting element 5004, at the same time. Note that duty ratio represents a driving condition of a light-emitting element, and which is a ratio of a light-emitting period to a certain period (including either or both light-emitting period and non-light-emitting period).

Therefore, combination of the driving method in Embodiment Modes 1 to 3 and a pixel structure using amorphous silicon can cause further effect. Besides, since a controller for driving a display device using amorphous silicon is generally externally provided, and the display device using amorphous silicon often has a large or medium size, so that a rate of cost for implementing the present invention to the cost for the whole display device is low when implementing the present invention in such a display device, as compared with implementing the present invention in a mobile phone or a digital camera.

[Embodiment Mode 23]

In a case of digital driving, only a binary value of a light-emitting state and a non-light-emitting state can be expressed as described in Embodiment Modes 21 and 22. Accordingly, another method may be used in combination to achieve multi-gray scale. A driving method for a pixel in the case where multi-gray scale is achieved is described.

To achieve multi-gray scale, a time gray scale method can be given. The time gray scale method is a method for expressing a gray scale by changing the length of light-emitting time during a certain period. In a digital time gray scale method, one-frame period is divided into a plurality of sub-frame periods. Then, a gray scale is expressed by changing the length of a lighting period during each sub-frame period.

Figure 53:
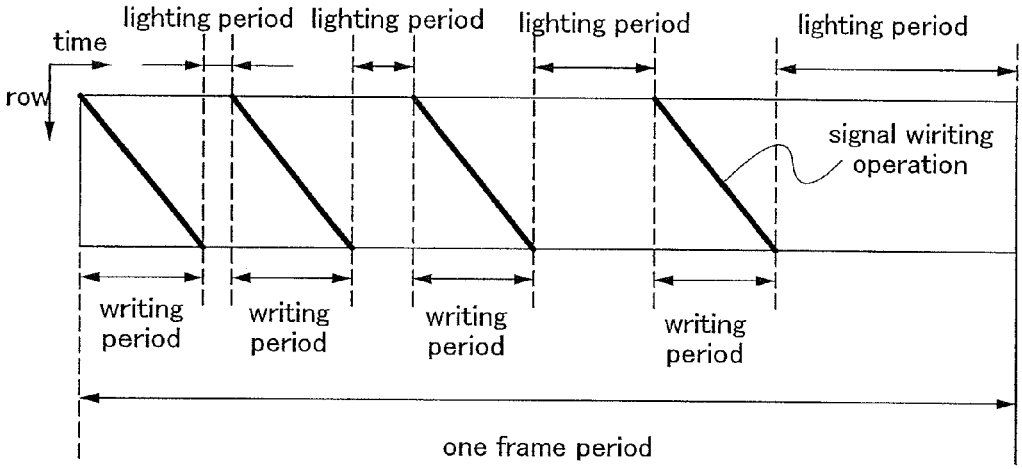
FIG. 53 shows a display device of Embodiment Mode 23.

FIG. 53 shows a timing chart in a case where a period where signals are written to a pixel (a writing period) and a period where light is emitted (a lightening time) are separated. First, signals for one screen are inputted to all pixels in a writing period. During this period, pixels do not emit light. After the writing period, a lighting period starts and pixels emit light. Next, a next sub-frame starts and signals for one screen are inputted to all pixels in a writing period. During this period, pixels do not emit light. After the writing period, a lighting period starts and pixels emit light.

In this case, a pixel structure shown in FIGS. 47 and 50 may be employed.

In a writing period, it is necessary that charge is not supplied to the light-emitting element or negative bias is applied to the light-emitting element. Specifically, potentials of the power supply line 4705, the power supply line 5005, and a counter electrode are controlled, so that positive bias is not supplied to the light-emitting element 4704 and the light-emitting element 5004. Alternatively, the counter electrode may be in a floating state without being supplied with charge. As a result, the light-emitting element 4704 and the light-emitting element 5004 can be prevented from lighting in the writing period.

Figure 54:
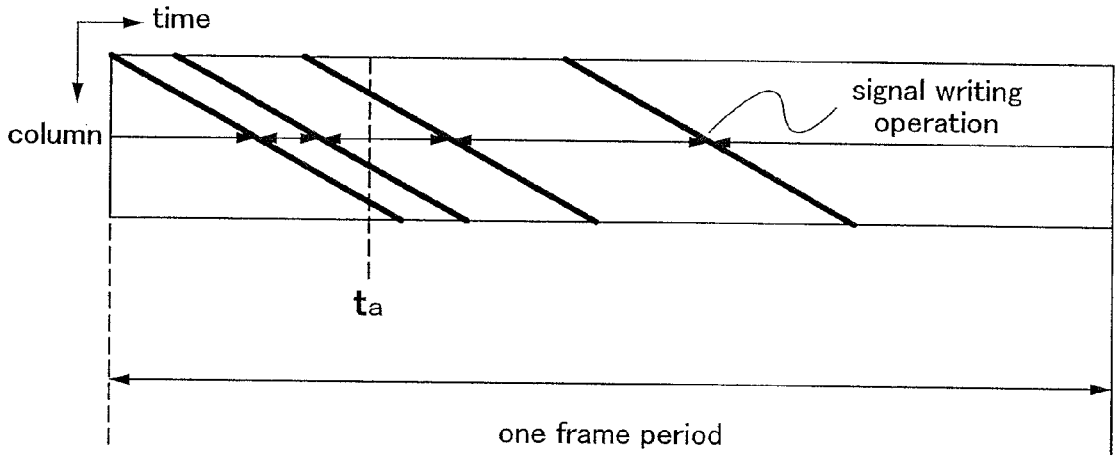
FIG. 54 shows a display device of Embodiment Mode 23.

Next, FIG. 54 shows a timing chart in a case where a period in which a signal is written to a pixel and a period in which light is emitted are not separated. Immediately after a signal is written to each row, a lighting period starts.

In a certain row, after writing of signals and a predetermined lighting period are completed, a signal writing operation starts in a next sub-frame. By repeating such operations, each length of the lighting periods can be controlled.

In this manner, many sub-frames can be arranged in one frame even if signals are written slowly. In addition, since a ratio of a lighting period to one-frame period (a so-called duty ratio) can be high, it is possible to reduce power consumption, suppress deterioration of the light-emitting element, or suppress a pseudo contour.

Figure 56:
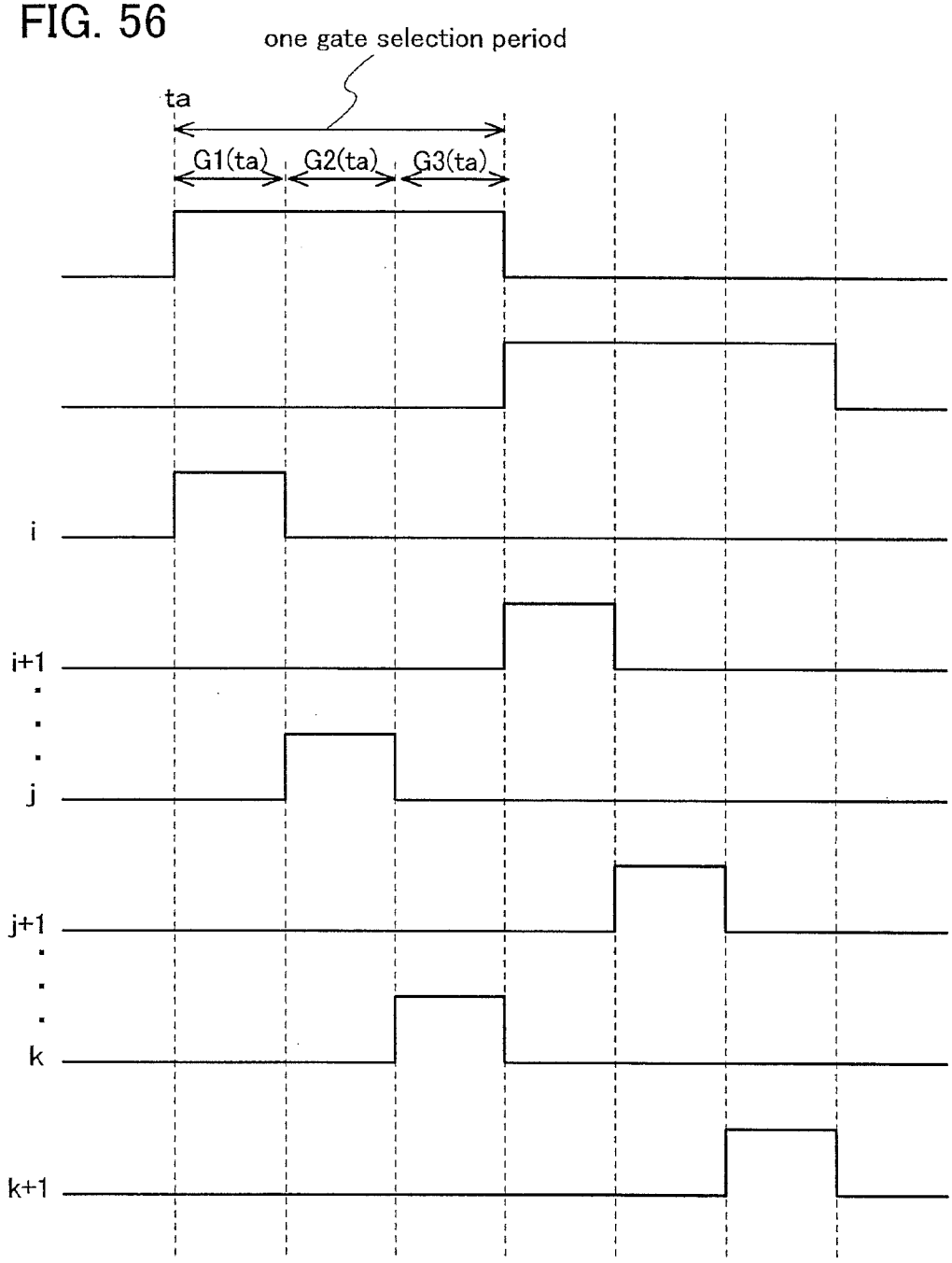
FIG. 56 shows a display device of Embodiment Mode 23.

In that case, a pixel structure shown in FIGS. 47 and 50 may be employed. In this case, where a time is to in FIG. 54, it is necessary to input signals into pixels of three rows at the same time. In general, it is impossible to input signals into pixels of a plurality of rows at the same time. Thus, as shown in FIG. 56, one gate selection period is divided into a plurality of periods (three in FIG. 56). Each gate signal line 4707 and gate signal line 5007 are selected in each of the divided selection periods and a corresponding signals are inputted to the source signal line 4706 and the source signal line 5006. For example, in one gate selection period, an i-th row is selected in G1(ta), a j-th row is selected in G2(ta), and a k-th row is selected in G3(ta). Accordingly, an operation can be performed as if the three rows were selected at the same time in the one gate selection period.

Note that although FIGS. 54 and 56 each shows the case where signals are inputted to pixels of three rows at the same time, the present invention is not limited thereto. A signal may also be inputted to more rows or less rows.

Figure 55:
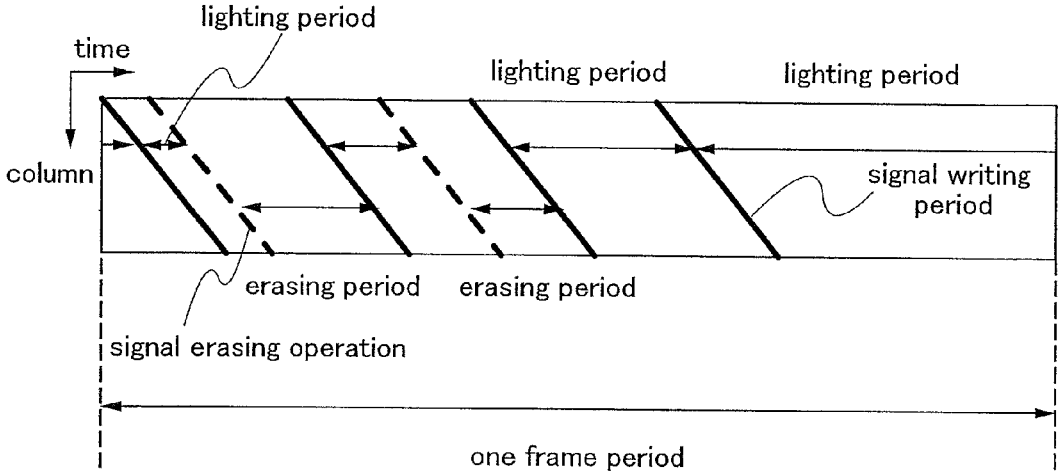
FIG. 55 shows a display device of Embodiment Mode 23.

FIG. 55 shows a timing chart in a case where signals in pixels are erased. In each row, a signal writing operation is performed and the signal in the pixel is erased before a next signal writing operation. According to this, the length of a lighting period can be easily controlled.

In a certain row, after writing of signals and a predetermined lighting period are completed, a signal writing operation starts in the next sub-frame. In a case where a lighting period is short, a signal erasing operation is performed to provide a non-light-emitting state. By repeating such operations, the lengths of the lighting periods can be controlled.

In this manner, many sub-frames can be arranged in one frame even if signals are written slowly. In addition, when an erasing operation is conducted, it is not necessary to obtain data for erasing and video signals, therefore, driving frequency of a source driver can be lowered.

[Embodiment Mode 24]

Figure 48:
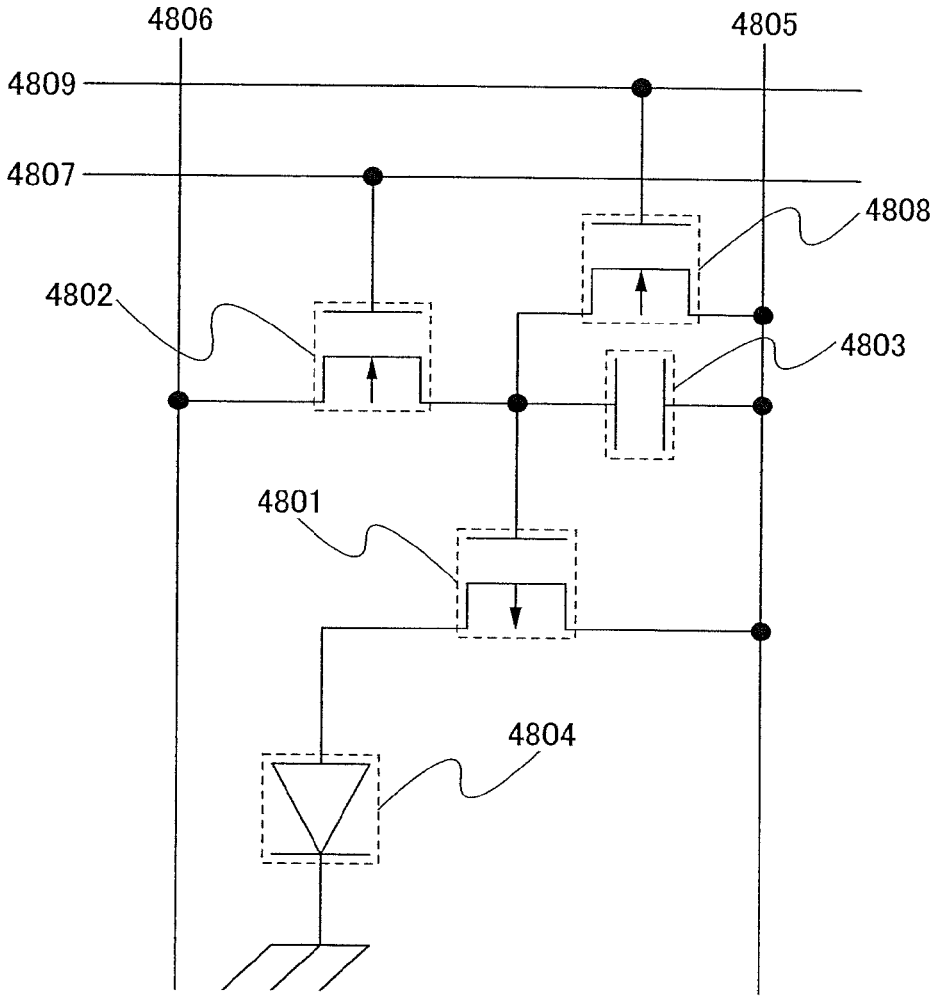
FIG. 48 shows a display device of Embodiment Mode 24.

A description is made on a pixel structure for realizing the timing chart of FIG. 55 described in Embodiment Mode 23 with reference to FIG. 48.

On or off of a selection transistor 4802 is controlled using a gate signal line 4807. When the selection transistor 4802 turns on, video signals are inputted to a capacitor 4803 from a source signal line 4806. Then, a driving transistor 4801 turns on/off according to the video signals. When the driving transistor 4801 turns on, current flows from a power supply line 4805 to a counter electrode through the driving transistor 4801 and a light-emitting element 4804. When the driving transistor 4801 turns off, current does not flow. Note that one electrode of the light-emitting element 4804 is connected to either a source or a drain of the driving transistor 4801, and the other electrode of the light-emitting element 4804 serves as the counter electrode.

When it is desired to erase a signal, an erasing gate signal line 4809 is selected to turn an erasing transistor 4808 on, so that the driving transistor 4801 is turned off. Then, no current flows from the power supply line 4805 to the counter electrode through the driving transistor 4801 and the light-emitting element 4804. Consequently, a non-lighting period can be provided and the length of a lighting period can be freely controlled.

Note that the capacitor 4803 holds the gate potential of the driving transistor 4801. Therefore, the capacitor 4803 is connected between a gate of the driving transistor 4801 and the power supply line 4805; however, the present invention is not limited thereto. The capacitor 4803 is only required to be disposed so as to be able to hold the gate potential of the driving transistor 4801. In a case where the gate potential of the driving transistor 4801 can be held using the gate capacitance of the driving transistor 4801 or the like, the capacitor 4803 may be omitted.

The selection transistor 4802 serves as a switch connected between the source signal line 4806 and the gate of the driving transistor 4801. The erasing transistor 4808 serves as a switch connected between the power supply line 4805 and the gate of the driving transistor 4801. In FIG. 48, an n-channel transistor is used as the selection transistor 4802; however, the present invention is not limited thereto. Any element having a function of connecting/disconnecting the source signal line 4806 and the gate of the driving transistor 4801 may be employed. Therefore, a p-channel transistor may be employed. In that case, a potential of the gate signal line 4807 is inverted.

Although the erasing transistor 4808 is used in FIG. 48, another method can be used as well. This is because, in order to forcibly provide a non-lighting period, it is only required that current be prevented from being supplied to the light-emitting element 4804. Therefore, a non-lighting period may be provided by disposing a switch somewhere in a path where current flows from the power supply line 4805 to the counter electrode through the driving transistor 4801 and the light-emitting element 4804, and by controlling on/off of the switch. Alternatively, a gate-source voltage of the driving transistor 4801 may be controlled to forcibly turn off the driving transistor.

Figure 49:
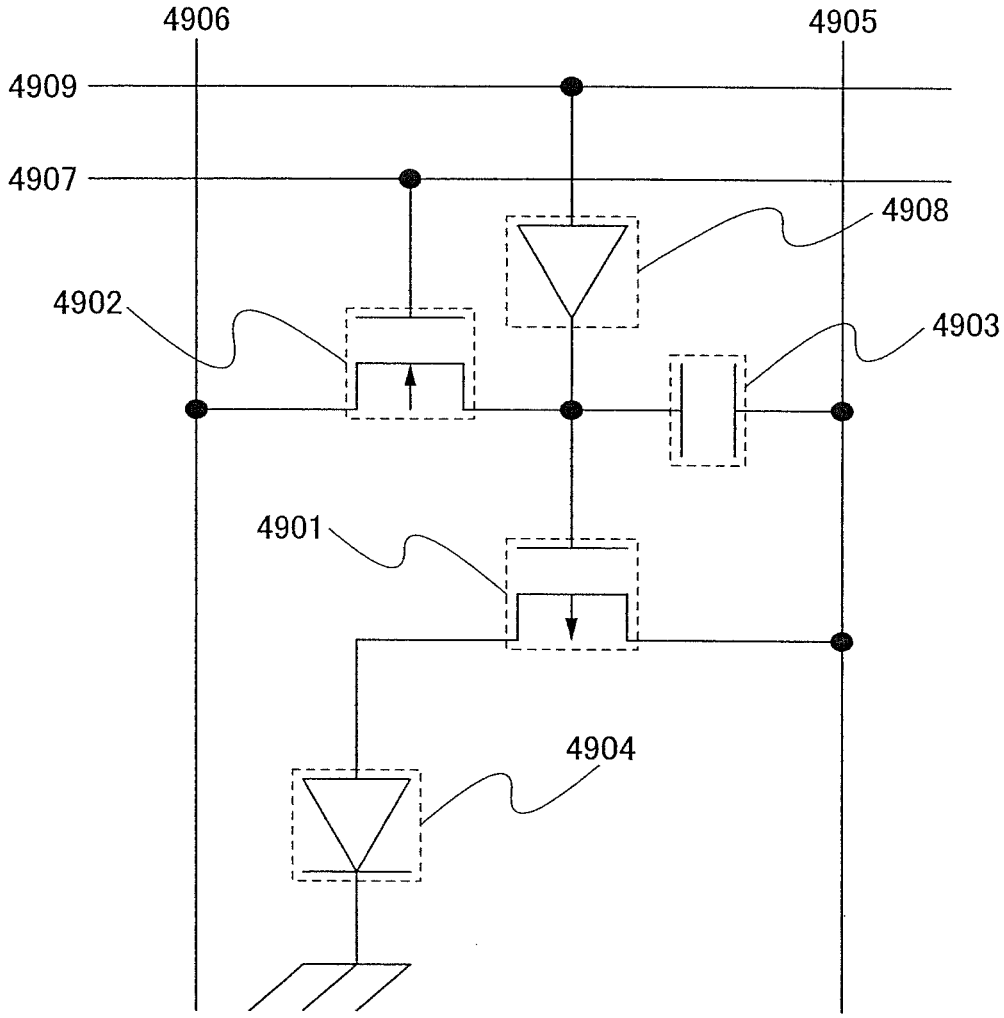
FIG. 49 shows a display device of Embodiment Mode 24.

A description is made on a pixel structure in which a driving transistor is forcibly turned off using a diode with reference to FIG. 49.

On or off of a selection transistor 4902 is controlled using a gate signal line 4907. When the selection transistor 4902 turns on, video signals are inputted to a capacitor 4903 from a source signal line 4906. Then, a driving transistor 4901 turns on/off according to the video signals. When the driving transistor 4901 turns on, current flows from a power supply line 4905 to a counter electrode through the driving transistor 4901 and a light-emitting element 4904. When the driving transistor 4901 turns off, current does not flow. Note that one electrode of the light-emitting element 4904 is connected to either a source or a drain of the driving transistor 4901, and the other electrode of the light-emitting element 4904 serves as the counter electrode.

When it is desired to erase a signal, the erasing gate signal line 4909 is selected (here, supplied with a potential equal to or higher than the power supply line 4905) to turn the erasing diode 4908 on, so that current flows from the erasing gate signal line 4909 to the gate of the driving transistor 4901. Consequently, the driving transistor 4901 is turned off. Then, no current flows from the power supply line 4905 to the counter electrode through the driving transistor 4901 and the light-emitting element 4904. Consequently, a non-lighting period can be provided and the length of a lighting period can be freely controlled.

When it is desired to hold a signal, the erasing gate signal line 4909 is not selected (here, supplied with a low potential). Then, the erasing diode 4908 is turned off and the gate potential of the driving transistor 4901 is thus held.

Note that the erasing diode 4908 may be any element as far as it has a rectifying property. The erasing diode 4908 may be a PN diode, a PIN diode, a Schottky diode, or a Zener diode.

In addition, a diode-connected transistor (a gate and a drain thereof are connected) may be used as well. As the erasing diode 4908, a diode-connected transistor is used. An n-channel transistor may be used and a p-channel transistor may also be used.

Note that the capacitor 4903 holds the gate potential of the driving transistor 4901. Therefore, the capacitor 4903 is connected between a gate of the driving transistor 4901 and the power supply line 4905; however, the present invention is not limited thereto. The capacitor 4903 is only required to be disposed so as to be able to store the gate potential of the driving transistor 4901. In a case where the gate potential of the driving transistor 4901 can be held using the gate capacitance of the driving transistor 4901 or the like, the capacitor 4903 may be omitted.

[Embodiment Mode 25]

Figure 51:
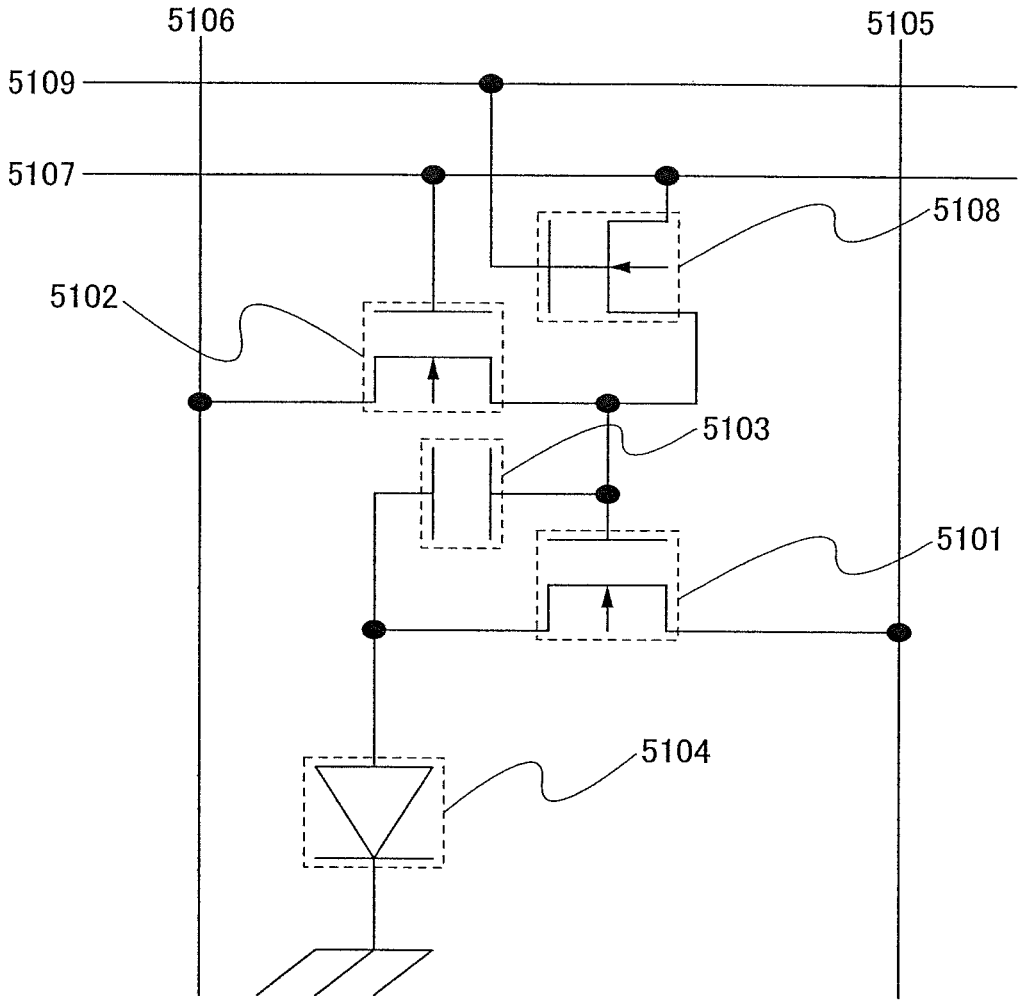
FIG. 51 shows a display device of Embodiment Mode 26.

A description is made on a pixel structure for realizing the timing chart of FIG. 55 described in Embodiment Mode 23 with reference to FIG. 51.

On or off of a selection transistor 5102 is controlled using a gate signal line 5107. When the selection transistor 5102 turns on, video signals are inputted to a capacitor 5103 from a source signal line 5106. Then, a driving transistor 5101 turns on/off according to the video signals. When the driving transistor 5101 turns on, current flows from a power supply line 5105 to a counter electrode through the driving transistor 5101 and a light-emitting element 5104. When the driving transistor 5101 turns off, current does not flow. Note that one electrode of the light-emitting element 5104 is connected to either a source or a drain of the driving transistor 5101, and the other electrode of the light-emitting element 5104 serves as the counter electrode.

When it is desired to erase a signal, an erasing gate signal line 5109 is selected to turn an erasing transistor 5108 on, so that the driving transistor 5101 is turned off. Then, no current flows from the power supply line 5105 to the counter electrode through the driving transistor 5101 and the light-emitting element 5104. Consequently, a non-lighting period can be provided and the length of a lighting period can be freely controlled.

Note that the capacitor 5103 holds the gate potential of the driving transistor 5101. Therefore, the capacitor 5103 is connected between a gate of the driving transistor 5101 and the power supply line 5105; however, the present invention is not limited thereto. The capacitor 5103 may be disposed so as to be able to store the gate potential of the driving transistor 5101. In a case where the gate potential of the driving transistor 5101 can be held using the gate capacitance of the driving transistor 5101 or the like, the capacitor 5103 may be omitted.

Although the erasing transistor 5108 is used in FIG. 51, another method can be used as well. This is because, in order to forcibly provide a non-lighting period, it is only required that current be prevented from being supplied to the light-emitting element 5104. Therefore, a non-lighting period may be provided by disposing a switch in a path where current flows from the power supply line 5105 to the counter electrode through the driving transistor 5101 and the light-emitting element 5104, and by controlling on/off of the switch. Alternatively, a gate-source voltage of the driving transistor 5101 may be controlled to forcibly turn off the driving transistor.

Figure 52:
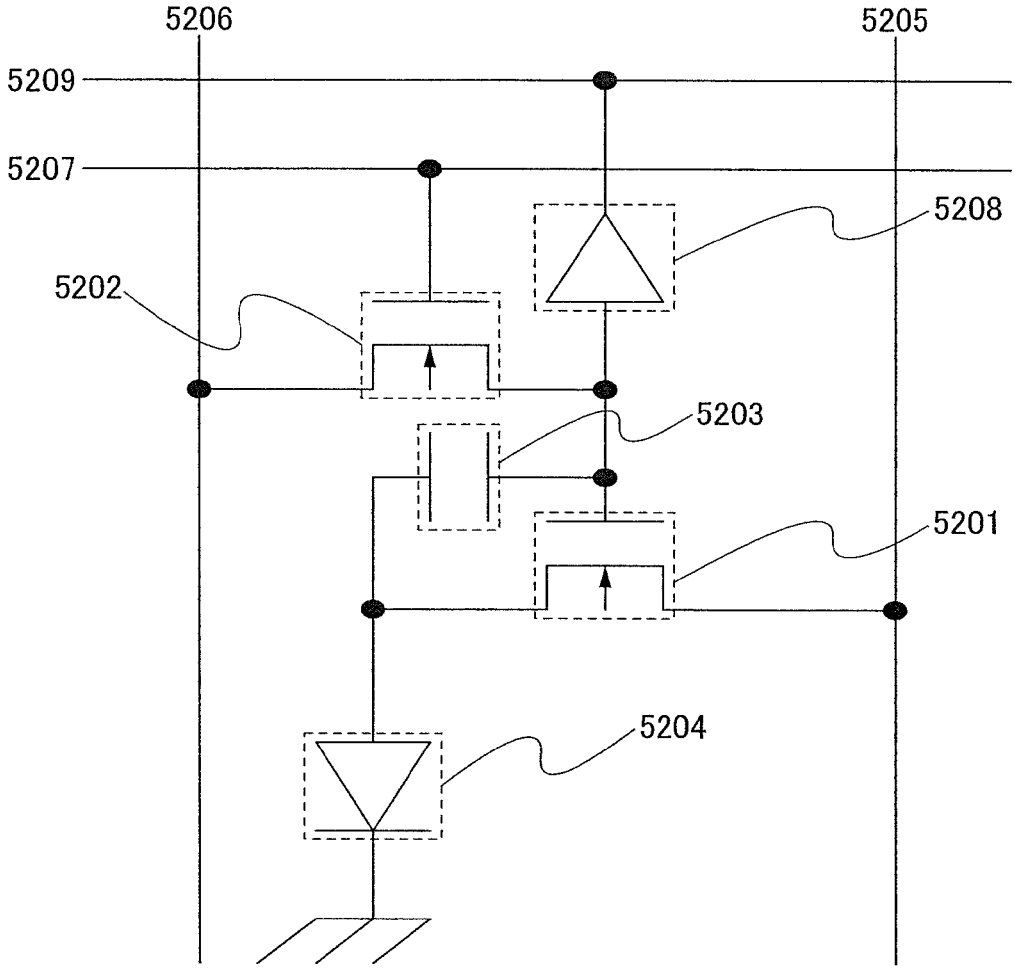
FIG. 52 shows a display device of Embodiment Mode 26.

A description is made on a pixel structure in which a driving transistor is forcibly turned off using a diode with reference to FIG. 52.

On or off of a selection transistor 5202 is controlled using the gate signal line 5207. When the selection transistor 5202 turns on, video signals are inputted to a capacitor 5203 from a source signal line 5206. Then, a driving transistor 5201 turns on/off according to the video signals. When the driving transistor 5201 turns on, a current flows from a power supply line 5205 to a counter electrode through the driving transistor 5201 and a light-emitting element 5204. When the driving transistor 5201 turns off, current does not flow. Note that one electrode of the light-emitting element 5204 is connected to either a source or a drain of the driving transistor 5201, and the other electrode of the light-emitting element 5204 serves as the counter electrode.

When it is desired to erase a signal, the erasing gate signal line 5209 is selected (here, supplied with a low potential) to turn the erasing diode 5208 on, so that current flows from the gate of the driving transistor 5201 to the erasing gate signal line 5209. Consequently, the driving transistor 5201 is turned off. Then, no current flows from the power supply line 5205 to the counter electrode through the driving transistor 5201 and the light-emitting element 5204. Consequently, a non-lighting period can be provided and the length of a lighting period can be freely controlled.

When it is desired to hold a signal, the erasing gate signal line 5209 is not selected (here, supplied with a high potential). Then, the erasing diode 5208 is turned off and the gate potential of the driving transistor 5201 is thus held.

Note that the erasing diode 5208 may be any element as far as it has a rectifying property. The erasing diode 5208 may be a PN diode, a PIN diode, a Schottky diode, or a Zener diode.

In addition, a diode-connected transistor (a gate and a drain thereof are connected) may be used as well. As the erasing diode 5208, a diode-connected transistor is used. In this embodiment mode an n-channel transistor may be used.

Note that the capacitor 5203 holds the gate potential of the driving transistor 5201. Therefore, the capacitor 5203 is connected between a gate of the driving transistor 5201 and the power supply line 5205; however, the present invention is not limited thereto. The capacitor 5203 may be disposed so as to be able to store the gate potential of the driving transistor 5201. In a case where the gate potential of the driving transistor 5201 can be held using the gate capacitance of the driving transistor 5201 or the like, the capacitor 5203 may be omitted.

In this embodiment mode, the selection transistor 5102, the erasing transistor 5108, and the driving transistor 5101 are n-channel transistors in FIG. 51. In FIG. 52, the selection transistor 5202, the erasing transistor 5208, and the driving transistor 5201 are n-channel transistors. With such a structure, amorphous silicon can be used, so that a low cost and a large screen can be easily realized. Note that there are problem with amorphous silicon such that the transistor is deteriorated, that is, the characteristics of the transistor change with time, which is called a threshold value shift. To solve such a phenomenon, it is necessary to employ a pixel structure in which a threshold value is corrected or a pixel structure in which video signals are inputted as current. However, when employing a pixel structure in which a threshold value is corrected, there arise other problems such that the number of transistor increases, so that the aperture ratio of pixels is lowered, or a potential of the power supply line 5105 or the counter electrode is lowered, which leads to reduction in duty ratio of the light-emitting element 5104. The reduction in aperture ratio and duty ratio requires increase in luminance of the light-emitting element 5104. Therefore, the light-emitting element 5104 deteriorates earlier and the lifetime of the display device is shortened.

On the other hand, when the driving method of Embodiment Modes 1 to 3 of the present invention is employed, change in characteristics of the driving transistors 5101 and 5201 can be corrected as well as the deterioration in light-emitting elements 5104 and 5204, at the same time.

Therefore, combination of the driving method in Embodiment Modes 1 to 3 and a pixel structure using amorphous silicon can cause further effect. Besides, since a controller for driving a display device using amorphous silicon is generally externally provided, and the display device using amorphous silicon has often a large or medium size, so that a rate of cost for implementing the present invention to the cost for the whole display device is low when implementing the present invention in such a display device, compared with implementing the present invention in a mobile phone or a digital camera.

Note that a driving method as shown in FIG. 55 can be achieved using the circuits in FIGS. 47 and 50 as other circuits. A timing chart shown in FIG. 56 may be applied in this case. As shown in FIG. 56, one gate selection period is divided into three; however, here, one gate selection period is divided into two. Each gate line is selected in each of the divided selection periods and a corresponding signal (a video signal and an erasing signal) is inputted to the source signal lines 4706 and 5006. For example, in one gate selection period, an i-th row is selected in the first half of the period and a j-th row is selected in the latter half of the period. Then, when the i-th row is selected, a video signal therefor is inputted. On the other hand, when the j-th row is selected, a signal for turning the driving transistor off is inputted. Accordingly, an operation can be performed as if the two rows are selected at the same time in the one gate selection period.

Note that the timing chart, the pixel structure, and the driving method are examples and the present invention is not limited thereto. The present invention can be applied to various timing charts, pixel structures, and driving methods.

[Embodiment Mode 26]

In this embodiment mode, description is made on structures and operations of a display device, a source driver, a gate driver, and the like.

Figure 45A:
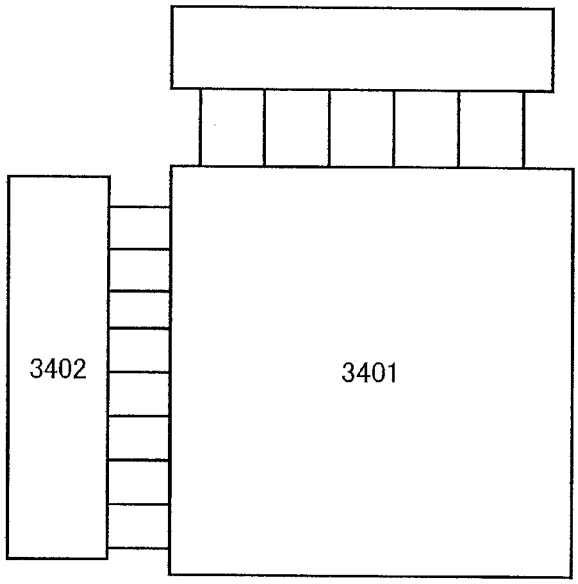
FIGS. 45A to 45C show a display device of Embodiment Mode 26.

As shown in FIG. 45A, a display device includes a pixel portion 3401, a gate driver 3402, and a source driver 3403.

Figure 45B:
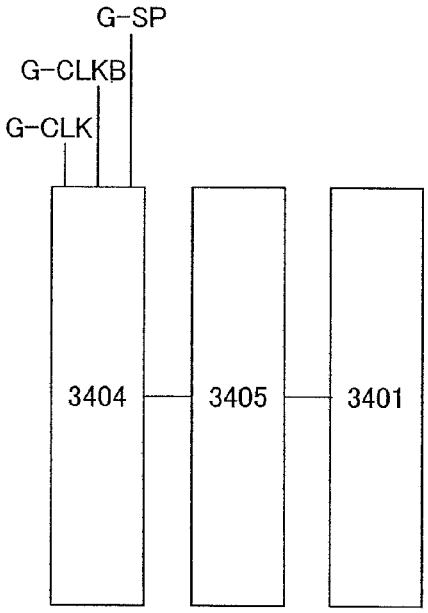

The gate driver 3402 sequentially outputs selection signals to the pixel portion 3401. FIG. 45B shows an example of a structure of the gate driver 3402. The gate driver includes a shift register 3404, a buffer circuit 3405, and the like. The shift register 3404 sequentially outputs pulses so as to select sequentially. Note that the gate driver 3402 further includes a level shifter circuit, a pulse width controlling circuit, or the like in many cases.

The source driver 3403 sequentially outputs video signals to the pixel portion 3401. The pixel portion 3401 displays an image by controlling the state of light in accordance with the video signals. The video signals inputted from the source driver 3403 to the pixel portion 3401 are often voltage. That is, a display element and an element for controlling the display element which are disposed in each pixel are changed in states by video signals (voltage) inputted from the source driver 3403. As an example of the display element disposed in each pixel, an EL element, an element used for an FED (field emission display), a liquid crystal, a DMD (digital micromirror device), and the like can be given.

Note that each of the gate driver 3402 and the source driver 3403 may be provided more than one.

In particular, in the case of using the driving method shown in Embodiment Mode 22, where one gate selection period is divided into a plurality of subgate selection periods, as many gate drivers as the division number of one gate selection period are usually required. In addition, such a gate driver may be employed that has a function of selecting an arbitrary gate line at arbitrary timing as well as performing a sequential scan operation, as typified by a gate driver using a decoder.

Figure 57:
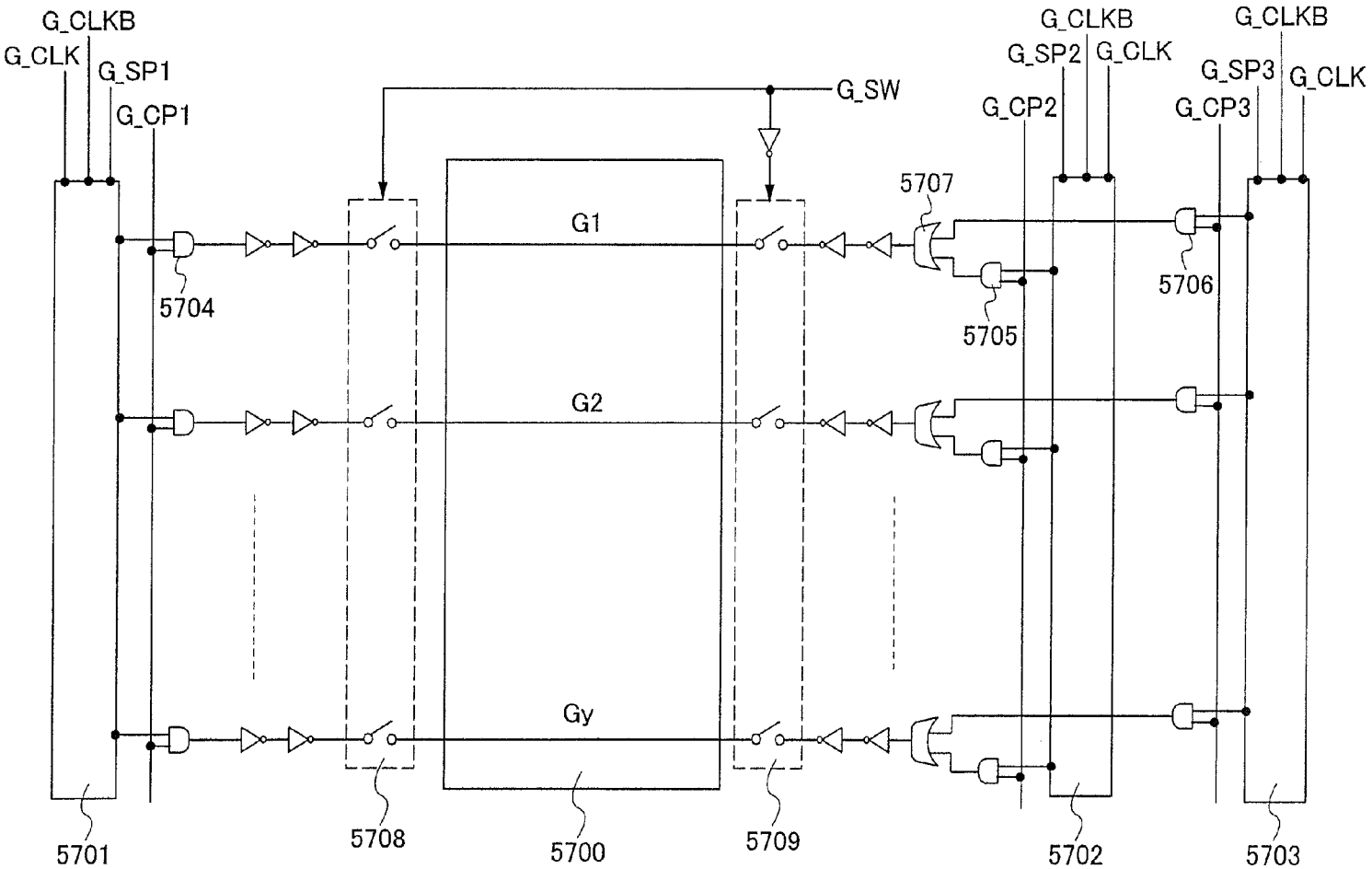
FIG. 57 shows a display device of Embodiment Mode 26.

Here, description is made with reference to FIG. 57 on an example of a structure of a display device in the case of using gate drivers as many as the division number of one gate selection period. Note that the present invention is not limited to this circuit structure, and any circuit having a similar function may be used. In addition, although FIG. 57 shows a gate driver in the case of dividing one gate selection period into three as an example, the division number of one gate selection period is not limited to three and it may be any number. For example, in the case of dividing one gate selection period into four, four shift registers are required in total for the gate driver.

FIG. 57 shows an example where a gate driver has three shift registers 5701, 5702, and 5703 provided on opposite sides of a pixel portion 5700. In the case of inputting outputs of these shift registers to one gate line from its opposite sides, the switch groups 5708 and 5709 are required so that the gate line will not receive an output from one of the shift registers while receiving an output from the other shift register, in order to prevent that the two outputs are inverted to each other, which would result in short circuit. While the switch group 5708 is on, the switch 5709 is off, while the switch group 5709 is on, the switch 5708 is off. When one of the second shift register 5702 and the third shift register 5703 is selected by an OR circuit 5707, a gate line connected to an end of the shift register is also selected. In this case, since both of the second shift registers are connected to each input terminal of the OR circuit 5707, short circuit of a power source can be prevented, which would otherwise be caused in the case where two signals are inputted. Reference symbols G_CP1, G_CP2, and G_CP3 are pulse width control signals. The output from G_CP1 and the first shift register 5701 are connected to input of an AND circuit 5704. When the output from the first shift register 5701 and G_CP1 are in a selected state, the gate signal line connected therefrom is in a selected state. The output from G_CP2 and the first shift register 5701 are connected to input of an AND circuit 5705. When the output from the second shift register 5702 and G_CP2 are in a selected state, the gate signal line connected therefrom is in a selected state. The output from G_CP3 and the first shift register 5703 are connected to input of an AND circuit 5706. When the output from the third shift register 5703 and G_CP3 are in a selected state, the gate signal line connected therefrom is in a selected state. As for a signal width of the shift registers, each of the three shift registers is set to have the same signal width as the width of one gate selection period, but it is changed into a pulse width which is to be actually outputted to a gate line (divided into three in this case) by using a pulse width control signal, thereby such a driving method can be performed that one gate selection period is divided into a plurality of subgate selection periods.

Figure 44:
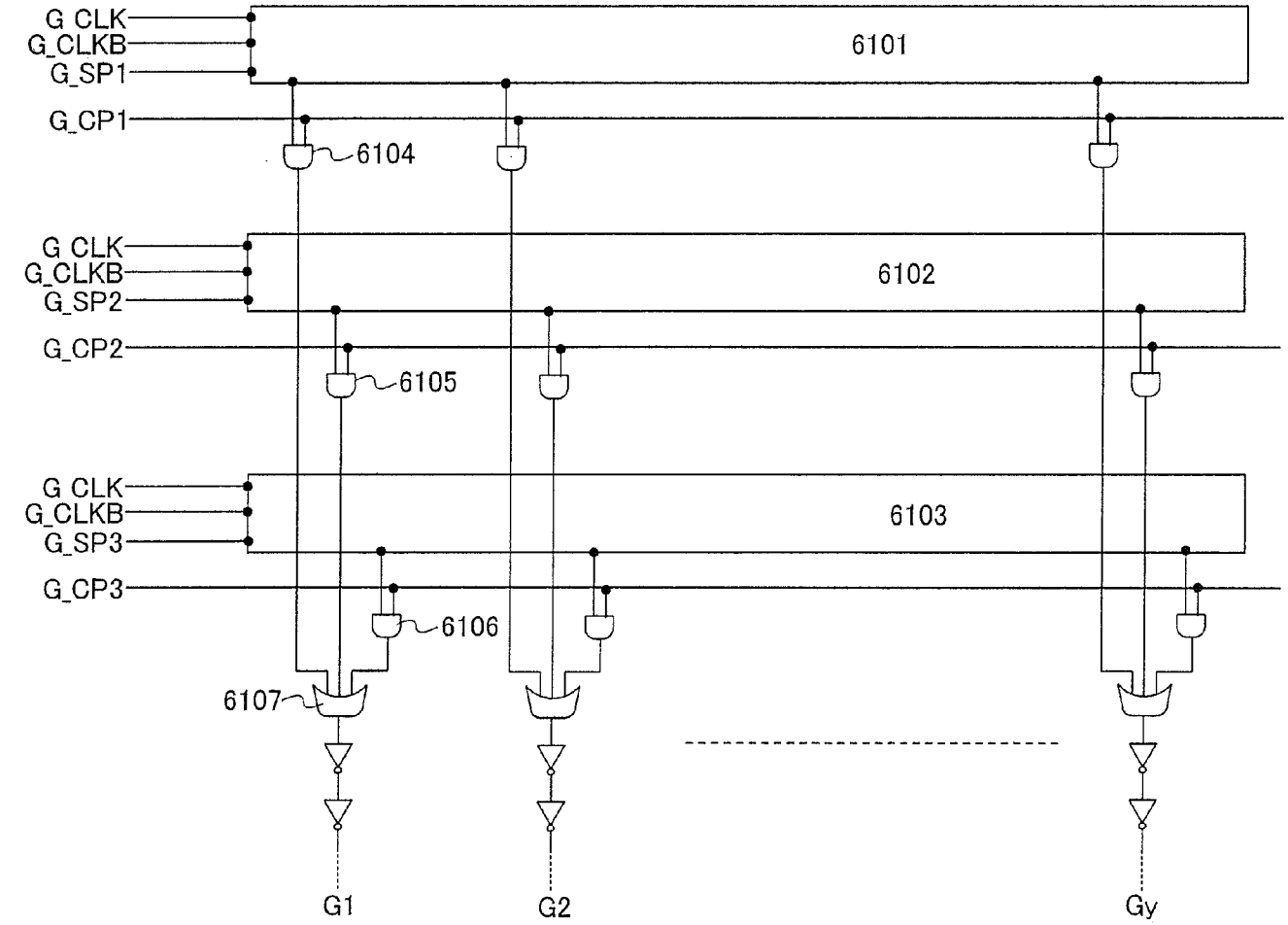
FIG. 44 shows a display device of Embodiment Mode 26.

FIG. 44 shows a gate driver with a structure where an output of shift registers are provided to one side of a pixel portion, with the condition that one gate selection period is divided into three. Since no switch for preventing short circuit of a display element is provided on opposite sides of the pixel portion in the structure in FIG. 44, more stable operation can be expected as compared to the operation of a gate driver with a structure where shift registers are provided on opposite sides of the pixel portion. Note that the division number of one gate selection period is not limited to three, and it may be any number.

Note that the details of such a driving method are disclosed in Japanese Patent Laid-Open No. 2002-215092, Japanese Patent Laid-Open No. 2002-297094, and the like, the content of which can be combined with the present invention.

An example of a structure of a display device which has a decoder type gate driver is described.

Figure 58:
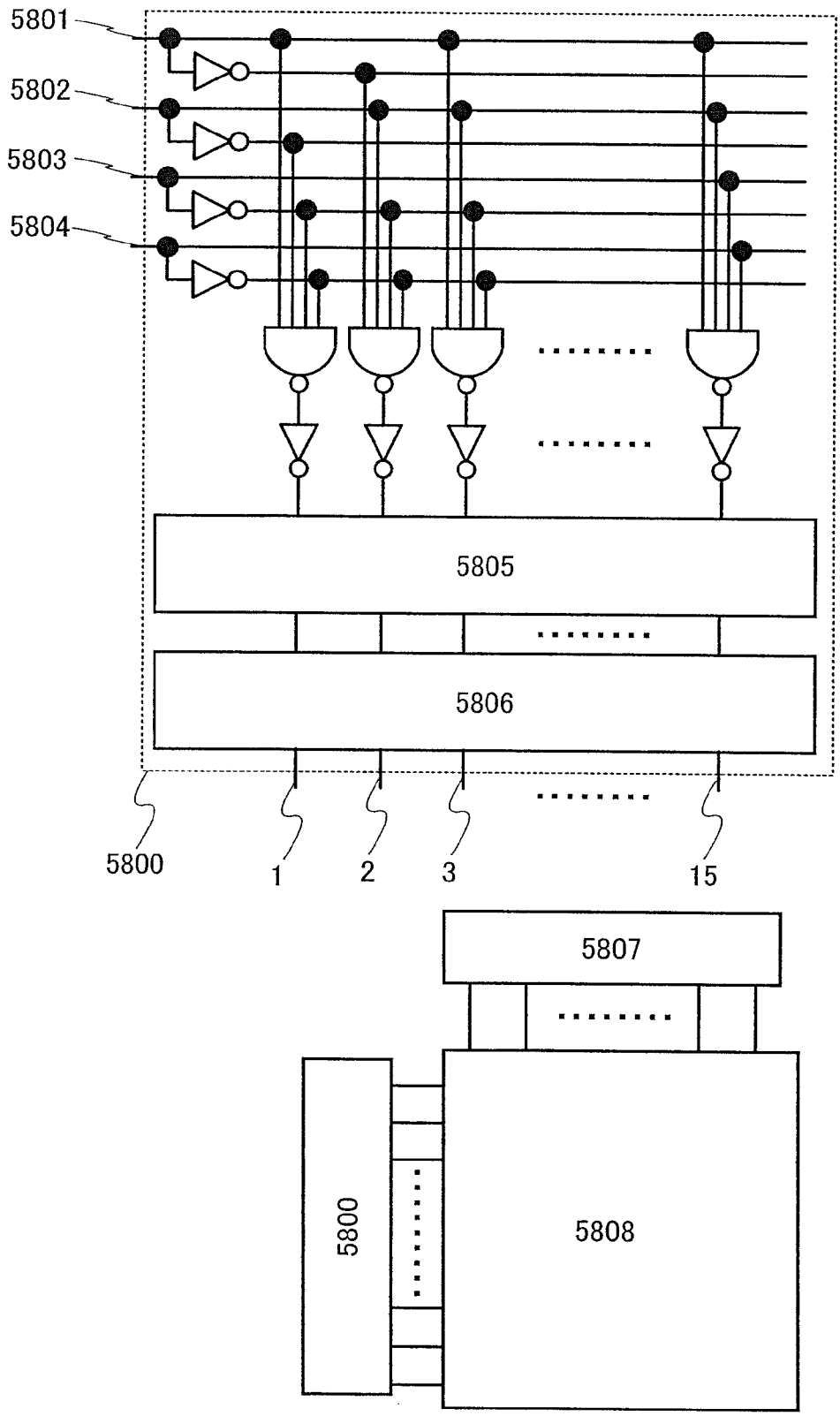
FIG. 58 shows a display device of Embodiment Mode 26.

FIG. 58 shows an example of a decoder type gate driver 5800. Reference numeral 5808 denotes a pixel portion, reference numeral 5800 denotes a gate driver, reference numeral 5807 denotes a source driver. Here, description is made on the case where 15 gate lines are driven with a 4-bit decoder. The number of bits of the decoder is appropriately determined in accordance with the number of gate signal lines of a display device. For example, when the number of gate lines is 60, it is effective to select a 6-bit decoder since $2^6=64$. Similarly, when the number of gate lines is 240, it is effective to select an 8-bit decoder since $2^8=256$. In this manner, it is effective to select a decoder having a larger number of bits than the number obtained by extracting a square root of the number of gate lines; however, the present invention is not limited to this.

As the operation of the decoder shown in FIG. 58, there are the following operations. In the case of selecting a gate signal line 1, (1, 0, 0, 0) are inputted to first to fourth input terminals 5801 to 5804, respectively. In the case of selecting a gate signal line 2, (0, 1, 0, 0) are inputted. In the case of selecting a gate signal line 3, (1, 1, 0, 0) are inputted. In this manner, by assigning one combination of digital signals to one gate line, an arbitrary gate line can be selected at arbitrary timing.

Figure 59:
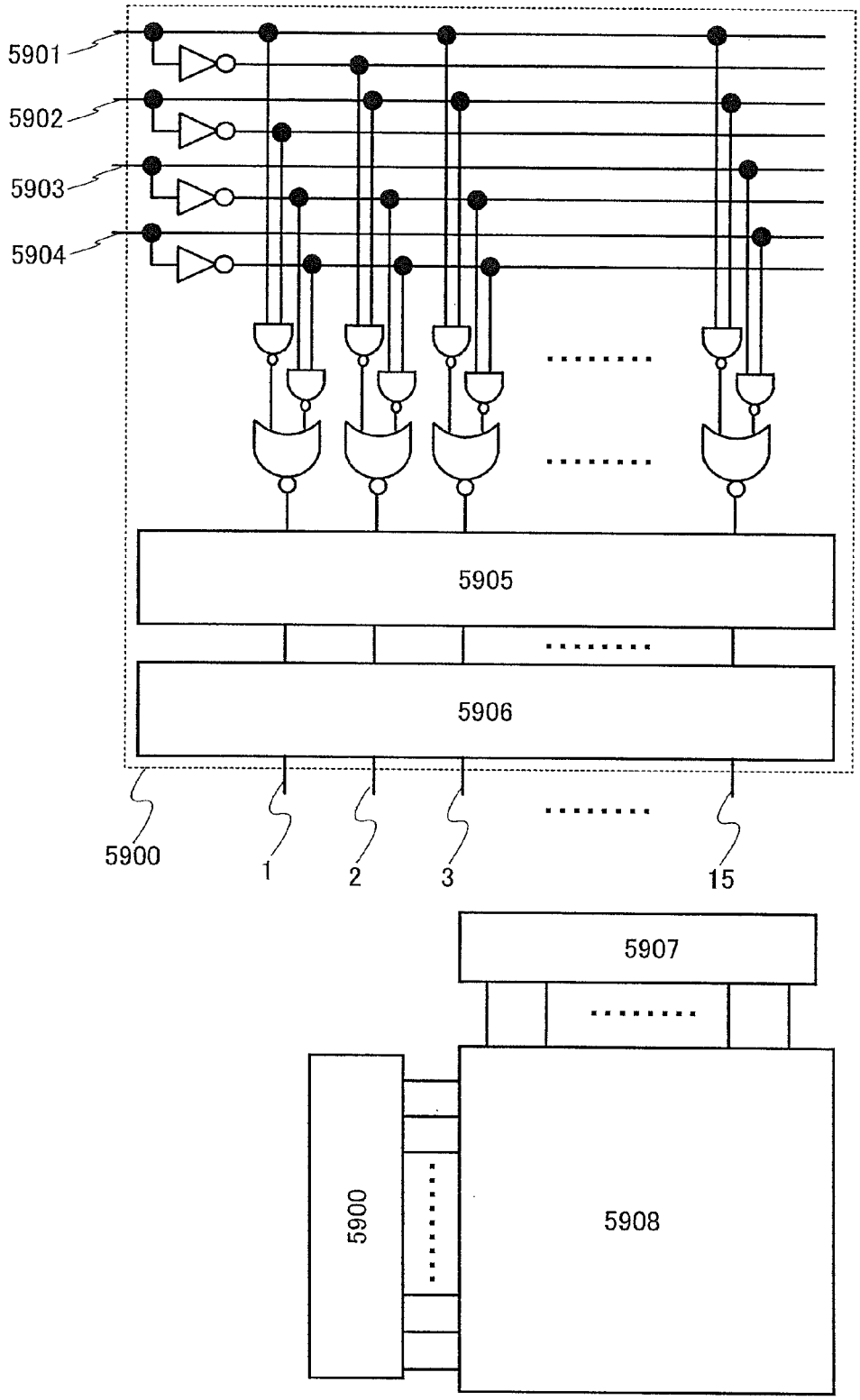
FIG. 59 shows a display device of Embodiment Mode 26.

In the case where the number of input terminals of a NAND circuit is large, the operation might be affected by the resistance of a transistor or the like. In such a case, the NAND circuit having a large number of terminals may be replaced by a digital circuit having a similar function and less input terminals, as shown in FIG. 59. Reference numeral 5908 denotes a pixel portion, reference numeral 5900 denotes a gate driver, reference numeral 5907 denotes a source driver. The gate driver 5900 using a decoder shown in FIG. 59 operates as follows. In the case of selecting a gate signal line 1, (1, 0, 0, 0) are inputted to first to fourth input terminals 5901 to 5904, respectively. In the case of selecting a gate signal line 2, (0, 1, 0, 0) are inputted. In the case of selecting a gate signal line 3, (1, 1, 0, 0) are inputted. In this manner, by assigning one combination of digital signals to one gate line, an arbitrary gate line can be selected at arbitrary timing.

FIG. 58 shows an example in which a level shifter 5805 and a buffer circuit 5806 for impedance matching are used in an output portion of the decoder, and FIG. 59 shows an example in which a level shifter 5905 and a buffer circuit 5906 for impedance matching are used in an output portion of the decoder. Note that as long as a similar function is provided, the structure of the gate driver using a decoder is not limited thereto.

Figure 45C:
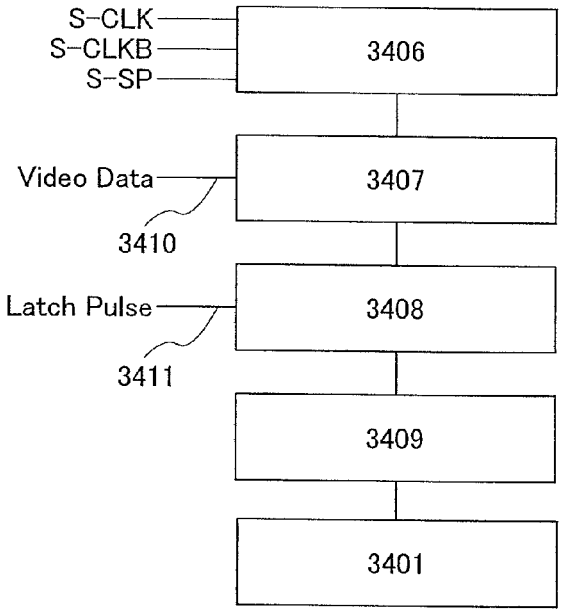

FIG. 45C shows an example of a structure of a source driver 3403. The source driver 3403 includes a shift register 3406, a first latch circuit (LAT1) 3407, a second latch circuit (LAT2) 3408, a level shifter 3409, and the like. The level shifter 3409 may have a function to convert digital signals to analog signals as well as a gamma correction function.

Each pixel has a display element such as a light-emitting element. There may be a case where a circuit for outputting current (video signal) to the display element, namely a current source circuit is provided.

Next, the operation of the source driver 3403 is described briefly. Clock signals (S-CLK), start pulses (S-SP), and inverted clock signals (S-CLKb) are inputted to the shift register 3406, and in accordance with the input timing of these signals, the shift register 3406 sequentially outputs sampling pulses.

The sampling pulses outputted from the shift register 3406 are inputted to the first latch circuit (LAT1) 3407. Video signals are inputted from a video signal line 3410 to the first latch circuit (LAT1) 3407, and these video signals are held in each column in accordance with the input timing of the sampling pulses.

After holding of video signals are completed up to the last column in the first latch circuit (LAT1) 3407, latch pulses are inputted from a latch control line 3411, and the video signals which have been held in the first latch circuit (LAT1) 3407 are transferred to the second latch circuit (LAT2) 3408 all at once in a horizontal flyback period. After that, the video signals of one row, which have been held in the second latch circuit (LAT2) 3408, are inputted to the level shifter 3409 all at once. A signal which is outputted from the level shifter 3409 is inputted to the pixel portion 3401.

While video signals held in the second latch circuit (LAT2) 3408 are inputted to the level shifter 3409, and then inputted to the pixel portion 3401, the shift register 3406 outputs sampling pulses again. That is, two operations are performed at the same time. Accordingly, line sequential driving can be performed. Hereafter, such operations are repeated.

Next, description is made on a source driver in the case of using a timing chart where address periods and lighting periods are not separated from each other as described in Embodiment Modes 22 and 25. Here, two examples are described. The first example is a method of increasing the driving frequency of the source driver 3403 without changing the structure of the source driver 3403 shown in FIG. 45. If address periods and lighting periods are not separated from each other, the source driver 3403 performs writing of one line in each subgate selection period in FIG. 56. That is, in the case of dividing one gate selection period into two, such driving that address periods and lighting periods are not separated from each other can be performed by increasing the driving frequency of the source driver 3403 to be twice as large, compared to that in the pre-divided gate selection period. Similarly, in the case of dividing one gate selection period into three, the foregoing operation can be performed by increasing the driving frequency to be three times as large, and in the case of dividing one gate selection period into n, the foregoing operation can be performed by increasing the driving frequency to be n times as large. This method is advantageous in that the structure of the source driver is not particularly modified and is simple.

Figure 60:
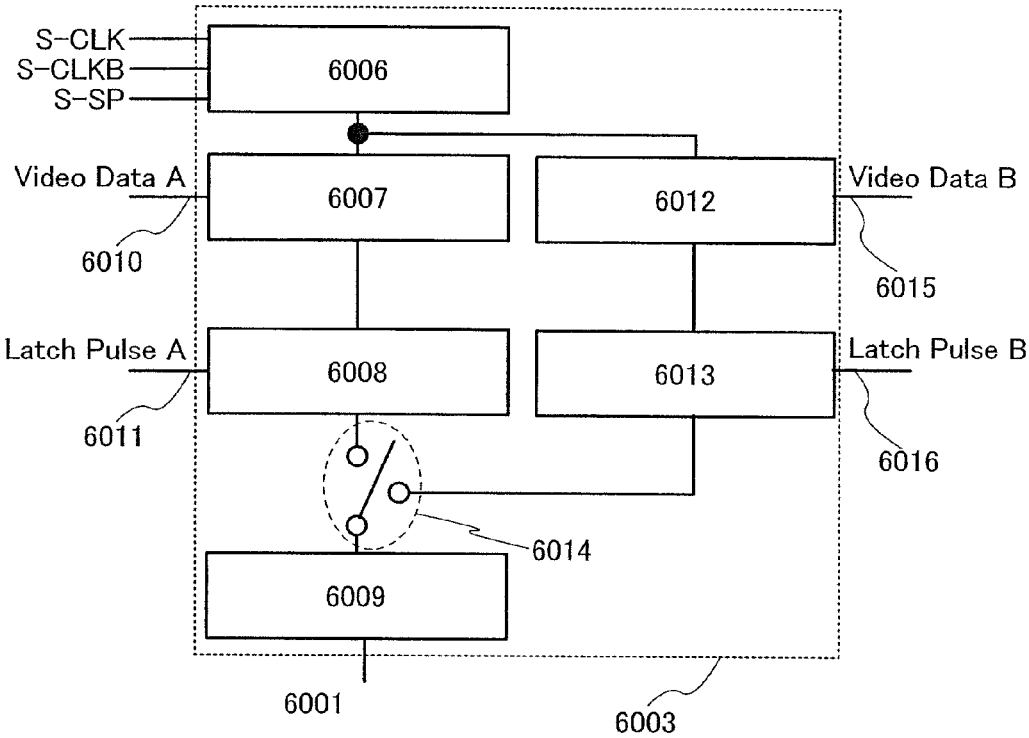
FIG. 60 shows a display device of Embodiment Mode 26.
Figure 60:
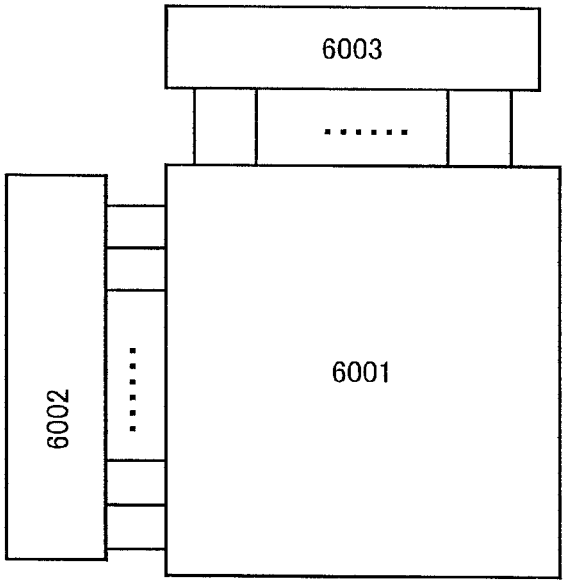

Next, the second example is described. FIG. 60 shows a structure of a source driver of the second example. Reference numeral 6001 denotes a pixel portion, reference numeral 6002 denotes a gate driver, reference numeral 6003 denotes a source driver. First, an output of a shift register 6006 is inputted to both a first latch circuit A6007 and a first latch circuit B6012. Note that although the output is inputted to the two first latch circuits A and B in this example, the number is not limited to two, and any number of first latch circuits may be provided. In addition, although an output of one shift register is inputted to a plurality of the first latch circuits in order to suppress an increase in circuit scale, the number of the shift registers is not limited to one, and any number of shift registers may be provided.

Video Data-A and Vide Data-B are inputted to the first latch circuit A6007 and the first latch circuit B6012 as video signals, respectively. The video signals are latched with an output of the shift register, and then the signals are outputted to second latch circuits. In each of second latch circuits A6012 and B6013, video signals for one line are held, and the data held therein is updated at the timing specified by Latch Pulse-A and Latch Pulse-B. Outputs of the second latch circuits A6012 and B6013 are each connected to a switch 6014 which can select either signals from the second latch circuit A6008 or signals from the second latch circuit B6013 to be inputted to a pixel portion. That is, in the case of writing video signals to pixels by dividing one gate selection period into two, such driving that one gate selection period is divided into two can be performed by outputting signals from the second latch circuit A6008 in the first half of the one gate selection period, and outputting signals from the second latch circuit B6013 in the second half of the one gate selection period. In this case, the driving frequency of the source driver 6003 can be kept about the same as compared to the structure shown in FIG. 45 where the first and second latch circuits are provided one by one. In addition, in the case of performing driving, for example, such that one gate selection period is divided into four with the structure in FIG. 45, the driving frequency of the source driver 6003 is increased to be four times as large, compared to the case where the gate selection period is not divided, whereas in the structure in FIG. 60, the driving frequency of the source driver 6003 is only required to be increased twice as large. That is, the structure of the source driver 6003 in FIG. 60 is advantageous as compared to the structure in FIG. 45 in power consumption, yield, reliability, and the like.

Note that the source driver or a part of it (e.g., a current source circuit, a level shifter, or the like) is not necessarily provided over the same substrate as the pixel portion 3401, and may be constructed with an external IC chip.

Figure 46:
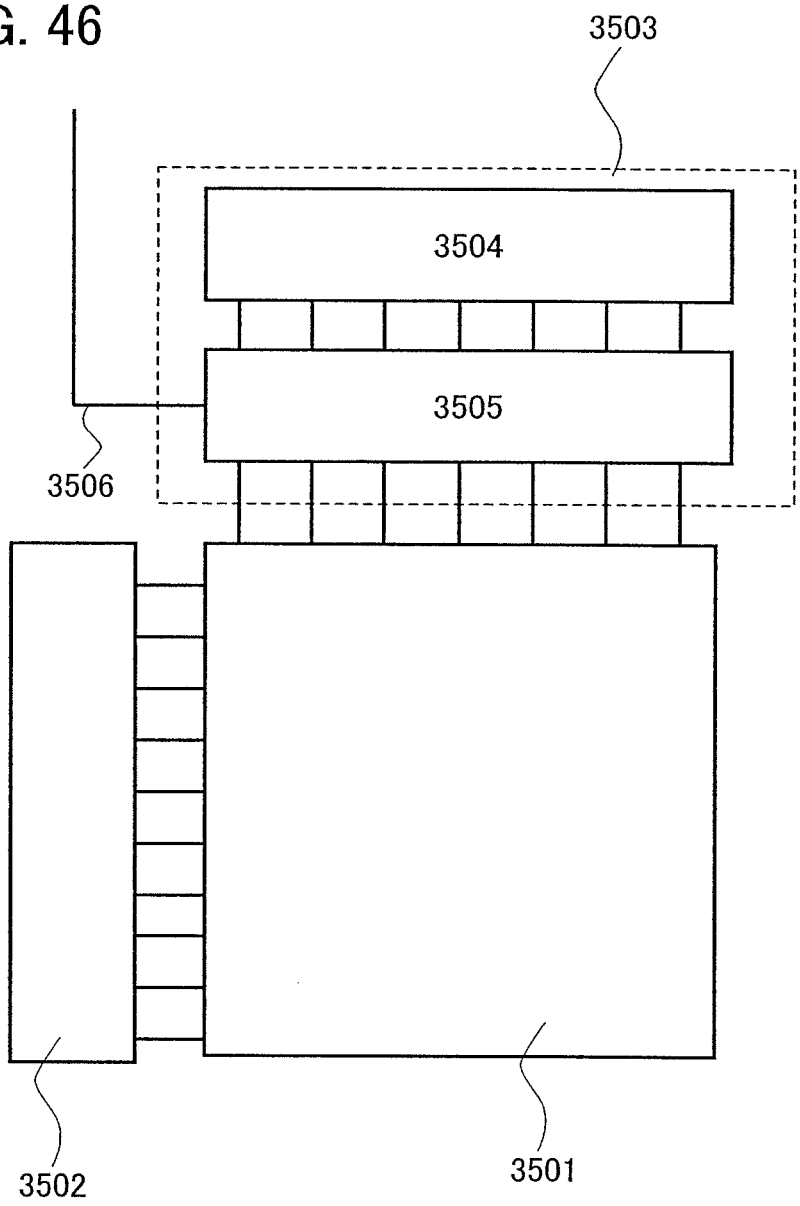
FIG. 46 shows a display device of Embodiment Mode 26.

Note that the structures of the source driver and the gate driver are not limited to those in FIGS. 45 and 60. For example, there is a case where signals are supplied to pixels by a dot sequential driving method. FIG. 46 shows an example of a source driver 3503 in that case. The source driver 3503 includes a shift register 3504 and a sampling circuit 3505. The shift register 3504 outputs sampling pulses to the sampling circuit 3505. Video signals, which are inputted form a video signal line 3506 are inputted to a pixel portion 3501 in accordance with the sampling pulses. Then, signals are sequentially inputted to pixels of a row selected by a gate driver 3402.

As is described already, transistors of the present invention may be any type of transistors, and formed over any substrate. Therefore, all the circuits as shown in FIGS. 45, 46, and 60 may be formed over a glass substrate, a plastic substrate, a single crystalline substrate, or an SOI substrate. Alternatively, a part of the circuits in FIGS. 45, 46, and 60 may be formed over one substrate, while another part of the circuits may be formed over another substrate. That is, not all the circuits in FIGS. 45, 46, and 60 are required to be formed over one substrate. For example, in FIGS. 45, 46, and 60, the pixel portion 3401 and the gate driver 3402 may be formed over a glass substrate using TFTs, while the source driver 3403 (or a part thereof) may be formed over a single crystalline substrate as an IC chip, and then the IC chip may be mounted onto the glass substrate by COG (Chip On Glass) bonding. Alternatively, the IC chip may be connected to the glass substrate by TAB (Tape Auto Bonding) or with a printed substrate.

Note that the descriptions in this embodiment mode correspond to the one utilizing the descriptions in Embodiment Modes 1 to 3. Accordingly, the descriptions in Embodiment Modes 1 to 3 can be applied to this embodiment mode.

[Embodiment 1]

Figure 24A:
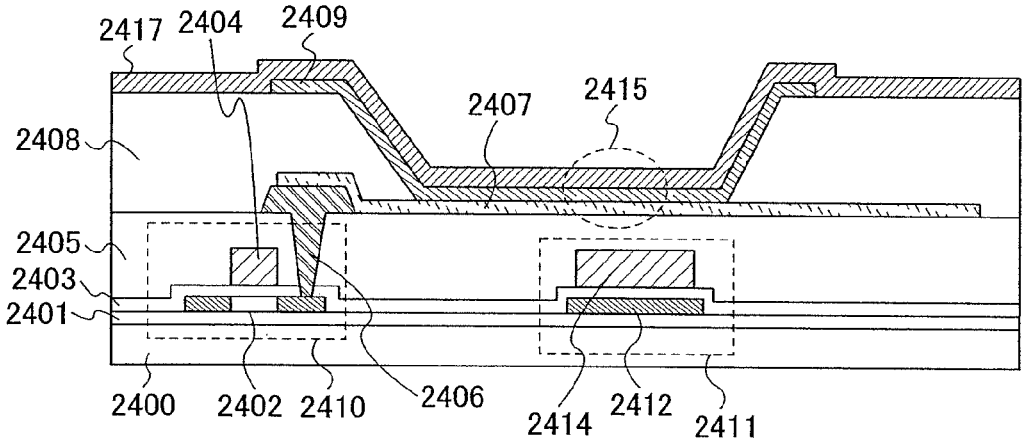
FIGS. 24A and 24B show display devices of Embodiment 1.
Figure 24B:
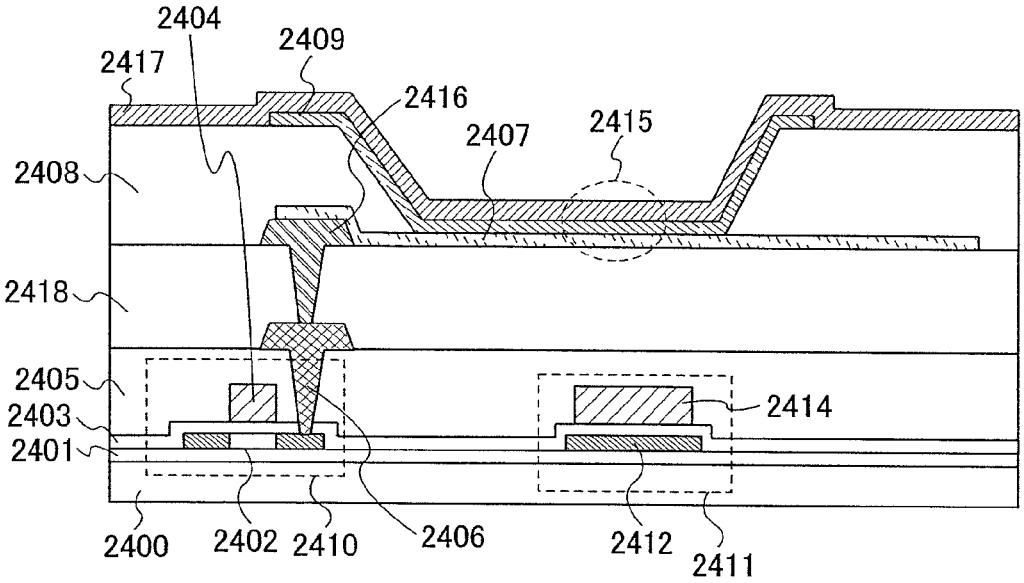

In this embodiment, description is made on an example of a pixel structure. FIGS. 24A and 24B are cross-sectional views of a pixel in a panel described in Embodiment Modes 21 to 25. An example where a TFT is used as a switching element provided in a pixel and a light-emitting element is used as a display medium provided in a pixel.

In this embodiment, a description is made on a display device having pixels with a structure described in embodiment modes with reference to FIGS. 47 to 52. Examples of the structure are shown in FIGS. 1, 3, and 5.

The gate signal line 4707 in FIG. 47 corresponds to the gate signal line 104 in FIGS. 1, 3, and 5. The source signal line 4706 in FIG. 47 corresponds to the source signal line 103 in FIGS. 3 and 5. The power supply line 4705 in FIG. 47 corresponds to the power supply line R105, the power supply line G106, or the power supply line B107 in FIGS. 3 and 5.

The gate signal line 4807 in FIG. 48 corresponds to the gate signal line 104 in FIGS. 1, 3, and 5. The source signal line 4806 in FIG. 48 corresponds to the source signal line 103 in FIGS. 3 and 5. The power supply line 4805 in FIG. 48 corresponds to the power supply line R105, the power supply line G106, or the power supply line B107 in FIGS. 3 and 5.

The gate signal line 4907 in FIG. 49 corresponds to the gate signal line 104 in FIGS. 1, 3, and 5. The source signal line 4906 in FIG. 49 corresponds to the source signal line 103 in FIGS. 3 and 5. The power supply line 4905 in FIG. 49 corresponds to the power supply line R105, the power supply line G106, or the power supply line B107 in FIGS. 3 and 5.

The gate signal line 5007 in FIG. 50 corresponds to the gate signal line 104 in FIGS. 1, 3, and 5. The source signal line 5006 in FIG. 50 corresponds to the source signal line 103 in FIGS. 3 and 5. The power supply line 5005 in FIG. 50 corresponds to the power supply line R105, the power supply line G106, or the power supply line B107 in FIGS. 3 and 5.

The gate signal line 5107 in FIG. 51 corresponds to the gate signal line 104 in FIGS. 1, 3, and 5. The source signal line 5106 in FIG. 51 corresponds to the source signal line 103 in FIGS. 3 and 5. The power supply line 5105 in FIG. 51 corresponds to the power supply line R105, the power supply line G106, or the power supply line B107 in FIGS. 3 and 5.

The gate signal line 5207 in FIG. 52 corresponds to the gate signal line 104 in FIGS. 1, 3, and 5. The source signal line 5206 in FIG. 52 corresponds to the source signal line 103 in FIGS. 3 and 5. The power supply line 5205 in FIG. 52 corresponds to the power supply line R105, the power supply line G106, or the power supply line B107 in FIGS. 3 and 5.

Note that other wires shown in FIGS. 47 to 52 are not shown in FIGS. 1 to 6.

In FIGS. 24A and 24B, reference numeral 2400 denotes a substrate; 2401, a base film; 2402, a semiconductor layer; 2412, a semiconductor layer; 2403, a first insulating film; 2404, a gate electrode; 2414, an electrode; 2405, a second insulating film; 2406, a first electrode; 2407, a second electrode; 2408, a third insulating film; 2409, a light-emitting layer; and 2417, a third electrode. Reference numeral 2410 denotes a TFT; 2415, a light-emitting element; and 2411, a capacitor. In FIGS. 24A and 24B, the TFT 2410 and the capacitor 2411 are shown as typical examples of the elements included in a pixel. A structure of FIG. 24A is described first.

As the substrate 2400, a glass substrate such as barium borosilicate glass or alumino borosilicate glass, a quartz substrate, a ceramic substrate, or the like can be used. Alternatively, a metal substrate containing stainless steel or a semiconductor substrate having a surface over which an insulating film is formed can be used. A substrate formed of a flexible synthetic resin such as plastic can also be used. The surface of the substrate 2400 may be planarized by polishing such as CMP.

As the base film 2401, an insulating film containing silicon oxide, silicon nitride, silicon nitride oxide, or the like can be used. The base film 2401 can prevent diffusion of alkali metals such as Na or alkaline earth metals contained in the substrate 2400 into the semiconductor layer 2402, which would otherwise adversely affect the characteristics of the TFT 2410. Although the base film 2401 is formed in a single layer in FIG. 24A, it may have two or more layers. Note that the base film 2401 is not necessarily provided in the case where diffusion of impurities is not of a big problem, for example in the case of using a quartz substrate.

As the semiconductor layer 2402 and the semiconductor layer 2412, a patterned crystalline semiconductor film or amorphous semiconductor film can be used. The crystalline semiconductor film can be obtained by crystallizing an amorphous semiconductor film. As the crystallization method, laser crystallization, thermal crystallization using RTA or an annealing furnace, thermal crystallization using metal elements which promote crystallization or the like can be used. The semiconductor layer 2402 includes a channel formation region and a pair of impurity regions doped with an impurity element which imparts a conductivity type. Note that another impurity region which is doped with the foregoing impurity elements so as to form a lower concentration may be provided between the channel formation region and the pair of impurity regions. The semiconductor layer 2412 may have such a structure that the entire layer is doped with an impurity element which imparts a conductivity type.

The first insulating film 2403 can be formed of silicon oxide, silicon nitride, silicon nitride oxide or the like, and formed by either a single layer or stacking a plurality of layers.

Note that the first insulating film 2403 may be formed by a film containing hydrogen so as to hydrogenate the semiconductor layer 2402.

The gate electrode 2404 and the electrode 2414 may be formed of one element selected from Ta, W, Ti, Mo, Al, Cu, Cr, and Nd, or an alloy or a compound containing plurality of such elements, and formed by either a single layer or stacked layer structure.

The TFT 2410 is formed to have the semiconductor layer 2402, the gate electrode 2404, and the first insulating film 2403 sandwiched between the semiconductor layer 2402 and the gate electrode 2404. Although FIG. 24 shows only the TFT 2410 connected to the second electrode 2407 of the light-emitting element 2415 as a TFT included in a pixel, a plurality of TFTs is may be provided. In addition, although this embodiment illustrates the TFT 2410 as a top-gate transistor, the TFT 2410 may be a bottom-gate transistor having a gate electrode below a semiconductor layer, or a dual-gate transistor having gate electrodes above and below a semiconductor layer.

The capacitor 2411 is formed to have the first insulating film 2403 as a dielectric, and the semiconductor layer 2412 and the electrode 2414 as a pair of electrode facing each other with the first insulating film 2403 sandwiched therebetween. Although FIG. 24 illustrates an example of a capacitor included in the pixel, where the semiconductor layer 2412 which is formed concurrently with the semiconductor layer 2402 of the TFT 2410 is used as one of the pair of electrodes, while the electrode 2414 which is formed concurrently with the gate electrode 2404 of the TFT 2410 is used as the other electrode, the present invention is not limited to such a structure.

The second insulating film 2405 may be formed to have either a single layer or stacked layers, using an inorganic insulating film or an organic insulating film. As the inorganic insulating film, there is a silicon oxide film formed by CVD or a silicon oxide film formed by SOG (Spin On Glass). As the organic insulating film, a film formed of polyimide, polyamide, BCB (benzocyclobutene), acrylic, a positive photosensitive organic resin, a negative photosensitive organic resin, or the like can be used.

The second insulating film 2405 may also be formed of a material having a skeletal structure with the bond of silicon (Si) and oxygen (O). As a substituent of such a material, an organic group containing at least hydrogen (e.g., an alkyl group or aromatic hydrocarbon) is used. Alternatively, a fluoro group may be used as the substituent or both the fluoro group and the organic group containing at least hydrogen may be used as the substituent.

Note that the surface of the second insulating film 2405 may be nitrided by high-density plasma treatment. High-density plasma is generated by using a microwave with a high frequency of 2.45 GHz, for example. Note that as the high-density plasma, plasma with an electron density of 2415 $cm^{-3}$ or more and an electron temperature of 0.2 to 2.0 eV (preferably, 0.5 to 1.5 eV) is used. Since the high-density plasma which has a feature of low electron temperature has low kinetic energy of activated species, a less defective film with less plasma damage can be formed as compared with that formed by a conventional plasma treatment. In performing high-density plasma treatment, the substrate 2400 is set at a temperature of 350 to 450° C. In addition, the distance between an antenna for generating microwaves and the substrate 2400 in an apparatus for generating high-density plasma is set to 20 to 80 mm (preferably, 20 to 60 mm).

The surface of the second insulating film 2405 is nitrided by performing the foregoing high-density plasma treatment under an atmosphere containing nitrogen (N) and a rare gas (at least one of He, Ne, Ar, Kr, and Xe), an atmosphere containing nitrogen, hydrogen (H), and a rare gas, or an atmosphere containing $NH_3$ and a rare gas. The surface of the second insulating film 2405 formed by such nitridation treatment with high-density plasma is mixed with elements such as H, He, Ne, Ar, Kr, or Xe. For example, by using a silicon oxide film or a silicon oxynitride film as the second insulating film 2405 and treating the surface of the film with high-density plasma, a silicon nitride film is formed. Hydrogen contained in the silicon nitride film formed in this manner may be used for hydrogenating the semiconductor layer 2402 of the TFT 2410. Note that this hydrogenation treatment may be combined with the foregoing hydrogenation treatment using hydrogen contained in the first insulating film 2403.

Note that another insulating film may be formed over the nitride film formed by the high-density plasma treatment, so as to be used as the second insulating film 2405.

The first electrode 2406 may be formed of one element selected from Al, Ni, C, W, Mo, Ti, Pt, Cu, Ta, Au, Mn, or an alloy or compound containing plurality of such elements, and formed by either a single layer or stacked layer structure.

Either or both the second electrode 2407 and the third electrode 2417 can be formed as a transparent electrode. The transparent electrode can be formed of indium oxide containing tungsten oxide (IWO), indium oxide containing tungsten oxide and zinc oxide (IWZO), indium oxide containing titanium oxide (ITiO), indium tin oxide containing titanium oxide (ITTiO), or the like. Needless to say, indium tin oxide (ITO), indium zinc oxide (IZO), indium tin oxide to which silicon oxide is added (ITSO), or the like may be used.

The light-emitting layer is preferably formed by a plurality of layers having different functions, such as a hole injecting/transporting layer, a light-emitting layer, and an electron injecting/transporting layer.

The hole injecting/transporting layer is preferably formed of a composite material of an organic compound material having a hole transporting property and an inorganic compound material which exhibits an electron accepting property with respect to the organic compound material. By using such a structure, many hole carriers are generated in the organic compound which inherently has few carriers, thereby an excellent hole injecting/transporting property can be obtained. Due to such an effect, a driving voltage can be suppressed compared to the conventional structure. Further, since the hole injecting/transporting layer can be formed thick without increasing the driving voltage, short circuit of the light-emitting element resulting from dust or the like can be also suppressed.

As an organic compound material having a hole transporting property, there is, for example, 4,4',4"-tris[N-(3-methylphenyl)-N-phenylamino]triphenylamine (abbreviation: MTDATA); 1,3,5-tris[N,N-di(m-tolyl)amino]benzene (abbreviation: m-MTDAB); N,N'-diphenyl-N,N'-bis(3-methylphenyl)-1,1'-biphenyl-4,4'-diamine (abbreviation: TPD); 4,4'-bis[N-(1-naphthyl)-N-phenylamino]biphenyl (abbreviation: NPB); or the like. However, the present invention is not limited to these materials.

As an inorganic compound material which exhibits an electron accepting property, there is, for example, titanium oxide, zirconium oxide, vanadium oxide, molybdenum oxide, tungsten oxide, rhenium oxide, ruthenium oxide, zinc oxide, or the like. In particular, vanadium oxide, molybdenum oxide, tungsten oxide, and rhenium oxide are preferable since they can be deposited in vacuum, and thus are easy to be handled.

The electron injecting/transporting layer is formed of an organic compound material having an electron transporting property. Specifically, there is tris(8-quinolinolato)aluminum (abbreviation: $Alq_3$), tris(4-methyl-8-quinolinolato)aluminum (abbreviation: $Almq_3$), or the like. However, the present invention is not limited to these.

The light-emitting layer can be formed of, for example, 9,10-di(2-naphthyl)anthracene (abbreviation: DNA); 9,10-di(2-naphthyl)-2-tert-butylanthracene (abbreviation: t-BuDNA); 4,4'-bis(2,2-diphenylvinyl)biphenyl (abbreviation: DPVBi); coumarin 30; coumarin 6; coumarin 545; coumarin 545T; perylene; rubrene; periflanthene; 2,5,8,11-tetra(tert-butyl)perylene (abbreviation: TBP); 9,10-diphenylanthracene (abbreviation: DPA); 5,12-diphenylanthracene; 4-(dicyanomethylene)-2-methyl-(p-dimethylaminostyryl)-4H-pyran (abbreviation: DCM1); 4-(dicyanomethylene)-2-methyl-6-[2-(julolidine-9-yl)ethenyl]-4H-pyran (abbreviation: DCM2); 4-(dicyanomethylene)-2,6-bis[p-(dimethylamino)styryl]-4H-pyran (abbreviation: BisDCM); or the like. Alternatively, the following compounds capable of generating phosphorescence can be used: bis[2-(4',6'-difluorophenyl)pyridinato-N,$C^{2'}$]iridium(III)picolinate (FIrpic); bis{2-[3',5'-bis(trifluoromethyl)phenyl]pyridinato-N,$C^{2'}$}iridium(picolinate) (abbreviation: $Ir(CF_3\ ppy)_2(pic)$); tris(2-phenylpyridinato-N,$C^{2'}$)iridium (abbreviation: $Ir(ppy)_3$); bis(2-phenylpyridinato-N,$C^{2'}$)iridium(acetylacetonate) (abbreviation: $Ir(ppy)_2(acac)$); bis[2-(T-thienyl)pyridinato-N,$C^{3'}$]iridium(acetylacetonate) (abbreviation: $Ir(thp)_2(acac)$); bis(2-phenylquinolinato-N,$C^{2'}$)iridium(acetylacetonate) (abbreviation: $Ir(pq)_2(acac)$); bis[2-(2'-benzothienyl)pyridinato-N,$C^{3'}$]iridium(acetylacetonate) (abbreviation: $Ir(btp)_2(acac)$); or the like.

Further alternatively, the light-emitting layer may be formed of an electroluminescent polymeric material such as a polyparaphenylene-vinylene-based material, a polyparaphenylene-based material, a polythiophene-based material, or a polyfluorene-based material.

In any case, the layer structure of the light-emitting layer may change, and modification is possible as long as a light-emitting element can be formed. For example, such a structure can be employed where no specific hole or electron injecting/transporting layer is provided, but instead, a substitute electrode layer for this purpose is provided or a light-emitting material is dispersed in the layer.

The other of the first electrode 2407 or the third electrode 2417 may be formed of a material which does not transmit light. For example, it may be formed of alkali metals such as Li and Cs, alkaline earth metals such as Mg, Ca, or Sr, alloys containing such metals (e.g., Mg:Ag, Al:Li, or Mg:In), compounds containing such metals (e.g., $CaF_2$ or CaN), or rare earth metals such as Yb or Er.

The third insulating film 2408 can be formed of a material similar to that of the second insulating film 2405. The third insulating film 2408 is formed on the periphery of the second electrode 2407 so as to cover the edge of the second electrode 2407, and has a function of separating the light-emitting layers 2409 of adjacent pixels.

The light-emitting layer 2409 is formed by a single layer or a plurality of layers. In the case where the light-emitting layer 2409 is formed by a plurality of layers, the layers can be classified into a hole injecting layer, a hole transporting layer, a light-emitting layer, an electron transporting layer, an electron injecting layer, and the like, in terms of the carrier transporting properties. Note that the boundary between the respective layers is not necessarily clear, and there may be a case where materials forming adjacent layers are partially mixed with each other, which makes the interface therebetween unclear. Each layer can be formed of an organic material or an inorganic material. The organic material may be any of high molecular, medium molecular, and low molecular materials.

The light-emitting element 2415 is formed to have the light-emitting layer 2409 and the second electrode 2407 and the third electrode 2417 which overlap each other with the light-emitting element 2409 sandwiched therebetween. One of the second electrode 2407 or the third electrode 2417 corresponds to an anode, while the other corresponds to a cathode. When forward-bias voltage which is higher than the threshold voltage is applied between the anode and the cathode of the light-emitting element 2415, current flows from the anode to the cathode, and thus the light-emitting element 2415 emits light.

A structure of FIG. 24B is described next. Note that common portions between FIGS. 24A and 24B are denoted by same reference numerals, and thus the description thereon will be omitted.

FIG. 24B shows a structure where another insulating film 2418 is provided between the second insulating film 2405 and the third insulating film 2408 in FIG. 24A. The second electrode 2416 and the first electrode 2406 are connected in a contact hole provided in the insulating film 2418.

The insulating film 2418 can be formed to have a structure similar to that of the second insulating film 2405. The second electrode 2416 can be formed to have a structure similar to that of the first electrode 2406.

[Embodiment 2]

Figure 28A:
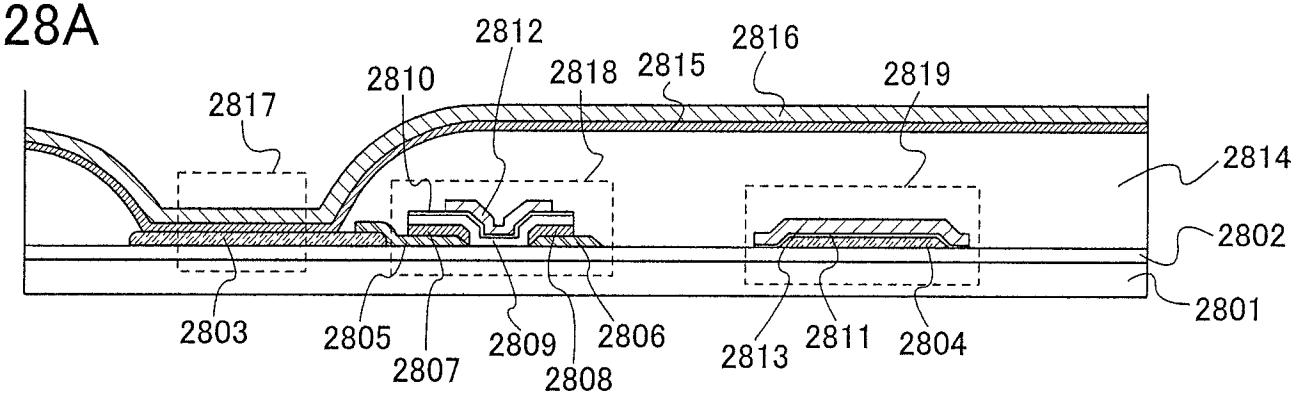
FIGS. 28A and 28B show a display device of Embodiment 2.
Figure 28B:
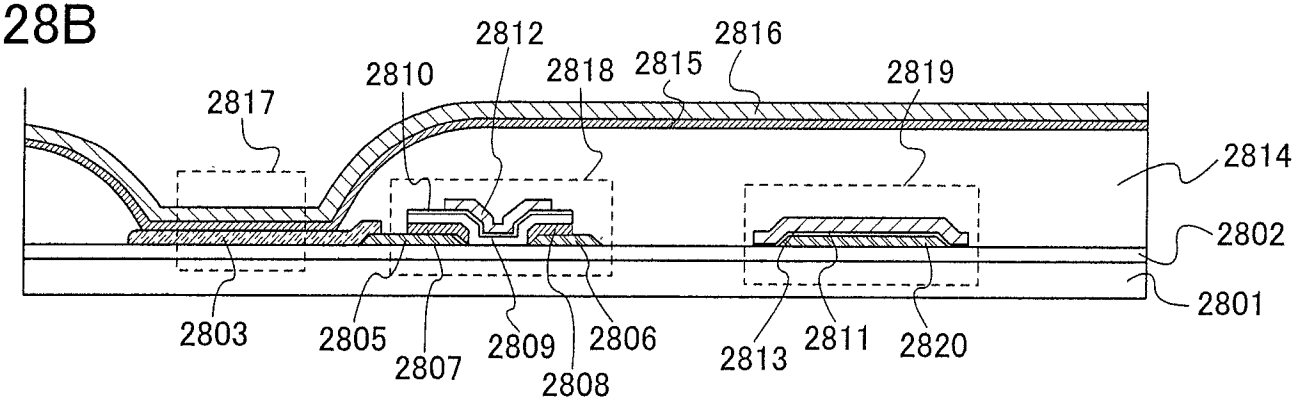

In this embodiment, description is made on a case where an amorphous silicon film is used as a semiconductor layer of a transistor. FIGS. 28A and 28B show top-gate transistors, while FIGS. 29A to 30B show bottom-gate transistors.

FIG. 28A shows a cross section of a transistor with a top-gate structure, where amorphous silicon is used for a semiconductor layer. As shown in FIG. 28A, a base film 2802 is formed over a substrate 2801. Further, a pixel electrode 2803 is formed over the base film 2802. In addition, a first electrode 2804 is formed of the same material and in the same layer as the pixel electrode 2803.

The substrate may be a glass substrate, a quartz substrate, a ceramic substrate, or the like. In addition, the base film 2802 may be formed of aluminum nitride (AlN), silicon oxide, silicon oxynitride ($SiO_xN_y$), and the like, and is formed by either a single layer or stacked layers.

Further, wires 2805 and 2806 are formed over the base film 2802, and the edge of the pixel electrode 2803 is covered with the wire 2805. N-type semiconductor layers 2807 and 2808 each having n-type conductivity are formed over the wires 2805 and 2806, respectively. In addition, a semiconductor layer 2809 is formed between the wires 2805 and 2806, and over the base film 2802. A part of the semiconductor layer 2809 is extended to cover the n-type semiconductor layers 2807 and 2808. Note that the semiconductor layer is formed by an amorphous semiconductor film such as amorphous silicon (a-Si:H), a microcrystalline semiconductor (μ-Si:H), or the like. A gate insulating film 2810 is formed over the semiconductor layer 2809. In addition, an insulating film 2811 is formed of the same material and in the same layer as the gate insulating film 2810, over the first electrode 2804. Note that the gate insulating film 2810 is formed by a silicon oxide film, a silicon nitride film, or the like.

A gate electrode 2812 is formed over the gate insulating film 2810. In addition, a second electrode 2813 is formed of the same material and in the same layer as the gate electrode, over the first electrode 2804 with the insulating film 2811 sandwiched therebetween. Thus, a capacitor 2819 is formed, in which the insulating film 2811 is sandwiched between the first electrode 2804 and the second electrode 2813. An interlayer insulating film 2814 is formed covering edges of the pixel electrode 2803, a driving transistor 2818, and the capacitor 2819.

A layer 2815 containing an organic compound and a counter electrode 2816 are formed over the interlayer insulating film 2814 and the pixel electrode 2803 positioned in an opening of the interlayer insulating film 2814. A light-emitting element 2817 is formed in a region where the layer 2815 containing an organic compound is sandwiched between the pixel electrode 2803 and the counter electrode 2816.

The first electrode 2804 shown in FIG. 28A may be replaced with a first electrode 2820 as shown in FIG. 28B. The first electrode 2820 is formed of the same material and in the same layer as the wires 2805 and 2806.

Figure 29A:
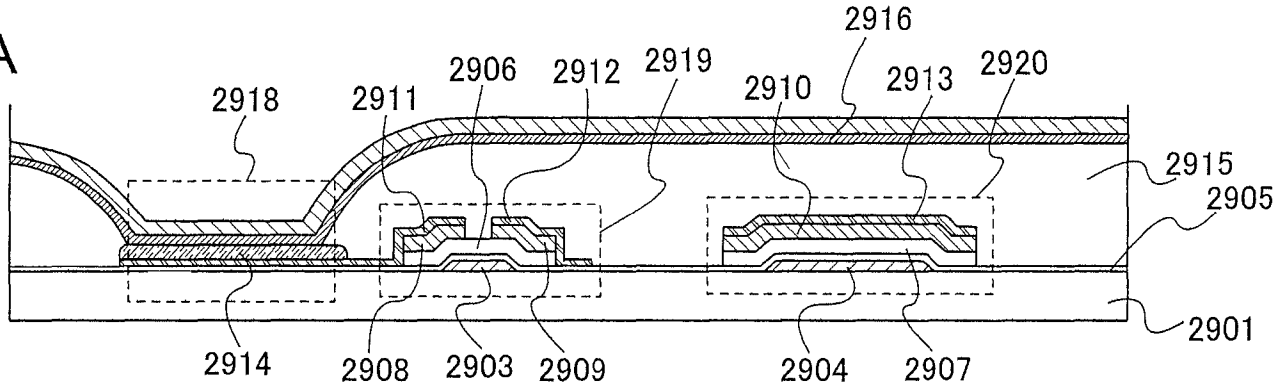
FIGS. 29A and 29B show a display device of Embodiment 2.
Figure 29B:
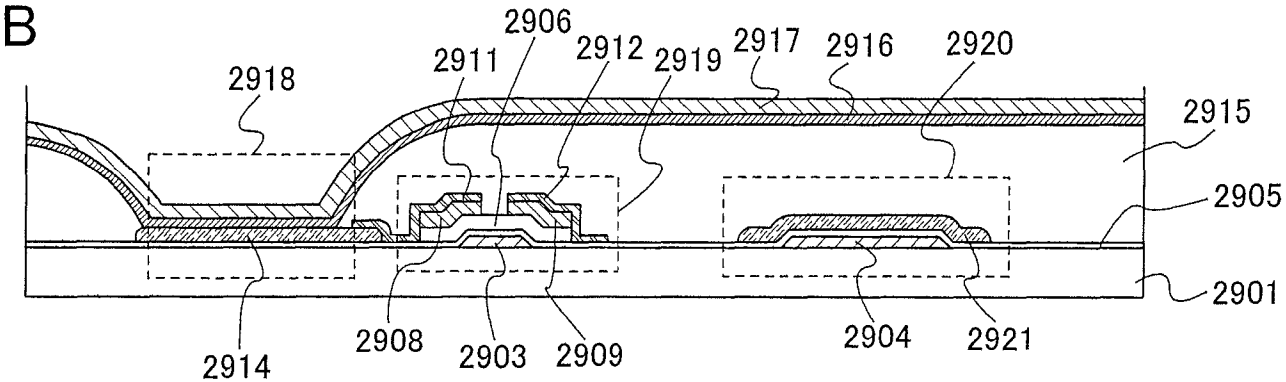

FIGS. 29A and 29B show partial cross-sectional views of a panel of a semiconductor device which has a bottom-gate transistor using amorphous silicon for its semiconductor layer.

A gate electrode 2903 is formed over a substrate 2901. In addition, a first electrode 2904 is formed of the same material and in the same layer as the gate electrode 2903. As a material of the gate electrode 2903, polycrystalline silicon to which phosphorus is added can be used. Silicide which is a compound of a metal and silicon may be used as well as the polycrystalline silicon.

In addition, a gate insulating film 2905 is formed to cover the gate electrode 2903 and the first electrode 2904. The gate insulating film 2905 is formed by a silicon oxide film, a silicon nitride film, or the like.

A semiconductor layer 2906 is formed over the gate insulating film 2905. In addition, a semiconductor layer 2907 is formed of the same material and in the same layer as the semiconductor layer 2906. The substrate may be any of a glass substrate, a quartz substrate, a ceramic substrate, and the like.

N-type semiconductor layers 2908 and 2909 each having n-type conductivity are formed over the semiconductor layer 2906, while an n-type semiconductor layer 2910 is formed over the semiconductor layer 2907.

Wires 2911 and 2912 are formed over the n-type semiconductor layers 2908 and 2909, respectively, and a conductive layer 2913 is formed of the same material and in the same layer as the wires 2911 and 2912, over the n-type semiconductor layer 2910.

A second electrode is formed to have the semiconductor layer 2907, the n-type semiconductor layer 2910, and the conductive layer 2913. Note that a capacitor 2920 is formed to have a structure where the gate insulating film 2905 is sandwiched between the second electrode and the first electrode 2904.

In addition, the edge of the wire 2911 is extended, and a pixel electrode 2914 is formed to be in contact with the top surface of the extended portion of the wire 2911.

An insulating layer 2915 is formed to cover a driving transistor 2919, the capacitor 2920, and the edge of the pixel electrode 2914.

A layer 2916 containing an organic compound and a counter electrode 2917 are formed over the pixel electrode 2914 and the insulating layer 2915. A light-emitting element 2918 is formed in a region where the layer 2916 containing an organic compound is sandwiched between the pixel electrode 2914 and the counter electrode 2917.

The semiconductor layer 2907 and the n-type semiconductor layer 2910 which serve as a part of a second electrode of the capacitor are not necessarily provided. That is, only the conductive layer 2913 may be used as the second electrode so that a capacitor is provided to have a structure where a gate insulating film is sandwiched between the first electrode 2904 and the conductive layer 2913.

Note that if the pixel electrode 2914 is formed before forming the wire 2911 shown in FIG. 29A, a capacitor 2920 shown in FIG. 29B can be formed, which has a structure where the gate insulating film 2905 is sandwiched between the first electrode 2904 and a second electrode 2921 formed by the pixel electrode 2914.

Although FIGS. 29A and 29B show examples of an inversely staggered transistor with a channel-etched structure, a transistor with a channel-protected structure may be employed as well. Next, description is made on a transistor with a channel-protected structure, with reference to FIGS. 30A and 30B.

Figure 30A:
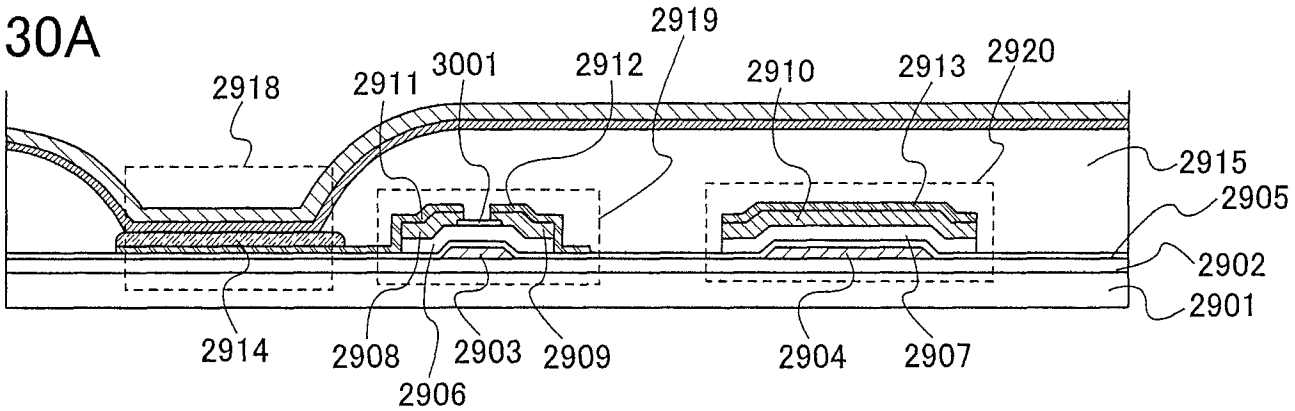
FIGS. 30A and 30B show a display device of Embodiment 2.

A transistor with a channel-protected structure shown in FIG. 30A differs from the driving transistor 2919 with a channel-etched structure shown in FIG. 29A in that an insulating layer 3001 serving as an etching mask is provided over a channel formation region in the semiconductor layer 2906. Common portions between FIGS. 29A and 30A are denoted by the same reference numerals.

Figure 30B:
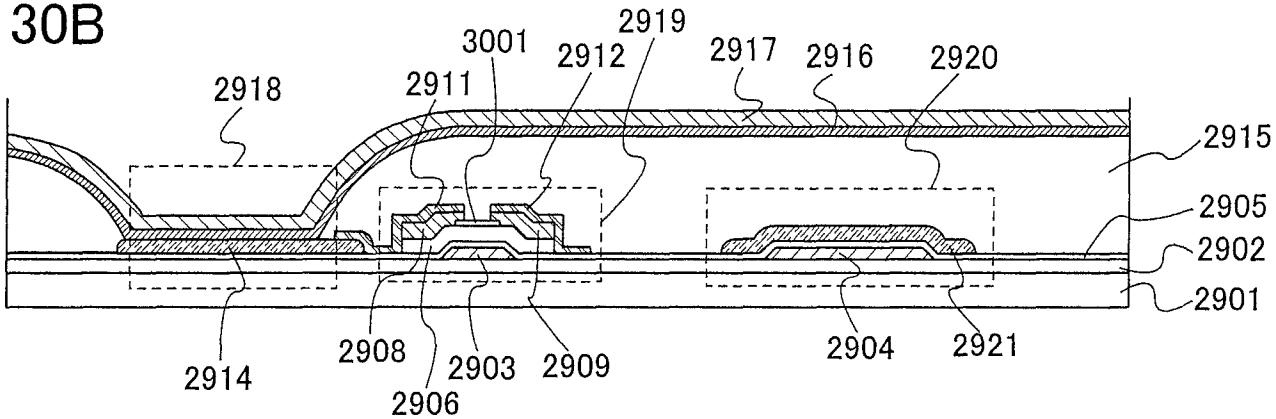

Similarly, a transistor with a channel-protected structure shown in FIG. 30B differs from the driving transistor 2919 with a channel-etched structure shown in FIG. 29B in that an insulating layer 3001 serving as an etching mask is provided over a channel formation region in the semiconductor layer 2906. Common portions between FIGS. 29B and 30B are denoted by the same reference numerals.

By using an amorphous semiconductor film for a semiconductor layer (such as a channel forming region, a source region, or a drain region) in a transistor included in a pixel of the present invention, a manufacturing cost can be reduced. For example, an amorphous semiconductor film can be applied by employing the pixel structure shown in FIGS. 6 and 7.

Note that the structures of transistors or capacitors to which the pixel structure of the present invention can be applied are not limited to the structures described above, and various structures of transistors or capacitors can be employed.

This embodiment can be conducted by freely combining with Embodiment 1.

[Embodiment 3]

In this embodiment, description is made on a method of manufacturing a display device using plasma treatment, as a method of manufacturing a display device including transistors, for example.

Figure 31A:
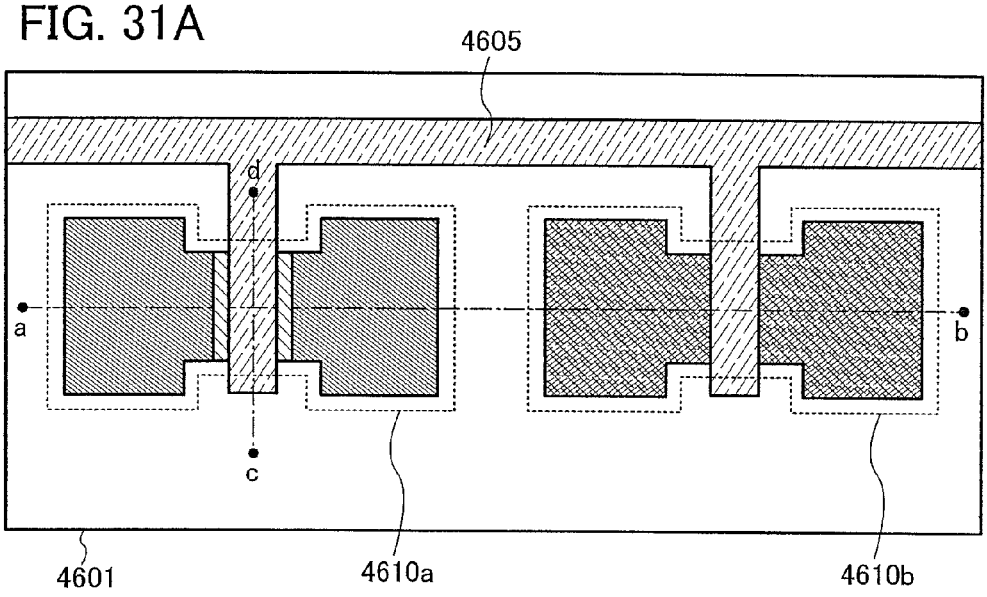
FIGS. 31A to 31C show a display device of Embodiment 3.
Figure 31B:
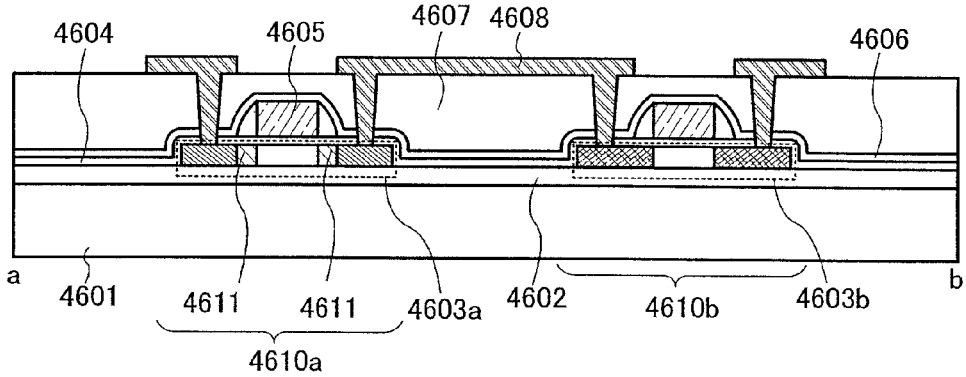
Figure 31C:
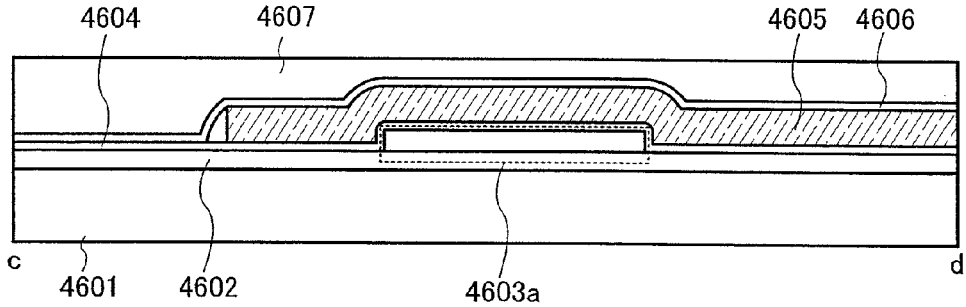

FIGS. 31A to 31C show an example of a structure of a semiconductor device including transistors. Note that FIG. 31B corresponds to a cross-sectional view taken along a line a-b in FIG. 31A, while FIG. 31C corresponds to a cross-sectional view taken along a line c-d in FIG. 31A.

The semiconductor device shown in FIGS. 31A to 31C includes semiconductor films 4603*a* and 4603*b* formed over a substrate 4601 with an insulating film 4602 sandwiched therebetween, a gate electrode 4605 formed over the semiconductor films 4603*a* and 4603*b* with a gate insulating layer 4604 sandwiched therebetween, insulating films 4606 and 4607 formed to cover the gate electrode, and a conductive film 4608 formed over the insulating film 4607 in a manner electrically connected to a source region or a drain region of the semiconductor films 4603*a* and 4603*b*. Although FIGS. 31A to 31C show a case of showing an n-channel transistor 4610*a* which uses a part of the semiconductor film 4603*a* as a channel region, and a p-channel transistor 4610*b* which uses a part of the semiconductor film 4603*b* as a channel region, the present invention is not limited to such a structure. For example, although the n-channel transistor 4610*a* is provided with LDD regions 4611, while the p-channel transistor 4610*b* is not provided with LDD regions in FIGS. 31A to 31C, such structures may be employed in that both of the transistors are provided with LDD regions or neither of the transistors is provided with LDD regions.

In this embodiment, the semiconductor device shown in FIGS. 31A to 31C is manufactured by oxidizing or nitriding a semiconductor film or an insulating film, that is, by performing oxidation or nitridation by plasma treatment to at least one layer among the substrate 4601, the insulating film 4602, the semiconductor films 4603*a* and 4603*b*, the gate insulating film 4604, the insulating film 4606, and the insulating film 4607. In this manner, by oxidizing or nitriding a semiconductor film or an insulating film by plasma treatment, the surface of the semiconductor film or the insulating film can be modified, thereby a dense insulating film can be formed compared with an insulating film formed by CVD or sputtering. Therefore, defects such as pin holes can be suppressed, and thus the characteristics and the like of the display device can be improved.

In this embodiment, description is made on a method of manufacturing a display device by oxidizing or nitriding the semiconductor films 4603*a* and 4603*b* or the gate insulating film 4604 shown in FIGS. 31A to 31C by plasma treatment, with reference to the drawings.

First, a case is shown where an island-shaped semiconductor film over a substrate is formed to have an edge with an angle of about 90°.

Figures 32A, 32B, 32C, 32D:
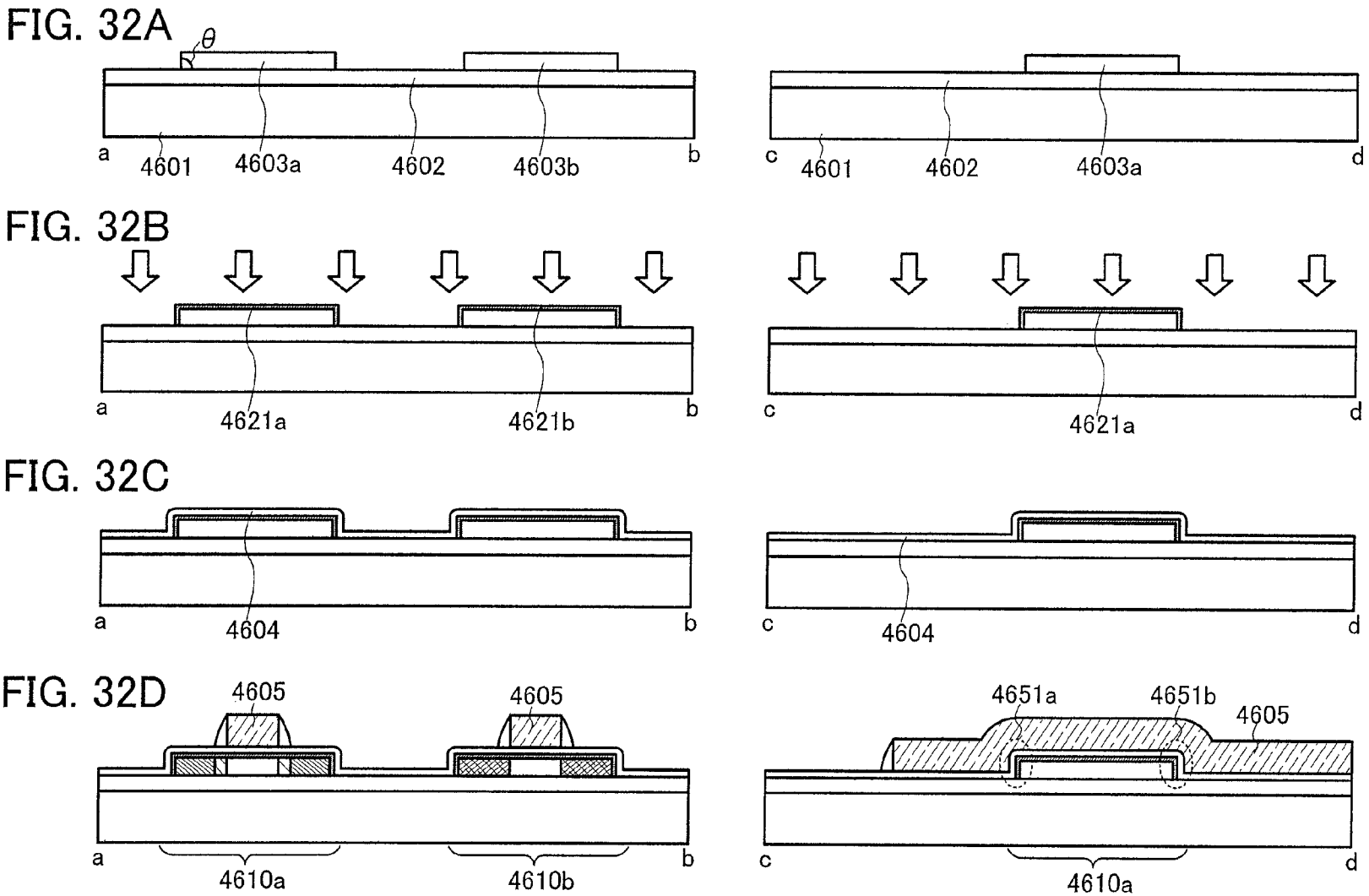
FIGS. 32A to 32D show a display device of Embodiment 3.

First, the semiconductor films 4603*a* and 4603*b* having island shapes are formed over the substrate 4601 (FIG. 32A). The island-shaped semiconductor films 4603*a* and 4603*b* can be provided by forming an amorphous semiconductor film by sputtering, LPCVD, plasma CVD, or the like using a material containing silicon (Si) as a main component (e.g., SixGe1-x) over the insulating film 4602 which is formed in advance over the substrate 4601, and then crystallizing the amorphous semiconductor film, and further etching the semiconductor film selectively. Note that the crystallization of the amorphous semiconductor film can be performed by a crystallization method such as laser crystallization, thermal crystallization using RTA or an annealing furnace, thermal crystallization using metal elements which promote crystallization, or a combination of them. Note that in FIGS. 32A to 32D, the island-shaped semiconductor films 4603*a* and 4603*b* are each formed to have an edge with an angle of about 90° (θ=85 to 100°).

Next, the semiconductor films 4603*a* and 4603*b* are oxidized or nitrided by plasma treatment to form oxide or nitride films 4621*a* and 4621*b* (hereinafter also called insulating films 4621*a* and 4621*b*) on the surfaces of the semiconductor films 4603*a* and 4603*b*, respectively (FIG. 32B). For example, when Si is used for the semiconductor films 4603*a* and 4603*b*, silicon oxide or silicon nitride is formed as the insulating films 4621*a* and 4621*b*. Further, after being oxidized by plasma treatment, the semiconductor films 4603*a* and 4603*b* may be treated with plasma again to be nitrided. In this case, silicon oxide is formed on the semiconductor films 4603*a* and 4604*b*, and then silicon nitride oxide ($SiN_xO_y$, x>y) is formed on the surface of the silicon oxide. Note that in the case of oxidizing the semiconductor film by plasma treatment, the plasma treatment is performed under an oxygen atmosphere (e.g., an atmosphere containing oxygen ($O_2$) and a rare gas (at least one of He, Ne, Ar, Kr, and Xe), an atmosphere containing oxygen, hydrogen ($H_2$), and a rare gas, or an atmosphere containing nitrous oxide and a rare gas). Meanwhile, in the case of nitriding the semiconductor film by plasma treatment, the plasma treatment is performed under a nitrogen atmosphere (e.g., an atmosphere containing nitrogen ($N_2$) and a rare gas (at least one of He, Ne, Ar, Kr, and Xe), an atmosphere containing nitrogen, hydrogen, and a rare gas, or an atmosphere containing $NH_3$ and a rare gas). As the rare gas for example, Ar can be used. Alternatively, a mixed gas of Ar and Kr may be used. Therefore, the insulating films 4621*a* and 4621*b* contain the rare gas (at least one of He, Ne, Ar, Kr, and Xe) used in the plasma treatment. In the case where Ar is used, the insulating films 4621*a* and 4621*b* contain Ar.

The plasma treatment is performed in the atmosphere containing the foregoing gas, with the conditions of an electron density of $1\times10^{11}$ to $1\times10^{13}$ $cm^{-3}$, and a plasma electron temperature of 0.5 to 1.5 eV. Since the plasma electron density is high and the electron temperature in the vicinity of the subject to be treated (here, the semiconductor films 4603*a* and 4603*b*) formed over the substrate 4601 is low, plasma damage to the subject to be treated can be prevented. In addition, since the plasma electron density is as high as $1\times10^{11}$ $cm^{-3}$ or more, an oxide or nitride film formed by oxidizing or nitriding the subject to be treated by plasma treatment is advantageous in its uniform thickness or the like as well as being dense compared with a film formed by CVD, sputtering, or the like. Further, since the plasma electron temperature is as low as 1 eV, oxidation or nitridation treatment can be performed at a low temperature compared with the conventional plasma treatment or thermal oxidation. For example, oxidation or nitridation treatment can be performed sufficiently even when plasma treatment is performed at a temperature lower than the strain point of a glass substrate by 100 degrees or more. Note that as a frequency for generating plasma, high frequencies such as microwaves (2.45 GHz) can be used. Note also that the plasma treatment is to be performed with the foregoing conditions unless otherwise specified.

Next, the gate insulating film 4604 is formed so as to cover the insulating films 4621*a* and 4621*b* (FIG. 32C). The gate insulating film 4604 can be formed by an insulating film containing oxygen or nitrogen, such as silicon oxide, silicon nitride, silicon oxynitride ($SiO_xN_y$, x>y), or silicon nitride oxide ($SiN_xO_y$, x>y) by sputtering, LPCVD, plasma CVD, or the like to have either a single-layer structure or a stacked layer structure. For example, when Si is used for the semiconductor films 4603*a* and 4603*b*, and the Si is oxidized by plasma treatment to form silicon oxide as the insulating films 4621*a* and 4621*b* on the surfaces of the semiconductor films 4603*a* and 4603*b*, silicon oxide is formed as a gate insulating film over the insulating films 4621*a* and 4621*b*. In addition, in FIG. 32B, if the insulating films 4621*a* and 4621*b* formed by oxidizing or nitriding the semiconductor films 4603*a* and 4603*b* by plasma treatment are sufficiently thick to form gate insulating films, the insulating films 4621*a* and 4621*b* can be used as the gate insulating films.

Next, by forming the gate electrodes 4605 or the like over the gate insulating film 4604, a display device having the n-channel transistor 4610*a* and the p-channel transistor 4610*b* which respectively have the island-shaped semiconductor films 4603*a* and 4603*b* as channel regions can be manufactured (FIG. 32D).

In this manner, by oxidizing or nitriding the surfaces of the semiconductor films 4603*a* and 4603*b* by plasma treatment before providing the gate insulating film 4604 over the semiconductor films 4603*a* and 4603*b*, short circuits or the like between the gate electrodes and the semiconductor films can be prevented, which would otherwise be caused by coverage defects of the gate insulating film 4604 at edges 4651*a* and 4651*b* of the channel regions. That is, if the edges of the island-shaped semiconductor films have an angle of about 90° (θ=85 to 100°), there may be a problem in that at the time when a gate insulating film is formed so as to cover the semiconductor films by CVD, sputtering, or the like, a coverage defect might be caused, resulting from breaking of the gate insulating film at the edges of the semiconductor films, or the like. However, such a coverage defect or the like can be prevented by oxidizing or nitriding the surfaces of the semiconductor films by plasma treatment in advance.

Figures 33A, 33B, 33C:
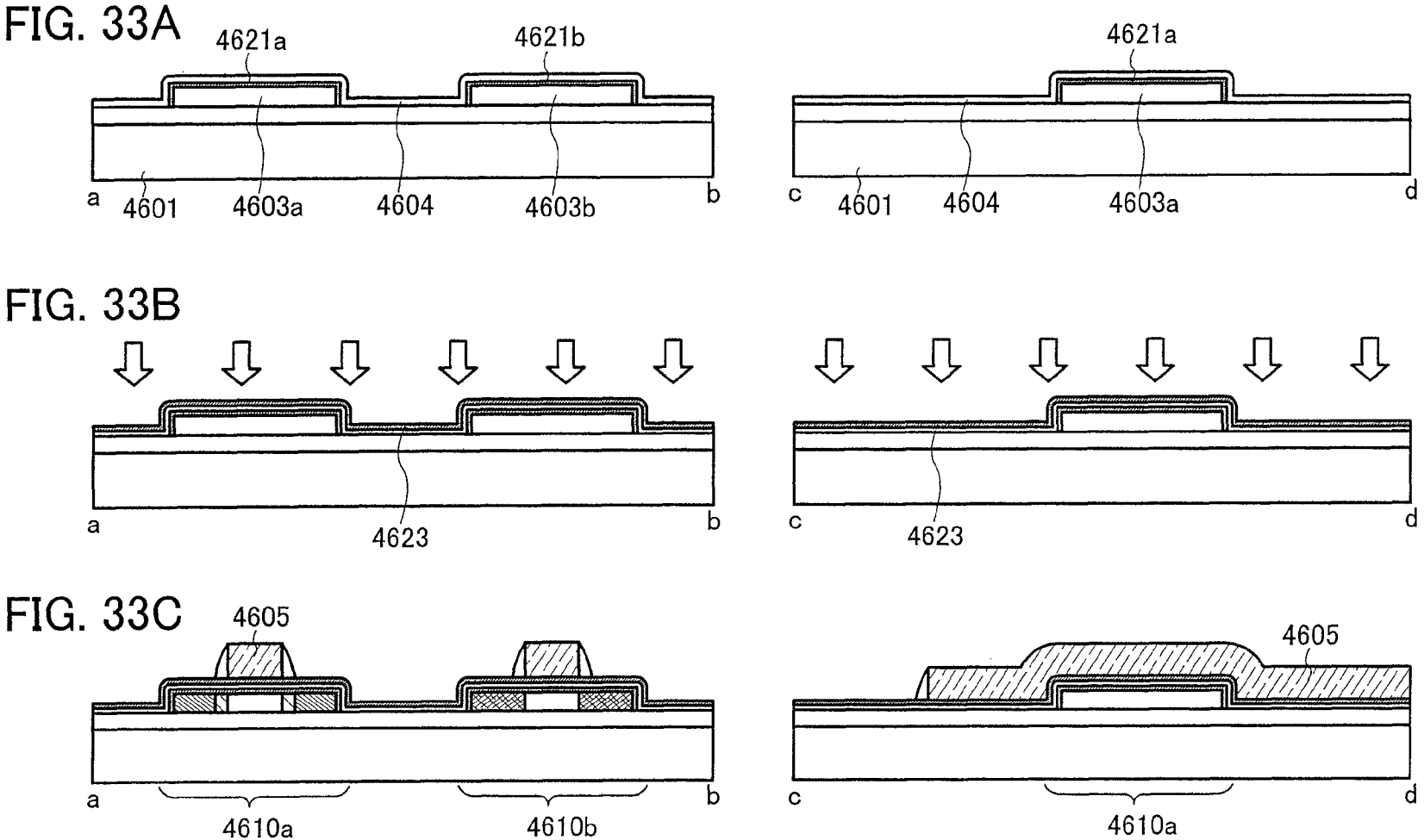
FIGS. 33A to 33C show a display device of Embodiment 3.

Alternatively, in FIGS. 32A to 32D, the gate insulating film 4604 may be formed and then, oxidized or nitrided by performing plasma treatment. In this case, an oxide or nitride film (hereinafter also referred to as an insulating film 4623) is formed on the surface of the gate insulating film 4604 (FIG. 33B) by oxidizing or nitriding the gate insulating film 4604 by performing plasma treatment to the gate insulating film 4604 which is formed to cover the semiconductor films 4603*a* and 4603*b* (FIG. 33A). The plasma treatment can be performed with conditions similar to those in FIG. 32B. In addition, the insulating film 4623 contains the rare gas which is used in the plasma treatment. For example, in the case where Ar is used, the insulating film 4623 contains Ar.

Alternatively, in FIG. 33B, after oxidizing the gate insulating film 4604 by performing plasma treatment under an oxygen atmosphere, the gate insulating film 4604 may be treated with plasma again under a nitrogen atmosphere so as to be nitrided. In this case, silicon oxide or silicon oxynitride ($SiO_xN_y$, x>y) is formed on the semiconductor films 4603*a* and 4603*b* side, and silicon nitride oxide ($SiN_xO_y$, x>y) is formed so as to be in contact with the gate electrodes 4605. After that, by forming the gate electrodes 4605 or the like over the insulating film 4623, a display device having the n-channel transistor 4610*a* and the p-channel transistor 4610*b* which respectively have the island-shaped semiconductor films 4603*a* and 4603*b* as channel regions can be manufactured (FIG. 33C). In this manner, by oxidizing or nitriding the surface of the gate insulating film by plasma treatment, the surface of the gate insulating film can be modified to form a dense film. The insulating film obtained by the plasma treatment is dense and has few defects such as pin holes compared with an insulating film formed by CVD or sputtering. Therefore, the characteristics of the transistors can be improved.

Although FIGS. 33A to 33C show the case where the surfaces of the semiconductor films 4603*a* and 4603*b* are oxidized or nitrided by performing plasma treatment to the semiconductor films 4603*a* and 4603*b* in advance, such a method may be employed in which plasma treatment is not performed to the semiconductor films 4603*a* and 4603*b*, but is performed after forming the gate insulating film 4604. In this manner, by performing plasma treatment before forming a gate electrode, a semiconductor film can be oxidized or nitrided even if the semiconductor film is exposed due to a coverage defect such as breaking of a gate insulating film at edges of the semiconductor film; therefore, short circuits or the like between the gate electrode and the semiconductor film can be prevented, which would otherwise be caused by a coverage defect of the gate insulating film at the edges of the semiconductor film.

In this manner, by oxidizing or nitriding the semiconductor films or the gate insulating film by plasma treatment, short circuits or the like between the gate electrodes and the semiconductor films can be prevented, which would otherwise be caused by a coverage defect of the gate insulating film at the edges of the semiconductor films, even if the island-shaped semiconductor films are formed to have edges with an angle of about 90°.

Next, a case is shown where the island-shaped semiconductor films formed over the substrate are formed to have tapered edges (θ=30 to 85°).

Figures 34A, 34B, 34C, 34D:
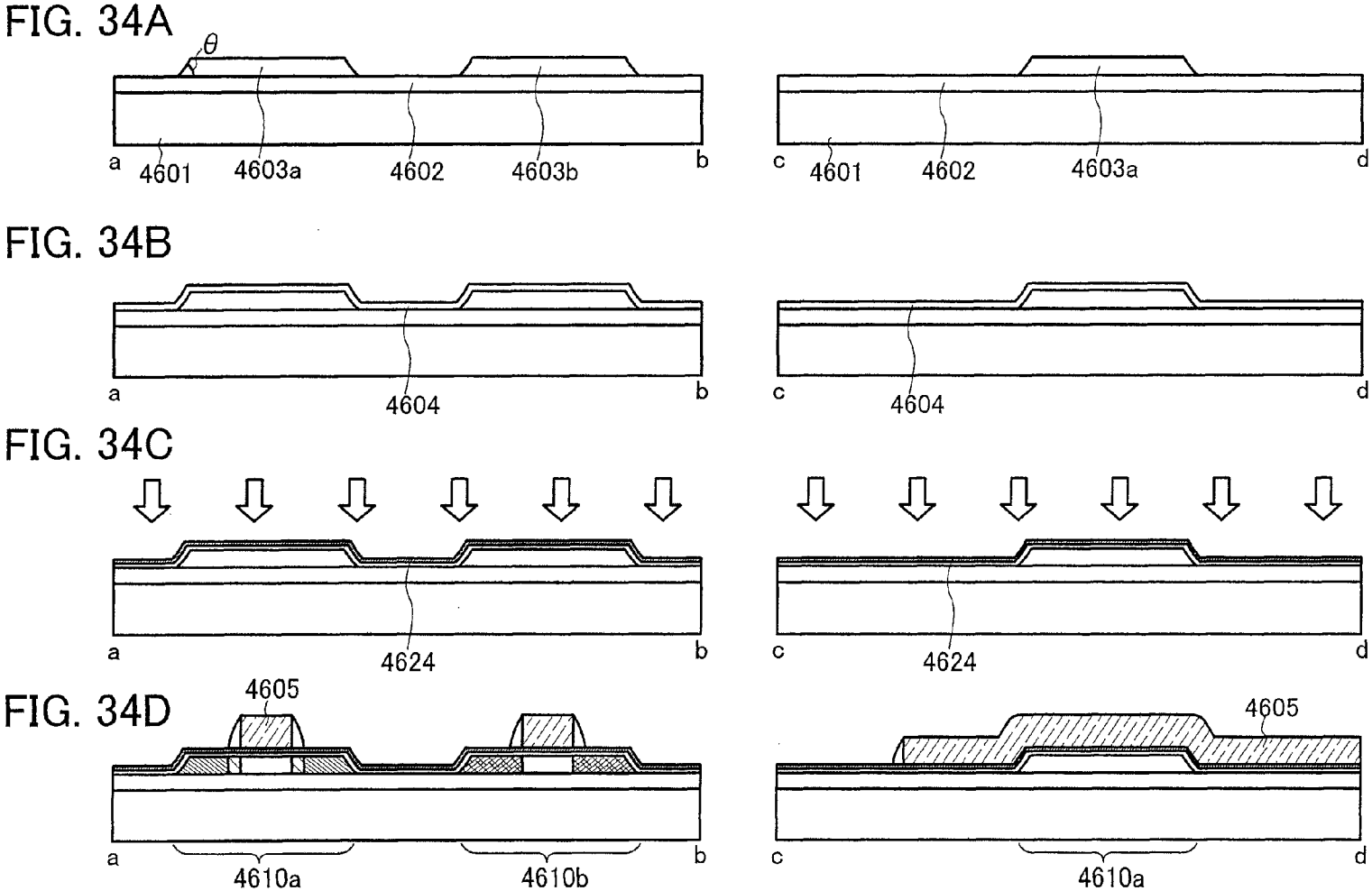
FIGS. 34A to 34D show a display device of Embodiment 3.

First, the semiconductor films 4603*a* and 4603*b* having island shapes are formed over the substrate 4601 (FIG. 34A). The island-shaped semiconductor films 4603*a* and 4603*b* can be provided by forming an amorphous semiconductor film by sputtering, LPCVD, plasma CVD, or the like using a material containing silicon (Si) as a main component (e.g., SixGe1-x) over the insulating film 4602 which is formed in advance over the substrate 4601, and then crystallizing the amorphous semiconductor film, and further etching the semiconductor film selectively. Note that the crystallization of the amorphous semiconductor film can be performed by a crystallization method such as laser crystallization, thermal crystallization using RTA or an annealing furnace, thermal crystallization using metal elements which promote crystallization, or a combination of them. Note that in FIGS. 34A to 34D, the island-shaped semiconductor films are each formed to have a tapered edge (θ=30 to 85°).

Next, the gate insulating film 4604 is formed so as to cover the insulating films 4603*a* and 4603*b* (FIG. 34B). The gate insulating film 4604 can be formed by an insulating film containing oxygen or nitrogen, such as silicon oxide, silicon nitride, silicon oxynitride ($SiO_xN_y$, x>y), or silicon nitride oxide ($SiN_xO_y$, x>y) by sputtering, LPCVD, plasma CVD, or the like to have either a single-layer structure or a stacked layer structure.

Next, an oxide or nitride film (hereinafter also referred to as an insulating film 4624) is formed on the surface of the gate insulating film 4604 by oxidizing or nitriding the gate insulating film 4604 by plasma treatment (FIG. 34C). The plasma treatment can be performed with the conditions similar to those described above. For example, if silicon oxide or silicon oxynitride ($SiO_xN_y$, x>y) is used as the gate insulating film 4604, the gate insulating film 4604 is oxidized by performing plasma treatment under an oxygen atmosphere, thereby a dense film can be formed on the surface of the gate insulating film with few defects such as pin holes compared with a gate insulating film formed by CVD, sputtering, or the like. On the other hand, if the gate insulating film 4604 is nitrided by plasma treatment under a nitrogen atmosphere, a silicon nitride oxide film ($SiN_xO_y$, x>y) can be provided as the insulating film 4624 on the surface of the gate insulating film 4604. Alternatively, after oxidizing the gate insulating film 4604 by performing plasma treatment under an oxygen atmosphere, the gate insulating film 4604 may be treated with plasma again under a nitrogen atmosphere so as to be nitrided. In addition, the insulating film 4624 contains the rare gas which is used in the plasma treatment. For example, in the case where Ar is used, the insulating film 4624 contains Ar.

Next, by forming the gate electrodes 4605 or the like over the gate insulating film 4604, a display device having the n-channel transistor 4610*a* and the p-channel transistor 4610*b* which respectively have the island-shaped semiconductor films 4603*a* and 4603*b* as channel regions can be manufactured (FIG. 34D).

In this manner, by performing plasma treatment to the gate insulating film, an insulating film formed of an oxide or nitride film can be provided on the surface of the gate insulating film, and thus the surface of the gate insulating film can be modified. Since the insulating film obtained by oxidation or nitridation with plasma treatment is dense and has few defects such as pin holes, compared with a gate insulating film formed by CVD or sputtering, the characteristics of the transistors can be improved. In addition, whereas short circuits or the like between the gate electrode and the semiconductor films can be prevented by forming the semiconductor films to have tapered edges, which would otherwise be caused by a coverage defect of the gate insulating film at the edges of the semiconductor films, short circuits or the like between the gate electrode and the semiconductor films can be prevented even more effectively by performing plasma treatment after forming the gate insulating film.

Next, description is made on a manufacturing method of a display device which differs from that in FIGS. 34A to 34C with reference to the drawings. Specifically, a case is shown where plasma treatment is selectively performed to tapered edges of semiconductor films.

Figures 35A, 35B, 35C, 35D:
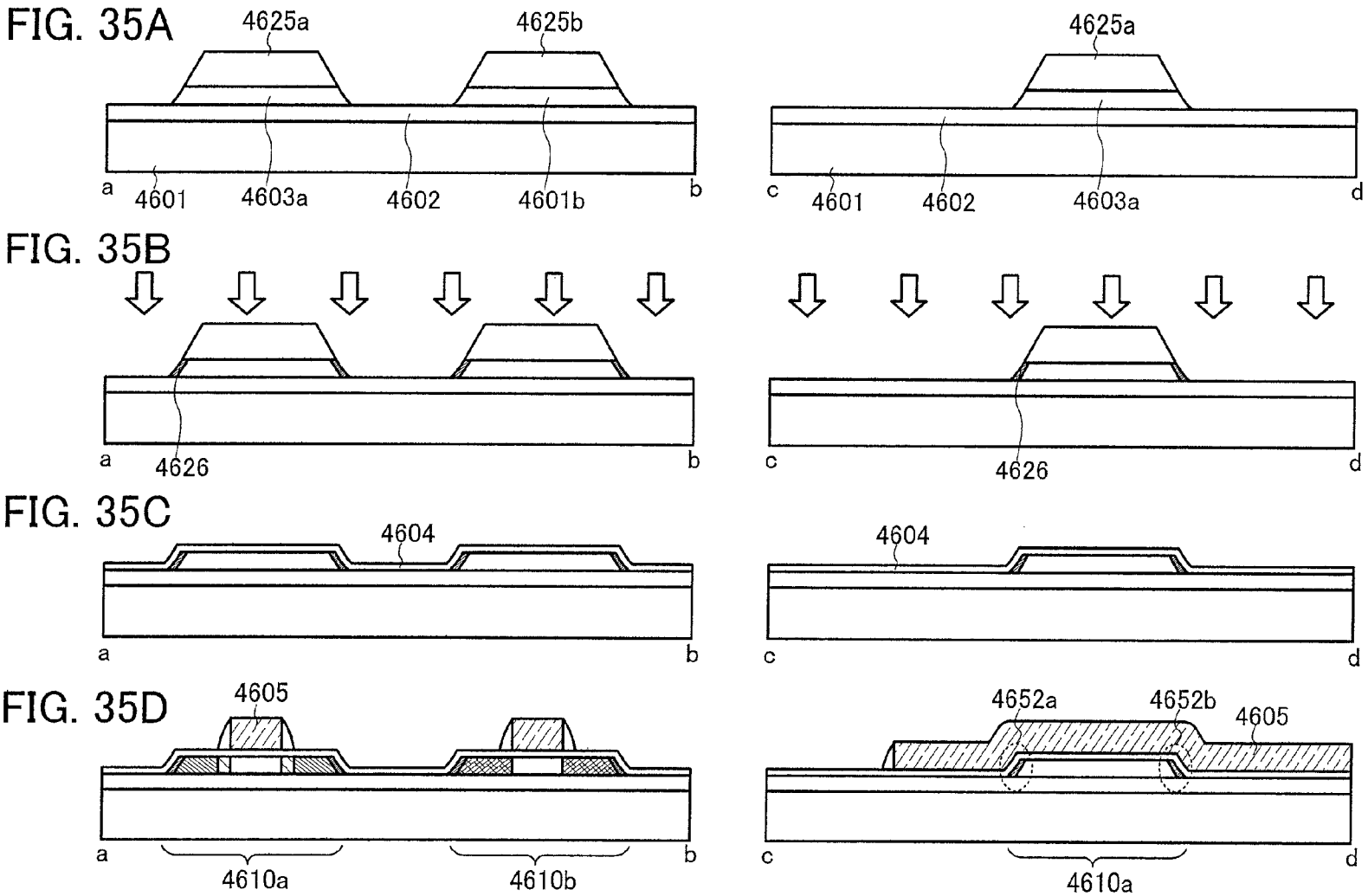
FIGS. 35A to 35D show a display device of Embodiment 3.

First, the island-shaped semiconductor films 4603*a* and 4603*b* are formed over the substrate 4601 (FIG. 35A). The island-shaped semiconductor films 4603*a* and 4603*b* can be provided by forming an amorphous semiconductor film using a material containing silicon (Si) as a main component (e.g., $Si_xGe_{1-x}$) or the like over the insulating film 4602 which is formed over the substrate 4601 in advance, by sputtering, LPCVD, plasma CVD, or the like, and crystallizing the amorphous semiconductor film, and further etching the semiconductor film selectively by using resists 4625*a* and 4625*b* as masks. Note that the crystallization of the amorphous semiconductor film can be performed by laser crystallization, thermal crystallization using RTA or an annealing furnace, thermal crystallization using metal elements which promote crystallization, or a combination of them.

Next, the edges of the island-shaped semiconductor films 4603*a* and 4603*b* are selectively oxidized or nitrided by plasma treatment before removing the resists 4625*a* and 4625*b* which are used for etching the semiconductor films, thereby an oxide or nitride film (hereinafter also referred to as an insulating film 4626) is formed on each of the semiconductor films 4603*a* and 4603*b* (FIG. 35B). The plasma treatment is performed with the foregoing conditions. In addition, the insulating film 4626 contains the rare gas which is used in the plasma treatment.

Next, the gate insulating film 4604 is formed so as to cover the semiconductor films 4603*a* and 4603*b* (FIG. 35C). The gate insulating film 4604 can be formed as described above.

Next, by forming the gate electrodes 4605 or the like over the gate insulating film 4604, a display device having the n-channel transistor 4610*a* and the p-channel transistor 4610*b* which respectively have the island-shaped semiconductor films 4603*a* and 4603*b* as channel regions can be manufactured (FIG. 35D).

If the semiconductor films 4603*a* and 4603*b* are provided with tapered edges, edges 4652*a* and 4652*b* of the channel regions which are formed in parts of the semiconductor films 4603*a* and 4603*b* are also tapered, thereby the thickness of the semiconductor films and the gate insulating film in that part differs from that in the central part, which may affect the characteristics of the transistors. Here, such effects on the transistors due to the edges of the channel regions can be reduced by forming insulating films on the edges of the semiconductor films which are the edges of the channel regions, by selectively oxidizing or nitriding the edges of the channel regions by plasma treatment.

Figure 37A:
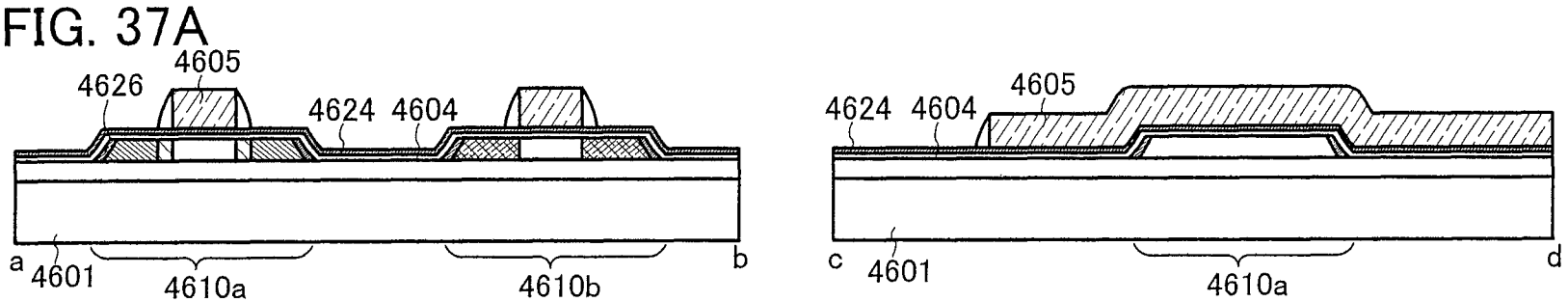
FIGS. 37A and 37B show a display device of Embodiment 3.

Although FIGS. 35A to 35D show an example where only the edges of the semiconductor films 4603*a* and 4603*b* are oxidized or nitrided by plasma treatment, the gate insulating film 4604 can also be oxidized or nitrided by plasma treatment as shown in FIGS. 34A to 34D (FIG. 37A).

Next, description is made on a manufacturing method of a semiconductor device which differs from that described above, with reference to the drawings. Specifically, a case is shown where plasma treatment is performed to tapered semiconductor films.

Figures 36A, 36B, 36C, 36D:
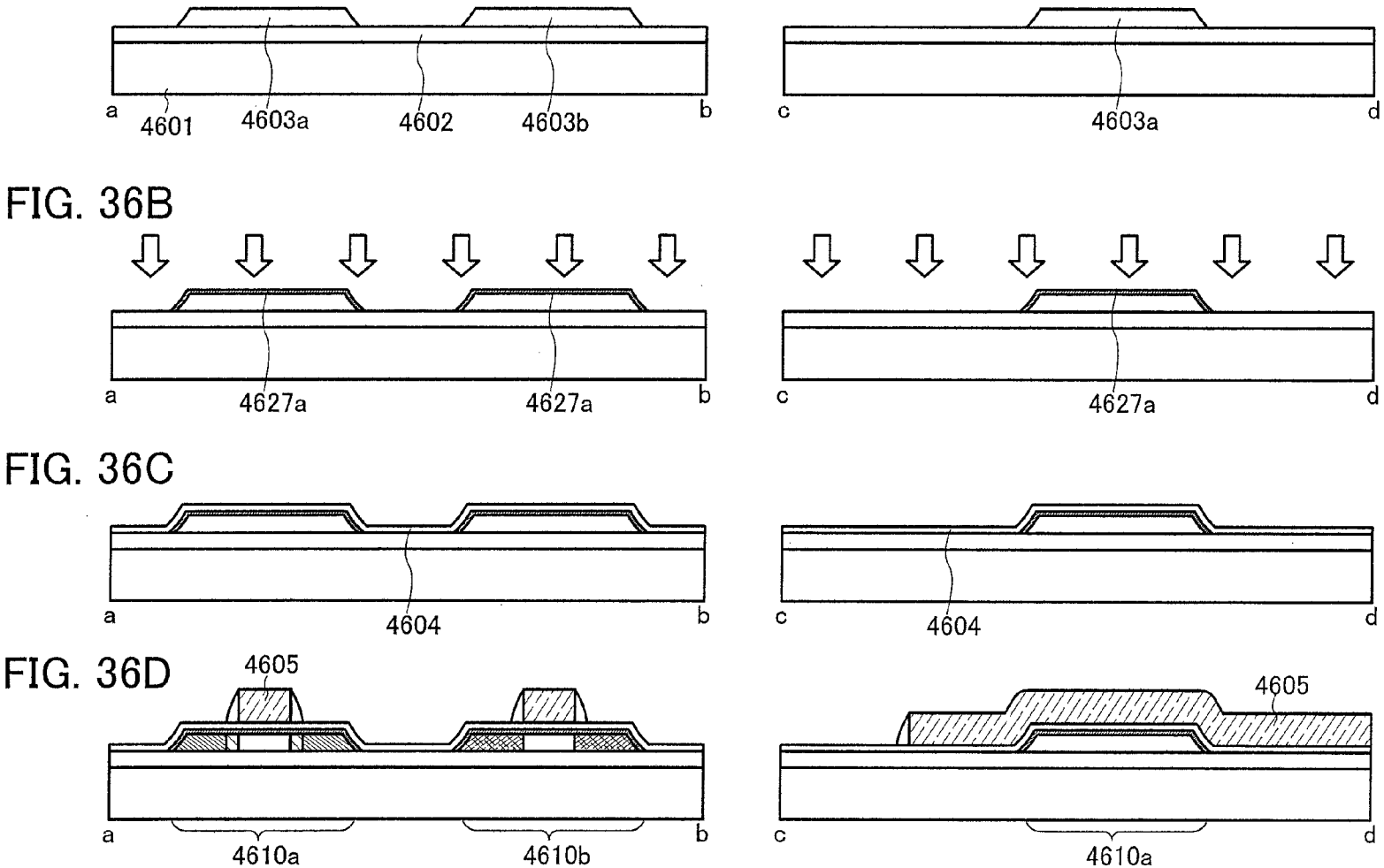
FIGS. 36A to 36D show a display device of Embodiment 3.

First, the island-shaped semiconductor films 4603*a* and 4603*b* are formed over the substrate 4601 in a manner similar to the foregoing (FIG. 36A).

Next, the semiconductor films 4603*a* and 4603*b* are oxidized or nitrided by plasma treatment to form oxide or nitride films (hereinafter also called insulating films 4627*a* and 4627*b*) on the surfaces of the semiconductor films 4603*a* and 4603*b*, respectively (FIG. 36B). The plasma treatment can be conducted under the above described conditions. For example, when Si is used for the semiconductor films 4603*a* and 4603*b*, silicon oxide or silicon nitride is formed as the insulating films 4627*a* and 4627*b*. Further, after being oxidized by plasma treatment, the semiconductor films 4603*a* and 4603*b* may be treated with plasma again to be nitrided. In this case, silicon oxide silicon oxynitride ($SiO_xN_y$, x>y), is formed on the semiconductor films 4603*a* and 4604*b*, and then silicon nitride oxide ($SiN_xO_y$, x>y) is formed on the surface of the silicon oxide. Therefore, the insulating films 4627*a* and 4627*b* contain the rare gas used in the plasma treatment. Note that the plasma treatment also oxide or nitride the edges of the semiconductor films 4603*a* and 4603*b* simultaneously.

Next, the gate insulating film 4604 is formed so as to cover the insulating films 4627*a* and 4627*b* (FIG. 36C). The gate insulating film 4604 can be formed by an insulating film containing oxygen or nitrogen, such as silicon oxide, silicon nitride, silicon oxynitride ($SiO_xN_y$, x>y), or silicon nitride oxide ($SiN_xO_y$, x>y) by sputtering, LPCVD, plasma CVD, or the like to have either a single-layer structure or a stacked layer structure. For example, when insulating films 4627*a* and 4627*b* are formed of silicon oxide over the semiconductor films 4603*a* and 4603*b* by oxidizing the semiconductor films 4603*a* and 4603*b* by plasma treatment using Si, silicon oxide is formed as the gate insulating film over the insulating films 4627*a* and 4627*b*.

Next, by forming the gate electrodes 4605 or the like over the gate insulating film 4604, a display device having the n-channel transistor 4610*a* and the p-channel transistor 4610*b* which respectively have the island-shaped semiconductor films 4603*a* and 4603*b* as channel regions can be manufactured (FIG. 36D).

If the semiconductor films are provided with tapered edges, edges of the channel regions which are formed in parts of the semiconductor films are also tapered, which may affect the characteristics of the semiconductor element. Such effects on the semiconductor element can be reduced by oxidizing or nitriding the edges of the semiconductor films which are the channel regions by plasma treatment to oxidize or nitride the edges of the channel regions.

Figure 37B:
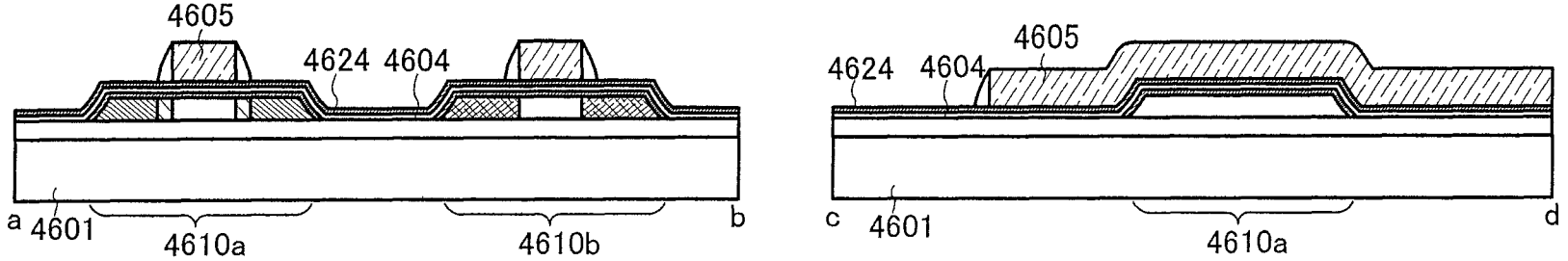

Although FIGS. 36A to 36D show an example where only the semiconductor films 4603*a* and 4603*b* are oxidized or nitrided by plasma treatment, the gate insulating film 4604 may also be oxidized or nitrided by plasma treatment as shown in FIG. 34 (FIG. 37B). In this case, after oxidizing the gate insulating film 4604 by performing plasma treatment under an oxygen atmosphere, the gate insulating film 4604 may be treated with plasma again under a nitrogen atmosphere so as to be nitrided. In such a case, silicon oxide or silicon oxynitride ($SiO_xN_y$, x>y) is formed over the semiconductor films 4603*a* and 4603*b* side, and then silicon nitride oxide ($SiN_xO_y$, x>y) is formed so as to be in contact with the gate electrodes 4605.

Figure 38A:
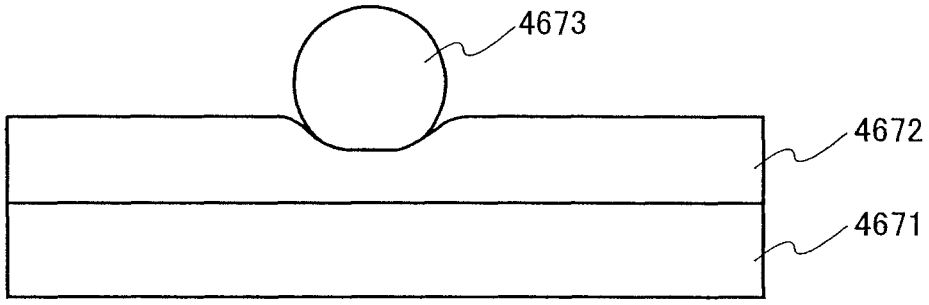
FIGS. 38A and 38B show a display device of Embodiment 3.
Figure 38B:
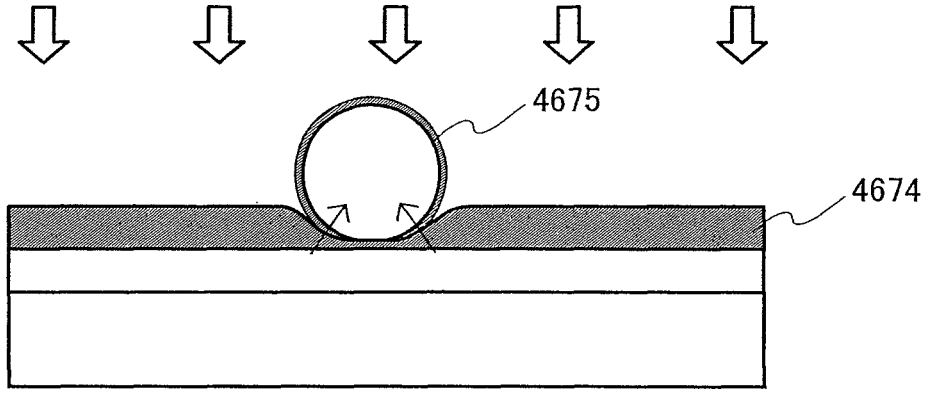

By performing plasma treatment in the foregoing manner, impurities such as dust which have attached to the semiconductor films or the insulating film can be easily removed. In general, a film formed by CVD, sputtering, or the like may have dust (also called particles) on its surface. For example, as shown in FIG. 38A, there is a case where dust 4673 attaches to the insulating film 4672 which is formed by CVD, sputtering, or the like over a film 4671 such as an insulating film, a conductive film, or a semiconductor film. Even in such a case, an oxide or nitride film (hereinafter also referred to as an insulating film 4674) is formed on the surface of the insulating film 4672 by oxidizing or nitriding the insulating film 4672 by plasma treatment. The insulating film 4674 is oxidized or nitrided in such a manner that not only a portion where no dust 4673 exists but also a portion below the dust 4673 is oxidized or nitrided; therefore, the volume of the insulating film 4674 is increased. Meanwhile, since the surface of the dust 4673 is also oxidized or nitrided by plasma treatment to form an insulating film 4675, the volume of the dust 4673 is also increased (FIG. 38B).

At this time, the dust 4673 is in a state of being easily removed from the surface of the insulating film 4674 by simple washing such as brushing. Thus, by performing plasma treatment, even a minute dust which has attached to the insulating film or the semiconductor film can be easily removed. Note that this effect is obtained by performing plasma treatment; therefore, the same can be said for not only this embodiment mode, but for other embodiment modes.

In this manner, by modifying the surface of a semiconductor film or an insulating film by oxidation or nitridation using plasma treatment, a dense and high-quality insulating film can be formed. In addition, dust or the like which has attached to the surface of the insulating film can be easily removed by washing. Accordingly, defects such as pin holes can be prevented even when the insulating film is formed to be thin, thereby miniaturization and high performance of semiconductor elements such as transistors can be realized.

Although this embodiment shows an example where plasma treatment is performed to the semiconductor films 4603*a* and 4603*b* or the gate insulating film 4604 so as to oxidize or nitride the semiconductor films 4603*a* and 4603*b* or the gate insulating film 4604, a layer to be oxidized or nitrided by plasma is not limited to these. For example, plasma treatment may be performed to the substrate 4601 or the insulating film 4602. Alternatively, plasma treatment may be performed to the insulating film 4606 or the insulating film 4607.

This embodiment can be conducted by freely combining with Embodiments 1 or 2.

[Embodiment 4]

In this embodiment, description is made on a halftone process as a process for manufacturing a display device including, for example, transistors.

Figure 39:
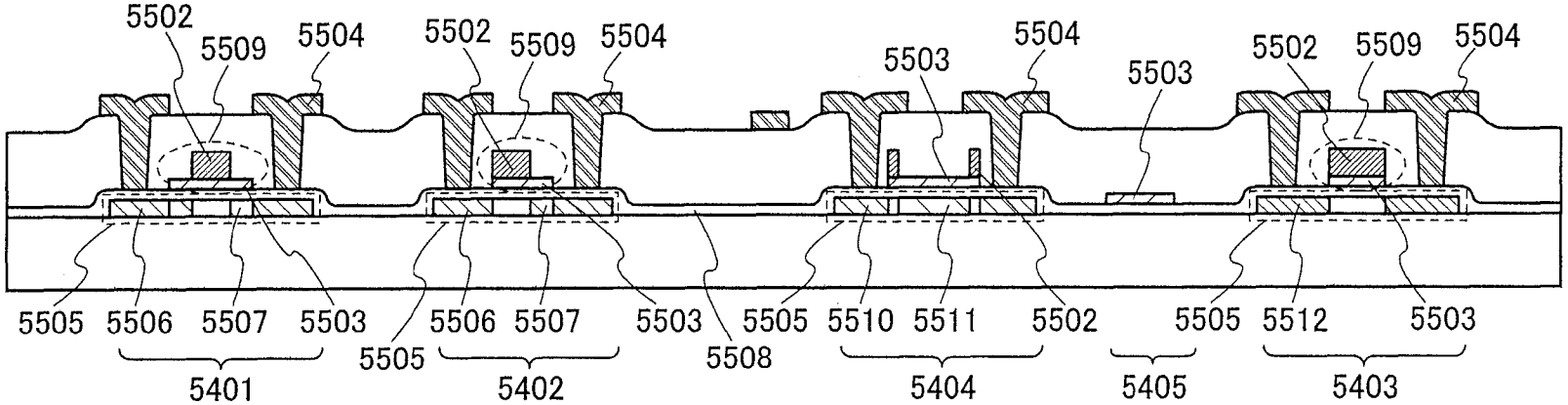
FIG. 39 shows a display device of Embodiment 4.

FIG. 39 shows a cross-sectional structure of a display device including a transistor, a capacitor, and a resistor. FIG. 39 shows an n-channel transistor 5401, an n-channel transistor 5402, a capacitor 5404, a resistor 5405, and a p-channel transistor 5403. Each transistor includes a semiconductor layer 5505, an insulating layer 5508, and a gate electrode 5509. The gate electrode 5509 is formed by a stacked layer structure of a first conductive layer 5503 and a second conductive layer 5502. The insulating layer 5508 sandwiched between the semiconductor layer 5505 and the gate electrode 5509 serves as a gate insulating layer. FIGS. 40A to 40E are top views corresponding to the transistors, the capacitor, and the resistor, which can be referred together with FIG. 39.

In FIG. 39, the n-channel transistor 5401 has the semiconductor layer 5505 in the channel length direction (the flowing direction of carriers) that includes impurity regions 5506 and 5507 which is doped at a lower concentration than that of the impurity region 5506. The impurity region 5506 serves as a source or a drain region and is connected to a wire 5504 electrically. The impurity region 5507 is also called a lightly doped drain (LDD). In the case of forming the n-channel transistor 5401, the impurity regions 5506 and 5507 are doped with an impurity imparting n-type conductivity such as phosphorus. The LDD is formed so as to prevent hot electron deterioration and a short channel effect.

Figure 40A:
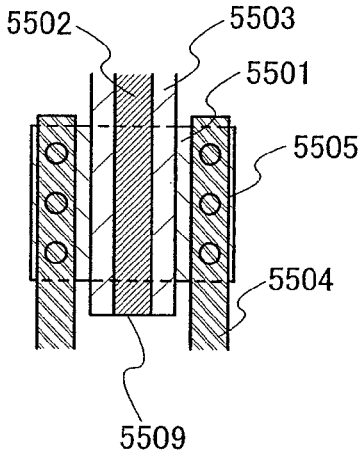
FIGS. 40A to 40E show a display device of Embodiment 4.

As shown in FIG. 40A, in the gate electrode 5509 of the n-channel transistor 5401, the first conductive layer 5503 is formed so as to extend to both sides of the second conductive layer 5502. In that case, the thickness of the first conductive layer 5503 is thinner than that of the second conductive layer. The thickness of the first conductive layer 5503 is set so as to transmit ion species accelerated in an electric filed of 10 to 100 kV. The impurity region 5507 is formed so as to overlap the first conductive layer 5503 of the gate electrode 5509. That is, an LDD region which overlaps the gate electrode 5509 is formed. In this structure, the impurity region 5507 is formed in a self alignment manner by adding an impurity imparting one conductivity type through the first conductive layer 5503 using the second conductive layer 5502 as a mask. That is, the LDD which overlaps the gate electrode is formed in a self alignment manner.

Figure 40B:
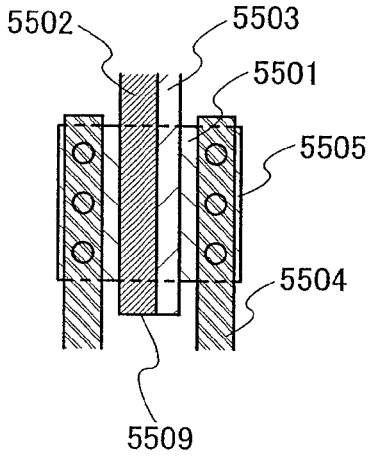

In FIG. 39, the n-channel transistor 5402 has the semiconductor layer 5505 that includes the impurity region 5506 serving as source and drain regions and the impurity region 5507 which is doped at a lower concentration than that of the impurity regions 5506. The impurity region 5507 is formed on one side of the channel formation region so as to be in contact with the impurity region 5506. As shown in FIG. 40B, in the gate electrode 5509 of the n-channel transistor 5402, the first conductive layer 5503 is formed so as to extend on one side of the second conductive layer 5502. In such a structure also, the LDD can be formed in a self alignment manner by adding an impurity imparting one conductivity type through the first conductive layer 5503 using the second conductive layer 5502 as a mask.

A transistor having an LDD on one side of the channel formation region may be used as a transistor in which either a positive voltage or a negative voltage is applied between source and drain electrodes. Specifically, the transistor may be applied to a transistor forming a logical gate such as an inverter circuit, a NAND circuit, a NOR circuit, and a latch circuit, a transistor forming an analog circuit such as a sense amplifier, a constant voltage generating circuit, and a VCO.

Figure 40C:
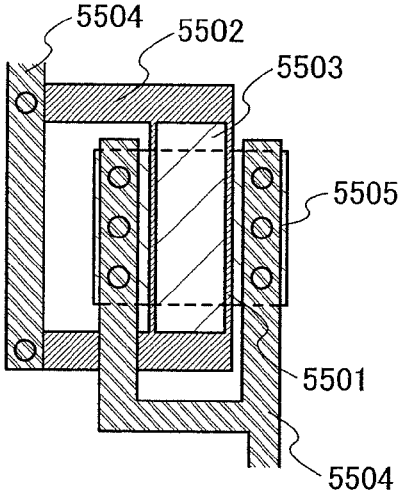
Figure 40D:
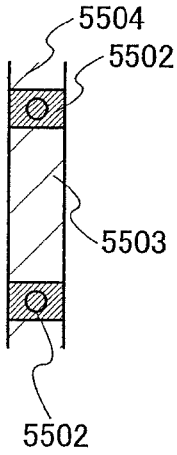

As shown in FIG. 39, the capacitor 5404 is formed so that the insulating layer 5508 is interposed between a first conductive layer 5503 and the semiconductor layer 5505. The semiconductor layer 5505 in the capacitor 5404 has the impurity regions 5510 and 5511. The impurity region 5511 is formed in the semiconductor layer 5505 so as to overlap the first conductive layer 5503. The impurity region 5510 is in contact with the wire 5504. Since the impurity region 5511 is doped with an impurity of one conductivity type through the first conductive layer 5503, the concentrations of the impurities contained in the impurity regions 5510 and 5511 may be the same or different. In any case, in the capacitor 5404, the semiconductor layer 5505 serves as an electrode; therefore the semiconductor layer 5505 is preferably doped with an impurity imparting one conductivity type to lower the resistance thereof. In addition, as shown in FIG. 40C, the first conductive layer 5503 can sufficiently operate as an electrode by using the second conductive layer 5502 as an auxiliary electrode. Thus, the capacitor 5404 can be formed in a self alignment manner by combining the first conductive layer 5503 and the second conductive layer 5502 to form a multiple electrode structure.

In FIG. 39, the resistor 5405 is formed using the first conductive layer 5503. The first conductive layer 5503 is formed so as to have a thickness of 30 to 150 nm, therefore the width or the length of the first conductive layer 5503 can be appropriately set to form the resistor.

Figure 40E:
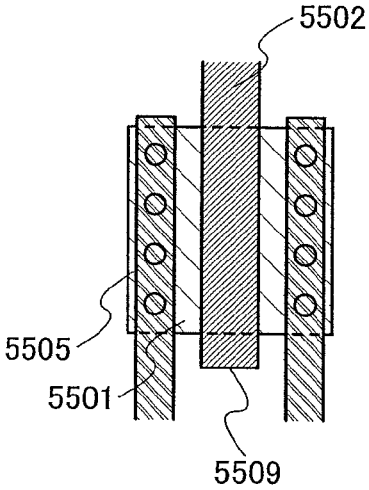

The resistor may be formed by a semiconductor layer containing an impurity element at a high concentration or a metal layer with a thin thickness. A metal layer is preferable to a semiconductor layer because the resistance value of the metal layer depends on a film thickness and a film quality while the resistance value of the semiconductor layer depends of a film thickness, a film quality, a concentration of an impurity, an activation ratio, and the like; therefore, variation in the resistance value of the metal layer is smaller than that of the semiconductor layer. FIG. 40E shows a top view of the resistor 5405.

In FIG. 39, the p-channel transistor 5403 has an impurity region 5512 in the semiconductor layer 5505. The impurity region 5512 forms source and drain regions each of which is connected to the wire 5504. The gate electrode 5509 has a structure in which the first conductive layer 5503 and the second conductive layer 5502 overlap each other. The p-channel transistor 5403 is a transistor having a single drain structure in which an LDD is not formed. When the p-channel transistor 5403 is formed, the impurity region 5512 is doped with an impurity for imparting p-type conductivity, such as boron. On the other hand, when the impurity region 5512 is doped with phosphorus, an n-channel transistor having a single drain structure can be formed. FIG. 40E shows a top view of the p-channel transistor 5403.

To either or both the semiconductor layer 5505 and the insulating layer 5508, oxidizing or nitriding treatment may be conducted using high-density plasma which is excited with a microwave and with an electron temperature of 2 eV or less, ion energy of 5 eV or less, and an electron density of approximately $10^{11}$ to $10^{13}/cm^{-3}$. At this time, the treatment is conducted with a substrate temperature of 300 to 450° C. and in an oxidizing atmosphere (e.g., $O_2$, or $N_2O$) or a nitriding atmosphere (e.g., $N_2$, or $NH_3$); thereby a defect level of an interface between the semiconductor layer 5505 and the insulating layer 5508 can be lowered. In addition, by conducting the treatment to the insulating layer 5508, the insulating layer 5508 can be denser. In other words, generation of a charged defect and change in a threshold voltage of a transistor can be suppressed. In a case where the transistor is driven at a voltage of 3 V or less, the insulating layer 5508 which is oxidized or nitrided by this plasma treatment can be used as a gate insulating layer. In a case where a transistor is driven at a voltage of 3 V or more, the insulating layer 5508 can be formed by combing the insulating layer which is formed on a surface of the semiconductor layer 5505 by this plasma treatment and the insulating layer which is stacked by CVD (plasma CVD or thermal CVD). In a similar manner, this insulating layer can be utilized as a dielectric layer of the capacitor 5404. In this case, the insulating layer formed by this plasma treatment has a thickness of 1 to 10 nm and is a dense film; therefore, a capacitor having a large charge capacitance can be formed.

As described with reference to FIGS. 39 and 40A to 40E, an element with various kinds of structures can be formed by combing conductive layers having different film thicknesses. A region in which only the first conductive layer is formed and a region in which the first and the second conductive layers are stacked can be formed by using a photomask or a reticle which is formed by a diffraction grating pattern or an auxiliary pattern which has a semi-transparent film with a function of reducing light intensity. That is, in a photolithography process, when a photoresist is exposed to light, the amount of light which transmits through a photomask is adjusted so that a developed resist mask has a varied thickness. In this case, a slit which is equal to or below the resolution limitation may be formed in the photomask or the reticle so that a resist having the foregoing complicated shape is formed. In addition, a mask pattern formed of a photoresist material may be changed in the shape by being baked at about 200° C. after development.

In addition, by using a photomask or a reticle which is formed by a diffraction grating pattern or an auxiliary pattern which has a semi-transparent film with a function of reducing light intensity, the region where only the first conductive layer is formed and the region where the first conductive layer and the second conductive layer are stacked can be continuously formed. As shown in FIG. 40A, a region in which only the first conductive layer is formed can be selectively formed over the semiconductor layer. Such a region is effective over the semiconductor layer but is not necessary in other regions (a wire region connected to the gate electrode). By using the photomask or the reticle, a region in which only the first conducive layer is formed is not formed in a wire part; therefore, wire density can be substantially increased.

In FIGS. 39 and 40A to 40E, the first conductive layer is formed of a high melting point metal such as tungsten (W), chromium (Cr), tantalum (Ta), tantalum nitride (TaN), or molybdenum (Mo); or an alloy or a compound mainly containing a high melting point metal to have a thickness of 30 to 50 nm. The second conductive layer is formed of a high melting point metal such as tungsten (W), chromium (Cr), tantalum (Ta), tantalum nitride (TaN), or molybdenum (Mo); or an alloy or a compound mainly containing a high melting point metal to have a thickness of 300 to 600 nm. For example, the first conductive layer and the second conductive layer are formed of different conductive materials so that the etching rates are different from each other in a next etching step. For example, the first conductive layer can be formed of TaN and the second conductive layer formed of a tungsten film.

In this embodiment, a transistor, a capacitor, and a resistor, each of which has a different electrode structure can be formed in one patterning step by using a photomask or a reticle which is formed by a diffraction grating pattern or an auxiliary pattern which has a semi-transparent film with a function of reducing light intensity. Thus, elements with different structures can be formed without increasing the number of steps and can be integrated according to the characteristics of the circuit.

This embodiment can be conducted by freely combining with Embodiments 1 to 3.

[Embodiment 5]

In this embodiment, description is made on an example of a mask pattern for manufacturing a display device including a transistor with reference to FIGS. 41A to 43B.

Figure 41A:
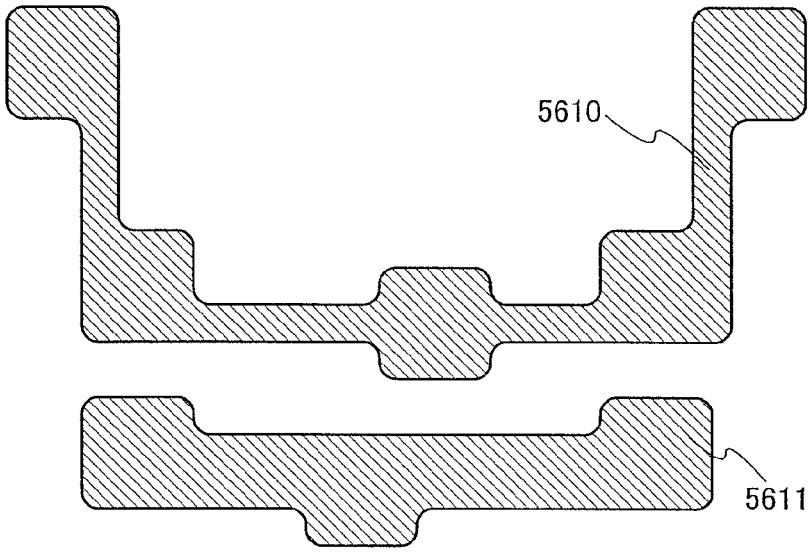
FIGS. 41A and 41B show a display device of Embodiment 5.

Semiconductor layers 5610 and 5611 shown in FIG. 41A are preferably formed of silicon or a crystalline semiconductor containing silicon. For example, polycrystalline silicon or single crystalline silicon which is formed by crystallizing a silicon film by laser annealing or the like is applied. In addition, a metal oxide semiconductor, amorphous silicon, or an organic semiconductor which shows semiconductor characteristics can be applied.

In any case, a semiconductor layer which is formed first is formed over the entire surface or a part (a region which is larger than a region which is specified to be a semiconductor region in a transistor) of a substrate having an insulating surface. Then, a mask pattern is formed over the semiconductor layer by photolithography. The semiconductor layer is etched using the mask pattern to form the predetermined island-shaped semiconductor layers 5610 and 5611 including source and drain regions and a channel formation region of a transistor. The semiconductor layers 5610 and 5611 are formed so as to have an appropriate layout.

Figure 41B:
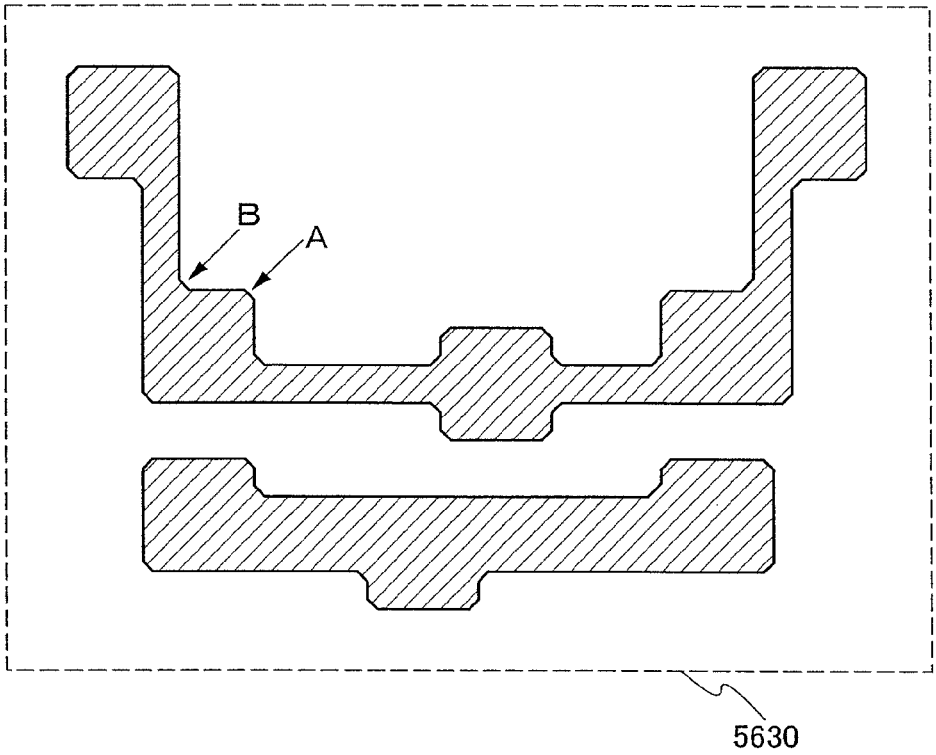

The photomask for forming the semiconductor layers 5610 and 5611 shown in FIG. 41A has a mask pattern 5630 shown in FIG. 41B. The mask pattern 5630 differs depending on whether a resist used in a photolithography step is a positive type or a negative type. When a positive type resist is used, the mask pattern 5630 shown in FIG. 41B is formed as a light shielding portion. The mask pattern 5630 has a polygon shape in which a top A is removed. In addition, in a corner portion B, the mask pattern bends a plurality of times so as not to make a right angle. That is, in this photomask pattern, a corner that is a right triangle is removed so that one side of the right triangle is, for example, 10 μm or less.

The shape of the mask pattern 5630 shown in FIG. 41B is reflected in the semiconductor layers 5610 and 5611 shown in FIG. 41A. In that case, the shape which is similar to the mask pattern 5630 may be transcribed. Alternatively, the shape may be transcribed so that the corner of the transcribed pattern has a rounder shape than the mask pattern 5630. That is, a round portion where the pattern shape is smoother than the mask pattern 5630 may be provided.

Figure 42A:
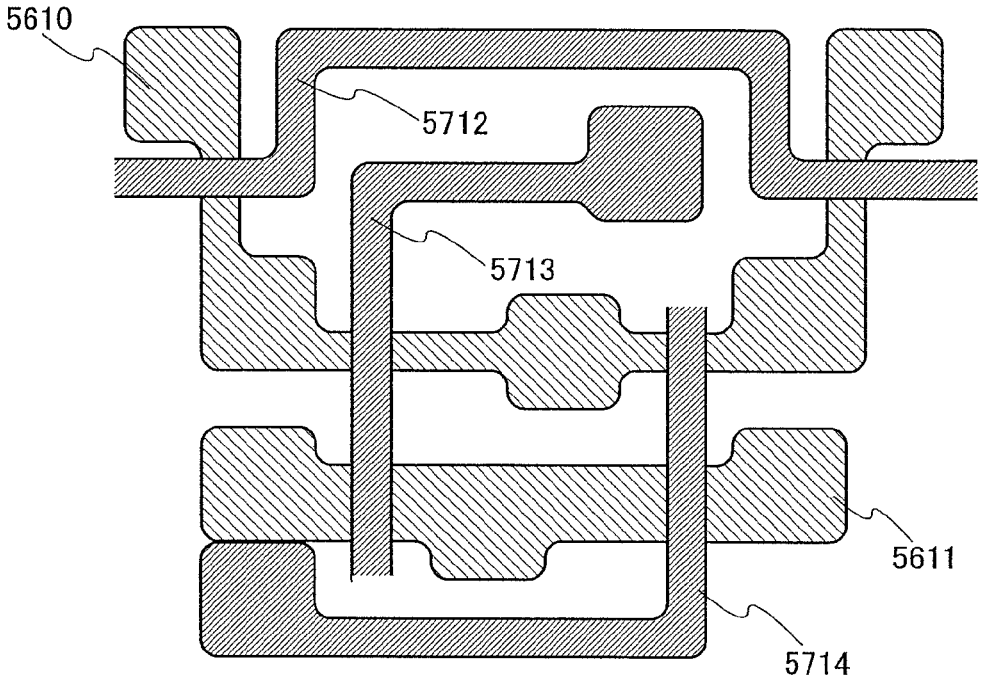
FIGS. 42A and 42B show a display device of Embodiment 5.

An insulating layer including silicon oxide or silicon nitride in at least one portion thereof is formed over the semiconductor layers 5610 and 5611. The insulating layer is formed so as to serve as a gate insulating layer. As shown in FIG. 42A, gate wires 5712, 5713, and 5714 are formed to overlap the semiconductor layer partially. The gate wire 5712 is formed corresponding to the semiconductor layer 5610 while the gate wire 5713 is formed corresponding to the semiconductor layers 5610 and 5611. In addition, the gate wire 5714 is formed corresponding to the semiconductor layers 5610 and 5611. The gate wire is formed by forming a metal layer or a semiconductor layer having high conductivity, and a shape of the gate wire is formed by photolithography over the insulating layer.

Figure 42B:
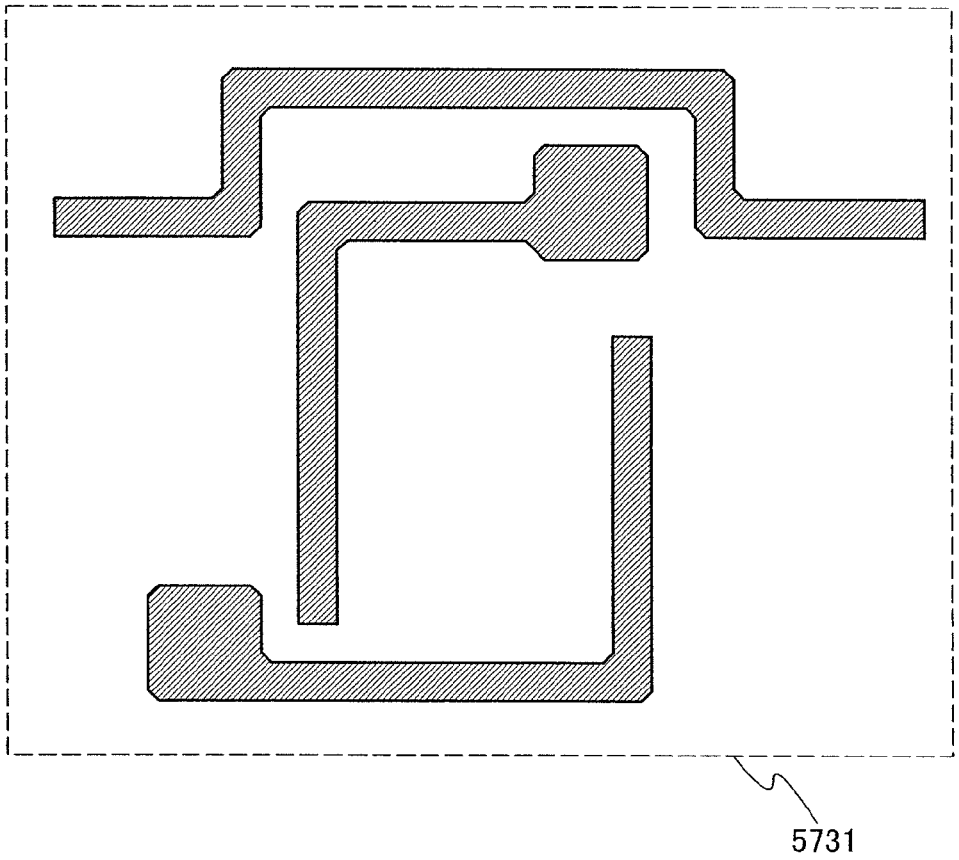

A photomask used for forming the gate wire has a mask pattern 5731 shown in FIG. 42B. In the mask pattern 5731, each corner portion bent into an L shape is removed so that one side of the right triangle is 10 μm or less, or one-fifth to half the width of the wire, thereby the corner portion is rounded. The shape of the mask pattern 5731 shown in FIG. 42B is reflected to the gate wires 5712, 5713, and 5714 shown in FIG. 42A. In that case, the shape which is similar to the mask pattern 5731 may be transcribed. Alternatively, the shape may be transcribed so that the corners in the gate wires 5712 to 5714 have rounder shapes than the mask pattern 5731. That is, a round part where the pattern shape is smoother than the mask pattern 5731 may be provided. In other word, the corner in the gate wires 5712 to 5714 is removed by one-fifth to half the width of the wire in order to have a round corner portion. Specifically, in order to form a round circumference of the corner portion, a portion of the mask is removed, which corresponds to an isosceles right triangle having two first straight lines that are perpendicular to each other making the corner portion, and a second straight line that makes an angle of about 45° with the two first straight lines. When removing the triangle, two obtuse angles are formed in the mask. It is preferable that the mask be set so that a curved line in contact with the first straight line and the second straight line is formed in each obtuse angle part by adjusting conditions appropriately. Note that the length of the two sides of the isosceles right triangle, which are equal to each other, is equal to or longer than one-fifth the width of the mask and equal to or shorter than half the width of the mask. In addition, the inner circumference of the corner portion is also made round in accordance with the outer circumference of the corner portion. In an outer side of the corner portion, generation of fine powder due to abnormal electrical discharge can be suppressed when dry etching by plasma is conducted. In addition, even if fine powder is generated, an inner side of the corner portion makes it possible to wash away the fine powder when cleaning without the fine powder remaining in the corner. As a result, a yield improves significantly.

An interlayer insulating layer is formed after forming the gate wires 5712 to 5714. The interlayer insulating layer is formed of an inorganic insulating material such as silicon oxide or an organic insulating material such as polyimide or an acryl resin. An insulating layer such as silicon nitride or silicon nitride oxide may be formed between the interlayer insulating layer and the gate wires 5712 to 5714. In addition, an insulating layer such as silicon nitride or silicon nitride oxide may also be formed over the interlayer insulating layer. The insulating layer can prevent contamination of the semiconductor layer and the gate insulating layer due to an impurity which is not favorable to a transistor, such as exogenous metal ion and moisture.

Figure 43A:
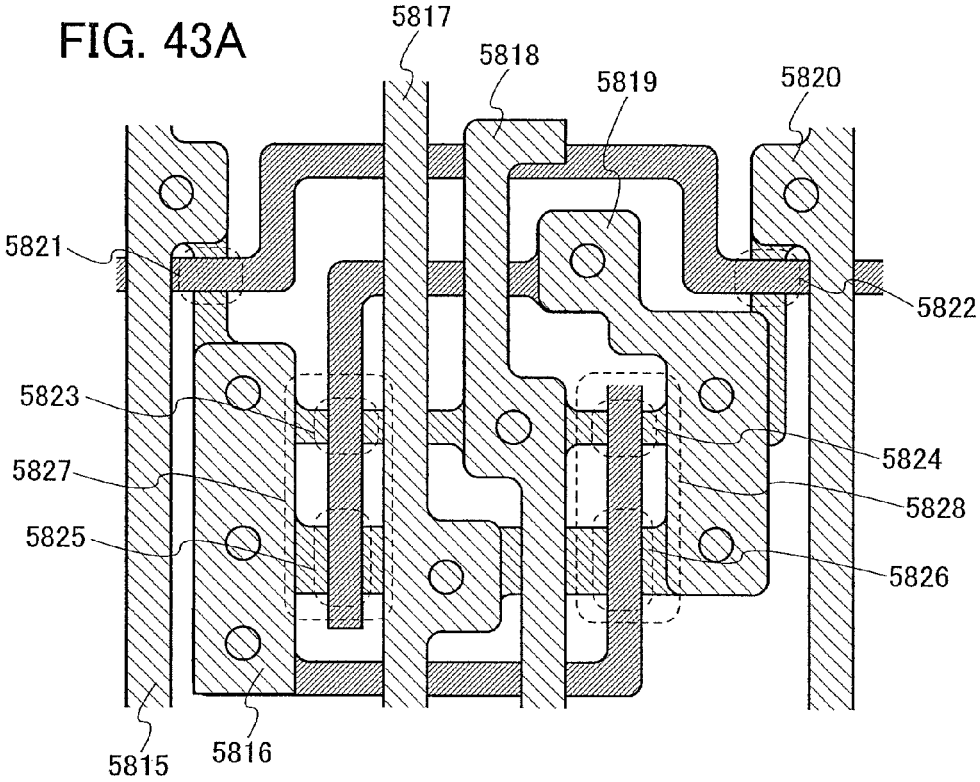
FIGS. 43A and 43B show a display device of Embodiment 5.

In the interlayer insulating layer, an opening is formed in a predetermined position. For example, the opening is formed corresponding to the gate wire or the semiconductor layer placed blow. A wire layer formed of a single layer or a plurality of layers of metal or a metal compound is etched into a predetermined pattern with a mask pattern formed by photolithography. Then, as shown in FIG. 43A, wires 5815 to 5820 are formed to overlap the semiconductor layer partially. The wire connects specific elements. The wire connecting an element to another element is not straight but bent due to restriction of a layout. In addition, the width of the wire changes in a contact portion or another region. In the contact portion, the width of the wire is widened in a part of the contact portion where the contact hole is equal to or wider than the width of the wire.

Figure 43B:
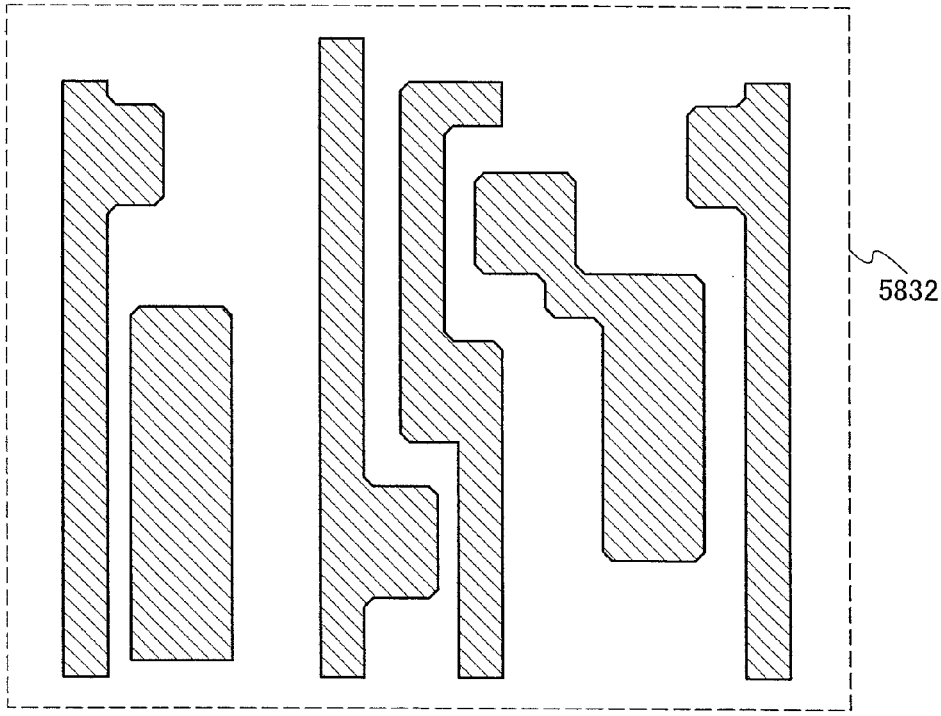

A photomask for forming the wires 5815 to 5820 has a mask pattern 5832 shown in FIG. 43B. In this case, the wire also has a pattern where a corner that is a right triangle in each corner portion is removed so that one side of the right triangle is 10 μm or shorter, or one-fifth to half the width of the wire; thereby the corner portion is rounded. In such a wire, in an outer side of the corner portion, generation of fine powder due to abnormal electrical discharge can be suppressed when dry etching by plasma is conducted. In addition, even if fine powder is generated, an inner side of the corner portion makes it possible to wash away the fine powder when cleaning without the fine powder remaining in the corner. As a result a yield improves significantly. Further, the round corner of the wire enhances electric conductivity. In addition, dusts in multiple parallel wires can be washed effectively.

In FIG. 43A, n-channel transistors 5821 to 5824 and p-channel transistors 5825 and 5826 are formed. The n-channel transistor 5823 and the p-channel transistor 5825, and the n-channel transistor 5824 and the p-channel transistor 5826 form inverters 5827 and 5828, respectively. A circuit including these six transistors forms an SRAM. An insulating layer such as silicon nitride and silicon oxide may be formed over the transistors.

This embodiment can be conducted by freely combining with Embodiments 1 to 4.

[Embodiment 6]

Figure 25A:
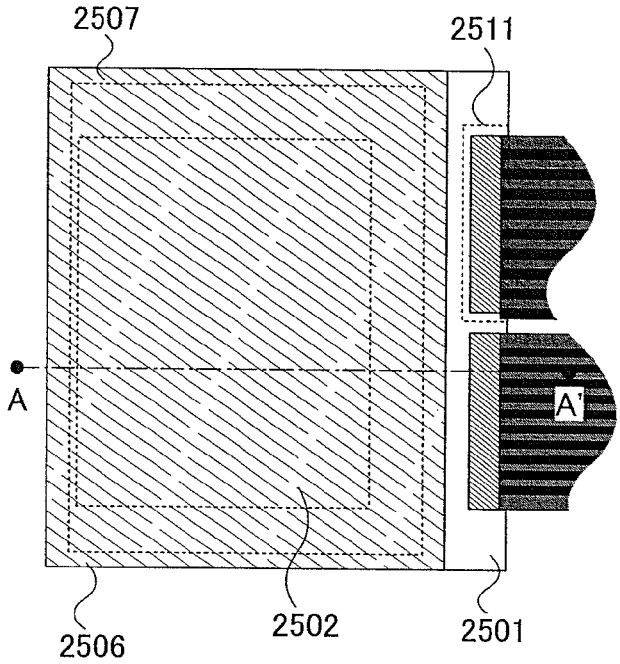
FIGS. 25A to 25C show display devices of Embodiment 6.
Figure 25B:
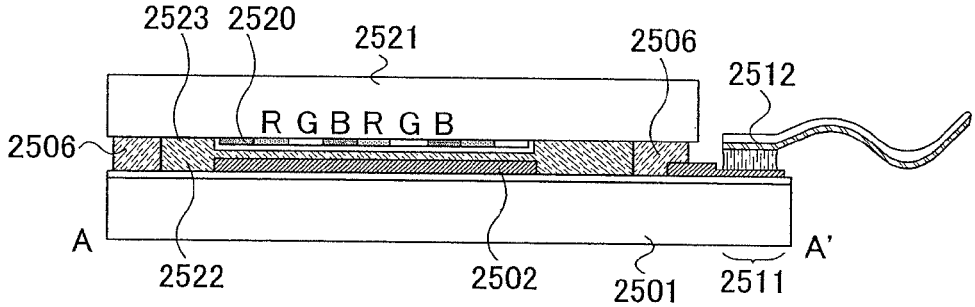
Figure 25C:
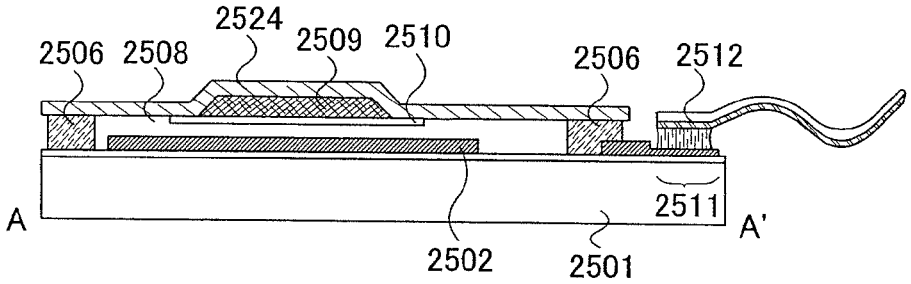

In this embodiment, description is made on a structure where a substrate provided with pixels is sealed, with reference to FIGS. 25A to 25C. FIG. 25A is a top view of a panel where a substrate provided with pixels is sealed, and FIGS. 25B and 25C are cross-sectional views taken along a line A-A' of FIG. 25A. FIGS. 25B and 25C show examples where sealing is performed by different methods.

In FIGS. 25A to 25C, a pixel portion 2502 having a plurality of pixels is provided over a substrate 2501, and a sealing material 2506 is provided so as to surround the pixel portion 2502, while a sealing material 2507 is attached thereto. For the structure of pixels, those shown in embodiment modes or Embodiment 1 can be employed.

In the display panel in FIG. 25B, the sealing material 2507 in FIG. 25A corresponds to a counter substrate 2521. The counter substrate 2521 which is transparent is attached to the substrate 2501 using the sealing material 2506 as an adhesive layer, and accordingly, a hermetically sealed space 2522 is formed by the substrate 2501, the counter substrate 2521, and the sealing member 2506. The counter substrate 2521 is provided with a color filter 2520 and a protective film 2523 for protecting the color filter. Light emitted from light-emitting elements which are disposed in the pixel portion 2502 is emitted to the outside through the color filter 2520. The hermetically sealed space 2522 is filled with an inert resin or liquid. Note that the resin for filling the hermetically sealed space 2522 may be a translucent resin in which moisture absorbent is dispersed. In addition, the same materials may be used for the sealing material 2506 and the hermetically sealed space 2522, so that the adhesion of the counter substrate 2521 and the sealing of the pixel portion 2502 may be performed concurrently.

In the display panel shown in FIG. 25C, the sealing material 2507 in FIG. 25A corresponds to a sealing material 2524. The sealing material 2524 is attached to the substrate 2501 using the sealing material 2506 as an adhesive layer, and a hermetically sealed space 2508 is formed by the substrate 2501, the sealing material 2506, and the sealing material 2524. The sealing material 2524 is provided with a moisture absorbent 2509 in advance in its depressed portion, and the moisture absorbent 2509 functions to keep a clean atmosphere in the hermetically sealed space 2508 by adsorbing moisture, oxygen, and the like to suppress deterioration of the light-emitting elements. The depressed portion is covered with a fine-meshed cover material 2510. The cover material 2510 transmits air and moisture but the moisture absorbent 2509 does not. Note that the hermetically sealed space 2508 may be filled with a rare gas such as nitrogen or argon, as well as an inert resin or liquid.

An input terminal portion 2511 for transmitting signals to the pixel portion 2502 and the like are provided over the substrate 2501. Signals such as video signals are transmitted to the input terminal portion 2511 through an FPC (Flexible Printed Circuit) 2512. At the input terminal portion 2511, wires formed over the substrate 2501 are electrically connected to wires provided in the FPC 2512 with the use of a resin in which conductors (anisotropic conductive resin: ACF) are dispersed.

A driver circuit for inputting signals to the pixel portion 2502 may be formed over the same substrate 2501 as the pixel portion 2502. Alternatively, the driver circuit for inputting signals to the pixel portion 2502 may be formed by an IC chip so as to be connected onto the substrate 2501 by COG (Chip-On-Glass) bonding, or the IC chip may be disposed on the substrate 2501 by TAB (Tape Automated Bonding) or by use of a printed board.

This embodiment can be conducted by freely combining with Embodiments 1 to 5.

[Embodiment 7]

The present invention can be applied to a display module where a circuit for inputting signals to a panel is mounted on the panel.

Figure 26:
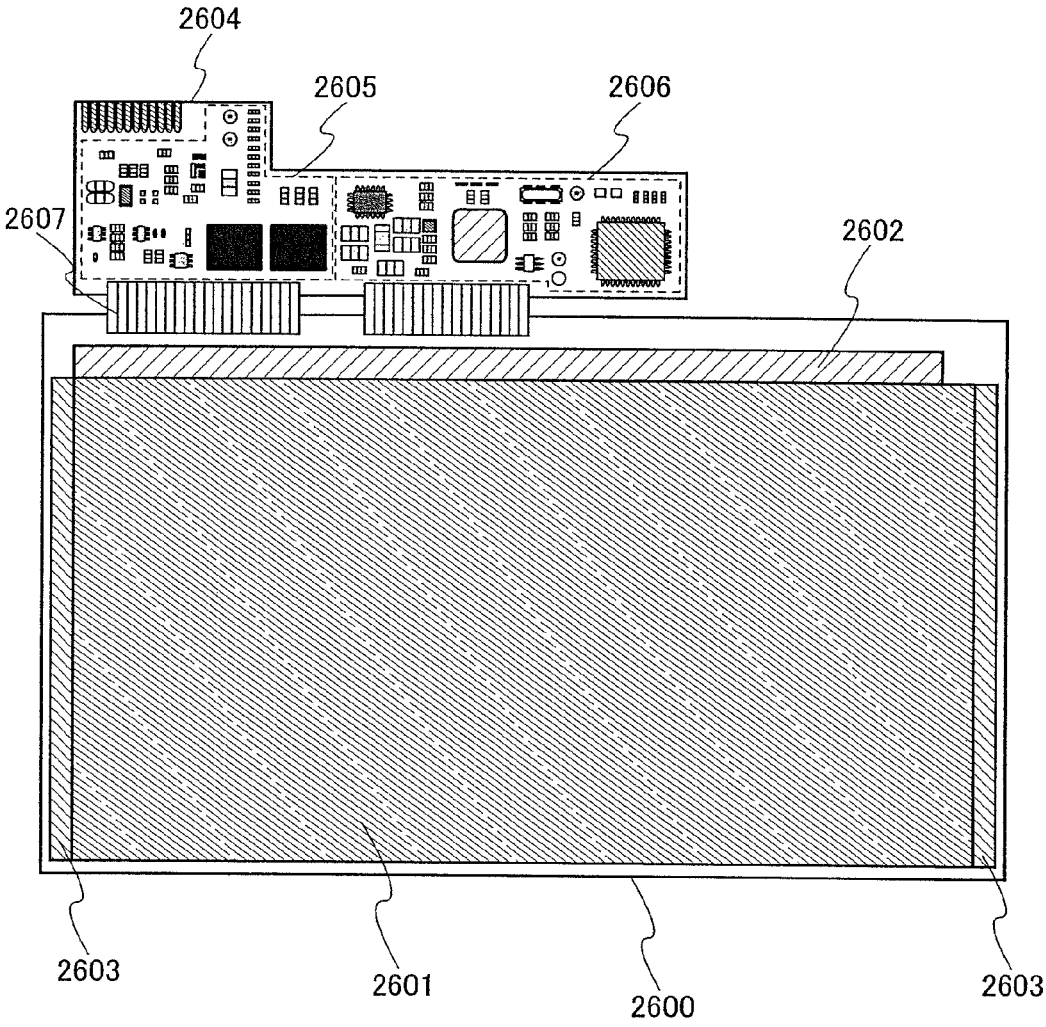
FIG. 26 is a display device of Embodiment 7.

FIG. 26 shows a display module where a panel 2600 is combined with a circuit board 2604. Although FIG. 26 shows an example where a controller 2605, a signal dividing circuit 2606, and the like are formed over the circuit board 2604, circuits formed over the circuit board 2604 are not limited to these. Any circuit which can generate signals for controlling the panel may be employed.

Signals outputted from the circuits formed over the circuit board 2604 are inputted to the panel 2600 through a connecting wire 2607.

The panel 2600 includes a pixel portion 2601, a source driver 2602, and a gate driver 2603. The structure of the panel 2600 may be similar to those shown in Embodiments 1, 2, and the like. Although FIG. 26 shows an example where the source driver 2602 and the gate driver 2603 are formed over the same substrate as the pixel portion 2601, the display module of the present invention is not limited to this. Such a structure may also be employed in which only the gate drivers 2603 are formed over the same substrate as the pixel portion 2601, while the source driver 2602 is formed over a circuit board. Alternatively, both of the source driver and the gate drivers may be formed over a circuit board.

Display portions of various electronic appliances can be formed by incorporating such a display module.

This embodiment can be conducted by freely combining with Embodiments 1 to 6.

[Embodiment 8]

The present invention can be applied to various electronic appliances. The electronic appliances include a camera (e.g., a video camera or a digital camera), a projector, a head-mounted display (a goggle display), a navigation system, a car stereo, a computer, a game machine, a portable information terminal (e.g., a mobile computer, a portable phone, or an electronic book), an image reproducing device provided with a recording medium (specifically, a device for reproducing a recording medium such as a digital versatile disc (DVD), and having a display portion for displaying the reproduced image), and the like. FIGS. 27A to 27D show examples of the electronic appliances.

Figure 27A:
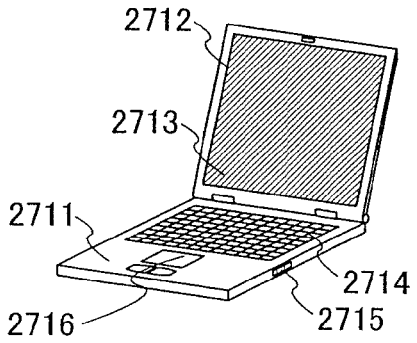
FIGS. 27A to 27D show display devices of Embodiment 8.

FIG. 27A shows a notebook personal computer, which includes a main body 2711, a housing 2712, a display portion 2713, a keyboard 2714, an external connecting port 2715, a pointing mouse 2716, and the like. The present invention is applied to the display portion 2713. With the present invention, power consumption of the display portion can be reduced.

Figure 27B:
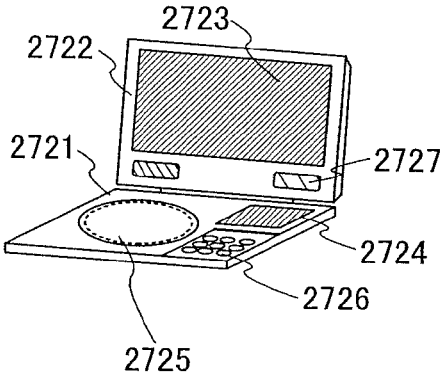

FIG. 27B shows an image reproducing device provided with a recording medium (specifically, a DVD reproducing device), which includes a main body 2721, a housing 2722, a first display portion 2723, a second display portion 2724, a recording medium (e.g., DVD) reading portion 2725, an operating key 2726, a speaker portion 2727, and the like. The first display portion 2723 mainly displays image data, while the second display portion 2724 mainly displays text data. The present invention is applied to the first display portion 2723 and the second display portion 2724. With the present invention, power consumption of the display portion can be reduced.

Figure 27C:
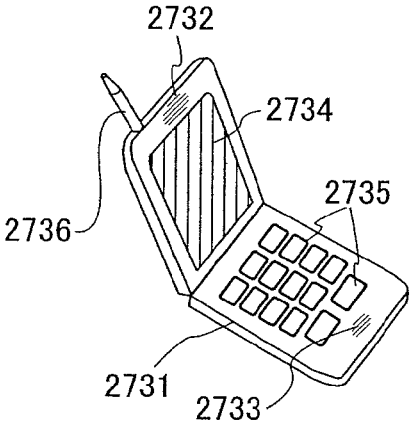

FIG. 27C shows a portable phone, which includes a main body 2731, an audio output portion 2732, an audio input portion 2733, a display portion 2734, operating switches 2735, an antenna 2736, and the like. The present invention is applied to the display portion 2734. With the present invention, power consumption of the display portion can be reduced.

Figure 27D:
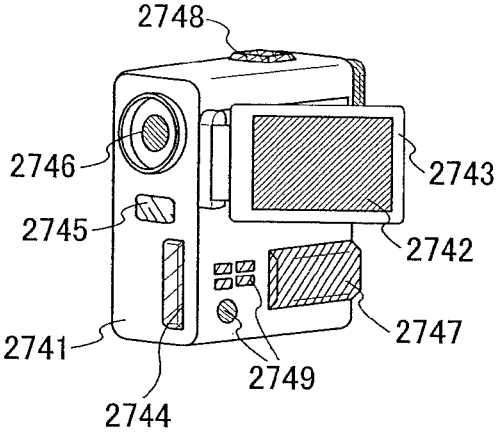

FIG. 27D shows a camera, which includes a main body 2741, a display portion 2742, a housing 2743, an external connecting port 2744, a remote controlling portion 2745, an image receiving portion 2746, a battery 2747, an audio input portion 2748, operating keys 2749, and the like. The present invention is applied to the display portion 2742. With the present invention, power consumption of the display portion can be reduced.

This embodiment can be conducted by freely combining with Embodiments 1 to 7.

[Embodiment 9]

In this embodiment, an application example of a display panel in which a display device using a pixel structure of the present invention is used for a display portion will be described with reference to drawings. The display panel in which a display device using a pixel structure of the present invention is used for a display portion, can be structured to be unified with a transportation unit, a building, or the like.

Figure 77A:
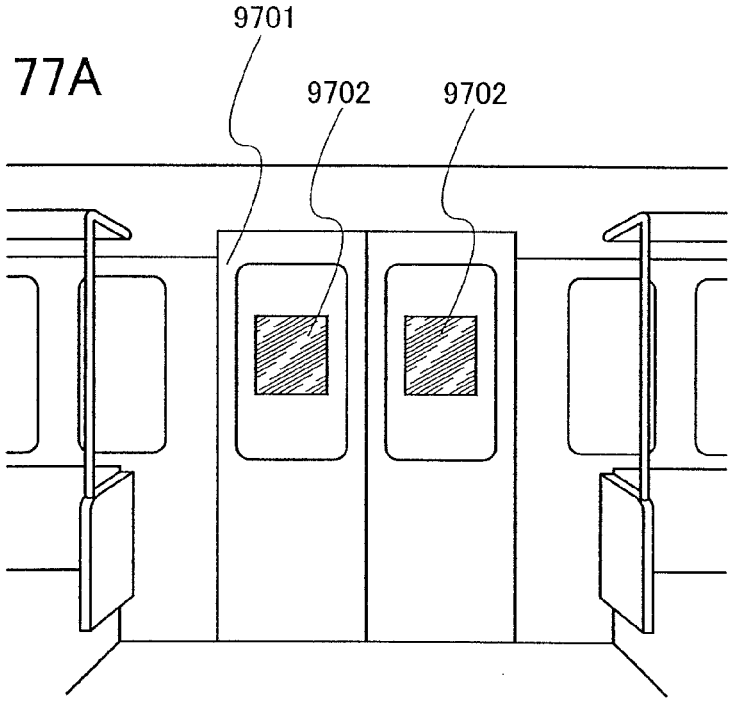
FIGS. 77A and 77B show application examples of a display device of the present invention.
Figure 77B:
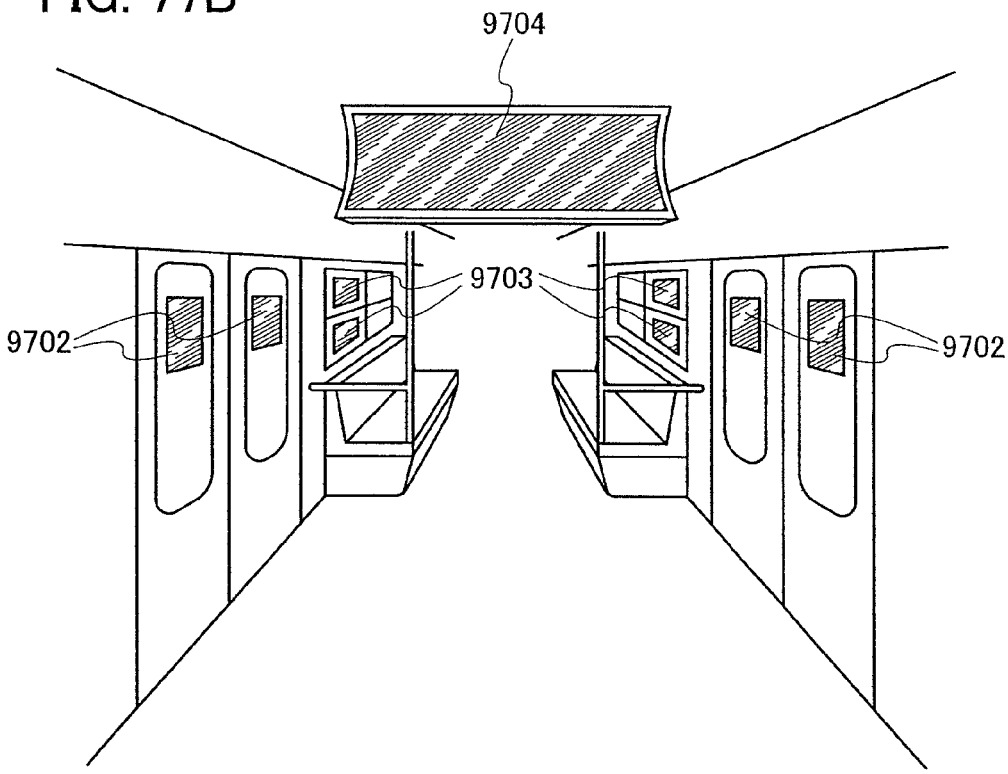

A transportation unit unified with a display device is shown in FIGS. 77A and 77B as one example of a display panel in which a display device using a pixel structure of the present invention is used for a display portion. FIG. 77A shows an example of a transportation unit unified with a display device, in which a display panel 9702 is used in a glass portion of a door in a train-car 9701. In the display panel 9702 having a display portion using a display device in which a pixel structure of the present invention shown in FIG. 77A is applied, an image to be displayed on the display portion can be easily shifted by an external signal. Thus, images of the display panel can be changed as the type of train passenger changes in accordance with different time periods. Accordingly, more effective advertising can be expected.

Applications for the display panel in which a display device using a pixel structure of the present invention is used in the display portion are not limited to a glass portion of a door of a train-car as shown in FIG. 77A. The shape of the display panel can be changed so that it can be set anywhere. FIG. 77B shows an example thereof.

FIG. 77B shows the inside of the train-car. In FIG. 77B, a display panel 9703 provided on a glass window, and a display panel 9704 hung on a ceiling are shown, in addition to the display panel 9702 of the glass portion of the door shown in FIG. 77A. The display panel 9703 equipped with a pixel structure of the present invention has a self-emission type display element. Thus, it is possible that images for advertisement be displayed when the train-car is crowded and be not displayed when the train-car is not crowded so that outside view can be seen from the train. By providing a switching element such as an organic transistor for a film-like substrate, and driving a self-emission type display element, the display panel 9704 itself having a pixel structure of the present invention can warp to display images.

Figure 78:
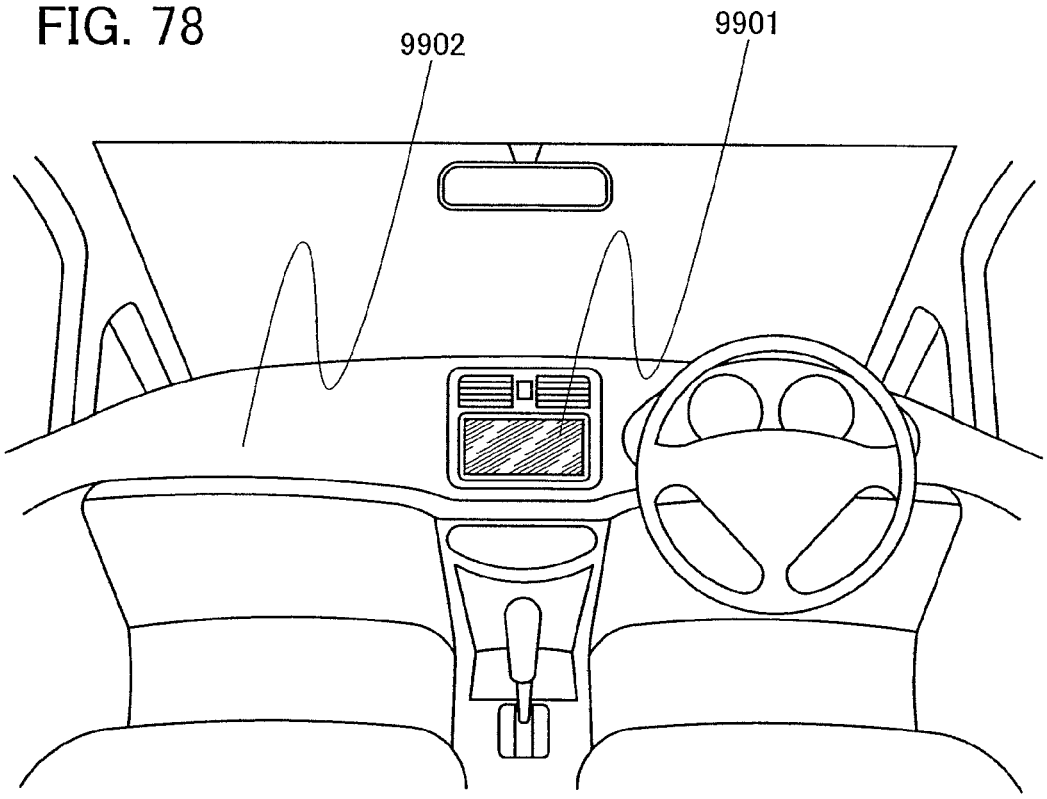
FIG. 78 shows an application example of a display device of the present invention.

FIG. 78 shows another application example of a transportation unit unified with a display device using a display panel having a display device in a display portion. The display device uses a pixel structure of the present invention in the display portion.

FIG. 78 shows an example of a transportation unit unified with a display device using a display panel having a display device in a display portion. The display device uses a pixel structure of the present invention in the display portion. FIG. 78 shows an example of a display panel 9902 unified with a car body 9901, as an example of a transportation unit unified with a display device. The display panel 9902 having a display device using a pixel structure of the present invention in a display portion shown in FIG. 78 is attached so as to be unified with the car body, and has a function of displaying on-demand car movement or information input from inside or outside the car or a navigation function to the destination.

Note that a display panel having a display device using a pixel structure of the present invention in a display portion is not limited to being applied to a front portion of a car body as shown in FIG. 78. By changing the shape, the display panel can be applied to any place, such as a glass window, a door, or the like.

Figure 79A:
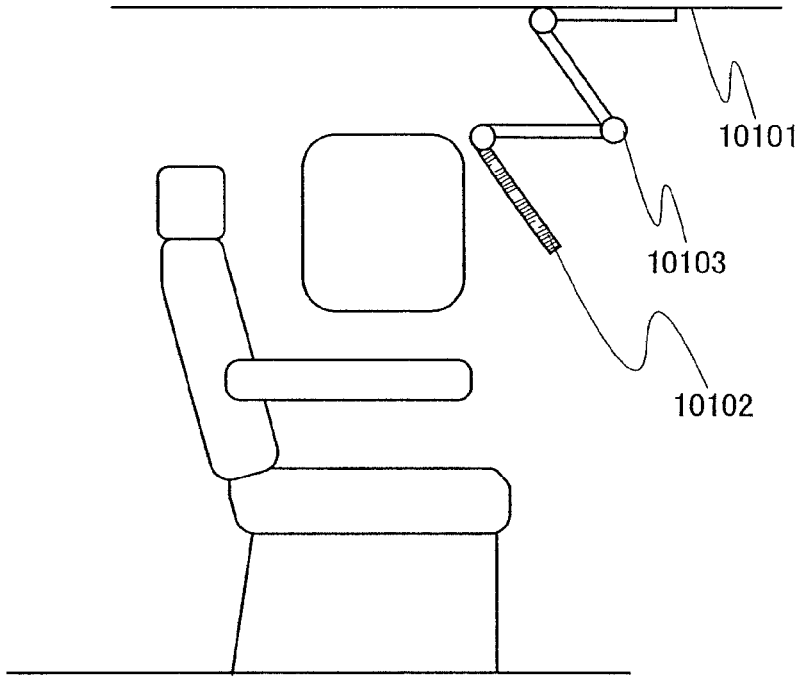
FIGS. 79A and 79B show application examples of a display device of the present invention.
Figure 79B:
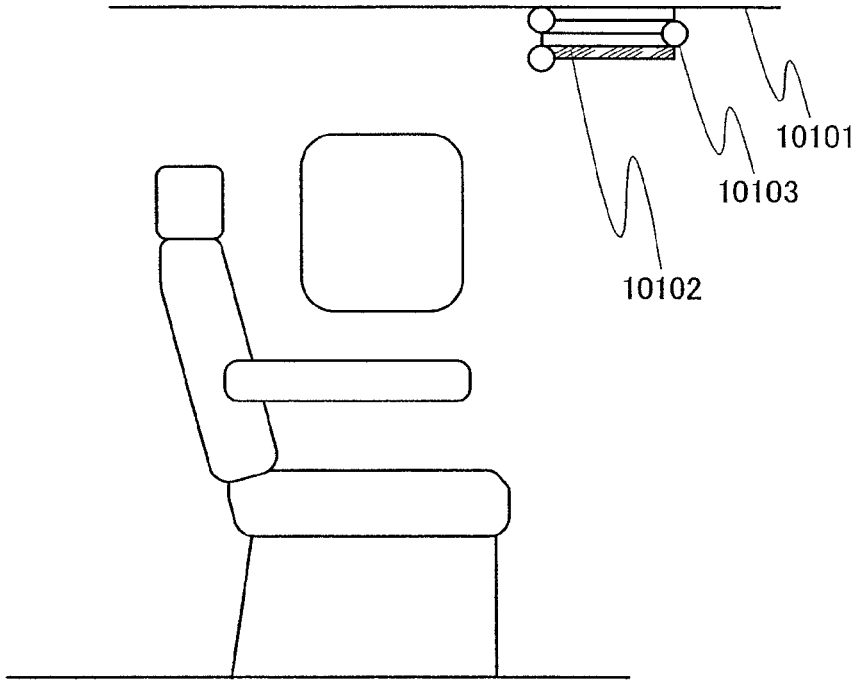

FIGS. 79A and 79B show another application example of a transportation unit unified with a display device using a display panel having a display device in a display portion. The display device uses a pixel structure of the present invention in the display portion.

FIGS. 79A and 79B show an example of a transportation unit which is unified with a display panel having a display device in a display portion. The display device uses a pixel structure of the present invention. FIG. 79A shows an example of a display panel 10102 which is unified with a ceiling above passengers inside an airplane body 10101, as an example of a transportation unit unified with a display device. The display panel 10102 having a display device using a pixel structure of the present invention in a display portion shown in FIG. 79A is attached so as to be unified with the airplane body 10101 with a hinge portion 10103. Passengers can move the display panel 10102 with the hinge portion 10103 to watch and listen to the display panel. The display panel 10102 has a function of displaying information or being used for an advertisement and entertainment unit by an operation of a passenger. As shown in FIG. 79B, the hinge portion folds to be stored in the airplane body 10101, and thus, the safety can be maintained during takeoff and landing. In addition, by lighting the display element of the display panel in emergency, it can be used as a guidance light of the airplane body 10101.

Note that a display panel having a display device using a pixel structure of the present invention in a display portion is not limited to being applied to a ceiling portion of the airplane body 10101 shown in FIGS. 79A and 79B. By changing its shape, it can be applied to anywhere, such as a passenger seat or a door. For example, a display panel may be provided on the back of the seat in front of the passenger, and the passenger may operate the display panel to watch or listen to it.

In this example, as a transportation unit, a train-car body, a car body, and an airplane body are given; however, the present invention is not limited thereto. The application range of the present invention is wide. For example, it includes an automobile two-wheeled vehicle, an automatic four-wheeled vehicle (including a car, a bus and the like), a train (including a monorail, a railroad train and the like), a ship and the like. By applying a display panel having a display portion using a pixel structure of the present invention, downsizing and low power consumption of the display panel are achieved, and a transportation unit equipped with a display medium which operates well can be provided. In particular, since display of display panels in a transportation unit can be easily changed all at once by an external signal, they are extremely effective as display devices for advertisement or information display in emergency aimed at the general public or a large number of passengers.

As an application example in which a display panel having a display device using a pixel structure of the present invention is used, an application mode applied to a building is described with reference to FIG. 80.

Figure 80:
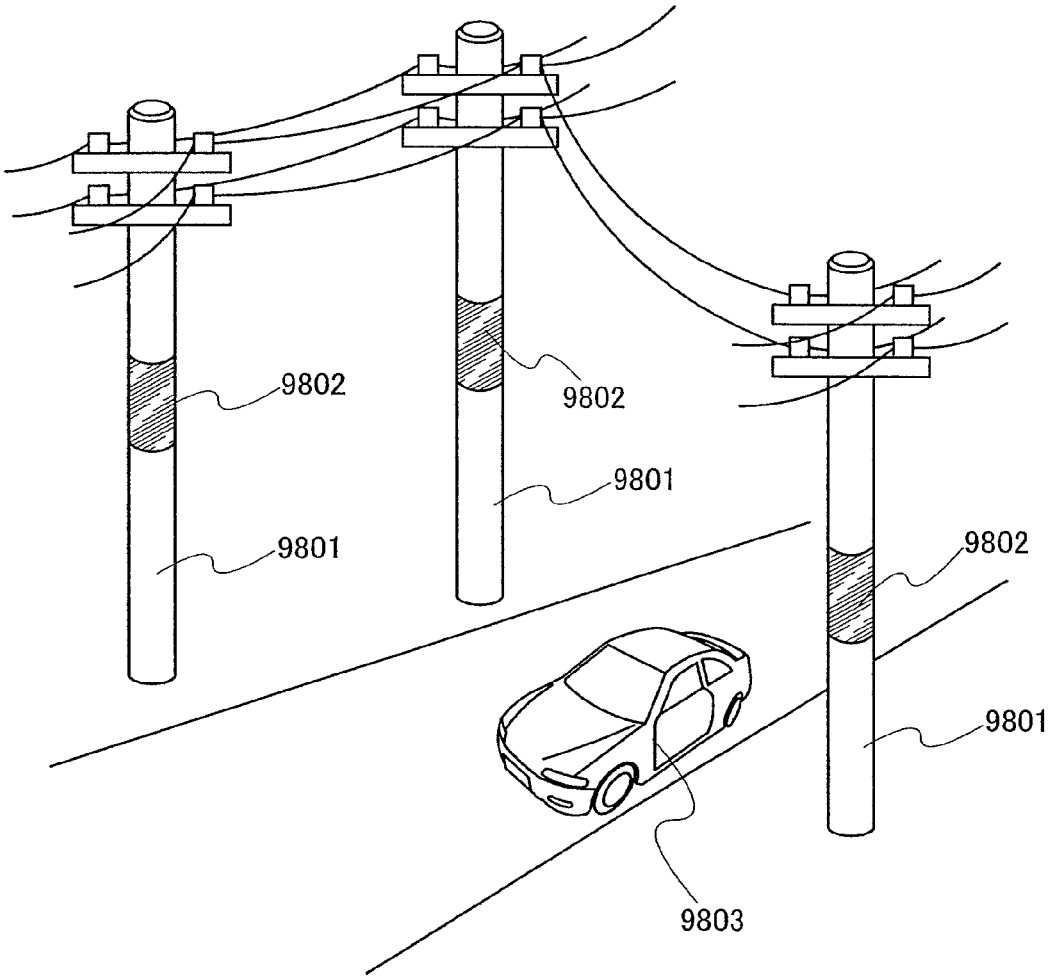
FIG. 80 shows an application example of a display device of the present invention.

FIG. 80 shows an application example of a display panel which can be warped by providing a switching element such as an organic transistor over a film substrate, and driving a self-emission display element, to display an image. The display panel is shown as an example of a display panel in which a display device using a pixel structure of the present invention is used in a display portion. In FIG. 80, a case where a display panel is provided on a curved surface of a columnar building such as a telephone pole provided outside as a building is shown. Here, the display panel 9802 is provided on a telephone pole 9801 which is has a columnar body.

The display panel 9802 shown in FIG. 80 is located in a position which is in about the middle of the height telephone pole, at a higher point than a human viewpoint. When the display panel is seen from a transportation unit 9803, an image displayed on the display panel 9802 can be recognized. Display panels are provided on telephone poles standing in a large number in outdoors so as to display the same image, and thus, displayed information or advertisement can be made visible to viewers. The display panels 9802 provided on the telephone poles 9801 of FIG. 80 can be easily made to display an image externally. Thus, extremely effective information for display and advertisement effect can be expected. By providing a self-emission type display element as a display element in a display panel of the present invention, the display panel is effective as a highly visible display medium even at night.

Figure 81:
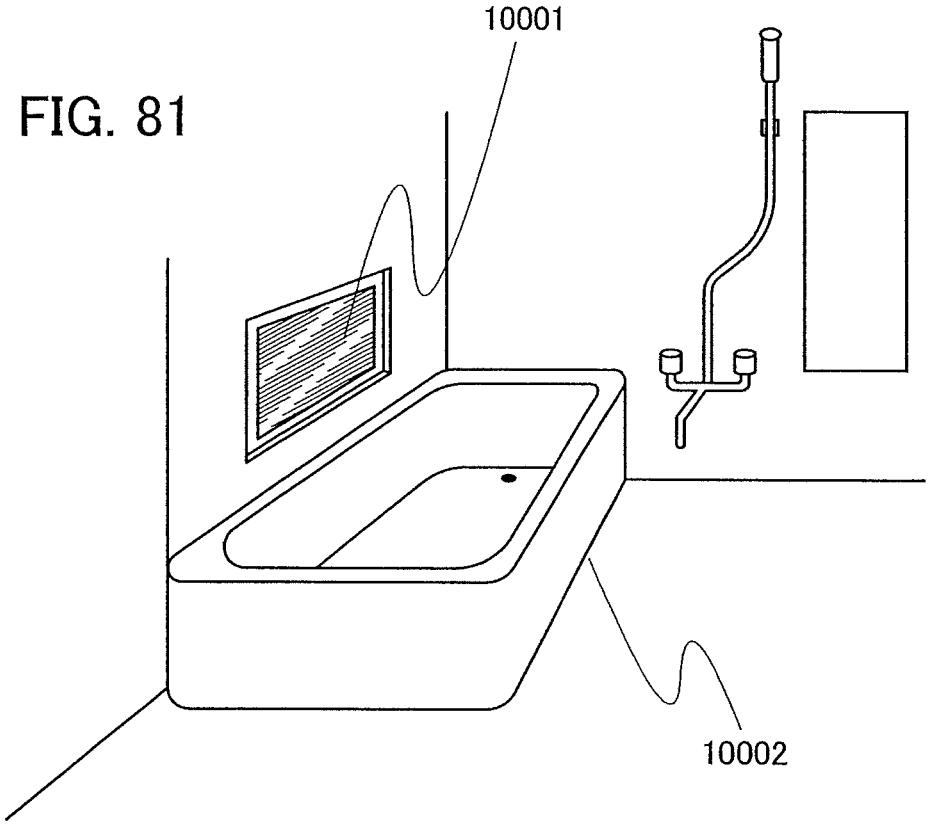
FIG. 81 shows an application example of a display device of the present invention.

FIG. 81 shows another application example of a building with which a display panel having a display device using a pixel structure of the present invention in a display portion is unified, which is different from that shown in FIG. 80.

FIG. 81 shows an application example of a display panel having a display device using a pixel structure of the present invention in a display portion. FIG. 81 shows an example of a display panel 10002 which is unified with an inner wall of a prefabricated bath 10001, as an example of a transportation unit unified with a display device. The display panel 10002 having a display device using a pixel structure of the present invention in a display portion shown in FIG. 81 is attached so as to be unified with the prefabricated bath 10001, and a bather can watch and listen to the display panel 10002. The display panel 10002 can have a function of displaying information or can be used as a means for an advertisement and entertainment by an operation of a bather.

The display panel having a display device using a pixel structure of the present invention in a display portion is not limited to being applied to only the side wall of the prefabricated bath 10001 shown in FIG. 81. By changing its shape, it can be applied to anywhere such as a part of a mirror or a bathtub itself.

Figure 82:
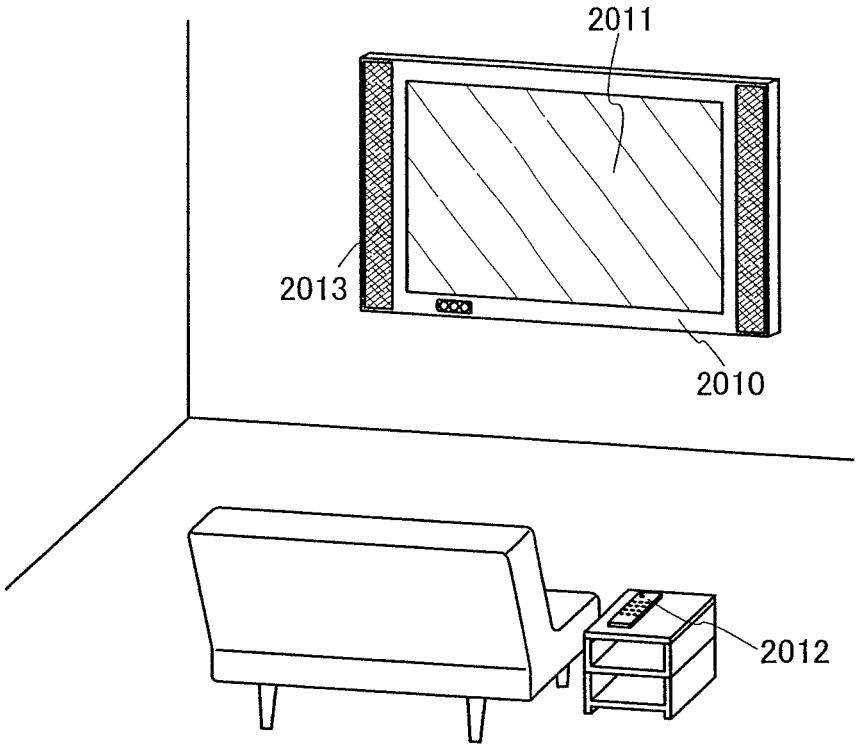
FIG. 82 shows an application example of a display device of the present invention.

FIG. 82 shows an example in which a television apparatus having a large display portion is provided in a building. FIG. 82 includes a housing 2010, a display portion 2011, a remote controller device 2012 which is an operating portion, a speaker 2103, and the like. A display panel which includes the display device using the pixel structure of the present invention in a display portion is applied for manufacturing the display portion 2011. A television apparatus shown in FIG. 82 is hung on the wall to be unified with the building, therefore, can be provided without requiring a wide space.

In this embodiment, a telephone pole which is an example of a columnar body or a prefabricated bath is given as an example of a building; however, this embodiment is not limited thereto and any structure can be adopted as long as it can be equipped with a display panel. By applying a display device using a display portion using a pixel structure of the present invention, downsizing and low power consumption of a display device can be achieved, and a transportation unit equipped with a display medium with favorable operation can be provided.

This application is based on Japanese Patent application No. 2005-245467 filed on Aug. 26, 2005 with the Japanese Patent Office, the entire contents of which are hereby incorporated by reference.

What is claimed is:

1. A method for driving a display device comprising:

displaying an image on pixels of the display device;

proceeding to a first charging period after a predetermined time from displaying the image, and determining in the first charging period whether a battery is charged;

when it is determined that the battery is charged, proceeding to a burn-in correction period wherein characteristics of light-emitting elements in the pixels are obtained by detecting current values of the light-emitting elements by a current value detection circuit and by storing the current values into a correction circuit; and when it is determined that the battery is not charged, proceeding to a normal driving period wherein corrected signals transmitted from the correction circuit are supplied to a gate driver of the display device.

2. The method for driving the display device according to claim 1, further comprising proceeding to a second charging period between the burn-in correction period and the normal driving period, and determining in the second charging period whether the battery is charged.

3. The method for driving the display device according to claim 1, wherein a driving frequency in the burn-in correction period is same as that in the normal driving period.

4. The method for driving the display device according to claim 1, wherein the current value detection circuit is connected to a power supply line of the light-emitting elements.

5. The method for driving the display device according to claim 1, wherein the display device is incorporated in one selected from the group consisting of a computer, an image reproducing device, a phone and a camera.

6. A method for driving a display device comprising:

displaying an image on pixels of the display device;

proceeding to a first charging period after a predetermined time from displaying the image, and determining in the first charging period whether a battery is charged;

when it is determined that the battery is charged, proceeding to a first burn-in correction period wherein characteristics of light-emitting elements in the pixels are obtained by detecting current values of the light-emitting elements one by one by a current value detection circuit and by storing the current values into a correction circuit;

proceeding to a second burn-in correction period after the first burn-in correction period, wherein characteristics of the light-emitting elements in the pixels are obtained by detecting current values of the light-emitting elements for three pixels at a same time by the current value detection circuit and by storing the current values into the correction circuit;

when it is determined that the battery is not charged, proceeding to a normal driving period wherein corrected signals transmitted from the correction circuit are supplied to a gate driver of the display device.

7. The method for driving the display device according to claim 6, further comprising proceeding to a second charging period between the second burn-in correction period and the normal driving period, and determining in the second charging period whether the battery is charged.

8. The method for driving the display device according to claim 6, wherein a driving frequency in the first burn-in correction period or the second burn-in correction period is same as that in the normal driving period.

9. The method for driving the display device according to claim 6, wherein the current value detection circuit is connected to a power supply line of the light-emitting elements.

10. The method for driving the display device according to claim 6, wherein the display device is incorporated in one selected from the group consisting of a computer, an image reproducing device, a phone and a camera.

* * * * *